US007863513B2

(12) United States Patent
Ishii et al.

(10) Patent No.: US 7,863,513 B2
(45) Date of Patent: Jan. 4, 2011

(54) SYNCHRONOUS PLAYBACK SYSTEM FOR REPRODUCING MUSIC IN GOOD ENSEMBLE AND RECORDER AND PLAYER FOR THE ENSEMBLE

(75) Inventors: Jun Ishii, Hamamatsu (JP); Rei Furukawa, Hamamatsu (JP); Yoshihiro Shiiya, Hamamatsu (JP); Takeyoshi Aihara, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 431 days.

(21) Appl. No.: 10/642,542

(22) Filed: Aug. 14, 2003

(65) Prior Publication Data

US 2004/0055444 A1 Mar. 25, 2004

(30) Foreign Application Priority Data

Aug. 22, 2002 (JP) ..... 2002-242481
Aug. 22, 2002 (JP) ..... 2002-242482
Oct. 30, 2002 (JP) ..... 2002-316806
Oct. 30, 2002 (JP) ..... 2002-316807

(51) Int. Cl.
*G10H 7/00* (2006.01)

(52) U.S. Cl. ..... 84/645; 386/96

(58) Field of Classification Search ..... 84/600–601, 84/609, 610, 616, 645, 654, 633, 665, 13, 84/664; 386/96
See application file for complete search history.

(56) References Cited

U.S. PATENT DOCUMENTS 4,594,930 A * 6/1986 Murakami ..... 84/612
5,148,419 A 9/1992 Koguchi
6,166,314 A 12/2000 Weinstock et al.
6,346,667 B2 2/2002 Ishii et al.
6,600,097 B2 7/2003 Shiiya
6,750,389 B2 * 6/2004 Hagiwara et al. ..... 84/631
2001/0007221 A1 7/2001 Uehara (Continued)

FOREIGN PATENT DOCUMENTS

EP 1 172 796 A1 1/2002

(Continued)

OTHER PUBLICATIONS

Notice of Ground of Rejection mailed Apr. 3, 2007, for JP Patent Application No. 2002-316806, with English Translation, six pages.

(Continued)

*Primary Examiner*—Jianchun Qin
(74) *Attorney, Agent, or Firm*—Morrison & Foerster LLP

(57) ABSTRACT

A synchronous player system is used for recording an ensemble between an automatic player piano and an audio player and playback therebetween; while a user is playing on the automatic player piano in ensemble with the audio player, reference characteristic data of the performance is extracted from the audio music data, and are stored in a memory together with the event codes; when the user instructs the synchronous player system to reproduce the performance in ensemble with the same piece of music recorded in another compact disc, the synchronous player system extracts objective characteristic data from the audio data recorded in the other compact disc, finds differences through a correlation analysis, by way of example, and rescheduling the timing to reproduce the note events for synchronously controlling the automatic player piano and audio player.

28 Claims, 68 Drawing Sheets

U.S. PATENT DOCUMENTS

| | | | | |
|---|---|---|---|---|
| 2002/0178898 | A1* | 12/2002 | Hagiwara et al. | 84/664 |
| 2003/0101862 | A1* | 6/2003 | Furukawa | 84/610 |
| 2003/0103076 | A1* | 6/2003 | Neuman | 345/723 |
| 2003/0131717 | A1* | 7/2003 | Shiiya | 84/610 |
| 2003/0133700 | A1* | 7/2003 | Uehara | 386/96 |
| 2003/0172798 | A1* | 9/2003 | Fujiwara et al. | 84/609 |
| 2003/0177890 | A1* | 9/2003 | Furukawa | 84/610 |

FOREIGN PATENT DOCUMENTS

| | | | |
|---|---|---|---|
| JP | 03-174194 | A | 7/1991 |
| JP | 03-188496 | A | 8/1991 |
| JP | 05-297867 | A | 11/1993 |
| JP | 2001-215958 | A | 8/2001 |
| JP | 2002-215143 | A | 7/2002 |
| JP | 2002-215160 | A | 7/2002 |
| JP | 2003-011820 | A | 1/2003 |
| JP | 2003-208166 | A | 7/2003 |
| JP | 2003-228368 | A | 8/2003 |

OTHER PUBLICATIONS

European Search Report mailed Feb. 24, 2010, for EP Application No. 03018938.5, three pages.

* cited by examiner

| COMPACT DISC CD-B | | | STANDARD MIDI FILE SMF | | DELTA TIME | | | | | | | |
|---|---|---|---|---|---|---|---|---|---|---|---|---|
| | | | | | BF. REG. | AFTER TIMING REGULATION | | | | | | |
| | | | | | | 1ST. | 2ND. | 3RD. | 4TH. | 5TH. | 6TH. | 7TH. |
| 1 | CHA. EVENT B | 0.11 | 1 | CHA. EVT. A | 0.13 | 0.11 | | | | | | |
| | | | 2 | NOTE EVT. | 0.49 | 0.41 | | | | | | |
| 2 | CHA. EVENT B | 0.75 | 2 | CHA. EVT. A | 0.81 | 0.69 | 0.75 | | | | | |
| | | | 2 | NOTE EVT. | 1.23 | 1.04 | 1.14 | | | | | |
| 3 | CHA. EVENT B | 1.36 | 3 | CHA. EVT. A | 1.45 | 1.23 | 1.34 | 1.36 | | | | |
| | | | 3 | NOTE EVT. | 2.18 | 1.84 | 2.02 | 2.04 | | | | |
| | | | 4 | NOTE EVT. | 2.41 | 2.04 | 2.23 | 2.26 | | | | |
| | | | 4 | CHA. EVT. A | 2.83 | 2.39 | 2.62 | 2.65 | | | | |
| | | | 5 | NOTE EVT. | 3.25 | 2.75 | 3.01 | 3.05 | | | | |
| 4 | CHA. EVENT B | 3.25 | 5 | CHA. EVT. A | 3.42 | 2.89 | 3.17 | 3.21 | 3.25 | | | |
| 5 | CHA. EVENT B | 3.94 | 6 | CHA. EVT. A | 4.16 | 3.52 | 3.85 | 3.90 | 3.95 | 3.94 | | |
| | | | 6 | NOTE EVT. | 4.36 | 3.69 | 4.04 | 4.09 | 4.14 | 4.13 | | |
| 6 | CHA. EVENT B | 4.85 | 7 | CHA. EVT. A | 5.12 | 4.33 | 4.74 | 4.80 | 4.87 | 4.85 | 4.85 | |
| | | | 7 | NOTE EVT | 5.45 | 4.61 | 5.05 | 5.11 | 5.18 | 5.16 | 5.16 | |
| 7 | CHA. EVENT B | 5.40 | 8 | CHA. EVT. A | 5.70 | 4.82 | 5.28 | 5.35 | 5.42 | 5.40 | 5.40 | |
| 8 | CHA. EVENT B | 6.16 | | | - | - | - | - | — | - | - | - |
| | | | 8 | NOTE EVT. | 6.72 | 5.69 | 6.22 | 6.30 | 6.39 | 6.36 | 6.36 | |
| 9 | CHA. EVENT B | 6.61 | 9 | CHA. EVT. A | 6.96 | 5.89 | 6.44 | 6.53 | 6.61 | 6.59 | 6.59 | 6.61 |
| 10 | CHA. EVENT B | 7.24 | 10 | CHA. EVT. A | 7.79 | 6.59 | 7.21 | 7.31 | 7.40 | 7.38 | 7.38 | 7.40 |

Fig. 26

| COMPACT DISC CD-B | | | STANDARD MIDI FILE SMF | | DELTA TIME | | | | | | | |
|---|---|---|---|---|---|---|---|---|---|---|---|---|
| | | | | | BF. REG. | AFTER TIMING REGURATION | | | | | | |
| | | | | | | 1ST. | 2ND. | 3RD | 4TH | 5TH | 6TH | 7TH |
| 1 | CHA. EVT. B | 0.11 | 1 | CHA. EVT. A | 0.13 | 0.11 | | | | | | |
| 2 | CHA. EVT. B | 0.75 | 2 | CHA. EVT. A | 0.81 | 0.69 | 0.75 | | | | | |
| 3 | CHA. EVT. B | 1.36 | 3 | CHA. EVT. A | 1.45 | 1.23 | 1.34 | 1.36 | | | | |
| | | | 4 | CHA. EVT. A | 2.83 | 2.39 | 2.62 | 2.65 | | | | |
| 4 | CHA. EVT. B | 3.25 | 5 | CHA. EVT. A | 3.42 | 2.89 | 3.17 | 3.21 | 3.25 | | | |
| 5 | CHA. EVT. B | 3.94 | 6 | CHA. EVT. A | 4.16 | 3.52 | 3.85 | 3.90 | 3.95 | 3.94 | | |
| 6 | CHA. EVT. B | 4.85 | 7 | CHA. EVT. A | 5.12 | 4.33 | 4.74 | 4.80 | 4.87 | 4.85 | 4.89 | |
| 7 | CHA. EVT. B | 5.40 | 8 | CHA. EVT. A | 5.70 | 4.82 | 5.28 | 5.35 | 5.42 | 5.40 | 5.40 | |
| 8 | CHA. EVT. B | 6.16 | | | - | - | - | - | - | - | - | - |
| 9 | CHA. EVT. B | 6.61 | 9 | CHA. EVT. A | 6.96 | 5.89 | 6.44 | 6.53 | 6.61 | 6.59 | 6.59 | 6.61 |
| 10 | CHA. EVT. B | 7.24 | 10 | CHA. EVT. A | 7.79 | 6.59 | 7.21 | 7.31 | 7.40 | 7.38 | 7.38 | 7.40 |

Fig. 28

| COMPACT DISC | CD-B | DELTA TIME | |
|---|---|---|---|
| | | BEFORE REGULATION | AFTER REGULATION |
| 1 | NOTE EVT. | 0.49 | 0.47 |
| 2 | NOTE EVT. | 1.23 | 1.16 |
| 3 | NOTE EVT. | 2.18 | 2.06 |
| 4 | NOTE EVT. | 2.41 | 2.27 |
| 5 | NOTE EVT. | 3.25 | 3.07 |
| 6 | NOTE EVT. | 4.36 | 4.11 |
| 7 | NOTE EVT. | 5.45 | 5.14 |
| 8 | NOTE EVT. | 6.72 | 6.33 |

| AUDIO DATA NA (SMF) | | | AUDIO DATA NB | | |
|---|---|---|---|---|---|
| | | DELTA TIME (SEC.) | | | ARRIVAL TIME (SEC.) |
| 0 | REFERENCE STARTING TIME | 1.15 | 0 | OBJECTIVE STARTING TIME+TOP OFFSET | 0.65 |
| 1 | CHARACTERISTIC "A" EVENT A | 1.51 | 1 | CHARACTERISTIC EVENT "B" | 1.01 |
| 2 | ditto | 2.38 | 2 | ditto | 1.88 |
| 3 | ditto | 4.04 | 3 | ditto | 3.54 |
| 4 | ditto | 4.69 | 4 | ditto | 4.19 |
| 5 | ditto | 5.49 | 5 | ditto | 4.98 |
| 6 | ditto | 8.77 | 6 | ditto | 9.76 |
| 7 | ditto | 10.19 | 7 | ditto | 12.34 |
| 8 | ditto | 12.77 | 8 | ditto | 13.91 |
| 9 | ditto | 14.35 | 9 | ditto | 15.57 |
| 10 | ditto | 18.22 | 10 | ditto | 17.78 |
| 11 | ditto | 19.84 | 11 | ditto | 19.43 |
| 12 | ditto | 22.90 | 12 | ditto | 24.45 |
| ⋮ | | ⋮ | ⋮ | | ⋮ |
| 69 | ditto | 165.47 | 69 | ditto | 160.67 |
| 70 | ditto | 169.94 | 70 | ditto | 168.49 |
| 71 | ditto | 170.77 | 71 | ditto | 170.32 |
| 72 | ditto | 172.27 | 72 | ditto | 171.13 |
| | | | 73 | ditto | 171.85 |
| | | | 74 | ditto | 172.67 |

Fig. 49

| AUDIO DATA NA (SMF) | | | PRESUMED TIME | AUDIO DATA NB | | |
|---|---|---|---|---|---|---|
| | | DELTA TIME (sec.) | | | | AR-RIVAL TIME |
| 0 | REF. STARTING TIME | 1.15 | – | 0 | OBJ. STAT. TIME +TOP OFFSET | 0.65 |
| 1 | CHARACTERISTIC EVENT "A" | 1.51 | – | 1 | CHARACTERISTIC EVENT "B" | 1.01 |
| 2 | ditto | 2.38 | 1.88 | 2 | ditto | 1.88 |
| 3 | ditto | 4.04 | 3.54 | 3 | ditto | 3.54 |
| 4 | ditto | 4.69 | 4.19 | 4 | ditto | 4.19 |
| 5 | ditto | 5.49 | 4.99 | 5 | ditto | 4.98 |
| 6 | ditto | 8.77 | 8.25 | – | | – |
| 7 | ditto | 10.19 | 9.67 | 6 | ditto | 9.76 |
| 8 | ditto | 12.77 | 12.35 | 7 | ditto | 12.34 |
| 9 | ditto | 14.35 | 13.93 | 8 | ditto | 13.91 |
| – | | – | – | 9 | ditto | 15.57 |
| 10 | ditto | 18.22 | 17.79 | 10 | ditto | 17.78 |
| 11 | ditto | 19.84 | 19.41 | 11 | ditto | 19.43 |
| 12 | ditto | 22.90 | 22.51 | – | | – |
| 13 | ditto | 24.84 | 24.46 | 12 | ditto | 24.45 |
| ⋮ | | ⋮ | ⋮ | ⋮ | | ⋮ |
| 68 | ditto | 160.34 | 160.66 | 69 | ditto | 160.67 |
| 69 | ditto | 165.47 | 165.83 | – | | – |
| – | | – | – | 70 | ditto | 168.49 |
| 70 | ditto | 169.94 | 170.32 | 71 | ditto | 170.32 |
| 71 | ditto | 170.77 | 171.15 | 72 | ditto | 171.13 |
| – | | – | – | 73 | ditto | 171.85 |
| 72 | ditto | 172.27 | 172.64 | 74 | ditto | 172.67 |

Fig. 50

| AUDIO DATA 'NA (SMF) | | | AUDIO DATA NB | | |
|---|---|---|---|---|---|
| | | DELTA TIME (SEC.) | | | ARRIVAL TIME (SEC.) |
| 0 | REFERENCE STARTING TIME | 1.15 | 0 | OBJECTIVE STARTING TIME+TOP OFFSET | 0.65 |
| 1 | CHARACTERISTIC EVENT "A" | 1.51 | 1 | CHARACTERISTIC EVENT "B" | 1.01 |
| 2 | ditto | 2.38 | 2 | ditto | 1.88 |
| 3 | ditto | 4.04 | 3 | ditto | 3.54 |
| 4 | ditto | 4.69 | 4 | ditto | 4.19 |
| 5 | ditto | 5.49 | 5 | ditto | 4.98 |
| 6 | ditto | 8.77 | 6 | ditto | 9.76 |
| 7 | ditto | 10.19 | 7 | ditto | 12.34 |
| 8 | ditto | 12.77 | 8 | ditto | 13.91 |
| 9 | ditto | 14.35 | 9 | ditto | 15.57 |
| 10 | ditto | 18.22 | 10 | ditto | 17.78 |
| 11 | ditto | 19.84 | 11 | ditto | 19.43 |
| 12 | ditto | 22.90 | 12 | ditto | 24.45 |
| ⋮ | | ⋮ | ⋮ | | ⋮ |
| 69 | ditto | 165.47 | 69 | ditto | 160.67 |
| 70 | ditto | 169.94 | 70 | ditto | 168.49 |
| 71 | ditto | 170.77 | 71 | ditto | 170.32 |
| 72 | ditto | 172.27 | 72 | ditto | 171.13 |
| | | | 73 | ditto | 171.85 |
| | | | 74 | ditto | 172.67 |

Fig. 71

| AUDIO DATA NA (SMF) | | | PRESUMED TIME | AUDIO DATA NB | | |
|---|---|---|---|---|---|---|
| | | DELTA TIME (sec.) | | | | AR-RIVAL TIME |
| 0 | REF. STARTING TIME | 1.15 | — | 0 | OBJ. STAT. TIME +TOP OFFSET | 0.65 |
| 1 | CHARACTERISTIC EVENT "A" | 1.51 | — | 1 | CHARACTERISTIC EVENT "B" | 1.01 |
| 2 | ditto | 2.38 | 1.88 | 2 | ditto | 1.88 |
| 3 | ditto | 4.04 | 3.54 | 3 | ditto | 3.54 |
| 4 | ditto | 4.69 | 4.19 | 4 | ditto | 4.19 |
| 5 | ditto | 5.49 | 4.99 | 5 | ditto | 4.98 |
| 6 | ditto | 8.77 | 8.25 | — | | — |
| 7 | ditto | 10.19 | 9.67 | 6 | ditto | 9.76 |
| 8 | ditto | 12.77 | 12.35 | 7 | ditto | 12.34 |
| 9 | ditto | 14.35 | 13.93 | 8 | ditto | 13.91 |
| — | | — | — | 9 | ditto | 15.57 |
| 10 | ditto | 18.22 | 17.79 | 10 | ditto | 17.78 |
| 11 | ditto | 19.84 | 19.41 | 11 | ditto | 19.43 |
| 12 | ditto | 22.90 | 22.51 | — | | — |
| 13 | ditto | 24.84 | 24.46 | 12 | ditto | 24.45 |
| ⋮ | | ⋮ | ⋮ | ⋮ | | ⋮ |
| 68 | ditto | 160.34 | 160.66 | 69 | ditto | 160.67 |
| 69 | ditto | 165.47 | 165.83 | — | | — |
| — | | — | — | 70 | ditto | 168.49 |
| 70 | ditto | 169.94 | 170.32 | 71 | ditto | 170.32 |
| 71 | ditto | 170.77 | 171.15 | 72 | ditto | 171.13 |
| — | | — | — | 73 | ditto | 171.85 |
| 72 | ditto | 172.27 | 172.64 | 74 | ditto | 172.67 |

Fig. 72

SYNCHRONOUS PLAYBACK SYSTEM FOR REPRODUCING MUSIC IN GOOD ENSEMBLE AND RECORDER AND PLAYER FOR THE ENSEMBLE

FIELD OF THE INVENTION

This invention relates to a playback system for a piece of music, a recorder and a player both forming parts of the playback system and, more particularly, to a synchronous playback system for reproducing a piece of music, a recorder and a player both forming parts of the synchronous player system.

DESCRIPTION OF THE RELATED ART

There are several standard books which describe different ways to express pieces of music. One of the standard books is called as "MIDI (Musical Instrument Digital Interface) standards", and the MIDI standards are popular among musicians who play electronic musical instruments. Music data based on the MIDI standards is referred to as "MIDI music data codes". Event codes and delta-time codes are the major part of a set of MIDI music data codes. A note-on event and a note-off event are typical examples of the event code. A tone is generated at the note-on event, and the tone is decayed at the note-off event. The delta-time code is representative of a time period between an event and the next event or the lapse of time from the initiation of playback. The MIDI music data code or codes contain a piece of information, and the information written in the MIDI data code or codes is hereinafter referred to as "MIDI data".

Another standard book is called as "Red Book", which are popular among the audio fans. A music passage is represented by a series of discrete binary values on an analog audio signal, and CDs (Compact-Disc) are used for recording pieces of music in the form of discrete binary values. A series of discrete binary values representative of a music passage is hereinafter referred to as "audio music data codes". The audio music data codes form a set of "audio data code" together with several sorts of control data codes. One of the sorts of control data codes is representative of a lapse of time from initiation of a performance to a group of tones to be reproduced, and is hereinafter referred to as "audio time data codes". The audio music data code contains a piece of information, and the information written in the audio music data code is hereinafter referred to as "audio data".

In the following description, "electronic musical instrument" is representative of equipment to at least either produce pieces of music data representative of a music passage or reproduce tones from the pieces of music data. From this viewpoint, an electronic piano, a synthesizer, a sampling machine, a hard disc recorder, a sequencer and a personal computer system with suitable software are categorized in the electronic musical instruments. Electronic musical instruments, which produce music passages represented by the MIDI music data, or which reproduce the music passage on the basis of the MIDI music data, are hereinafter referred to as "MIDI musical instruments". Electronic musical instruments, which produce music passages represented by the audio music data codes, or which reproduce the music passages from the audio music data codes, are hereinafter referred to as "electronic audio musical instruments".

A synchronous playback system has been proposed for reproducing a piece of music in ensemble between the MIDI musical instrument and the electronic audio musical instrument. The audio time data codes are available for the synchronous playback, and the synchronous technologies are, by way of example, disclosed in Japanese Patent Application Nos. 2002-7872 and 2002-7873.

A human player firstly records his or her performance in ensemble with the electronic audio musical instrument through the prior art synchronous playback system, and, thereafter, the performance is reproduced in ensemble with the electronic audio musical instrument through the prior art synchronous playback system. In detail, the MIDI musical instrument such as an electronic keyboard and the electronic audio musical instrument are connected to a recorder, which forms a part of the prior art synchronous playback system. The human player starts the playback of a piece of music through the electronic audio musical instrument, and gets ready to finger the piece of music on the electronic keyboard. The audio music data codes and audio time data codes are sequentially read out from a compact disc, and are respectively supplied to the sound system and the recorder. When the sound system reproduces the first tone or tones, the human player initiates his or her performance on the electronic keyboard. The human player selectively depresses and releases the keys in ensemble with the electronic audio musical instrument, and the fingering on the electronic keyboard is converted to the MIDI music data codes. The event codes intermittently reach the recorder, and the delta time codes are produced by the recorder. The audio time data codes also intermittently reach the recorder, and the recorder stores the event codes and delta time codes together with the audio time data codes in an information storage medium such as a floppy disc.

The human player is assumed to instruct the prior art playback system to reproduce the ensemble. The electronic audio musical instrument starts to reproduce the piece of music, and the audio music data codes and audio time data codes are respectively supplied to the sound system and the prior art playback system. The event codes, delta time codes and audio time data codes are read out from the floppy disc, and the event codes are intermittently supplied to the MIDI musical instrument. Thus, the tones are reproduced partially through the sound system and partially through the electronic keyboard in ensemble. While the MIDI music data codes and audio time data codes are being read out from the floppy disc, the prior art playback system compares the audio time data codes read out from the floppy disc with the audio time data codes supplied from the electronic audio musical instrument to see whether or not the playback through the electronic keyboard is synchronized with the playback through the sound system. When the answer is given affirmative, the prior art playback system continues the playback in ensemble. On the other hand, if the answer is given negative, the prior art playback system changes the time interval between the event code and the next event code for keeping the playback synchronous.

The prior art technology is available for the synchronization between the musical instrument and another sort of instrument such as an illuminator, video reproducing system or a sounder. The prior art synchronization technology is disclosed in Japanese Patent Application laid-open No. 2001-195061. Flags, which are, by way of example, indicative of a change in illumination, are added to the music data codes. While the music data codes are being processed, the flags intermittently reach the prior art controller, and the prior art controller instructs another sort of instrument to change the illumination. Thus, the illumination is changed in synchronization with the playback of the piece of music.

Yet another prior art technology is disclosed in Japanese Patent Application No. 2001-215958. Synchronous data codes are supplemented in the series of event codes.

A problem is encountered in the prior art synchronous playback system in that the synchronous playback is hardly achieved in the ensemble between the floppy disc, in which the event codes and delta time codes have been already stored together with the audio time data codes, and a compact disc different in edition from the compact disc used in the recording. This is because of the fact that, even though the title of the compact disc and player's name are same, the audio time data codes do not guarantee the lapse of time from the initiation of the playback based on the audio music data codes stored in another compact disc for the prior art playback system.

A piece of music is assumed to be performed by a certain musician. The performance was recorded in a master tape. When a recording company manufacturers a music compact disc, the manufacturer designs a metal master for the piece of music stored in the master tape and other pieces of music. The recording company duplicates a lot of music compact discs from the metal master, and sells them in the music market. The recording company wishes to further manufacturer the music compact disc, and designs another medal master for the piece of music stored in the master tape and other pieces of music. Although the piece of music and player are same, it is impossible to make the metal master strictly identical with the previous metal master. For example, the silent time, which is the time period from the head of the read-in to the audio music data codes representative of the first tone, of the previous edition is usually different from the silent time of the new edition. This means that the prior art playback system starts the part assigned to either MIDI musical instrument or electronic audio musical instrument earlier than the other part assigned to the other musical instrument. In other words, the synchronous playback is hardly achieved through the prior art playback system.

The audio time data codes stored in the floppy disc are not always identical with the audio time data codes stored in the compact disc different in edition from the compact disc used in the recording. While the recording company is preparing the new edition, the editor may add the reverberation to certain tones. This results in the audio time data codes representative of the progress of the playback slightly different from the progress of the original performance. Moreover, the clock signal used in the recording is not always strictly equal in frequency to the clock signal used in the edition. This also results in that either MIDI musical instrument or audio musical instrument is delayed from the other musical instrument in the playback.

SUMMARY OF THE INVENTION

It is therefore an important object of the present invention to provide a synchronous player system, which makes plural instruments strictly synchronized.

It is also an important object of the present invention to provide a method used in the synchronizing system.

To accomplish the object, the present invention proposes to reschedule the timing to supply pieces of first sort of music data such as, for example, note events through comparison between particular features of an audio waveform of a music passage recorded in a compact disc and corresponding particular features of another audio waveform of the music passage recorded in another compact disc.

In accordance with one aspect of the present invention, there is provided a recorder for recording a performance represented by pieces of first sort of music data in ensemble with a playback of a music passage represented by pieces of second sort of music data different in format from the first sort of music data, and the recorder comprises an interface connected to a data source of the pieces of the first sort of music data, another data source of the pieces of the second sort of music and a destination to which a music data file is supplied and a data processing unit connected to the interface, extracting pieces of reference characteristic data representative of particular features of an audio waveform expressing the music passage from the pieces of the second sort of music data and forming the pieces of the first sort of music data, the pieces of reference characteristic data and pieces of time data representative of timing to reproduce tones produced in the performance into the music data file for supplying the music data file through the interface to the destination.

In accordance with another aspect of the present invention, there is provided a player for reproducing tones in a performance represented by pieces of first sort of music data in ensemble with a playback of a music passage represented by pieces of second sort of music data different in format from the first sort of music data, and the player comprises an interface connected to a source of music data file storing at least one music data file containing the pieces of sad first sort of music data, pieces of reference characteristic data representative of particular features of an audio waveform represented by other pieces of the second sort of music data expressing the music passage and pieces of time data representative of timing to reproduce the tones in the performance, a data source of the pieces of the second sort of music data, a sound source for producing the tones on the basis of the pieces of the first music data and another sound source for producing other tones from the pieces of the second sort of music data and a data processing unit connected to the interface, extracting pieces of objective characteristic data representative of particular features of another audio waveform expressing the music passage from the pieces of second sort of music data, comparing the pieces of objective characteristic data with the pieces of reference objective characteristic data so as to find time differences between the particular features of the audio waveform and the particular features of the aforesaid another audio waveform, rescheduling timing to supply the pieces of the first sort of music data to the sound source by changing the pieces of time data, and supplying the pieces of the second sort of music data to the aforesaid another sound source and the pieces of the first sort of music data to the sound source at the timing represented by the pieces of time data already changed.

In accordance with yet another aspect of the present invention, there is provided a synchronous player system carrying out at least a preliminary recording and a synchronous playback, and the synchronous player system comprises an interface connected to a data source of pieces of first sort of music data representative of tones to be produced in a performance, another data source of pieces of second sort of music data different in format from the first sort of music and expressing a music passage and other pieces of the second sort of music data expressing the music passage, a source of music data file storing at least one music data file containing the pieces of the first music data, pieces of reference characteristic data representative of particular features of an audio waveform represented by the pieces of second sort of music data and pieces of time data represented by timing to produce the tones in the performance, a sound source producing the tones on the basis of the pieces of first sort of music data and another sound source producing other tones from the other pieces of the second music data and a data processing unit connected to the interface and communicating with the data source, the aforesaid another and the source of music data file for the preliminary recording and with the source of music data file, the sound source and the aforesaid another sound source for the synchronous playback, in which the data processing unit extracts the pieces of reference characteristic data from the pieces of the second sort of music data, and forms the pieces of the first sort of music data, the pieces of reference characteristic data and the pieces of time data into the music data file for supplying the music data file through the interface to the source of music data file, and in which the data processing unit extracts pieces of objective characteristic data representative of particular features of another audio waveform expressing the music passage from the other pieces of second sort of music data, compares the pieces of objective characteristic data with the pieces of reference objective characteristic data so as to find time differences between the particular features of the audio waveform and the particular features of the aforesaid another audio waveform, reschedules timing to supply the pieces of the first sort of music data to the first sound source by changing the pieces of time data, and supplies the other pieces of the second sort of music data to the aforesaid another sound source and the pieces of the first sort of music data to the sound source at the timing represented by the pieces of time data already changed.

BRIEF DESCRIPTION OF THE DRAWINGS

The features and advantages of the synchronous player system and the method will be more clearly understood from the following description taken in conjunction with the accompanying drawings, in which FIG. 26 is a table showing changes of timing to supply note events to an automatic player piano through a timing regulation in the synchronous playback mode, FIG. 28 is a table showing the change of timing to supply note events to an automatic player piano.

FIG. 49 is a table showing a relation between characteristic events stored in a standard MIDI file and characteristic events extracted from pairs of audio music data codes reproduced in the synchronous playback, FIG. 50 is a table showing presumed arrival times of the characteristic events.

FIG. 71 is a table showing a relation between characteristic events stored in a standard MIDI file and characteristic events extracted from pairs of audio music data codes reproduced in the synchronous playback, FIG. 72 is a table showing presumed arrival times of the characteristic events.

DESCRIPTION OF THE PREFERRED EMBODIMENTS

Figure 1:
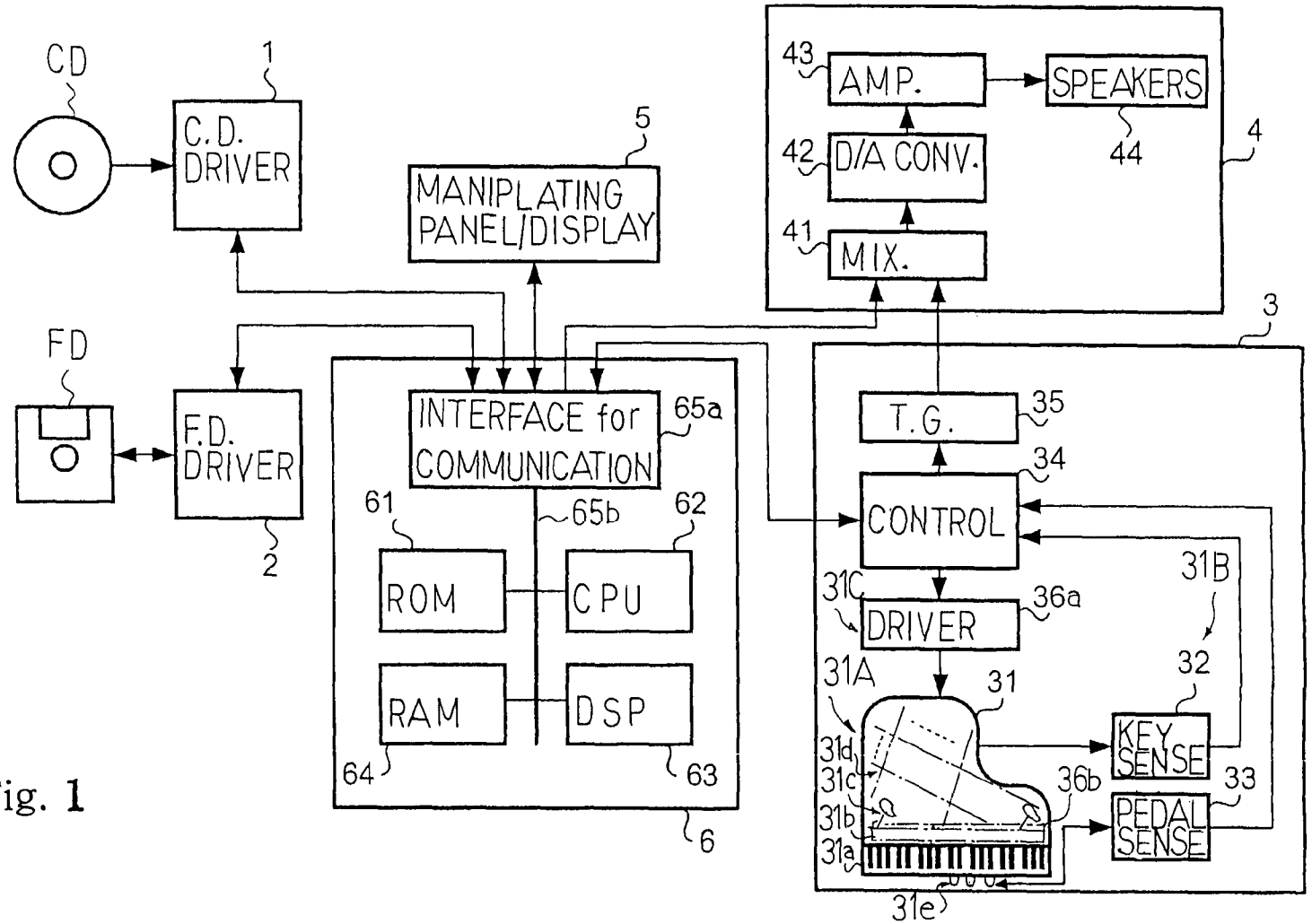
FIG. 1 is a block diagram showing the system configuration of a synchronous player system according to the present invention.

A basic concept of the present invention is to reschedule note events on the basis of time lag between particular features of an audio waveform expressing a music passage and corresponding particular features of another audio waveform expressing the same music passage. While the note events are being produced through a musical instrument, by way of example, the user hears the playback of the music passage, and controls his or her fingering in synchronism with the progression of the music passage. This means that the particular features of the audio waveform is influential in the fingering. Even if time lag takes place between the former progression of the music passage and the latter progression of the same music passage, the user feels the reproduction of the performance in good ensemble with the latter progression of the music passage in so far as the note events are well corresponding to the particular features of the audio waveform expressing the music passage.

The present invention is made on the basis of the above-described discovery. The first technology to be required for the good ensemble is to make the particular features of an audio waveform correspond to the particular features of another audio waveform so as to find time lag between the particular features and the corresponding particular features. The second technology to be required is to eliminate the time lag from therebetween, if any.

A correlation analysis is available for making the particular features corresponding to one another, i.e. as the first technology. It is necessary to prepare pieces of correlation data before the correlation analysis. The pieces of correlation data are, by way of example, prepared as follows. The audio waveform are represented by sampled values of audio music data codes, which were obtained through a sampling on the audio waveform, so that the sampled values per se can serve as the particular features. Nevertheless, the audio waveform usually contains noise components. Therefore, it is preferable to eliminate the noise components from the sampled values through a suitable filtering. Moreover, the particular features tend to be found in a waveform at a low frequency range. Therefore, it is also preferable to extract the low frequency components from the sampled values. If the data processing capability is large enough to execute the data processing on all the sampled values, any down-sampling is not required for the pieces of correlation data. If not, it is preferable to carry out a down-sampling on the sampled values. Thus, the pieces of correlation data are produced from the sampled values of the audio music data codes. The pieces of correlation data for one audio waveform are compared with the pieces of correlation data for another audio waveform to see whether or not time lag takes place therebetween. If the time lag is found, the time lag is eliminated from therebetween by using the second technology, which will be described hereinafter in detail. Since the note events were produced synchronously with the correlation data extracted from one audio waveform, the note events are considered to be reproduced synchronously with the correlation data extracted from another audio waveform after the elimination of the time lag.

The correlation data may be extracted from a part of the waveform or the entire audio waveform. The part of the waveform may occupy a head portion of the piece of music, an end portion of the piece of music or an intermediate portion of the piece of music. It is preferable that the correlation data is extracted from a characteristic portion of the piece of music.

Abrupt changes of an attribute of sound can serve as the particular features. The attribute of sound may be the volume or loudness of a certain frequency range. In order to find the abrupt changes of the volume in the certain frequency range, low frequency components and extremely low frequency components are extracted from the sampled values of the audio music data codes through a low pass filtering on the sampled values. The components in the low frequency range and components in the extremely low frequency range are referred to as "medium-range index" and "long-range index". When the volume of the certain frequency range such as, for example, 1 Hz to 100 Hz is abruptly enlarged in the audio waveform, the medium-range index exceeds the long-range index. For this reason, the medium-range index is compared with the long-range index so as to determine the abrupt changes or the particular features. The abrupt changes are referred to as "characteristic events". The characteristic events in an audio waveform are made correspond to the characteristic events in another audio waveform, and checks to see whether or not any time lag takes place between the two sets of characteristic events. If the time lag takes place, the time lag is eliminated from therebetween by using the second technology. Since the note events were produced synchronously with the characteristic events extracted from one audio waveform, the note events are considered to be reproduced synchronously with the characteristic events extracted from another audio waveform after the elimination of the time lag.

Other sorts of abrupt changes may be used as the particular features so that the abrupt changes in loudness do not set any limit to the technical scope of the present invention.

The time lag is eliminated from between the note events produced in ensemble with a music passage recorded in a certain compact disc and the note events to be reproduced in ensemble with the music passage recorded in another compact disc as follows. The pieces of music is assumed to be recorded in both compact discs in the form of the set of audio data code, and the performance is represented by a set of note event codes and delta time codes, which represent a lapse of time from the initiation of the performance to the associated note events.

In a compact disc, there is recorded silence before a piece of music and after the piece of music. Even if the same piece of music was recorded in both compact discs, the silence in one compact disc is longer or shorter than the silence in another compact disc. These compact discs are referred to as "compact discs in the first category". Moreover, if the silence is equal between one compact disc and another compact disc, the piece of music is different in tempo between one compact disc and another compact disc. These compact discs are referred to as "compact discs in the second category". Finally, both silence and tempo are difference between one compact disc and another compact disc. These compact discs are referred to as "compact discs in the third category". The extraction of correlation data and extraction of characteristic events are selectively applied those compact discs, i.e., the compact discs in the first category, the compact discs in the second category and the compact discs in the third category.

In case where two compact discs are fallen within the first category, the extraction of correlation data may be applied to those compact discs. While a user is producing note events in ensemble with the playback of the piece of music recorded in one compact disc, the pieces of correlation data are extracted from the sampled values of the audio music data codes representative of the piece of music, and the pieces of correlation data are memorized for the playback together with the note events, timing, i.e., pieces of time data at which the note events were respectively produced and a piece of time data at which a certain piece of correlation data was produced from the sampled value.

When the user wishes to reproduce the performance represented by the note events in ensemble of the playback of the music passage recorded in the other compact disc, pieces of correlation data are extracted from the sampled values of the audio music data codes recorded in the other compact disc, and arrival times are determined. The correlation analysis is carried out on the two sets of pieces of correlation data. When a part of the piece of music is found to be highly correlated with the part of the piece of music already memorized, a piece of correlation data corresponding to the certain piece of correlation data already memorized is specified, and the piece of time data associated with the sampled value, from which the corresponding piece of correlation data is produced, is compared with the piece of time data for the certain piece of correlation data to see whether or not time lag takes place. If the time lag is found, the amount of time lag is added to or subtracted from the pieces of time data representative of the timing at which the not events took place. Thus, the note events are rescheduled. The compact discs in the first category will be described in more detail in conjunction with the first embodiment. The correlation analysis may be carried out before the playback or in a real time fashion.

In case where compact discs are fallen within the second category, the extraction of characteristic events may be applied thereto. While a user is producing note events in ensemble with the playback of the piece of music recorded in one compact disc, the characteristic events are extracted from the sampled values of the audio music data codes representative of the audio waveform of the piece of music, and the characteristic events are memorized for the playback together with the note events and the timing, i.e., pieces of time data at which the note events and characteristic events were respectively produced.

When the user wishes to reproduce the performance represented by the note events in ensemble with the playback of the music passage recorded in the other compact disc, characteristic events are extracted from the sampled values of the audio music data codes recorded in the other compact disc, and the characteristic events are compared with the corresponding characteristic events to see whether or not time lag takes place. If the time lag is found, the amount of time lag is added to or subtracted from the pieces of time data representative of the timing at which the not events took place. Thus, the note events are rescheduled. The compact discs in the second category will be described in more detail in conjunction with the second embodiment. The rescheduling may be repeated upon the time lag takes place between each of the characteristic events and the corresponding characteristic event.

In case where the compact discs are fallen within the third category, while a user is producing the note events in ensemble with a piece of music recorded in one compact disc, pieces of correlation data at a head portion are extracted from the sampled values representative of a head portion of the piece of music, and piece of correlation data at an end portion are extracted from the sampled values representative of an end portion of the piece of music, and the correlation data at the head portion and correlation data at the end portion are memorized together with the note events, piece of time data for the note events, a certain time at which a predetermined piece of correlation data took place in the correlation data at the head portion and another certain time at which another predetermined piece of correlation data took place in the correlation data at the end portion. When the user wishes to reproduce the performance, pieces of correlation data at a head portion is extracted from the sampled values representative of the head portion of the piece of music recorded in the other compact disc, and pieces of correlation data at an end portion from the sampled values representative of an end portion of the piece of music. The correlation analysis is carried out on the two set of correlation data at the head portion and the two sets of correlation data at the end portion, and determines a time corresponding to the certain time and another time corresponding to the other certain time. A top offset, i.e., a time difference between the certain time and the corresponding time and an end offset, i.e., a time difference between the other certain time and the corresponding time are determined. The ratio between the tempo in the piece of music recorded in one compact disc and the tempo in the piece of music recorded in the other compact disc is calculated on the basis of the top offset, end offset and those times. Then, the timing at which the note events are to be produced is rescheduled by using the ratio. Thus, the extraction of correlation data is applied to the compact discs in the third category. Of course, the extraction of characteristic events is applicable to the compact disc in the third category. These applications are described in more detail in conjunction with the third and fourth embodiments.

Nevertheless, the extraction of characteristic events may be applied to the compact discs in the first category, and the extraction of correlation data may be applied to the compact discs in the second category.

The above-described correspondence between the particular features and elimination of the time lag from therebetween are achieved through data processing in the first to fourth embodiments. A data processing unit is incorporated in a recorder, a player and a synchronous player system embodying the present invention, and runs computer programs for the given tasks. The computer programs will be hereinafter described in conjunction with the first to fourth embodiments.

First Embodiment

System Configuration

Referring first to FIG. 1 of the drawings, a synchronous player system embodying the present invention largely comprises a compact disc driver 1, floppy disc driver 2, an automatic player piano 3, an audio unit 4, a manipulating panel/display 5 and a controller 6. The compact disc driver 1, floppy disc driver 2, automatic player piano 3, audio unit 4 and manipulating panel/display 5 are connected to one another through signal lines, and the automatic player piano 3 and audio unit 4 are directly connected to each other through signal lines. The synchronous playback system has at least a preliminary recording mode and a synchronous playback mode. The synchronous playback system preliminarily prepares a MIDI standard file in a floppy disc FD where pieces of MIDI data and pieces of delta time data are stored together with pieces of reference correlation data according to the present invention in the preliminary recording mode. The pieces of delta time data are indicative of the lapse of time from the initiation of ensemble, and the pieces of reference correlation data are representative of a waveform of an audio signal to be produced from pieces of audio music data codes.

On the other hand, the synchronous playback system receives the pieces of MIDI data, pieces of delta time data and pieces of reference correlation data from the floppy disc FD and audio music data from the compact disc driver 1. The synchronous playback system compares the pieces of reference correlation data with pieces of objective correlation data, which are produced from audio music data codes supplied from the compact disc player 1 in the synchronous playback mode, for a correlation analysis, and regulates the MIDI music data to a proper timing for the ensemble with the playback through the compact disc driver/audio unit 1/4. Thus, the synchronous playback system makes the automatic player piano 3 and audio unit 4 synchronously reproduce a music passage in good ensemble.

The manipulating panel/display 5 is connected to the controller 6. A user gives instructions to the controller 6 through the manipulating panel, and the controller 6 notifies the user of the current status of the synchronous playback system through visual images produced on the display. The controller 6 is further connected to the compact disc driver 1, floppy disc driver 2, automatic player piano 3 and audio unit 4, and the automatic player piano 3 is directly connected to the audio unit 4. The pieces of MIDI data, pieces of audio music data, pieces of delta time data, pieces of reference correlation data and other sorts of data are selectively transferred between these system components 1, 2, 3, 4, 5 and 6 in the preliminary recording mode and synchronous playback mode. The behavior of these system components 1, 2, 3, 4, 5 and 6 will be described hereinlater in detail.

Compact Disc Driver

A read-in, plural frames and a read-out are stored in series in the compact disc CD for music passages, and the pieces of audio time data and pieces of audio music data form the frames together with predetermined sorts of control data. The pieces of audio music data and pieces of audio time data are found in the form of binary code, and are corresponding to the audio music data codes and audio time data codes, respectively. The audio music data codes are produced from analog audio signals. The analog audio signals, which are assigned the right channel and left channel, are sampled at 44,100 Hz, and the sampled discrete values are quantized into the 16-bit audio music data codes for right and left channels. The audio music data codes are partially produced from the right-channel analog audio signal, and are referred to as "right-channel audio music data codes". The remaining audio music data codes are produced from the left-channel analog audio signal, and are referred to as "left-channel audio music data codes".

The compact disc CD is loaded into and unloaded from the compact disc driver 1, and the compact disc driver 1 is responsive to user's instructions given through the manipulating panel/display 5 so as to start and stop the reproduction of the music passages. While a music passage is being reproduced, only the audio music data codes are supplied from the compact disc driver 1 to the controller 6. The compact disc driver 1 is of a standard type, and includes a disc tray, a motor for the disc tray, a servo-mechanism for the motor, an optical pickup unit, a focus servo-mechanism for the optical pickup unit, a synchronizing circuit for the servo-mechanisms and an error correcting system. These components are well known to the skilled person, and no further description is hereinbelow incorporated.

Floppy Disc Driver

The floppy disc driver 2 includes a microprocessor which runs on a computer program so that the floppy disc driver 2 has a data processing capability. The floppy disc driver 2 receives the event codes, delta time codes and reference correlation data codes representative of the pieces of reference correlation data from the controller 6, and creates a standard MIDI file in a floppy disc FD. The floppy disc driver 2 reads out the MIDI music data codes and pieces of reference correlation data from the standard MIDI file, and supplies the MIDI music data codes and pieces of reference correlation data to the controller 6.

Figure 2A:
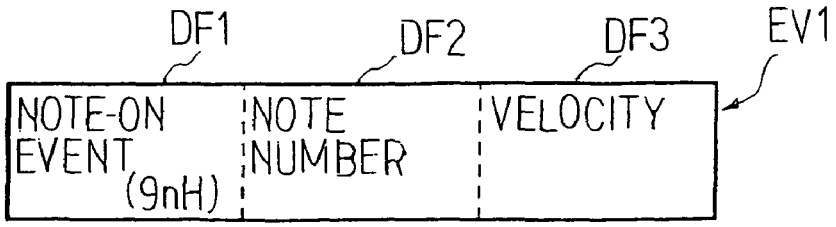
FIG. 2A is a view showing the format of a note-on event code.
Figure 2B:
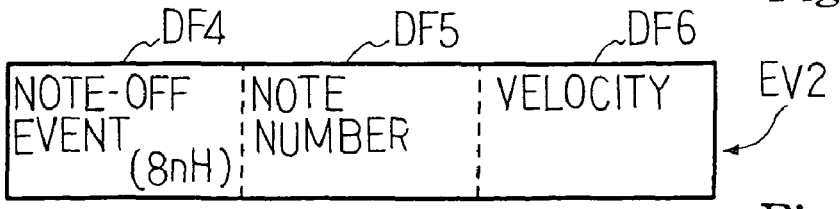
FIG. 2B is a view showing the format of a note-off event code.
Figure 2C:
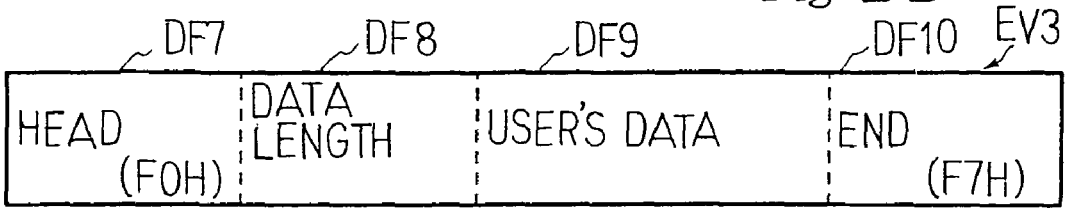
FIG. 2C is a view showing the format of a system exclusive event code.
Figure 3:
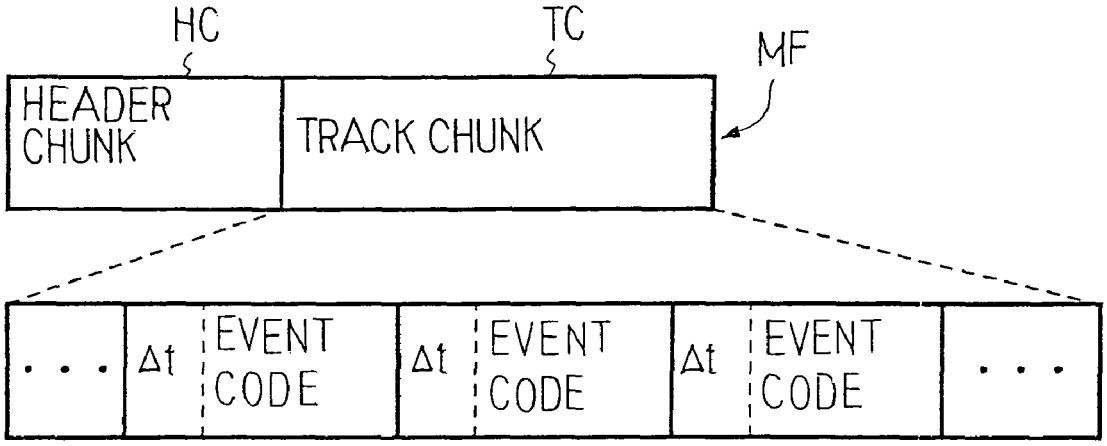
FIG. 3 is a view showing the structure of a standard MIDI file.

FIGS. 2A, 2B and 2C show formats for the MIDI music data codes, and FIG. 3 shows the structure of a standard MIDI file. FIG. 2A shows data fields DF1/DF2/DF3 of the note-on event code EV1, FIG. 2B shows data fields DF4/DF5/DF6 of the note-off event code EV2, and FIG. 2C shows data fields DF7/DF8/DF9/DF10 of the system exclusive event code EV3. The note-on event code EV1 has three data fields DF1, DF2 and DF3. The first data field DF1 is representative of the note-on event and a channel assigned to the tone to be generated. According to the MIDI standards, hexadecimal number [9n]H is to be written in the first data field DF1. "H" indicates that [9n] is a hexadecimal number, and "n" is indicative of the channel assigned to the tone to be generated. The second data field DF2 is assigned to the note number, which is representative of the pitch of the tone to be generated, and the third data field DF3 is indicative of the velocity. The velocity defines the key motion toward the end position, and is proportional to the loudness of the tone to be generated. The note-off event code EV2 also has three data fields DF4, DF5 and DF6.

The note-off event code EV2 also has three data fields DF4, DF5 and DF6. Hexadecimal number [8n]H is to be written in the first data field DF4. "8" represents the note-off event, and "n" is indicative of the channel already assigned to the tone to be decayed. The second data field DF5 is assigned to the note number indicative of the pitch of the tone to be decayed, and the third data field DF6 is assigned to the velocity. The velocity defines the key motion toward the rest position, and is inversely proportional to the time period until the silence.

A system composer and/or a software house can freely design the system exclusive event code EV3. The system exclusive event code EV3 has four data fields DF7, DF8, DF9 and DF10. The first data field DF7 is indicative of the head of the system exclusive event code EV3, and [F0]H is to be written in the first data field DF7. The second data field DF8 is indicative of a data length of user's data, and the third data field DF9 is assigned to the user's data. The last data field DF10 is indicative of the end of the system exclusive event code EV3. [F7]H is to be written in the last data field DF10.

As will be understood, the event codes EV1, EV2 and EV3 do not have any piece of time data. In other words, the event codes EV1 and EV2 are immediately executed for controlling the tones, and the user's data are also immediately processed.

Those sorts of event codes EV1, EV2 and EV3 form the standard MIDI file MF. The standard MIDI file MF is broken down into a header chunk HC and a track chunk TC. The header chunk HC is assigned to pieces of control data representative of the format for the music data to be stored in the track chunk TC and the unit of time. The track chunk TC is assigned to the MIDI music data codes, i.e., the event codes and delta time codes. The delta time code is representative of a time interval between an event code and the next event code or the lapse of time from the initiation of the playback. The time interval is expressed as a number of clock pulses, and the lapse of time is represented by hours, minutes and seconds, the number of frames and the combinations thereof. In this instance, the delta time codes are assumed to be indicative of the lapse of time in seconds.

Automatic Player Piano

The automatic player piano 3 largely comprises an acoustic piano 31A, a coding system 31B and an automatic playing system 31C. A user plays a music passage on the acoustic piano 31A, and acoustic piano tones are generated through the acoustic piano 31A. The coding system 31B and automatic playing system 31C are associated with the acoustic piano 31A. While the user is playing the tune, the key action and pedal action are memorized in the event codes through the coding system 31B, and the event codes are transferred from the coding system 31B to the controller 6, which in turn transfers the event codes to the floppy disc driver 2 for creating the standard MIDI file SMF in a floppy disc FD. On the other hand, when the user requests the automatic playing system 31C to reproduce the music passage on the basis of the event codes. The MIDI music data codes are supplied through the controller 6 to the automatic playing system 31C, and the acoustic piano tones are reproduced through the acoustic piano 31A along the music passage. The automatic player piano 31C is further operative to produce a digital audio signal on the basis of the MIDI music data codes, and the digital audio signal is supplied to the audio unit 4 for reproducing electronic tones from the digital audio signal.

The acoustic piano 31A is a standard grand piano, and includes a keyboard 31*a*, action units 31*b*, hammers 31*c*, strings 31*d*, dampers (not shown) and pedals 31*e*. Black keys and white keys form parts of the keyboard 31*a*, and are selectively depressed and released by the user. The depressed keys make the action units 31*b* activated and the dampers spaced from the associated strings. The activated action units 31*b* drive the associated hammers 31*c* for rotation, and the hammers 31*c* strikes the associated strings 31*d* at the end of the rotation. The dampers have been already spaced from the strings so that the hammers 31*c* give rise to vibrations for generating the acoustic piano tones. The pedals 31*e* are linked with the keyboard 31*a* and dampers. When the user steps on the pedals in his or her performance, the dampers make the acoustic piano tones prolonged, and/or the keyboard 31*a* makes the loudness of the acoustic piano tones reduced.

The coding system 31B includes key sensors 32, pedal sensors 33 and a controller 34. The key sensors 32 monitor the black/white keys, respectively, and the pedal sensors 33 monitor the pedals 31*e*, respectively. The key sensors 32 produce key position signals representative of the current positions of the associated black/white keys 32, and supply the key position signals to the controller 34. Similarly, the pedal sensors 33 produce pedal position signals representative of the current positions of the associated pedals 31*e*, and supply the pedal position signals to the controller 34. The controller 34 includes a microprocessor, and the microprocessor periodically fetches the pieces of positional data represented by the key position signals and pedal position signals. The microprocessor analyzes the pieces of positional data to see whether or not the user depresses any one of the keys/pedals. The user is assumed to depress a black key and step on one of the pedals. The microprocessor specifies the depressed black key and pedal, and calculates the velocity.

The microprocessor memorizes these pieces of music data in the event codes, and supplies the event codes to the controller 6.

The automatic playing system 31C includes the controller 34, a tone generator 35, a driver unit 36*a* and an array of solenoid-operated key/pedal actuators 36*b*. The controller 34 receives the event codes from the controller 6. If the user instructs the synchronous player system to produce the electronic tones, the controller 34 transfers the event codes to the tone generator 35, and the tone generator 35 produces a pair of digital audio signal for the right and left channels on the basis of the event codes. On the other hand, if the user instructs the synchronous playback system to produce the acoustic piano tones, the controller 34 determines the trajectories of the black/white keys to be moved, and instructs the driver unit 36*a* to energize the solenoid-operated key actuators 36*b* for moving the associated black/white keys along the trajectories. The driver units 36*a* selectively supplies a driving signal to the solenoid-operated key/pedal actuators 36*b* so that the solenoid-operated key/pedal actuators 36*b* give rise to the key motion and/or pedal motion for moving the black/white keys and pedals 31*e*. The black/white keys makes the action units 31*b* activated, and the hammers 31*c* strike the strings 31*d* at the end of the rotation. Thus, the automatic playing system 31C produces the acoustic piano tones or electronic tones on the basis of the event codes.

If the user instructs the controller 34 to supply the event codes to the tone generator 35 during the performance on the keyboard 31*a*, the controller 34 supplies the event codes to the tone generator 35, and the pair of digital audio signal is supplied from the tone generator 35 to the audio unit 4.

Audio Unit

The audio unit 4 includes a mixer 41, a digital-to-analog converter 42, amplifiers 43 and loud speakers 44. The controller 6 and tone generator 35 are connected to the mixer 41, and the pair of digital audio signal and another pair of digital audio signals are supplied from the tone generator 35 and controller 6 to the mixer 41. The pair of digital audio signals supplied from the controller 6 was produced from the audio music data codes. The mixer 41 mixes the digital audio signals for the right channel and the digital audio signals for the left channels into a pair of digital audio signals through an arithmetic mean, and supplies the pair of digital audio signals to the digital-to-analog converter 42. The digital audio signals are converted to an analog audio signal for the right channel and another analog audio signal for the left channel, and supplies the analog audio signals to the amplifiers 43. The analog audio signals are equalized and amplified through the amplifiers 43, and are, thereafter, supplied to the loud speakers 44. The loud speakers 44 convert the analog audio signals to the stereophonic electric tones.

Manipulating Panel/Display

The manipulating panel/display 5 includes an array of keys, switches, indicators and a display window. The user gives his or her instructions to the controller 6 through the keys and switches, and the controller 6 reports the current status to the user through the indictors and display window. When the controller 6 supplies a digital control signal representative of pieces of bit map data, the manipulating panel/display produces characters and/or other sorts of visual images on the display window.

Controller

The controller 6 includes a read only memory 61 abbreviated as "ROM", a central processing unit 62 abbreviated as "CPU", a digital signal processor 63 abbreviated as "DSP", a random access memory 64 abbreviated as "RAM", an interface 65 for communicating with the other system components 1, 2, 3 and 4 and a bus system 65*b*. The read only memory 61, central processing unit 62, digital signal processor 63, random access memory 64 and interface 65*a* are connected to the bus system 65*b*, and are communicable with one another through the bus system 65*b*.

The read only memory 61 is a sort of the non-volatile memory, and instruction codes, which form computer programs, are stored in the read only memory 61. The central processing unit 62 is implemented by a general-purpose microprocessor. The central processing unit 62 sequentially fetches the instruction codes, and executes the instruction codes for achieving given jobs. As will be hereinafter described in detail, the central processing unit 62 runs on certain computer programs in the preliminary recording mode and synchronous playback mode.

The digital signal processor 63 is a high-speed special-purpose microprocessor, and can process the audio music data codes at high speed under the control of the central processing unit 62. The digital signal processor 63 further works on the pieces of reference correlation data/pieces of objective correlation data, and reports the result of a correlation analysis to the central processing unit 62 as will be hereinafter described in detail.

The random access memory 64 is a sort of the volatile memory, and offers a temporary data storage to the central processing unit 62. In other words, the random access memory 64 serves as a working memory. The interface 65*a* transfers digital codes between the system components 1, 2, 3, 4 and 5. In case where the data format is different between the system components, the interface 65*a* changes the digital codes from the data format to another data format.

Preliminary Recording Mode

The user plays a piece of music on the keyboard 31*a* in ensemble with the playback through the compact disc player 1 and the audio unit 4, and the performance on the keyboard 31*a* is recorded in the floppy disc FD together with the pieces of reference correlation data. The compact disc CD used in the preliminary recording is hereinafter referred to as "CD-A", and a compact disc CD used in the synchronous playback is referred to as "CD-B" so as to make the compact discs distinguishable from one another. Although the music title and player are same, the compact disc CD-B is different in edition from the compact disc CD-A.

The user firstly loads the compact disc CD-A into the compact disc driver 1 and the floppy disc FD into the floppy disc driver 2. The user pushes the key on the manipulating panel/display 5 so that the central processing unit 62 acknowledges the user's instruction to start the preliminary recording. Then, the central processing unit 62 supplies a control signal representative of a request for playback through the interface 65*a* to the compact disc driver 1.

The compact disc driver 1 drives the compact disc CD-A for rotation, and supplies the audio music data codes to the interface 65*a*. A pair of audio music data codes is transferred to the interface 65*a* for the right channel and left channel at every interval of 1/44100 second. The pair of audio music data codes is expressed as (R(n), L(n)), and the value of the audio music data code R(n)/L(n) is hereinafter referred to as "sampled value". The sampled value is an integer, and all the sampled values are fallen within the range from −32768 to +32767. "n" is indicative of the place of the audio music data code in the track. For example, the first pair of audio music data codes is expressed as (R(0), L(0)), and the next one is expressed as (R(1), L(1)). Thus, the place is incremented by one during the playback.

When the pair of audio music data codes (R(n), L(n)) reaches the interface 65*a*, the central processing unit 62 fetches the pair of audio music data codes (R(n), L(n)) from the interface 65*a*. The central processing unit 62 transfers the pair of audio music data codes (R(n), L(n)) through the interface 65*a* to the mixer 41. The pair of audio music data codes (R(n), L(n)) is converted to the analog audio signals, and the analog audio signals are supplied through the amplifiers 43 to the loud speakers 44. Thus, the pairs of audio music data codes (R(n), L(n)) are sequentially supplied from the compact disc driver 1 through the controller 6 to the audio unit 4 for reproducing the piece of music through the loud speakers 44.

The central processing unit 62 is further operative to accumulate a predetermined number of the pairs of audio music data codes (R(n), L(n)) into the random access memory 64 for a predetermined time period. In this instance, the central processing unit 62 checks $2^{16}$ pairs of audio music data codes, i.e., 65536 pairs of audio music data codes for the accumulation. Pairs of audio music data codes (R(n), L(n)) representative of silence or almost silence are ignored, and are not accumulated in the random access memory 64. In other words, the central processing unit 62 accumulates the 65536 pairs of audio music data codes after a certain time period. The 65536 pairs of audio music data codes are equivalent to 1.49 seconds.

In detail, when the first pair of audio music data code (R(0), L(0)) reaches the central processing unit 62, the central processing unit 62 starts to check the pairs of audio music data codes (R(0), L(0)) to (R(65535) to see whether or not the sampled values exceed a threshold value. The threshold value is representative of the boundary. In this instance, the threshold is assumed to be 1000. At least one of the sampled values is assumed to exceed the threshold at the pair of audio music data codes (R(52156), L(52156)). While "n" is being incremented from zero to 52155, the answer is given negative, and the central processing unit 62 ignores these pairs of audio music data codes (R(0), L(0)) to (R(52155), L(52155). In other words, the central processing unit 62 does not accumulate the pairs of audio music data codes (R(0), L(0)) to (R(52155), L(52155)). The silent time period is about 1.18 seconds. When "n" reaches 52156, the central processing unit 62 changes the answer to affirmative. With the positive answer, the central processing unit 62 transfers the pair of audio music data codes (R(52156), L(52156) to the random access memory 64 together with the address assigned to the memory location where the audio music data codes (R(52156), L(52156)) is to be stored. The central processing unit 62 successively transfers the 65536 pairs of audio music data codes to the random access memory 64 so that the pairs of audio music data codes (R(52156), L(52156)) to (R(117691), L(117691)) are accumulated in the random access memory 64. Thus, the pair of audio music data codes representative of the silence or almost silence are not accumulated in the random access memory 64. The sampled values of those pairs of audio music data codes (R(52156), L(52156)) to (R(117691), L(117691)) are hereinafter referred to as "raw material for reference correlation data" or "reference raw material".

When the central processing unit 62 completes the accumulation of the reference raw material for reference correlation data, the central processing unit 62 starts an internal clock, and instructs the digital signal processor 63 to produce pieces of reference correlation data from the raw material for the reference correlation data. The pairs of audio music data codes (R(n), L(n)) were produced from the sampled values obtained through the sampling on the analog audio signal at 44100 Hz. The digital signal processor 63 converts the sampled values to the pieces of reference correlation data equivalent to sampled values at 172.27 Hz. The pieces of reference correlation data are used in a correlation analysis between the audio music data codes read out from the compact disc CD-B and the audio music data codes read out from the compact disc CD-A as will be described hereinlater in detail.

Figure 4:
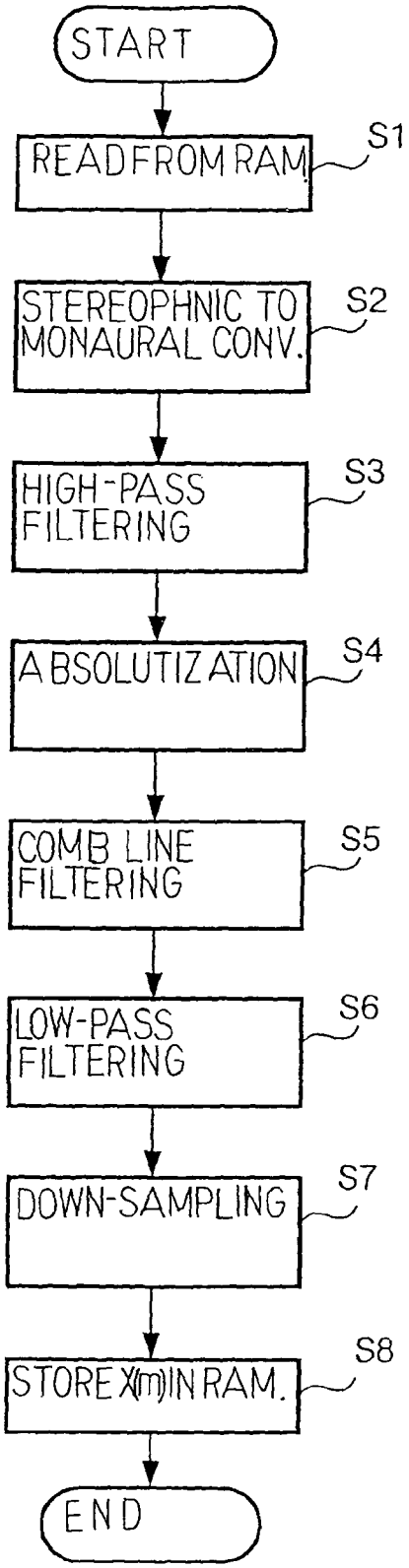
FIG. 4 is a flowchart showing a method for producing pieces of correlation data.

FIG. 4 shows a method for converting the sampled values to the pieces of reference correlation data. The method is stored in the program memory in the form of a computer program. The digital signal processor 62 reads out the pieces of reference raw material, i.e., the sampled values of the pairs of audio music data codes (R(n), L(n)) from the random access memory 64 as by step S1, and calculates the arithmetic mean of the pieces of reference raw material for converting the stereophonic audio music data to the monophonic audio music data as by step S2. The conversion from the stereophonic audio music data to the monophonic audio music data makes the load on the digital signal processor 63 light.

Subsequently, the digital signal processor 63 eliminates a value representative of the direct current component of the analog audio signal from the values of the arithmetic mean through a data processing equivalent to a high-pass filtering as by step S3. The calculated values are plotted in both positive and negative domains. It is preferable from the viewpoint of accuracy in the correlation analysis that the calculated values are dispersed in both positive and negative domains.

Subsequently, the calculated values are absolutized as by step S4. Substitute values of the power are determined for the calculated values through the absolutization. The absolute values are less than the square numbers representative of the power, and are easy to handle in the following data processing. Nevertheless, if the digital signal processor 63 has an extremely large data processing capability, the digital signal processor 63 may calculate the square numbers of the calculated values instead of the absolute values.

Subsequently, the digital signal processor 63 extracts a low frequency component representative of a tendency in the variation of the waveform of the original audio signal from the absolute values through a data processing equivalent to a comb line filter as by step S5. Although the low frequency component is usually extracted through a data processing equivalent to a low pass filter, the data processing equivalent to the comb line filter is lighter in load than the data processing equivalent to the low pass filter. For this reason, the data processing equivalent to the comb line filter, i.e., the comb line filtering is employed.

Figure 5:
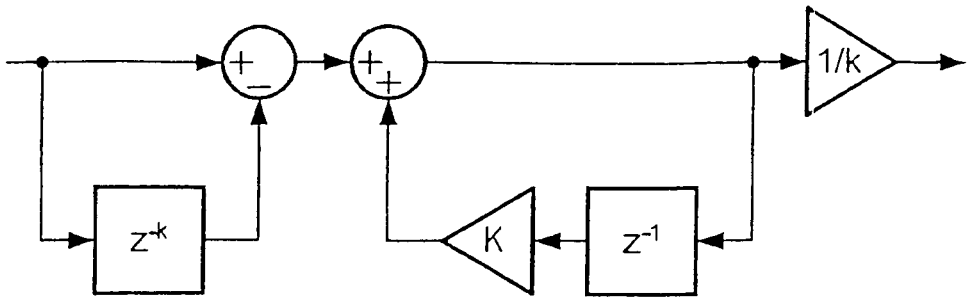
FIG. 5 is a block diagram showing a comb line filter.

FIG. 5 shows the circuit configuration of a comb line filter. Boxes stand for delays, and triangles stand for the multiplication. "$Z^{-k}$" is put in the left box, and "k" represents that the delay time is equal to (sampling period×k). The sampling frequency is 44100 Hz so that the sampling period is equal to $1/44100$ second. The multipliers are put in the triangles. In FIG. 5, "k" is given as follows $$k=(44100-\pi\times f)/(44100+\pi\times f) \qquad \text{expression 1}$$

The data processing through the multiplication with the multiplier "k" makes the comb line filter achieve a high pass filtering at frequency f, and the direct current component is perfectly eliminated from the absolute values. It is possible to experimentally optimize "k" and "f" so as to enhance the accuracy in the correlation analysis.

Turning back to FIG. 4, the digital signal processor 63 carries out a data processing equivalent to a low pass filter as by step S6 for preventing the sampled data through a down sampling from the fold-over noise. As will be described in conjunction with the next step S7, the digital signal processor 63 converts the sampled values at 44100 Hz to down-sampled values at 172.27 Hz, and the fold-over noise takes place. In order to prevent the down-sampled values from the fold-over noise, it is necessary to eliminate the frequency components higher than 86.13 Hz, i.e., half of 172.27 Hz. Although the comb line filter fairly eliminates the high frequency components from the sampled values, the high frequency components are still left in the sampled values. For this reason, the digital signal processor 63 perfectly eliminates the high frequency components from the sampled values before the down-sampling. In case where the digital signal processor 63 has a large data processing capability, the digital signal processor 63 may carry out a data processing equivalent to a high-precision low pass filtering instead of the two sorts of data processing at steps S5 and S6.

Subsequently, the digital signal processor 63 takes out a sample from every 256 samples as by step S7. Namely, the digital signal processor 63 carries out the down-sampling at 1/256. Upon completion of the down-sampling, the amount of data is reduced from 65536 to 256. The samples after the down-sampling serve as the pieces of reference correlation data X(m). "m" ranges from zero to 255. In this instance, X(0)-X(255) stand for the 256 pieces of reference correlation data. Finally, the digital signal processor 63 stores the pieces of reference correlation data X(0)-X(255) in the random access memory 64.

While the digital signal processor 63 is producing the pieces of reference correlation data X(0)-X(255), the user gets ready to play the piece of music on the keyboard 31*a*. As described hereinbefore, the central processing unit 62 starts the internal clock upon completion of the accumulation of the reference raw material. After the internal clock starts to increment the lapse of time, the user performs the piece of music in ensemble with the playback through the compact disc player/audio unit 1/4. This means the user selectively depresses and releases the black/white keys, and steps on the pedals 31*e*.

When the black/white keys and pedals 31*e* are moved, the black/white keys and pedals 31*e* changes the current key positions and current pedal positions, and associated key sensors 32 and associated pedal sensors 33 inform the controller 34 of the current key positions and current pedal positions through the key position signals and pedal position signals. The controller 34 periodically fetches the pieces of positional data from the data port, and accumulates the pieces of positional data in the random access memory 64. The controller 34 checks the accumulated data to see whether or not the user changes the current key positions and/or current pedal positions. When the answer is given affirmative, the controller 34 produces the event codes for the depressed/released keys and/or depressed/released pedals 31*e*. The controller 34 supplies the event codes to the controller 6.

When the event code reaches the interface 65*a*, the central processing unit 62 fetches the event code, and checks the internal clock for the arrival time. The central processing unit 62 produces the delta time code representative of the arrival time, and stores the event code and delta time code in the random access memory 64.

Figure 6:
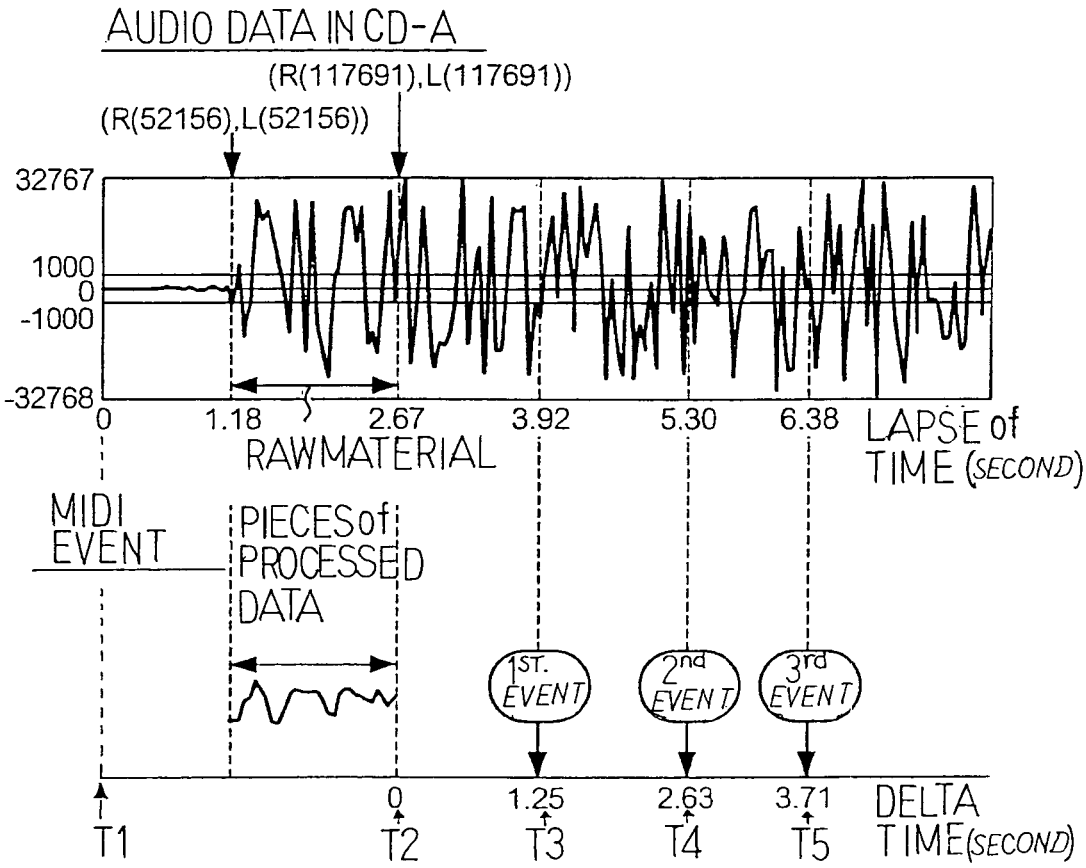
FIG. 6 is a view showing a sequence for producing MIDI music data codes.

FIG. 6 shows the sequence for producing the MIDI music data codes. The compact disc driver 1 starts to read out the audio music data codes, i.e., audio data from the compact disc CD-A at time T1, and the lapse of time is increased. The sampled value exceeds the threshold at 1.18 seconds from the initiation of the playback. Then, the central processing unit 62 starts to store the sampled values of the pairs of audio music data codes (R(52156), L(52156)) to (R(117691), L(117691)) in the random access memory 64, and the digital signal processor 63 produces the pieces of reference correlation data X(m) from the reference raw material as described hereinbefore in detail.

The sampled values of the last pair of audio music data code (R(117691), L(117691)) are stored in the random access memory 64 at time T2, i.e., 2.67 seconds after the initiation of the playback. Then, the central processing unit 62 starts the internal clock, and the user gets ready to perform the piece of music on the keyboard 31*a*. The user starts his or her fingering on the keyboard 31*a*, and the controller 34 supplies the first event code to the interface 65*a*. The central processing unit 62 acknowledges the reception of the first event code at time T3 , i.e., 3.92 seconds after the initiation of the playback. The internal clock is indicative of 1.25 seconds at time T3, and the central processing unit 62 stores the first event code together with the delta time code representative of the time T3 in the random access memory 64.

The controller 34 produces the second event code, and supplies the second event code to the interface 65*a*. The central processing unit 62 acknowledges the reception of the second event code at time T4 , i.e., 5.30 seconds after the initiation of the playback, and the internal clock is indicative of 2.63 seconds at time T4. The central processing unit 62 produces the delta time code representative of the time T4 , and stores the second event code together with the delta time code in the random access memory 64.

The third event takes place around time T5 , and the controller 34 supplies the third event code to the interface 65*a*. The central processing unit 62 acknowledges the reception of the third event code at time T5 , i.e., 6.38 seconds after the initiation of the playback, and the internal clock is indicative of 3.71 seconds at time T5 . The central processing unit 62 produces the delta time code representative of the time T5 , and stores the third event code together with the delta time code in the random access memory 64. The other event codes are stored in the random access memory 64 together with the delta time codes in the similar manner to the first to third event codes.

The compact disc player 1 reaches the end of the playback, and, accordingly, the user stops his or her fingering. Then, the user pushes one of the keys on the manipulating panel/display 5 for notifying the controller 6 of the completion of the performance. Then, the manipulating panel/display 5 supplies a control signal representative of the completion of the performance to the interface 65*a*.

Figure 7:
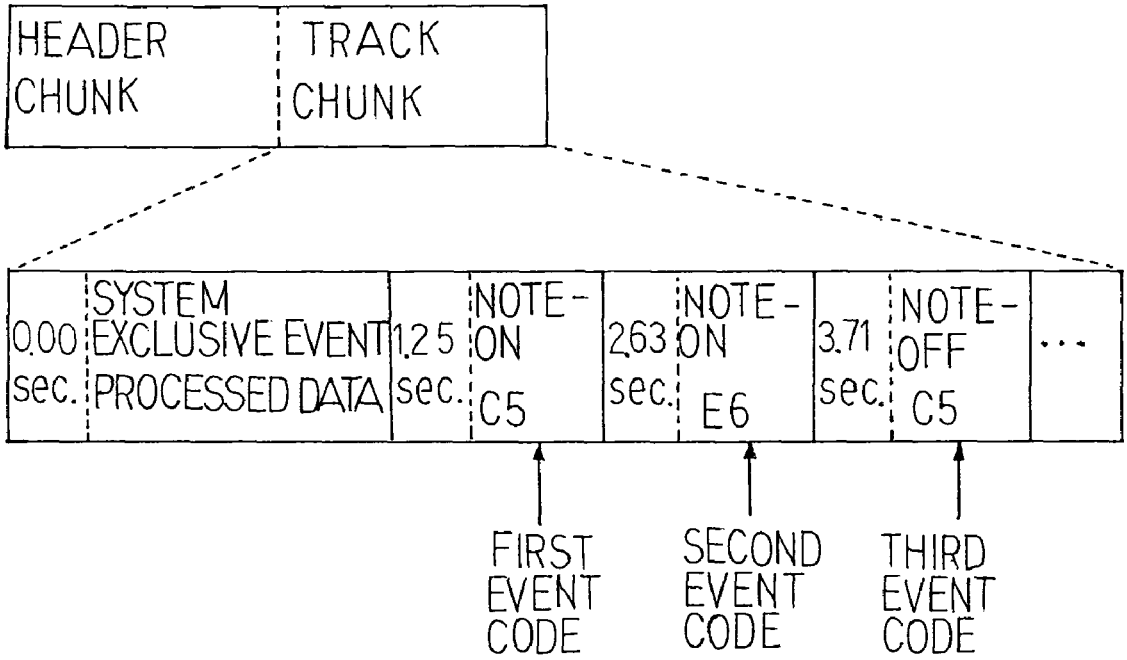
FIG. 7 is a view showing a data format for a standard MIDI file.

The central processing unit 62 acknowledges the completion of the performance, and supplies the control signal representative of the termination of the playback to the compact disc driver 1. The compact disc driver 1 stops the playback. The central processing unit 62 reads out the event codes, delta time codes and pieces of reference correlation data X(m) from the random access memory 64, and forms the pieces of reference correlation data X(m), event codes and delta time codes into the track chunk. The central processing unit 62 adds the header chunk to the track chunk so as to create the standard MIDI file as shown in FIG. 7. The pieces of reference correlation data X(m) are stored in the first area of the track chunk in the form of system exclusive event together with the delta time code representative of 0.00 second. The first event code and second event code represent the note-on at C5 and the note-on at E6, and the third event code represents the note-off at C5. The first event code is stored in the track chunk together with the delta time code representative of 1.25 seconds after the system exclusive event, and the second event code and delta time code representative of 2.63 seconds follow the first event code. The third event code and delta time code representative of 3.71 seconds follow the second event code. Thus, the event codes and associated delta time codes are stored in the track chunk until the user completes the performance.

Upon completion of the standard MIDI file, the central processing unit 62 transfers the standard MIDI file from the random access memory 64 to the floppy disc driver 2, and requests the floppy disc driver 2 to store the standard MIDI file in the floppy disc FD. The floppy disc driver 2 is responsive to the instruction of the central processing unit 62 so that the standard MIDI file is created in the floppy disc FD.

Synchronous Playback

The user is assumed to instruct the synchronous playback system to reproduce the ensemble between the acoustic piano 31A and the compact disc driver/audio unit 1/4. The compact disc CD-B is used in the synchronous playback. A piece of music stored in the compact disc CD-B is same in title as the piece of music reproduced in the preliminary recording mode. However, the compact disc CD-B was duplicated from the metal master different from the metal master from which the compact disc CD-A was duplicated. For this reason, the silent time period and dynamic range are not equal between the piece of music stored in the compact disc CD-A and the corresponding piece of music stored in the compact disc CD-B. Moreover, while the master metal was designed for the compact disc CD-B, the recording company added a sound effect to the piece of music. This means that the piece of music recorded in the compact disc CD-B is not strictly identical in melodic progression with the piece of music recorded in the compact disc CD-A.

The user is assumed to instruct the controller 6 to reproduce the performance on the acoustic piano 31A in ensemble with the playback through the compact disc player/audio unit 1/4. The floppy disc FD and compact disc CD-B have been already loaded in the floppy disc driver 2 and compact disc driver 1, respectively.

When the central processing unit 62 receives the control signal representative of the user's instruction from the manipulating panel/display 5, the central processing unit 62 requests the floppy disc driver 2 to send the standard MIDI file through the control signal. The floppy disc driver 2 accesses the standard MIDI file stored in the floppy disc FD, and transfers the standard MIDI file from the floppy disc FD to the central processing unit 62 through the interface 65*a*. The central processing unit 62 restores the standard MIDI file in the random access memory 64.

Subsequently, the central processing unit 62 requests the compact disc driver 1 to send pairs of audio music data codes. The compact disc driver 1 reads out the audio data codes from the compact disc CD-B, and transfers the audio music data codes (r(n), l(n)) to the interface 65*a*. Definitions of "r", "l" and "n" are same as those of "R", "L" and "n", respectively.

The central processing unit 62 fetches the audio music data codes (r(0), l(0)), (r(1), l(1)), (r(2), l(2)), . . . from the interface 65*a*. The central processing unit 62 firstly transfers the audio music data codes (r(0), l(0)), (r(1), l(1)), (r(2), l(2)), . . . through the interface 65*a* to the audio unit 4. The audio unit 4 converts the audio music data codes (r(0), l(0)), (r(1), l(1)), (r(2), l(2)), . . . to sound. The electric tones are heard after a certain time period.

The central processing unit 62 gives an instruction requesting the correlation analysis to the digital signal processor 63 so that the digital signal processor 63 gets ready for the correlation analysis. Then, the central processing unit 62 successively supplies the audio music data codes (r(0), l(0)), (r(1), l(1)), (r(2), l(2)), . . . to the digital signal processor 63 for the correlation analysis. The pieces of objective correlation data, which are produced from the audio music data codes (r(n), l(n)), are compared with the pieces of reference correlation data produced from the audio music data codes (R(n), L(n)), which were read out from the floppy disc FD, to see whether or not they are analogous to each other in the correlation analysis.

Figure 8:
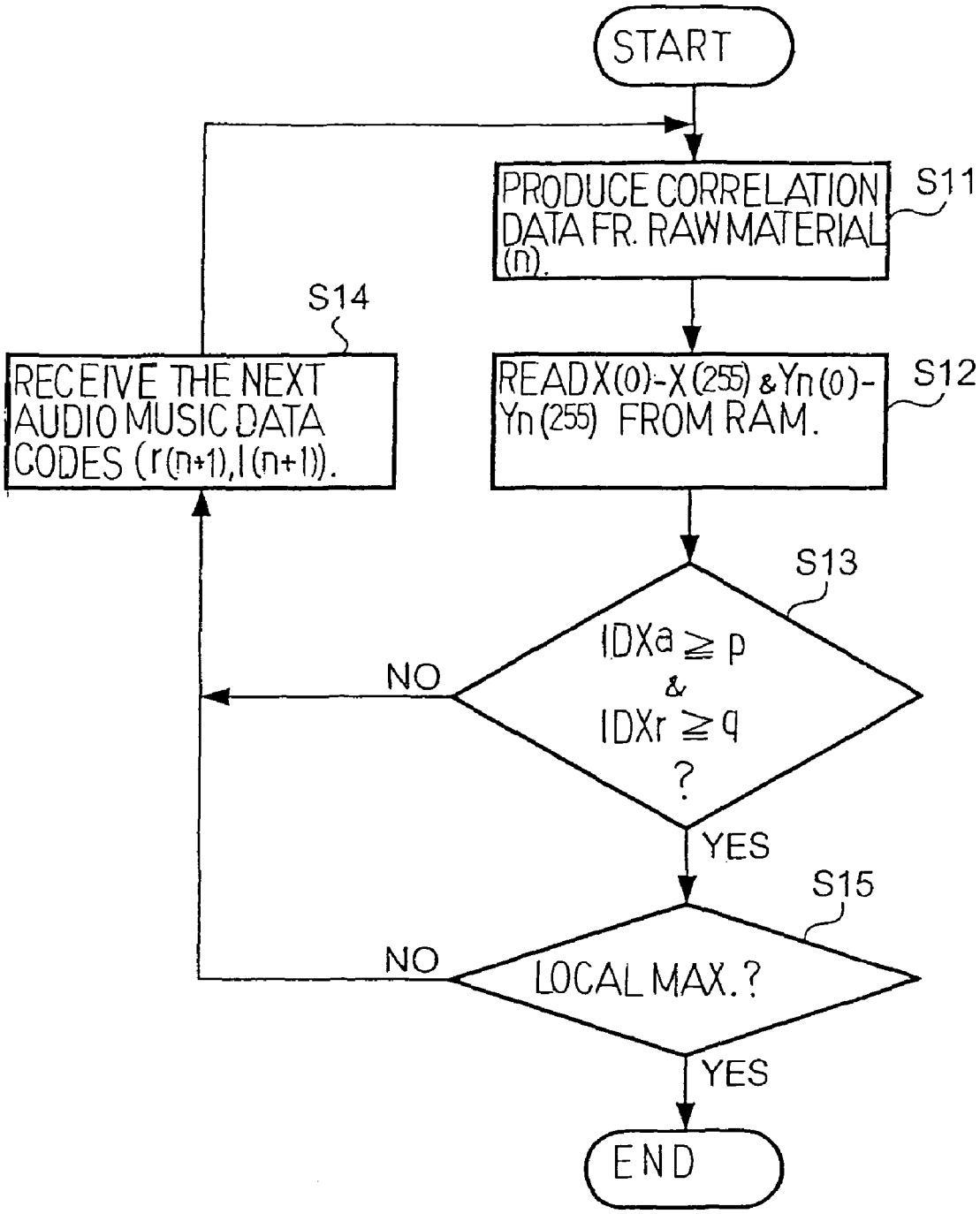
FIG. 8 is a flowchart showing a method for a correlation analysis.

FIG. 8 shows a method for the correlation analysis. While the central processing unit 62 is transferring the pairs of audio music data codes (r(n), l(n)) to the digital signal processor 63, the digital signal processor 63 accumulates the pairs of audio music data codes (r(n), l(n)) in the random access memory 64. The 65536 sampled values of pairs of audio music data codes (r(n), l(n)), (r(n+1), l(n+1)) . . . (r(n+65535), l(n+65535)) are referred to as "objective raw material (n)". When the digital signal processor 63 accumulates the pair of audio music data code (r(65535), l(65535)) in the random access memory 64, the digital signal processor 63 starts to produce pieces of objective correlation data from the objective raw material (0) as by step S111. In detail, the digital signal processor 63 firstly reads out the objective raw material (0), i.e., (r(0), l(0)) to (r(65535, l(65535)) from the random access memory 64, and carries out the data processing at steps S1 to S8 (see FIG. 4). Upon completion of the data processing, 256 pieces of objective correlation data Yn(0) to Yn(255) are left in the random access memory 64. Yn(0) to Yn(255) represent that the pieces of objective correlation data are produced from the objective raw material (n). The pair of 256 pieces of objective correlation data is hereinbelow referred to as "objective correlation data (n)".

Subsequently, the digital signal processor 63 reads out the pieces of reference correlation data X(0) to X(255), which form the part of the system exclusive event, and the pieces of objective correlation data Yn(0) to Yn(255) from the random access memory 64 as by step S12.

Subsequently, the digital signal processor 63 determines an absolute correlation index, and compares the absolute correlation index IDXa with a constant p to see whether or not the absolute correlation index IDXa is equal to or greater than the constant p.

$$\sum_{i=0}^{255} (x(i) \times Y_0(i)) \Big/ \sum_{i=0}^{255} (x(i)^2) \geq p \qquad \text{expression 2}$$

The left side of expression 2 is representative of the absolute correlation index IDXa, and the constant p has a value ranging from zero to 1. The closer the reference correlation data X(m) and the objective correlation data Y0(m) are to each other, the nearer the absolute correlation index is to 1. The pieces of reference correlation data are assumed to be paired with the corresponding pieces of objective correlation data. If the number of the pairs, which are equal in value between the piece of reference correlation data and the corresponding piece of objective correlation data, is increased, the value of the left side becomes greater. The constant p is determined in such a manner that the pieces of objective correlation data for a certain passage and corresponding pieces of reference raw material for the same passage make the answer to expression 2 affirmative and that the pieces of reference correlation data for the certain passage and corresponding pieces of objective correlation data for another passage make the answer to expression 2 negative. Thus, the contact p is experimentally optimized.

The digital signal processor further determines a relative correlation index IDXr, and compares the relative correlation index IDXr with a constant q to see whether or not the relative correlation index IDXr is equal to or greater than the constant q.

$$\left\{\sum_{i=0}^{255}(x(i)\times Y_0(i))\right\}^2 \Big/ \left\{\sum_{i=0}^{255}(x(i)^2)\times\sum_{i=0}^{255}(Y_0(i)^2)\right\} \geq q \qquad \text{expression 3}$$

The left side of expression 3 is representative of the relative correlation index IDXr, and has a value ranging between zero and 1. The more analogous the audio waveform represented by the reference correlation data X(m) is to the audio waveform represented by the pieces of objective correlation data Y0(m), the nearer the relative correlation index IDXr is to 1. The constant q has a value between zero and 1, and is experimentally optimized.

The relative correlation index IDXr is different from the absolute correlation index IDXa as follows. The reference correlation data and objective correlation data are assumed to express a performance on a certain music passage. If the dynamic range of the analog audio signal for the objective correlation data is lower than the dynamic range of the analog signal for the reference correlation data, the absolute correlation index IDXa is less than 1, and the difference between the absolute correlation index IDXa and 1 is dependent on the dynamic range of the analog audio signal for the pieces of objective data. In case where the dynamic range of the analog audio signal for the objective correlation data is higher than the dynamic range of the analog signal for the reference correlation data, the absolute correlation index IDXa is greater than 1, and the difference is dependent on the dynamic range of the analog signal. On the other hand, the relative correlation index IDXr has a value closer to 1 regardless of the difference in dynamic range. In other words, even though the compact disc CD-B is different in edition from the compact disc CD-A, the answer to expression 3 is given affirmative.

If one of or both of the answers are given negative, the digital signal processor 63 terminates the correlation analysis on the objective correlation data Y0(m) at step S13, and proceeds to step S14. The digital signal processor 63 waits for the next pair of audio music data codes (r(256), l(256)) at step S14. When the central processing unit 62 receives the next pair of audio music data codes (r(256), l(256)), the central processing unit 62 transfers the next pair of audio music data codes (r(256), l(256)) to the random access memory 64, and the next pair of audio music data codes (r(256), l(256)) is stored in the random access memory 64. Upon completion of the data write-in, the central processing unit 62 requests the digital signal processor 63 to carry out the correlation analysis, and the next pair of audio music data codes (r(1), l(1)) to (r(256), l(256) is transferred from the random access memory 64 to the digital signal processor 63 as by step S14. The digital signal processor 63 returns to step S11, and executes the jobs at steps S11 to S14 for the correlation analysis on the next pair of audio music data codes (r(1), l(1)) to (r(256), l(256)). Thus, the digital signal processor 63 reiterates the loop consisting of steps S11 to S14. If the digital signal processor 63 repeats the loop n times, the objective raw material (0) to objective raw material (n−1 are subjected to the correlation analysis.

Both answers to expressions (2) and (3) are assumed to be changed to affirmative. The digital signal processor 63 calculates the rate of change for the sum of products between X(m) and Yn(m) at n=0 as follows.

$$d\left(\sum_{i=0}^{255}(x(i)\times Y_0(i))\right)/dn = 0 \qquad \text{expression 4}$$

The sum of products X(m) and Yn(m) between is hereinafter referred to as "correlation value R". The correlation value R has the following tendency. The pieces of reference correlation data are assumed to be respectively paired with the pieces of objective correlation data. If the number of the pairs, which have the pieces of reference correlation data close in value to the associated pieces of objective correlation data, is increased, the correlation value R gets greater. Moreover, when the correlation value R is plotted in terms of time, i.e., R0 between X(m) and Y0(m), R1 between X(m) and Y1(m), R2, R3, . . . and Rn, the rate of change becomes zero at the extreme values on the function of correlation value R. Thus, the digital signal processor 63 checks the correlation value R for the extreme values through expression 4.

Subsequently, the digital signal processor 63 differentiates the function f(R), again, and seeks a local maximum MX on the function of correlation value Rn as follows.

$$d^2\left(\sum_{i=0}^{255}(x(i)\times Y_0(i))\right)/d^2n = 0 \qquad \text{expression 5}$$

Thus, the digital signal processor 63 checks the series of reference correlation data X(m) and objective correlation data Yn(m) to see whether or not the correlation value Rn is at the local maximum on the function as by step S15.

Of course, when "n" is zero, there is not any objective correlation data prior to the objective correlation data Y0(m). Then, the digital signal processor 63 immediately gives the negative answer to the inquiry at step S15, and the digital signal processor 63 proceeds to step S14. As described hereinbefore, the digital signal processor 63 starts to accumulate the pairs of audio music data codes (R(n), L(n)) in the reference raw material after the sampled value exceeds the threshold. However, the digital signal processor 63 successively accumulates the pairs of audio music data codes (r(n), l(n)) in the objective raw material (0) from the first pair (r(0), l(0)) regardless of the sampled value. In this situation, there is little possibility that the pair of audio music data code (R(n), L(n)), which firstly exceeded the threshold, occupies the head of the series of audio music data codes (r(n), l(n)).

The pieces of reference correlation data X(m) and pieces of objective correlation data Yn(m) have discrete values so that the digital signal processor 63 processes the pieces of reference correlation data/pieces of objective correlation data X(m)/Yn(m) at step S15 as follows. The digital signal processor 63 determines the difference Dn between the sum-products of X(m) and Yn(m) and the sum-products of X(m) and Yn−1 (m), and checks the difference Dn to see whether or not Dn−1 is greater than zero and Dn is less than zero. If Dn−1 is greater than zero and Dn is less than zero, the rate of change of the correlation value R is at the local maximum or in the vicinity of the local maximum. Then, the digital signal processor 63 gives the positive answer "Yes" to the inquiry at step S15. The digital signal processor 63 requires "n" equal to or greater than 2 for the above-described data processing. For this reason, when "n" is 1, the digital signal processor 63 gives the negative answer "No" to the inquiry at step S15.

If the answer is given negative at step S15, the digital signal processor 63 waits for the request for the correlation analysis. When the next pair of audio music data codes is fetched by the central processing unit 62, the next pair of audio music data codes is written in the random access memory 64, and the central processing unit 62 requests the digital signal processor 63 to carry out the correlation analysis. Then, the digital signal processor reads out the new objective correlation data Yn+x from the random access memory 64, and restarts the correlation analysis through steps S11 to S15.

While the answer at either step S13 or S15 remains negative, the digital signal processor repeats the correlation analysis through steps S11 to S14 and/or S11 to S15. When the digital signal processor 63 finds the correlation value Rn+y to occupy the local maximum, the answer at step S15 is changed to affirmative, and the digital signal processor 63 completes the correlation analysis.

Assuming now that the series of the pairs of audio music data codes (r(n), l(n)) in the compact disc CD-B is delayed from the series of the pairs of audio music data codes (r(n), l(n)) in the compact disc CD-A by 51600 sampling points, i.e., 1.17 seconds. As described hereinbefore, the pairs of audio music data codes (R(52156), L(52156)) to (R(117691), L(117691)) form in combination the reference raw material. The pairs of audio music data codes (r(n), l(n)) corresponding to those pairs (R(52156), L(52156)) to (R(117691), L(117691)) occupy the positions from 103756 to 169291. In other words, the pairs of audio music data codes (r(103756), l(103756)) to (r(169291, l(169291)) are corresponding to the pairs of audio music data codes (R(52156), L(52156)) to (R(117691), L(117691)). While the digital signal processor 63 is analyzing the set of pieces of objective correlation data Y0(m) to the set of pieces of objective correlation data Y103755(m) for the correlation, the answer at one of the steps S13 and S15 is given negative. This is because of the fact that the sets of pieces of objective correlation data Y0(m)-Y103755(m) are deviated from the set of pieces of reference correlation data X(m). In other words, the digital signal processor 63 does not find any one of the sets of pieces of objective correlation data Y0(m) to Y103755(m) highly correlated with the pieces of reference correlation data X(m).

However, when the digital signal processor 63 analyzes the set of pieces of objective correlation data Y103756(m) for the correlation with the pieces of reference correlation data X(m), the answers are given affirmative at steps S13 and S15, because the pieces of objective correlation data Y103756(m) are respectively corresponding to the pieces of reference correlation data X(m). With the positive answer, the digital signal processor 63 reports the correlation between the reference correlation data X(m) and the objective correlation data Y103756(m) to the central processing unit 62.

When the positive report arrives at the central processing unit 62, the central processing unit 62 starts the playback through the automatic player piano 31A. The standard MIDI file has been already transferred from the floppy disc FD to the random access memory 64, and the central processing unit 62 is continuously transferring the audio music data codes (r(n), l(n)) through the interface 65*a* to the audio unit 4 for reproducing the electric tones through the loud speakers 44.

The central processing unit 62 firstly starts the internal clock, and reads out the first delta time code from the random access memory 64. The central processing unit 62 periodically compares the internal clock with the first delta time code to see whether or not the first event code is to be transferred to the automatic player piano 31A. While the answer is given negative, the central processing unit waits for the time to transfer the first event code to the automatic player piano 31A. When the time period expressed by the delta time code is expired, the central processing unit 62 transfers the first event code through the interface 65*a* to the controller 34.

The controller 34 analyzes the first event code, and determines the trajectory to be traced by the black/white key. The controller 34 requests the driver 36*a* to move the black/white key along the trajectory. The driver 36*a* energizes the solenoid-operated key actuator 36*b* with the driving signal, and causes the solenoid-operated key actuator 36*b* to drive the associated black/white key for rotation. The black/white key actuates the associated action unit 31*b*, which in turn drives the associated hammer 31*c* for rotation through the escape of the jack. The hammer 31*b* strikes the associated string 31*d* at the end of the rotation, and the acoustic piano tone is generated from the vibrating string 31*d*.

If the user has instructed the controller 6 to playback the piece of music only through the audio unit 4, the controller 34 transfers the first event code to the tone generator 35, and the digital audio signal is supplied from the tone generator 35 to the mixer 41. The digital audio signal from the tone generator 35 is mixed with the digital audio signal from the compact disc driver 1, i.e., the pairs of audio music data codes (r(n), l(n)), and the electric tones are produced from the loud speakers 44.

When the central processing unit 62 transfers the first event code, the next delta time code is read out from the random access memory 64 to the central processing unit 62, and periodically checks the internal clock to see whether or not the second event code is to be transferred to the automatic player piano 3. When the time to transfer the second event code comes, the central processing unit 62 transfers the second event code through the interface 65*a* to the automatic player piano 3. Thus, the central processing unit 62 intermittently transfers the event codes to the automatic player piano 3, and the acoustic piano tones/electric tones are reproduced synchronously with the generation of the electric tones based on the audio music data codes (r(n), l(n)).

Figures 9A, 9B, 9C:
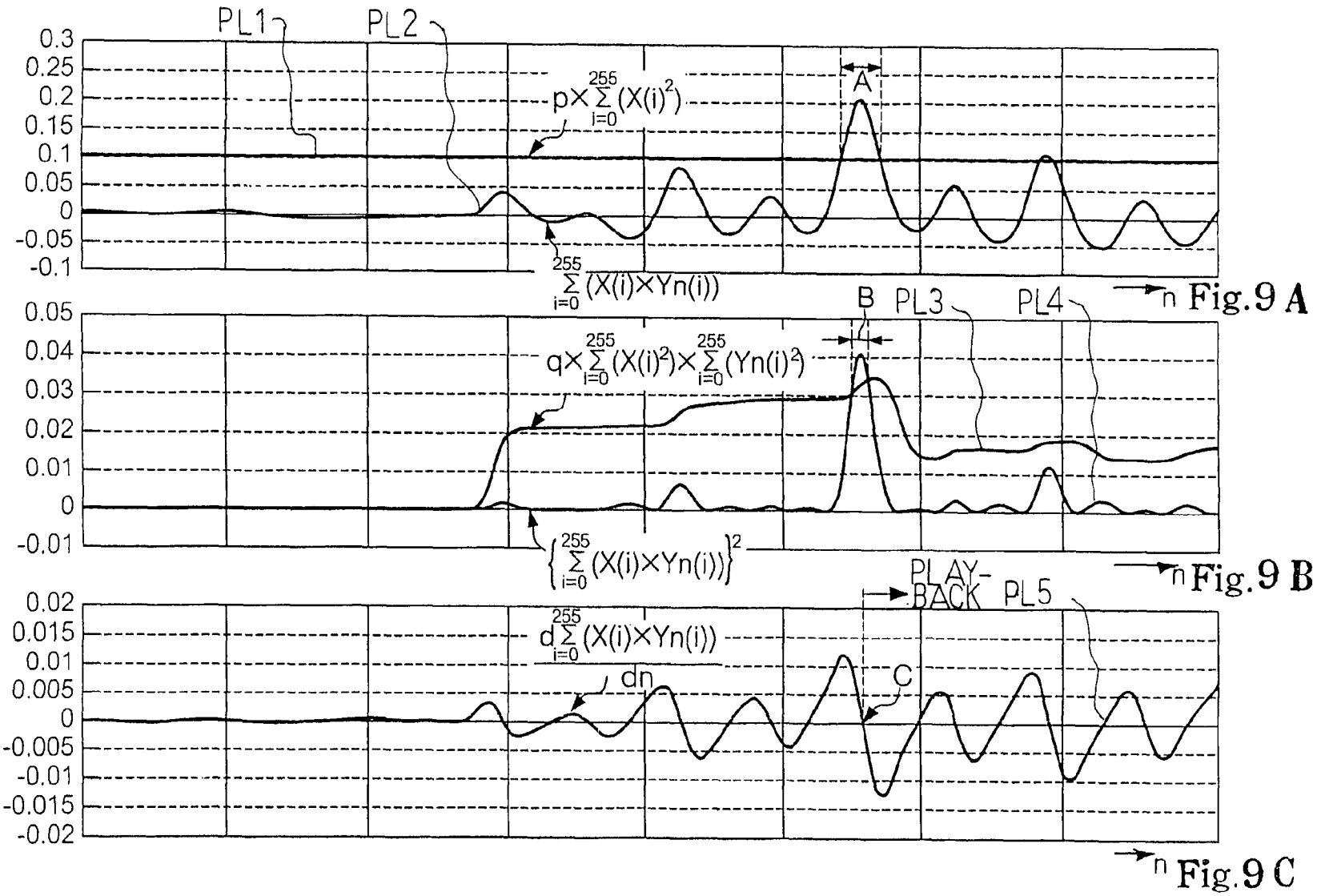
FIGS. 9A to 9C are graphs showing a result of a correlation analysis.

FIGS. 9A to 9C shows a result of the correlation analysis. The correlation analysis was carried out under the conditions that the data processing at step S3 was equivalent to the circuit behavior of a single-stage IIR (Infinite Impulse Response) filter serving as a high-pass filter at 25 Hz and that the comb line filter at step S5 had the constant k equal to 4410 and another constant f equal to 1 and that the data processing at step S6 was equivalent to the circuit behavior of a single-stage IIR filter serving as a low pass filter at 25 Hz. The constants p and q at step S13 were set to 0.5 and 0.8, respectively.

In FIGS. 9A, 9B and 9C, "n" is increased along the axes of abscissas in the rightward direction, and the axes of ordinates represent the values of the following plots. Plots PL1 is representative of the product between the constant p and the denominator of the left side of expression 2, and plots PL2 stand for the numerator of the left side of expression 2. Plots PL3 are representative of the product between the constant q and the denominator of the left side of expression 3, and plots PL4 stand for the numerator of the left side of expression 3. Plots PL5 are representative of the left side of expression 4. Plots PL1 were constant. Most of the plots PL2 were waved under the plots PL1. However, plots PL2 exceeded plots PL1 in domain A. In other words, the left side of expression 2 had the value equal to or greater than the constant P. Domain B was fallen within domain A. While "n" was passing through domain B, plots PL4 exceeded plots PL3, and the left side of expression 3 had the value equal to or greater than the constant q. Thus, the absolute correlation index IDXa and relative correlation index IDXr were equal to or greater than constant p and constant q, respectively, and the answer at step S13 was given affirmative only in domain B.

On the other hand, the left side of expression 4 was equal to zero at C, and expression 5 was satisfied at point C. The point C was fallen within domain B. Thus, the answer at step S15 was given affirmative, and the synchronous playback system started the playback at point C in ensemble between the automatic player piano 31A and the compact disc driver/audio unit 1/4. The present inventors confirmed that the automatic player piano 31A was well synchronized with the compact disc drier/audio unit 1/4 for reproducing the piece of music in ensemble.

As will be understood, the controller 6 analyzes the set of pairs of audio music data codes (R(n), L(n)) and a series of pairs of audio music data codes (r(n), l(n)) in the real time fashion for seeking the timing at which the automatic player piano 31A starts. This means that the automatic player piano 31A starts to reproduce the acoustic piano tones in good ensemble with the playback through the compact disc/audio unit 1/4. In other words, the controller 6 eliminates the difference between the silent time in the compact disc CD-A and the silent time in the compact disc CD-B from the ensemble between the automatic player piano 31A and the compact disc driver/audio unit 1/4.

Figure 10:
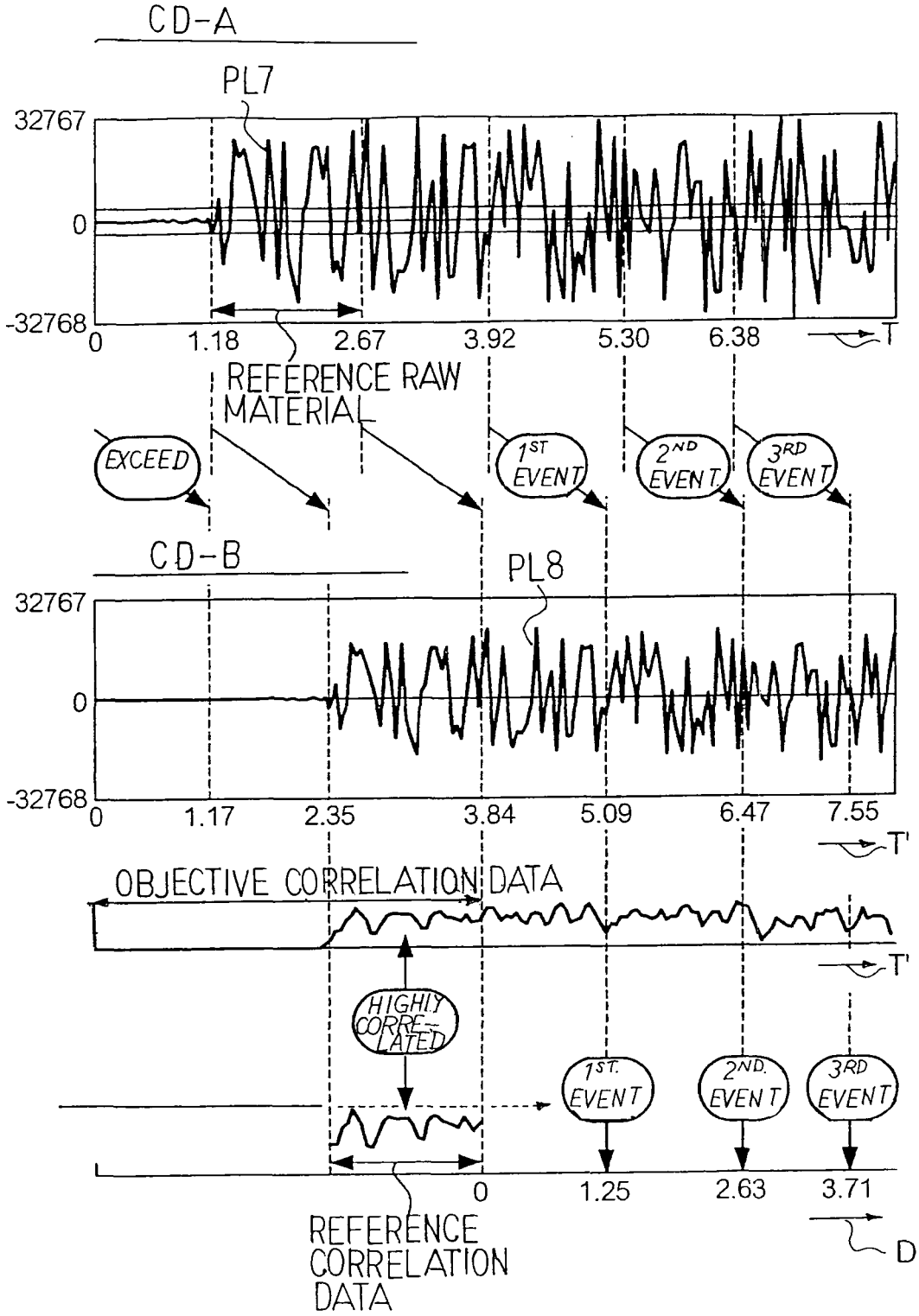
FIG. 10 is a timing chart showing a synchronous playback through the synchronous player system.

The present inventors confirmed the synchronous playback as follows. FIG. 10 shows the relation between the music data in the preliminary recording and the music data in the synchronous playback. PL7 represents the analog audio signal reproduced from the audio music data codes (R(n), L(n)), and the time runs in a direction T.

The silent time was continued around 1.18 seconds, and the sampled value exceeded the threshold at 1.18 seconds. The audio music data codes (R(n), L(n)) from 1.18 seconds to 2.67 seconds were stored in the floppy disc FD as the reference raw material. The reference raw material was accumulated in the random access memory 64 in the form of the system exclusive event, and the accumulation was completed at 2.67 seconds. Then, the central processing unit 62 started the internal clock, and, thereafter, the user started his or her fingering on the keyboard 31*a*. The first event, second event and third event took place at 3.92 seconds, 5.30 seconds and 6.38 seconds, respectively. The first event was delayed from the end of the accumulation of the reference raw material by 1.25 seconds. The event codes representative of the first event to the last event were stored in the standard MIDI file together with the delta time codes.

Plots PL8 represents the analog audio signal produced from the audio music data codes (r(n), l(n)) stored in the compact disc CD-B, and the time runs in a direction T'. The dynamic range of the audio signal reproduced from the compact disc CD-B was narrower than the dynamic range of the audio signal reproduced from the compact disc CD-A.

The silent time in the compact disc CD-B was longer than the silent time in the compact disc CD-A. When the pair of audio music data codes (r(0), l(0)) reached the central processing unit 62, the digital signal processor 63 starts to produce the pieces of objective correlation data from the objective raw material, and analyzes the pieces of reference correlation data and pieces of objective correlation data for looking for the highly correlated state In case where the controller 6 simply transferred the event codes to the automatic player piano 31A, the first event, second event and third event took place at 3.92 seconds, 5.30 seconds and 6.38 seconds, respectively, so that the automatic player piano 31A advanced the performance. This resulted in that the compact disc player/audio unit 1/4 was not well ensembled with the automatic player piano 31A.

On the other hand, the user instructed the controller 6 to reproduce the performance in ensemble with the playback through the automatic player piano 31A. The digital signal processor 63 had not acknowledged the highly correlated state before 3.84 seconds. When the playback reached 3.84 seconds, the digital signal processor 63 found the objective correlation data to be highly correlated with the reference correlation data, and the central processing unit 62 started the internal clock. The time ran in a direction D. The central processing unit 62 read out the first delta time code, and compared the lapse of time with the time represented by the first delta time code. When the internal clock was matched with the time, the central processing unit 62 transferred the first event code to the automatic player piano 31A, and the acoustic piano tone was generated. The first event code was transferred to the automatic player piano 31A 1.25 seconds after the completion of the correlation analysis, i.e., 5.09 seconds. The time interval from the exceed over the threshold to the transfer to the first event code was equal to the time interval after the silent time in the compact disc CD-B. The second event and third event were transferred to the automatic player piano 31A at 6.47 seconds and 7.55 seconds. The time intervals of the event codes were equal between the preliminary recording and the synchronous playback. Thus, the synchronous playback system achieved the good ensemble between the automatic player piano 31A and the compact disc driver/audio unit 1/4 regardless of the length of silent time and dynamic range.

As will be appreciated from the foregoing description, the synchronous playback system embodying the present invention reproduces the performances on the piece of music in good ensemble regardless of the length of silent time and the dynamic range.

First Modification

Figure 11:
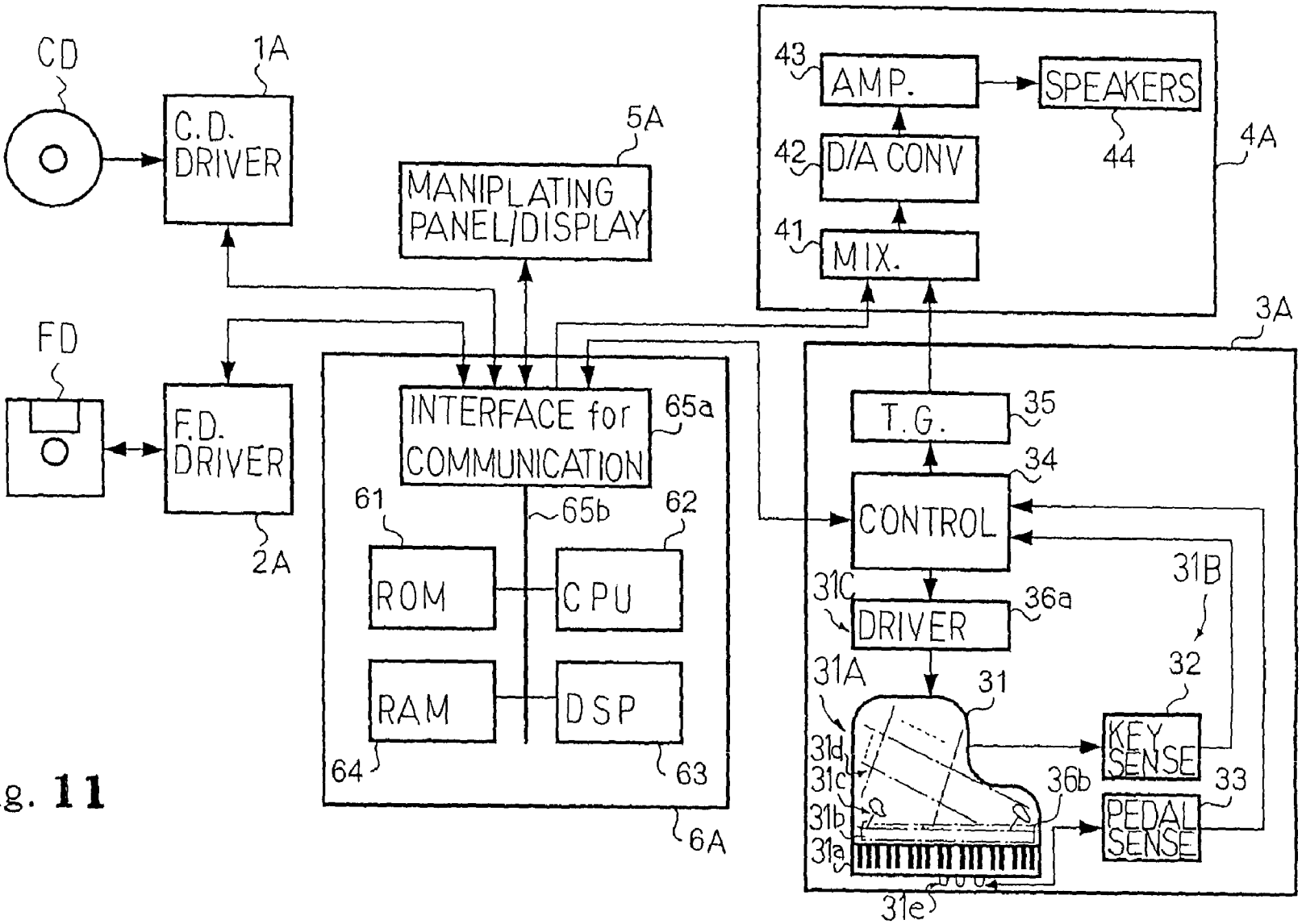
FIG. 11 is a block diagram showing the system configuration of a modification of the synchronous player system according to the present invention.

Turning to FIG. 11 of the drawings, the first modification of the synchronous player system embodying the present invention also largely comprises a compact disc driver 1A, a floppy disc driver 2A, an automatic player piano 3A, an audio unit 4A, a manipulating panel/display 5A and a controller 6A. The floppy disc driver 2A, automatic player piano 3A, audio unit 4A and manipulating panel/display 5A are similar in configuration and behavior to those of the synchronous player system embodying the present invention, and the component parts are labeled with the references designating the corresponding component parts shown in FIG. 1. Although the controller 6A is slightly different in data processing from the controller 6, the system configuration is similar to that of the controller 6, and, for this reason, the component parts are labeled with references designating the corresponding component parts of the controller 6 without detailed description.

The first modification also selectively enters the preliminary recording mode and synchronous playback mode, and the behavior in those modes of operation is generally identical with that of the synchronous playback system. For this reason, description is focused on differences from the digital processing executed by the synchronous playback system.

The compact disc driver 1A sequentially reads out the audio music data codes and audio time data codes from a compact disc CD, and transfers not only the audio music data codes but also the audio time data codes to the controller 6A. This is the difference from the behavior of the compact disc driver 1.

The controller 6A differently behaves in both preliminary recording and synchronous playback modes as follows. While the compact disc driver 1A is transferring the audio music data codes (R(n), L(n)) and audio time data codes to the controller 6A, the central processing unit 62 successively checks the pairs of audio music data codes (R(n), L(n)) to see whether or not the sampled value exceeds the threshold. When the central processing unit 62 finds the sampled value to exceed the threshold, the audio time data code is stored in the random access memory 64 together with the first piece of reference raw material. The audio time data code forms a part of the system exclusive event, and is stored in the standard MIDI file. Another difference is that the audio time data codes at which the event codes reach the controller 6A are stored in the standard MIDI file together with the delta time codes. In the synchronous playback mode, the controller 6A transfers the event codes to the automatic player piano 3A on the basis of the audio time data codes supplied from the compact disc driver 1A. The audio time data codes are representative of the lapse of time from the initiation of playback in hours, minutes, seconds and frames. However, the lapse of time is expressed in only seconds in the following description for the sake of simplicity.

In detail, a user is assumed to instruct the synchronous playback system to preliminary record the performance on the keyboard 31*a* in ensemble with the playback through the compact disc driver/audio unit 1A/4A through the manipulating panel/display 5A. The piece of music is reproduced from the compact disc CD-A in the preliminary recording mode, and will be reproduced from the compact disc CD-B in the synchronous playback mode.

The audio music data codes and audio time data codes are successively read out from the compact disc CD-A, and are supplied from the compact disc driver 1A to the interface 65*a*. The central processing unit 62 fetches the audio music data codes and audio time data codes from the interface 65*a*, and transfers the audio music data codes to the audio unit 4A. The audio unit 4A converts the audio music data codes to the electric tones so that the piece of music is reproduced through the laud speakers 44. While the central processing unit 62 is transferring the audio music data codes to the audio unit 4A, the central processing unit 62 is further operative to check the pairs of audio music data codes (R(n), L(n)) to see whether or not at least one sampled value exceeds the threshold. When the central processing unit 62 finds a pair of audio music data codes with the sampled value exceeding the threshold, the central processing unit 62 changes the audio time data code received immediately before the pair of audio music data codes to a delta time code representative of the lapse of time stored in the audio time data code. The central processing unit 62 stores the delta time code in the random access memory 64. The sampled value is assumed to exceed the threshold immediately after the arrival of the audio time data code indicative of 1.18 seconds. Accordingly, the delta time code stored in the random access memory 64 is indicative of 1.18 seconds. The delta time code stored in the random access memory 64 is hereinafter referred to as "reference delta time code".

After exceeding the threshold, the central processing unit 62 transfers the pairs of audio music data codes to the random access memory 64 for 1.49 seconds, and memorizes the sampled values thereof in the random access memory 64 as pieces of raw material.

Upon completion of the accumulation of the pieces of raw material in the random access memory 64, the central processing unit 62 requests the digital signal processor 63 to produce pieces of reference correlation data from the pieces of raw material through the data processing shown in FIG. 4. Thus, pieces of reference correlation data are produced from the pieces of raw material, and are stored in the random access memory 64.

When the first electric tone is radiated from the laud speakers 44, the user starts his or her fingering on the keyboard 31*a* and selectively step on the pedals 31*e*. While the user is playing the piece of music on the acoustic piano 31A in ensemble with the playback through the compact disc player/audio unit 1A/4A, the controller 34 produces the event codes representative of the note-on, note-off, pedal-on and pedal-off from the key position signals and pedal position signals, and supplies the event codes to the interface 65*a*.

The central processing unit 62 fetches the event codes from the interface 65*a*, and produces the delta time codes from the audio music data codes received immediately before the event codes. The central processing unit 62 stores the event codes and delta time codes in the random access memory 64.

When the user stops his or her performance, the user instructs the synchronous playback system to record the performance through the manipulating panel/display 5A. Then, the central processing unit 62 instructs the compact disc driver 1A to stop the playback, and reads out the reference delta time code, pieces of reference correlation data, event codes and associated delta time codes from the random access memory 64 so as to form a standard MIDI file SMF2.

Figure 12:
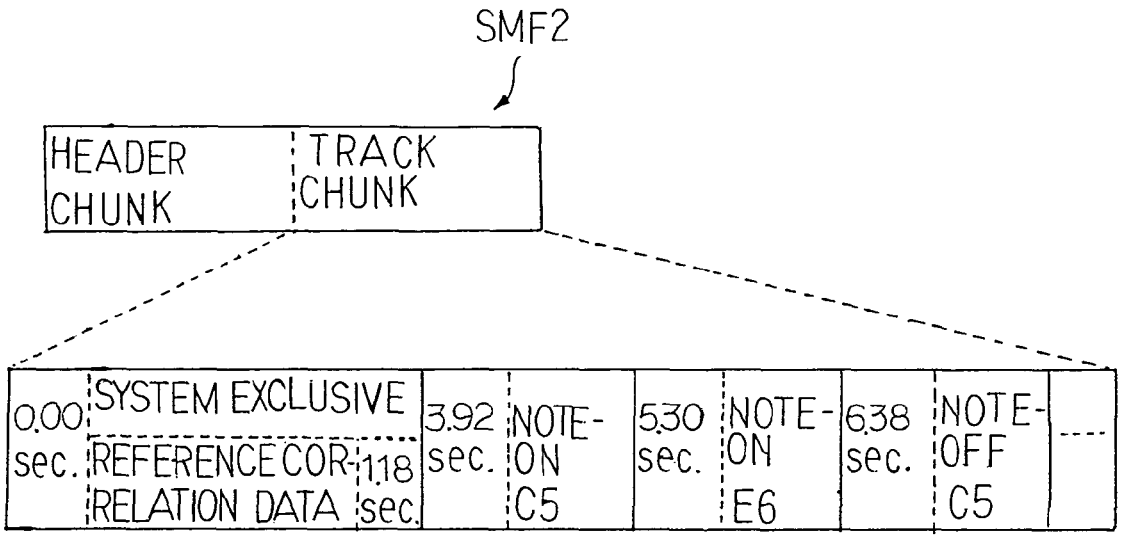
FIG. 12 is a view showing a data format for a standard MIDI file.

FIG. 12 shows the data format for the standard MIDI file SMF2. The system exclusive event code, event code for the note-on at C5, event code for the note-on at E6, event code for the note-off at C5 are stored in the track chunk, and the reference delta time code indicative of 1.18 seconds is stored in the system exclusive event data code together with the pieces of reference correlation data. The delta time code indicative of 3.92 seconds represents the timing at which the note-on event at C5 reaches the interface 65*a*. Similarly, the delta time code indicative of 5.30 seconds represents the timing at which the note-on event at E6 reaches the interface 65*a*, and the delta time code indicative of 6.38 seconds represents the timing at which the note-off event at C5 reaches the interface 65*a*.

The standard MIDI file SMF2 is transferred from the central processing unit 62 to the floppy disc driver 1A, and is written in the floppy disc FD.

The user is assumed to instruct the synchronous playback system to reproduce the performance on the keyboard 31*a* through the automatic player piano 3A in ensemble with the playback through the compact disc driver/audio unit 2A/4A. The user loads the compact disc CD-B into the compact disc driver 1A.

The central processing unit 62 requests the floppy disc driver 2A to transfer the standard MIDI file SMF2 to the interface 65*a*. The standard MIDI file SMF2 is read out from the floppy disc FD, and is transferred from the floppy disc driver 2A to the interface 65*a*. The central processing unit 62 fetches the data codes stored in the standard MIDI file from the interface 65*a*, and restores the system exclusive event code, event codes and delta time codes in the random access memory 64.

The central processing unit 62 further requests the compact disc driver 1A to successively transfer the audio music data codes and audio time data codes from the compact disc CD-B to the interface 65*a*. The central processing unit 62 fetches the audio music data codes and audio time data codes from the interface 65*a*, and selects the audio music data codes from the received data. The central processing unit 62 transfers the audio music data codes to the audio unit 4A, and the audio unit 4A converts the audio music data codes to the electric tones. Thus, the piece of music is reproduced through the audio unit 4A.

The central processing unit 62 further transfers the event code/codes together with the delta time code to the random access memory 64, and the event code/codes and delta time code are stored in the random access memory 64.

When the $65536^{th}$ pair of audio music data codes (r(65535), l(65535)) is stored in the random access memory 64, the central processing unit 62 requests the digital signal processor 63 to start the correlation analysis. Although the pieces of reference correlation data are unchanged, the newly produced piece of objective correlation data pushes out the oldest piece of objective correlation data from the set. Thus, the members of the set of pieces of objective correlation data are changed with time. The digital signal processor 63 compares the pieces of reference correlation data with the pieces of objective correlation data to see whether or not the pieces of objective correlation data are highly correlated with the pieces of reference correlation data as described in conjunction with the method shown in FIG. 8. When the answer at step S15 is given affirmative, the digital signal processor 63 completes the correlation analysis on the pieces of objective correlation data. Then, the digital signal processor 63 reports the central processing unit 62 that the correlation analysis is successfully completed, and sends the identification number assigned to the first piece of objective correlation data of the last set to the central processing unit 62. In this instance, the identification number "103756" is assumed to be sent to the central processing unit 62.

Upon reception of the successful report and identification number "103756", the central processing unit 62 accesses the random access memory 64, and reads out the audio time data code associated with the pair of audio music data codes (r(103756), l(103756)). The audio time data code is assumed to be indicative of 2.35 seconds. The central processing unit 62 further reads out the reference delta time code from the random access memory 64, and compares the audio time data code with the reference delta time code to see whether or not the silent time is equal between the compact disc CD-A and the compact disc CD-B. In this instance, the reference delta time code is indicative of 1.18 seconds. Then, the answer is given negative. With the negative answer, the central processing unit 62 calculates the difference between the silent time of the compact disc CD-A and the silent time of the other compact disc CD-B. The difference is 1.17 seconds. This means that the compact disc driver/audio unit 1A/4A started the playback of the piece of music stored in the compact disc CD-A 1.17 seconds earlier than the playback of the same piece of music stored in the compact disc CD-B. For this reason, the central processing unit 62 adds 1.17 seconds to the lapse of time indicated by each of the delta time codes stored in the standard MIDI file SMF2.

The first note-on event at C5 is to take place at 3.92 seconds from the initiation of the playback (see FIG. 12). Upon completion of the addition of the time difference, the first note-on event at C5 is delayed from 3.92 seconds to 5.09 seconds. Similarly, the second note-on event at E6 is delayed from 5.30 seconds to 6.47 seconds, and the note-off event at C5 is delayed from 6.38 seconds to 7.55 seconds. Thus, the lapse of time stored in the delta time codes is regulated to the lapse of time in the playback of the piece of music stored in the compact disc CD-B. The jobs for eliminating the time difference from the lapse of time stored in the delta time codes is hereinafter referred to as "timing regulation", and the delta time codes after the timing regulation are referred to as "regulated delta time codes".

Upon completion of the timing regulation, the central processing unit reads out the first delta time code from the random access memory 64, and checks the audio time data code supplied from the compact disc driver 1A to see whether or not the associated event code is to be transferred to the automatic player piano 3A. While the audio time data codes are indicating the lapse of time shorter than the lapse of time indicated by the first regulated delta time code, the central processing unit 62 transfers the pairs of audio music data codes (r(n), l(n)) to the audio unit 4A, but does not transfer the event code to the automatic player piano 3A. For this reason, only the electric tones are radiated from the laud speakers 44.

When the audio time data code indicative of 3.92 seconds is fetched by the central processing unit 62, the answer is changed to affirmative, and the central processing unit 62 transfers the first event code at C5 from the random access memory 64 to the controller 34 of the automatic player piano 3A. The controller 34 supplies the driving signal to the solenoid-operated key actuator 36*b* for driving the hammer 31*c* for rotation. The hammer 31*c* strikes the associated string 3*d*, and the acoustic tone is generated at C5.

In the similar manner, the central processing unit 62 compares the lapse of time expressed by the regulated delta time codes with the lapse of time expressed by the audio time codes to see whether or not the associated event codes are to be transferred to the automatic player piano 3A, and transfers the associated event codes to the automatic player piano 3A at appropriate timing. This results in good ensemble between the playback through the automatic player piano 3A and the playback through the compact disc driver/audio unit 1A/4A.

Figure 13:
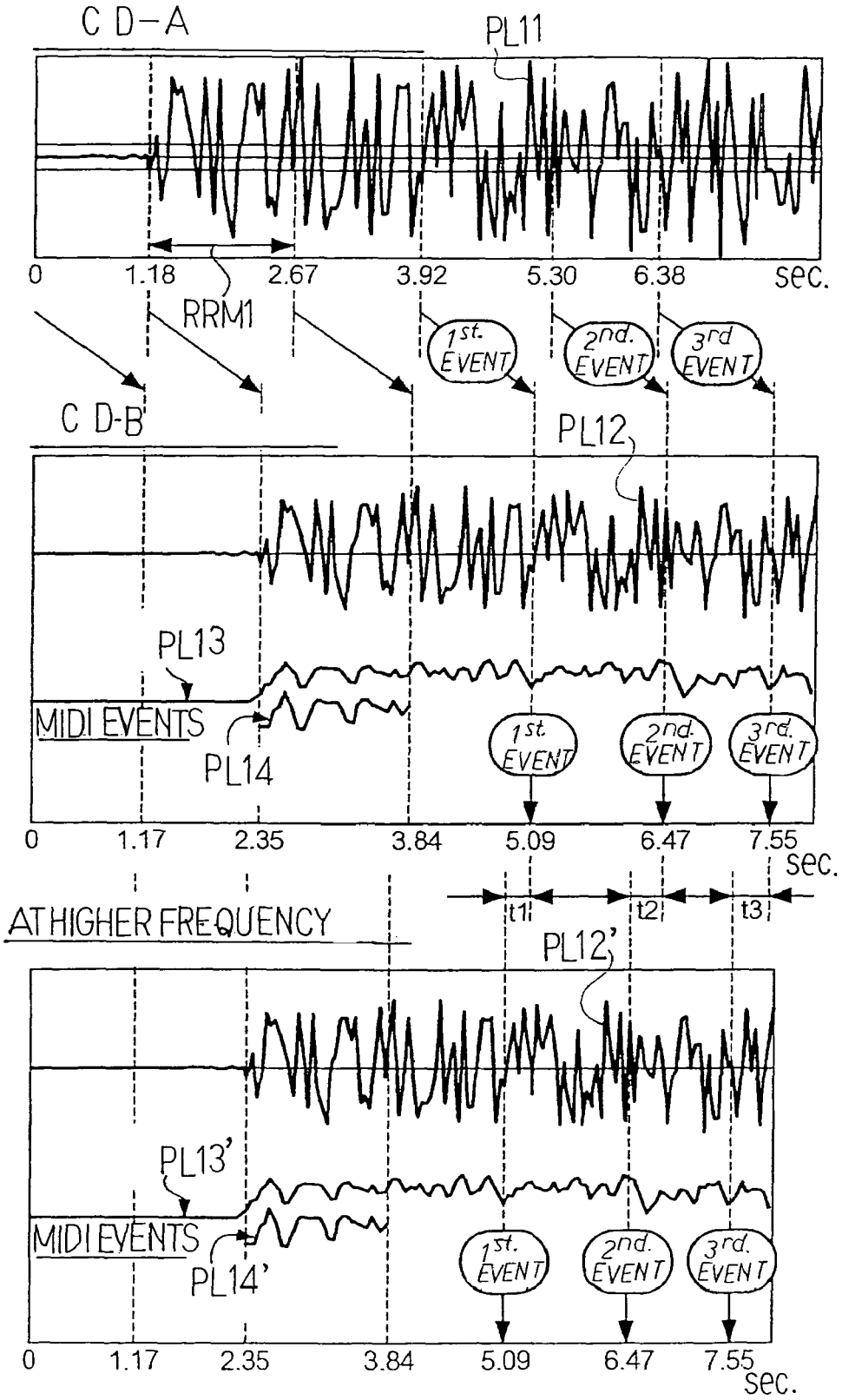
FIG. 13 is a timing chart showing a synchronous playback through the modification.

FIG. 13 shows the synchronous playback through the first modification of the synchronous playback system. The axes of abscissa were indicative of the lapse of time represented by the audio time data codes. Plots PL11 were representative of the waveform of the analog audio signal produced from the audio music data codes (R(n), L(n)) stored in the compact disc CD-A, and plots PL12 stood for the waveform of the analog audio signal produced from the audio music data codes (r(n), l(n)) stored in the compact disc CD-B. The pieces of reference correlation data were produced from the reference raw material RRM1 from 1.18 seconds to 2.67 seconds, and the first event, second event and third event took place at 3.92 seconds, 5.30 seconds and 6.38 seconds, respectively. Accordingly, the delta time codes were indicative of the lapse of time at 3.92 seconds, 5.30 seconds and 6.38 seconds, and were stored in the standard MIDI file SMF2.

On the other hand, plots PL13 were representative of the waveform of an analog signal produced from the pieces of objective correlation data, and were highly correlated with the waveform of another analog signal produced from the pieces of reference objective correlation data PL14 between 2.35 seconds and 3.84 seconds. Thus, the pieces of objective correlation data were delayed from the pieces of reference correlation data by 1.17 seconds.

The central processing unit 62 eliminated the time difference from between the objective correlation data and the reference correlation data through the timing regulation so that the first, second and third events were delayed from 3.92 seconds, 5,30 seconds and 6.38 seconds to 5.09 seconds, 6.47 seconds and 7.55 seconds, respectively.

The compact disc driver 1A had an oscillator, and the oscillation signal was divided to the clock signal of 44100 Hz. The audio data codes were read out from the compact disc CD-B in synchronism with the clock signal. The oscillator was unstable, and the audio data codes were read out from the compact disc CD-B in synchronism with the clock signal higher in frequency than that of the previous synchronous playback. Although the audio time codes were indicative of the same lapse of time, the time intervals were shrunk, and time differences t1, t2 and t3 took place between the first, second and third events in the previous synchronous playback and the first, second and third events in the synchronous playback under the higher clock frequency. Although the central processing unit 62 executed the jobs under the clock signal different from that of the compact disc driver 1A, the central processing unit 62 compares the lapse of time indicated by the delta time codes with the lapse of time represented by the audio time data codes in the real time fashion so that the event codes were transferred to the automatic player piano 3A earlier than those in the previous synchronous playback. Thus, the automatic player piano 3A reproduces the piece of music in good ensemble with the playback through the compact disc driver/audio unit 1A/4A.

Second Modification

Figure 14:
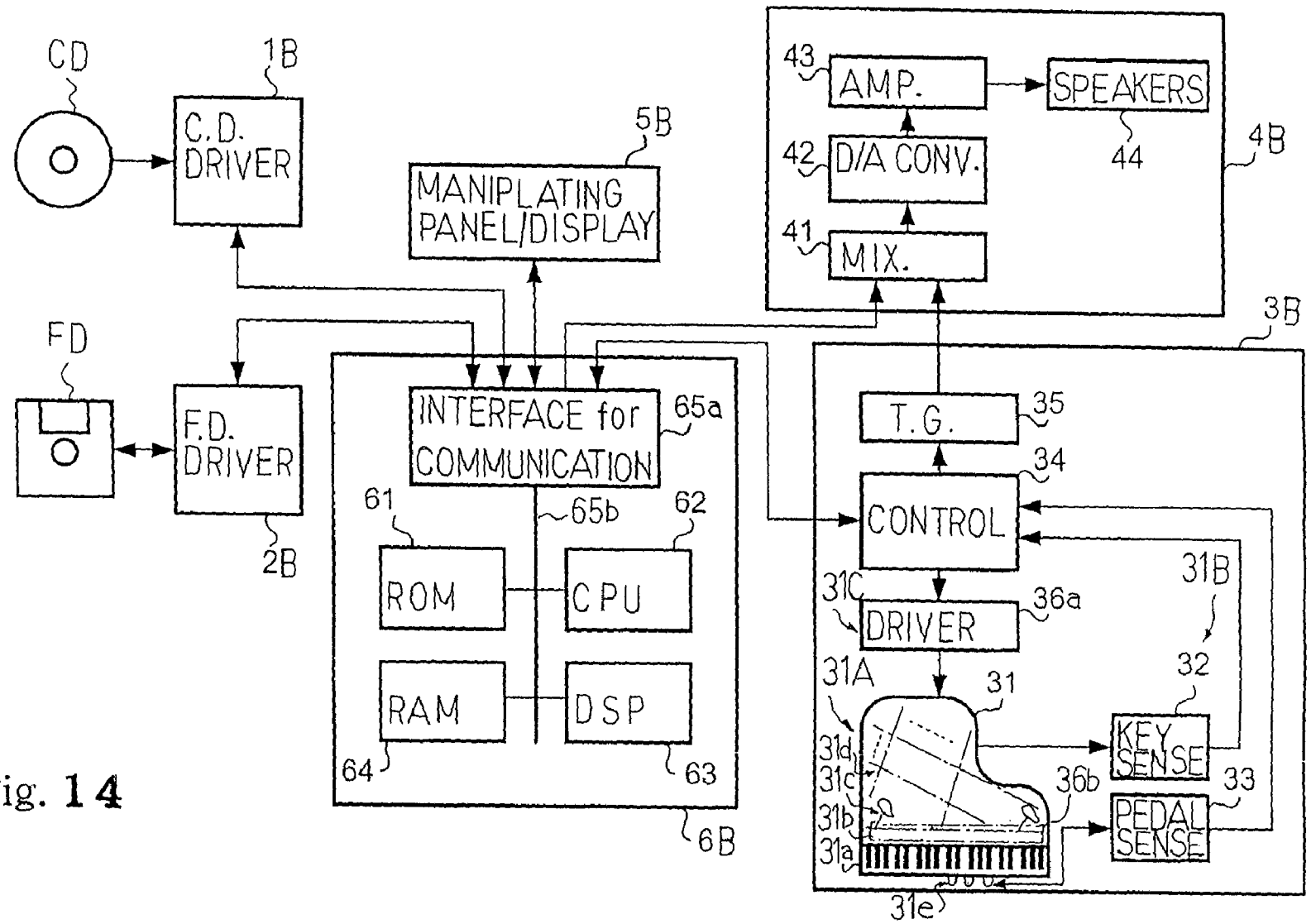
FIG. 14 is a block diagram showing the system configuration of another modification of the synchronous player system according to the present invention.

FIG. 14 shows the second modification of the synchronous player system embodying the present invention also largely comprises a compact disc driver 1B, a floppy disc driver 2B, an automatic player piano 3B, an audio unit 4B, a manipulating panel/display 5B and a controller 6B. The compact disc driver 1B, floppy disc driver 2B, automatic player piano 3B, audio unit 4B and manipulating panel/display 5B are similar in configuration and behavior to those of the synchronous player system implementing the first embodiment, and the component parts are labeled with the references designating the corresponding component parts shown in FIG. 1. Although the controller 6B is different in data processing from the controller 6, the system configuration is similar to that of the controller 6, and, for this reason, the component parts are labeled with references designating the corresponding component parts of the controller 6 without detailed description.

The second modification also selectively enters the preliminary recording mode and synchronous playback mode, and the behavior in those modes of operation is generally identical with that of the synchronous playback system. For this reason, description is focused on differences from the digital processing executed by the synchronous playback system shown in FIG. 1.

The major difference is that the controller 6B produces the pieces of reference correlation data from pieces of raw material extracted from an intermediate portion of the piece of music. Another difference is the complete playback from the head of the compact disc after the correlation analysis.

A user is assumed to instruct the controller 6B to preliminary record his or her performance in ensemble with the playback of a piece of music through the compact disc driver/audio unit 1B/4B. The digital signal processor 63 produces pieces of reference correlation data from any passage of the piece of music. The passage may be distinctive. Such a distinctive passage may appear from 3 minutes after the first tone of the piece of music. In this instance, the pieces of reference correlation data are produced from the pairs of audio music data codes (R(n), L(n)) supplied from the compact disc unit 1B for 1.49 seconds. In the following description, the passage starts at 180 seconds from the head, and continues 1.49 seconds.

When the central processing unit 62 acknowledges the instruction for the preliminary recording, the central processing unit 62 requests the compact disc driver 1B to transfers the pairs of audio music data codes (R(n), L(n)) representative of the passage to the interface 65*a*. Then, the compact disc driver 1B moves the pickup to the audio time data code indicative of 180 minutes, and transfers 65536 pairs of audio music data codes (R(n), L(n)) equivalent to 1.49 seconds and associated audio time data codes to the interface 65*a*. The 65536 pairs of audio music data codes (R(n), L(n)) form the reference raw material. The central processing unit 62 converts the first audio time data code to a reference delta time code, and stores the reference delta time code to the random access memory 64. In this instance, the reference delta time code is indicative of 180 seconds. The central processing unit 62 further stores the 65536 pairs of audio music data, which forms the reference raw material, in the random access memory 64.

When all the reference raw material is stored in the random access memory 64, the central processing unit 62 requests the digital signal processor 63 to produce pieces of reference correlation data from the reference raw material. The digital signal processor 63 starts the data processing shown in FIG. 4, and produces pieces of reference correlation data as similar to that of the controller 6. The pieces of reference correlation data are stored in the random access memory 64, and the digital signal processor 63 informs the central processing unit 62 of the completion of the data write-in.

Then, the central processing unit 62 requests the compact disc driver 1B to transfer the audio music data codes and associated audio time data codes to the interface 65*a*. The compact disc driver 1B moves the pickup to the first pair of audio music data codes (R(0), L(0)), and transfers the audio music data codes and associated audio time data codes to the interface 65*a*. The central processing unit 62 fetches the audio music data codes and associated audio time data codes from the interface 65*a*, and transfers the audio music data codes to the audio unit 4B. The audio music data codes are converted to the electric tones through the laud speakers 44. The audio time data code is stored in the internal register of the central processing unit 62, and is rewritten when the next audio time data code reaches the interface 65*a*.

The user fingers on the keyboard 31*a*, and the controller 34 supplies the event codes to the interface 65*a*. When the central processing unit 62 fetches the event code, the central processing unit 62 transfers the event code together with the delta time code representative of the lapse of time expressed by the audio time data code presently stored in the internal register. Thus, the event code and associated delta time code are stored in the random access memory.

Figure 15:
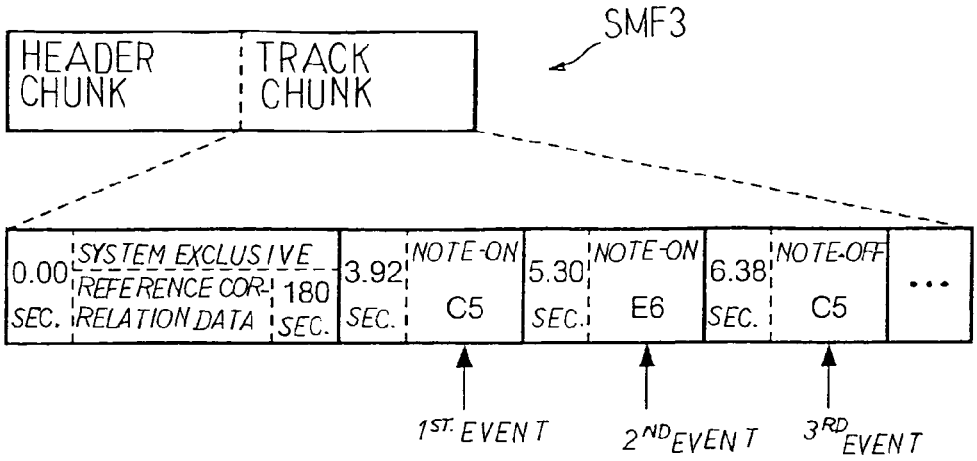
FIG. 15 is a view showing a data format for a standard MIDI file.

When the user completes his or her performance, the user instructs the controller 6A to terminate the preliminary recording. The central processing unit 62 requests the compact disc driver 1B to stop the data read-out from the compact disc CD-A. The central processing unit 62 forms a standard MIDI file SMF3 from the pieces of reference correlation data (see FIG. 15), reference delta time code, event codes and delta time codes, and requests the floppy disc driver 2B to store the standard MIDI file SMF3 in a floppy disc FD. The reference delta time code indicative of 180 seconds is stored in the system exclusive event code as shown.

The user is assumed to instruct the synchronous playback system to synchronously reproduce the performance in ensemble with the playback of the piece of music stored in the compact disc CD-B through the compact disc driver/audio unit 1B/4B. The central processing unit 62 requests the floppy disc driver 2B to transfer the standard MIDI file SMF3 from the floppy disc FD to the interface 65*a*, and stores the reference delta time code, event codes and associated delta time codes in the random access memory 64.

The central processing unit 62 further requests the compact disc driver 1B to transfer the audio data codes to the interface 65*a*. The central processing unit 62 does not transfer the audio music data codes to the audio unit 4B so that the user does not hear any electric tone. The central processing unit 62 stores the pairs of audio music data codes (r(n), l(n)) in the random access memory 64. When 65536 pairs of audio music data codes (r(0), l(0)) to (r(65535), l(65535)) are stored in the random access memory 64, the central processing unit 62 requests the digital signal processor 63 to start the correlation analysis on the pieces of reference correlation data and pieces of objective correlation data. The central processing unit 62 continuously stores newly received audio music data codes in the random access memory 64, and the digital signal processor 63 repeats the correlation analysis on the predetermined number of pieces of objective correlation data.

When the digital signal processor 63 finds a set of pieces of objective correlation data to be highly correlated with the set of pieces of reference correlation data, the digital signal processor 63 reports the set of pieces of objective correlation data is found to be highly correlated with the pieces of reference correlation data. Then, the central processing unit 62 compares the audio time data code relating to the first piece of objective correlation data with the reference delta time code to see how long there is the time difference between the passage in the compact disc CD-A and the corresponding passage in the compact disc CD-B. The time difference is assumed to be 1.17 seconds. This means that, when the pieces of objective correlation data from 181.17 seconds to 182.66 seconds were compared with the pieces of reference correlation data, the answer at step S15 was changed to affirmative.

The central processing unit 62 adds the time difference of 1.17 seconds to the lapse of time expressed by the delta time codes for the timing regulation. Upon completion of the timing regulation, the central processing unit 62 requests the compact disc driver 2B to transfer the audio data codes, i.e., the pair of audio music data codes (r(0), l(0)) . . . and associated audio time data codes from the compact disc CD-B to the interface 65*a*.

While the compact disc driver 1B is transferring the audio data codes from the compact disc driver CD-B to the interface 65*a*, the central processing unit 62 supplies the audio music data codes (r(0), l(0)) . . . to the audio unit 4B for converting them to the electric tones, and compares the lapse of time expressed by the audio time data codes with the delta time codes to see whether or not the associated event codes are to be transferred to the automatic player piano 3B. When the answer is given affirmative, the central processing unit 62 transfers the associated event code or codes to the automatic player piano 3B, and the controller/driver 34/36*a* make the acoustic piano 31 to generate the acoustic piano tones. Thus, the performance is reproduced through the automatic player piano 3B in good ensemble with the playback through the compact disc driver/audio unit 1B/4B.

Figure 16:
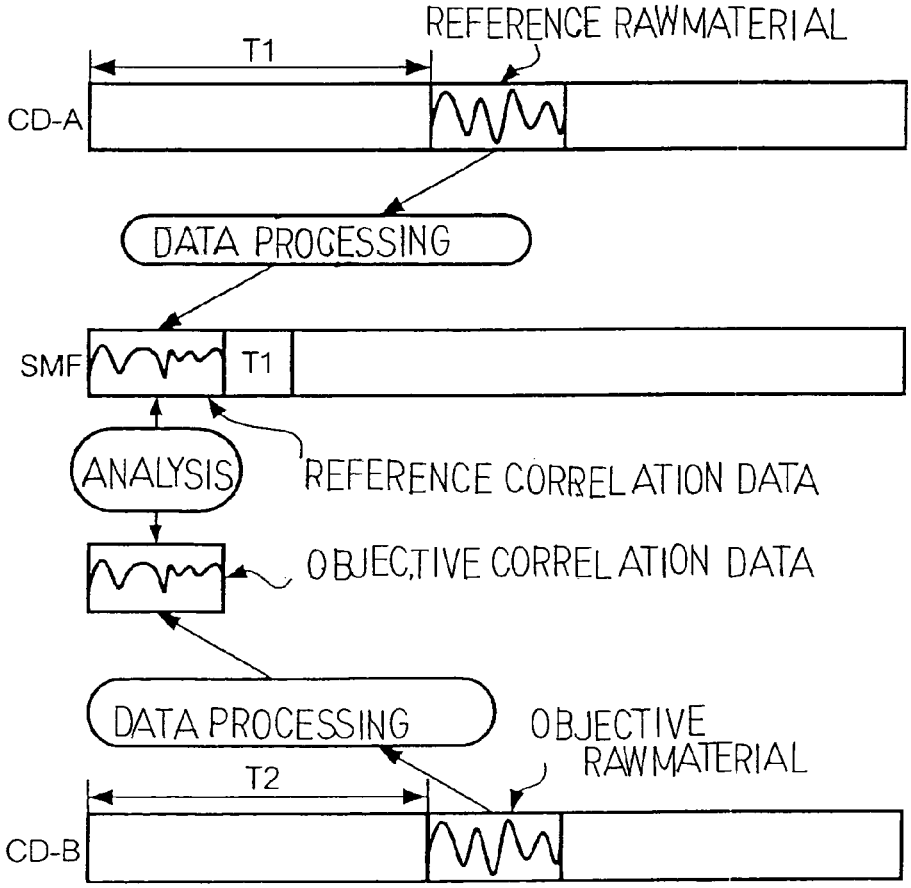
FIG. 16 is a block diagram showing a preliminary recording and synchronous playback through the second modification.

FIG. 16 shows the method for the synchronous playback. Upon expiry of the predetermined time period Ti, the raw material is extracted from the set of audio data code stored in the compact disc CD-A, and the pieces of reference correlation data are stored together with the reference delta time code in the system exclusive event code forming a part of the standard MIDI file SMF. On the other hand, there are stored the pieces of objective raw material in the compact disc CD-B, and the time period T2 is unknown. The pieces of objective correlation data are produced from the pieces of objective raw material through the data processing, and are sequentially replaced with new pieces of objective correlation data. While new pieces of objective raw material are being taken into the account, the sets of pieces of objective correlation data are successively compared with the pieces of reference correlation data for the correlation analysis. When the set of pieces of objective correlation data is found to be highly correlated with the pieces of reference correlation data, the time period T2 is determined. The time difference (T1−T2) is added to the lapse of time expressed by the delta time codes for the timing regulation. If the difference has a positive number, the lapse of time expressed by the delta time codes is shortened. On the other hand, if the difference has a negative number, the lapse of time is prolonged. Thus, the timing regulation is completed before the initiation of the synchronous playback.

Other Modifications

In the above-described first embodiment and two modifications, the system components 1/1A/1B, 2/2A/2B, 4/4A/4B, 5/5A/5B and 6/6A/6B are accommodated in the automatic player piano 3/3A/3B. However, a third modification is constituted by plural components physically separated from one another. The synchronous player system implementing the third modification may be physically separated into plural components such as 1. Compact disc driver 1/lA/1B,
2. Floppy disc driver 2/2A/2B,
3. Automatic player piano 3/3A/3B,
4. Mixer/digital-to-analog converter 41/42,
5. Amplifiers 43,
6. Laud speakers 44, and
7. Manipulating panel/display and controller 5/5A/5B and 6/6A/6B. Moreover, the controller 6/6A/6B may be physically separated into a recording section and a playback section.

These system components may be connected through audio cables, MIDI cables, optical fibers for audio signals, USB (Universal Serial Bus) cables and/or cable newly designed for the synchronous playback system. Standard floppy disc drivers, standard amplifiers and standard laud speakers, which are obtainable in the market, may be used in the synchronous playback system according to the present invention.

The separate type synchronous playback system is desirable for users, because the users constitute their own systems by using some system components already owned.

The fourth modification of the synchronous playback system does not include the compact disc driver 1/1A/1B and floppy disc driver 2/2A/2B, but the controller 6/6A/6B has a hard disc and an interface connectable to a LAN (Local Area Network), WAN or an internet. In this instance, the audio data codes are supplied from a suitable data source through the interface, and are stored in the hard disc. Similarly, a standard MIDI file is transferred from the external data source through the interface, and is also stored in the hard disc. While a user is fingering on the keyboard 31*a*, the audio music data codes are read out from the hard disc, and are transferred to the audio unit 4/4A/4B for converting them to electric tones. The event codes and delta time codes are stored in the track chunk, and the standard MIDI file is left in the hard disc.

In the synchronous playback system implementing the first embodiment, the digital signal processor 63 carries out the correlation analysis through the analysis on the absolute correlation index, analysis on the relative correlation index and analysis on the correlation value. Although the three sorts of analysis make the correlation analysis accurate, the three sorts of analysis may be too heavy. For this reason, the fifth modification carries out the correlation analysis through one of or two of the three sorts of analysis.

The sixth modification makes a decision at step S15 through only expression (4). In detail, the digital signal processor calculates the product between $D_{n-1}$ and $D_n$, and checks it to see whether or not the product is equal to or less than zero. When the product is equal to or less than zero, the rate of change in the function of correlation value is zero or is changed across zero. This means that the correlation value is at the maximum or in the vicinity of the maximum. For this reason, the answer at step S15 is given affirmative. In case where there is little possibility to have the minimum and maximum close to one another, the same answer is obtained through the simple data processing.

As will be appreciated from the foregoing description, the synchronous player system according to the present invention reproduces the performance on the musical instrument, i.e., acoustic piano 31A in good ensemble with the playback through the audio system, i.e., the compact disc driver/audio unit 1/4, 1A/4A or 1B/4B regardless of the difference between the compact discs CD-A and CD-B. In other words, even if the compact disc CD-B used in the synchronous playback is edited differently from the compact disc CD-A used in the preliminary recording, the user requires only one preliminarily recorded data for the synchronous playback of the single music passage. Thus, the synchronous player system makes the synchronous playback simple and the data management easy.

In the first embodiment and modifications thereof, the audio music data codes representative of the waveform of analog audio signal are used for the correlation analysis so that the synchronous player system exactly determines the correlation between a music passage and the music passage different in recording level from that used in the preliminary recording.

Finally, even if the compact disc driver is unstable in the data read-out speed, the synchronous player system implementing the first modification eliminates the difference in read-out speed from between the series of audio data used in the preliminary recording and the series of audio data used in the synchronous playback, and, accordingly, reproduces the performance in good ensemble with the playback through the compact disc driver/audio unit 1A/4A.

Second Embodiment

Figure 17:
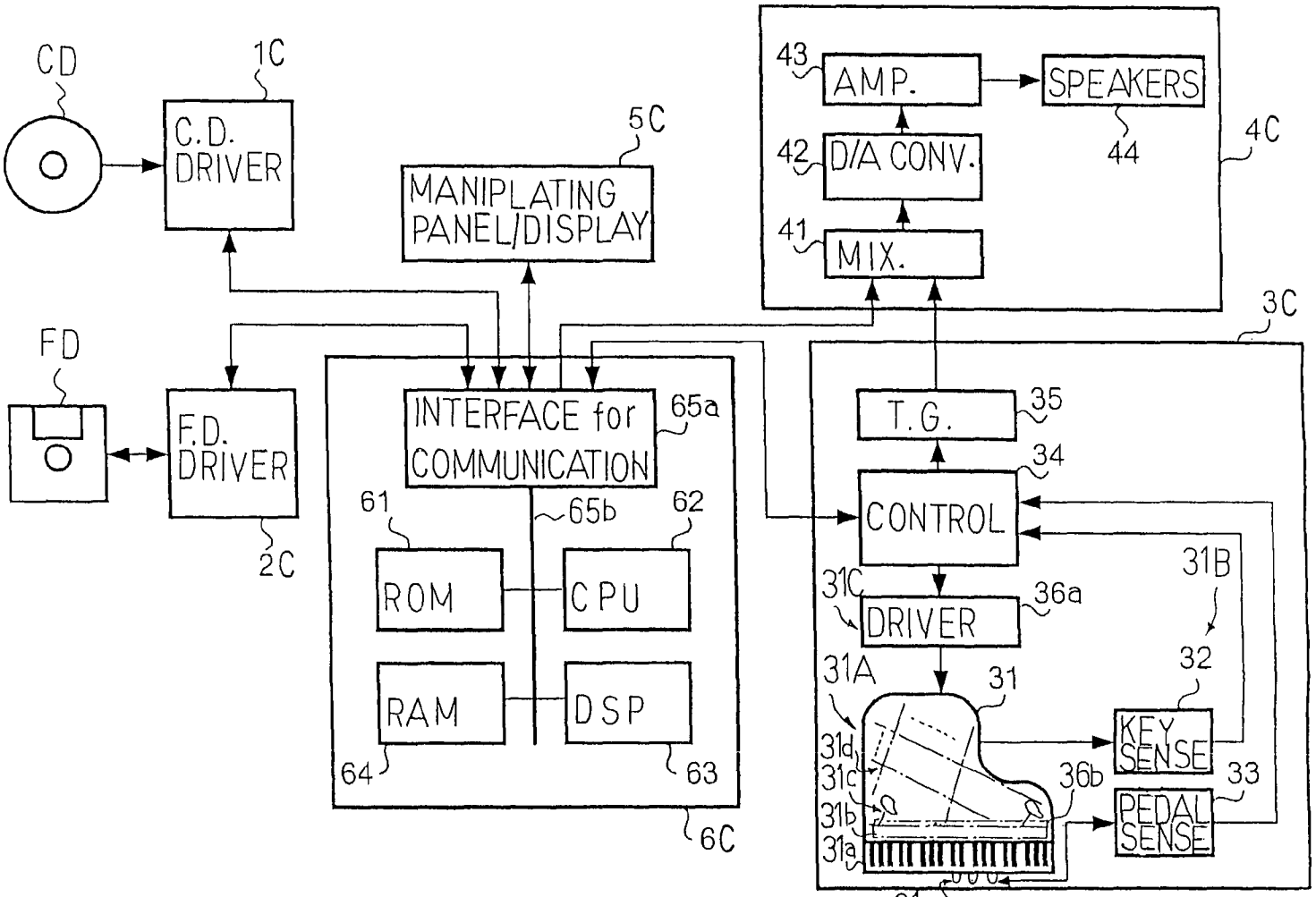
FIG. 17 is a block diagram showing the system configuration of another synchronous player system according to the present invention.

Referring to FIG. 17 of the drawings, another synchronous player system embodying the present invention largely comprises a compact disc driver 1C, a floppy disc driver 2C, an automatic player piano 3C, an audio unit 4C, a manipulating panel/display 5C and a controller 6C. The compact disc driver 1C, floppy disc driver 2C, automatic player piano 3C, audio unit 4C and manipulating panel/display 5C are similar to those of the first embodiment. The component parts are labeled with references designating corresponding parts shown in FIG. 1 without detailed description. Moreover, the controller 6C is similar in system configuration to the controller 6, and computer programs are different from those of the controller 6. For this reason, description is focused on the jobs to be achieved by the central processing unit 62 and digital signal processor 63.

Figure 18A:
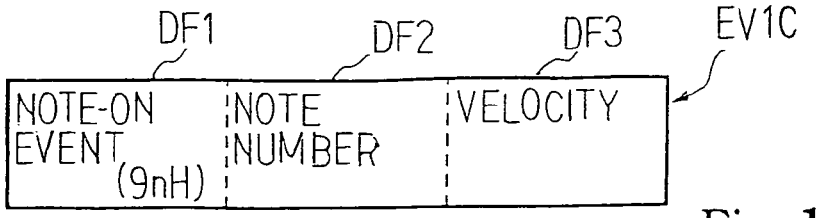
FIG. 18A is a view showing the format of a note-on event code processed by the synchronous player system.
Figure 18B:
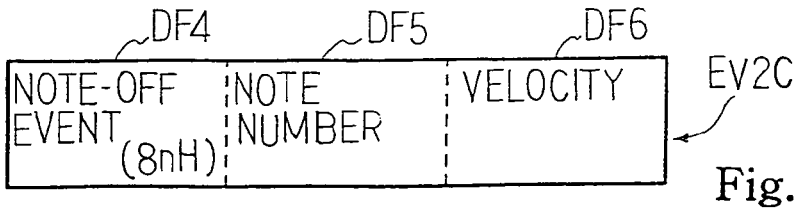
FIG. 18B is a view showing the format of a note-off event code processed by the synchronous player system.
Figure 18C:
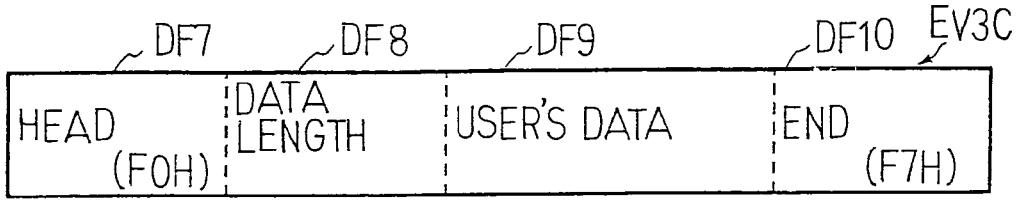
FIG. 18C is a view showing the format of a system exclusive event code processed by the synchronous player system.

FIGS. 18A, 18B and 18C show the data formats for a note-on event code EV1C, a note-off event code EV2C and a system exclusive event code EV3C. The note-on event code EV1C has three data fields DF1, DF2 and DF3, the note-off event code EV2C also has three data fields DF4, DF5 and DF6, and the system exclusive event code EV3C has four data fields DF7, DF8, DF9 and DF10. These data fields DF1 to DF10 are identical with those of the event codes EV1, EV2 and EV3 so that no further description is hereinbelow incorporated for the sake of simplicity.

Figure 19:
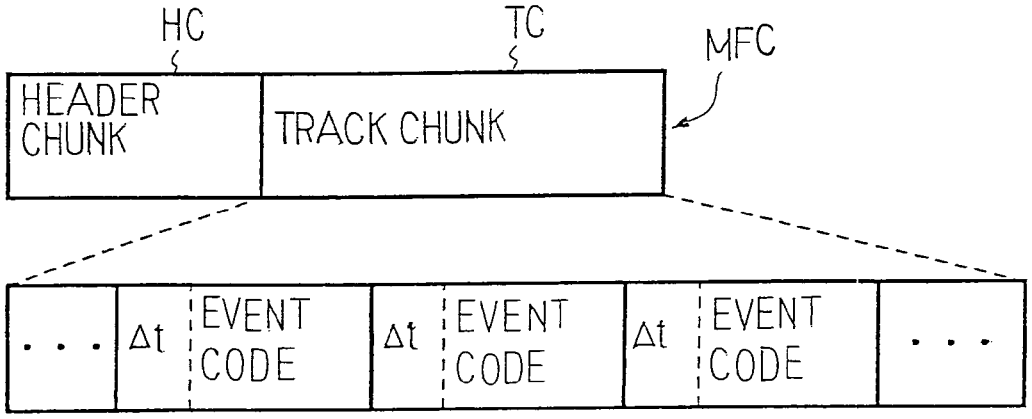
FIG. 19 is a view showing the structure of a standard MIDI file created by the synchronous player system.

As shown in FIG. 19, the standard MIDI file MFC has the data structure similar to that of the standard MIDI file MF. The header chunk HC and track chunk TC are similar to those of the standard MIDI file MF, and no further description is hereinafter incorporated for avoiding undesirable repetition.

The synchronous player system implementing the second embodiment selectively enters a preliminary recording mode and a synchronous playback mode. While the synchronous player system is recording a performance in the preliminary recording mode, the controller 6C extracts a medium-range index representative of the magnitude of low frequency components and a long-range index representative of the magnitude of extremely low frequency components from the audio music data, and memorizes pieces of administrative information representative of the abrupt change of the magnitude in system exclusive event codes. The system exclusive event codes are stored in a floppy disc FD together with the note event codes, delta time codes indicative of the timing to supply the note event codes to the automatic player piano and other delta time codes indicative of the timing at which the pieces of administrative information are to be take place.

While the compact disc driver 1C is transferring the audio music data codes from another compact disc CD-B to the controller 6C, the controller 6C transfers the audio music data codes to the audio system 4D for producing electric tones, and produces the medium-range index and long-range index from the audio music data codes so as to produce pieces of administrative information also representative of the abrupt changes of the magnitude. When the abrupt change stored in the system exclusive event code is to occur, the controller 6C looks for the abrupt change already taken place or to occur within a predetermined time period, and determines the ratio between the lapses of time. The controller 6C multiplies the lapse of time expressed by the delta time codes for the note events by the ratio, and reschedules the timing to supply the note events to the automatic player piano 3C. This results in good ensemble between the performance through the automatic player piano 3C and the playback of the piece of music recorded in the compact disc CD-B.

Preliminary Recording

The user plays a piece of music on the keyboard 31A in ensemble with the playback through the compact disc player 1C and the audio unit 4C, and the performance on the keyboard 31*a* is recorded in the floppy disc FD together with pieces of administrative information, which will be hereinafter described in detail. The compact disc CD used in the preliminary recording is hereinafter referred to as "CD-A", and a compact disc CD used in the synchronous playback is referred to as "CD-B" so as to make the compact discs distinguishable from one another. Although the music title and player are same, the compact disc CD-B is different in edition from the compact disc CD-A. In this instance, the piece of music recorded in the compact disc CDB is different in tempo from the corresponding piece of music recorded in the compact disc CD-A. Moreover, although reverberation was not artificially imparted to the piece of music recorded in the compact disc CD-A, the editor artificially imparted reverberation to the tones of the piece of music recorded in the compact disc CD-B. For this reason, the audio signal reproduced from the audio music data codes stored in the compact disc CD-B is slightly different in waveform and dynamic range from the audio signal reproduced from the audio music data codes stored in the compact disc CD-B.

The user firstly loads the compact disc CD-A into the compact disc driver 1C and the floppy disc FD into the floppy disc driver 2C. The user pushes the key on the manipulating panel/display 5C so that the central processing unit 62 acknowledges the user's instruction to start the preliminary recording. Then, the central processing unit 62 supplies a control signal representative of a request for playback through the interface 65*a* to the compact disc driver 1C.

The compact disc driver 1C drives the compact disc CD-A for rotation, and transfers the audio music data codes from the compact disc CD-A to the interface 65*a*. A pair of audio music data codes is transferred to the interface 65*a* for the right channel and left channel at every interval of $\frac{1}{44100}$second. The set of audio music data codes is expressed as (R(n), L(n)), and the value of the audio music data code R(n)/L(n) is hereinafter referred to as "sampled value". The sampled value is an integer, and all the sampled values are fallen within the range from −32768 to +32767. "n" is indicative of the place of the audio music data code in the track, and is incremented from zero by 1, i.e., 0, 1, 2, . . . For example, the first pair of audio music data codes is expressed as (R(0), L(0)), and the next one is expressed as (R(1), L(1)). Thus, the place is incremented by one during the playback.

When the pair of audio music data codes (R(n), L(n)) reaches the interface 65*a*, the central processing unit 62 fetches the pair of audio music data codes (R(n), L(n)) from the interface 65*a*. The central processing unit 62 starts the internal clock, and the internal clock increments the lapse of time. Furthermore, the central processing unit 62 successively supplies the audio music data codes (R(n), L(n)) to the audio unit 4C, and the audio music data codes (R(n), L(n)) are converted to electric tones through the laud speakers 44. Although the pairs of audio music data codes (R(n), L(n)) are initially representative of the silence, the pairs of audio music data codes (R(n), L(n)) soon dynamically change the sampled values, and the electric tones are produced along the piece of music.

The central processing unit 62 is further operative to transfer the pairs of audio music data codes (R(n), L(n)) to the random access memory 64, and stores the sampled values in a predetermined memory area of the random access memory 64. The central processing unit 62 counts the number of the pairs of audio music data codes (R(n), L(n)) already transferred to the random access memory 64, and stops the data transfer to the random access memory upon reaching a predetermined number. The predetermined number is dependent on the filtering characteristics described hereinafter in detail. Nevertheless, the predetermined number is assumed to be 44100, which is equivalent to a minute. The predetermined number of pairs of audio music data codes are labeled with (R(0), L(0)) to (R(44099), L(44099)) and is referred to as "reference raw material".

When the pairs of audio music data codes reach the predetermined number, the central processing unit 62 requests the digital signal processor 63 to produce the pieces of administrative information. The digital signal processor 63 carries out a low pass filtering at different frequencies, twice, and compares the low frequency components acquired through the first low pass filtering with the low frequency components acquired through the second low pass filtering for determining characteristics events. The characteristic events are a sort of flag used for producing pieces of timing information. The cut-off frequency in the second low pass filtering is lower than the cut-off frequency in the first low pass filtering.

Figure 20:
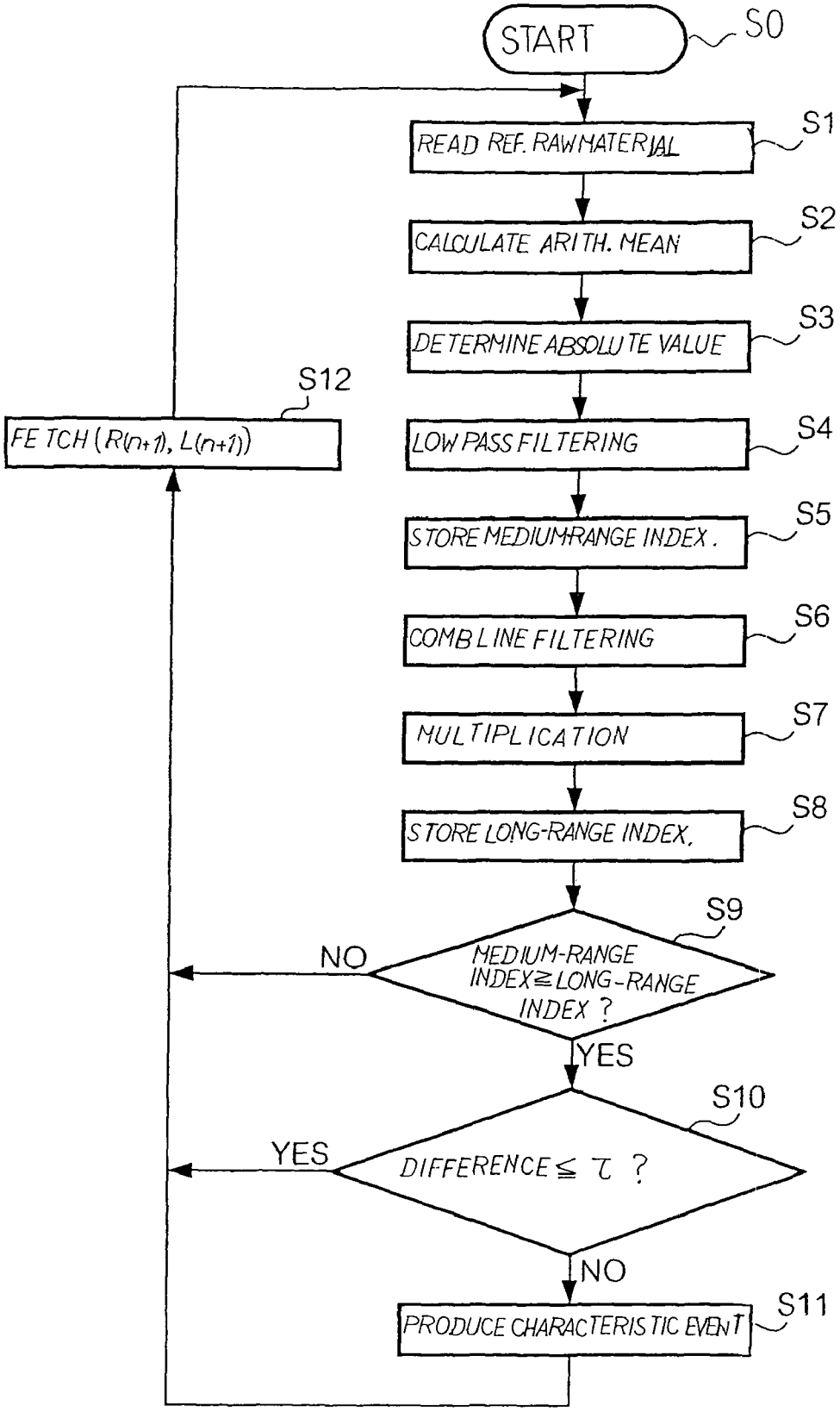
FIG. 20 is a flowchart showing a method for producing pieces of administrative information.

FIG. 20 shows a method for producing the pieces of administrative information. The method is expressed as a computer program executed by the digital signal processor 63.

When the digital signal processor 63 receives the request for producing the administrative information, the digital signal processor 63 starts the computer program at step S0. The digital signal processor 63 reads out the pairs of audio music data codes (R(0), L(0)) to (R(44099), L(44099)) from the random access memory for storing them in the internal register thereof as by step S1. A set of the predetermined number of pairs of audio music data codes, which forms the reference raw material, is hereinafter expressed with the last pair of audio music data codes. The set of pairs of audio music data codes (R(0), L(0)) to (R(44099), L(44099)) is, by way of example, expressed as "reference raw material (44099)".

Subsequently, an arithmetic mean is calculated from the sampled values of each pair of audio music data codes as by step S2. This arithmetic operation is equivalent to the conversion from the stereophonic sound to the monophonic sound. The arithmetic mean makes the load on the digital signal processor 63 light.

Subsequently, the digital signal processor 63 determines the absolute values of the arithmetic mean as by step S3. Substitute values for the power are obtained through the through the absolutization. The absolute values are less than the square numbers representative of the power, and are easy to handle in the following data processing. Nevertheless, if the digital signal processor 63 has an extremely large data processing capability, the digital signal processor 63 may calculate the square numbers of the calculated values instead of the absolute values.

Subsequently, the digital signal processor 63 carries out a data processing equivalent to the low pass filtering on the absolute values as by step S4. The cut-off frequency is assumed to be 100 Hz in this instance. Upon completion of the data processing equivalent to the low pass filtering, a medium-range index is obtained for the pairs of audio music data codes. The medium-range index for the pair of audio music data codes (R(n), L(n)) is expressed as "medium-range index (n)". The medium-range index (n) is representative of the tendency of the variation in the audio waveform in a medium range. In general, the audio waveform is frequently varied in a short range. The variation in the short range is eliminated from the series of sampled values through the data processing equivalent to the low pass filtering, because the short-range variation is restricted by the previous sampled values. As a result, data information representative of the middle-range variation and long-range variation are left in the digital signal processor 63. In other words, the medium-range index . . . (n−2), (n−1), (n) is left in the digital signal processor 63. The digital signal processor 63 transfers the medium-range index to the random access memory 64, and the medium-range index is stored in the random access memory 64 as by step S5.

Subsequently, the digital signal processor 63 carries out a data processing equivalent to a low pass filtering through a comb line filter as by step S6. The cut-off frequency at step S6 is lower than the cut-off frequency at step S4. This is equivalent to an extraction of low frequency components from the waveform expressed by the medium-range index. The comb line filter is desirable for the digital signal processor 63, because the data processing equivalent to the comb line filter is lighter than the data processing equivalent to the low pass filter.

Figure 21:
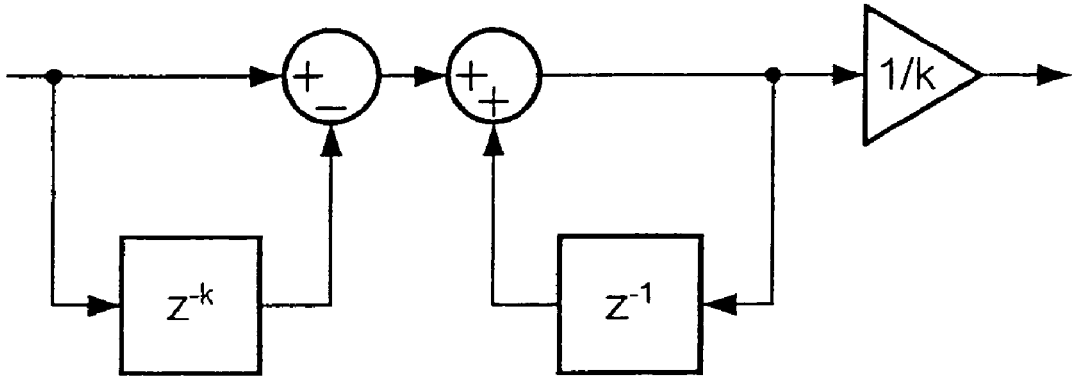
FIG. 21 is a block diagram showing the circuit configuration of a comb line filter.

FIG. 21 shows the digital processing equivalent to the comb line filter. Boxes and circles form two loops connected in series, and a triangle is connected between the second loop and an data output port. The boxes introduce delay into the signal propagation, and "$Z^{-k}$" represents that the delay time is equal to the product between the sampling period and constant k. As described hereinbefore, the sampling frequency is 44100 Hz. This means that the sampling period is $\frac{1}{44100}$ second. The triangle is representative of a multiplication, and "1/k" is the multiplier. In the following description, "k" is assumed to be equal to 22050. The frequency components higher than 1 Hz are almost eliminated from the medium-range index through the data processing equivalent to the comb line filter. Thus, the components representative of the long-range variation are left in the digital signal processor 63 upon completion of the data processing at step S6.

Subsequently, the digital signal processor 63 multiplies the series of components representative of the long-range variation by a positive constant "h". The frequency in the acquisition of positive answer at the next step S9 is adjusted to an appropriate value through the multiplication at step S8. If "h" is small, the time intervals between a positive answer and the next positive answer is narrow. In case where the time intervals of the positive answers are too wide, the characteristic events are produced at long time intervals at step S11, and the accuracy of timing regulation is lowered. On the other hand, if the time intervals of the positive answers are narrow, the positive answers tend to be canceled at step S10, and the characteristic events are obtained at long time intervals. This results in that the accuracy of the timing regulation is lowered. In this situation, the multiplier "h" is experimentally determined. Upon completion of the multiplication at step S7, long-range index is left in the digital signal processor 63. The long-range index corresponding to (R(n), L(n)) is hereinafter referred to as "long-range index (n)". Thus, the long-range index . . . (n−2), (n−1) and (n) is left in the digital signal processor 63 upon completion of the data processing at step S7. The digital signal processor 63 transfers the long-range index to the random access memory 64, and the long-range index is stored in a predetermined memory area of the random access memory 64 as by step S8.

Subsequently, the digital signal processor reads out the medium-range index (n) and long-range index (n) from the random access memory 64 for a comparison therebetween as by step S9. First, the digital signal processor 63 reads out the last medium-range index (44099) and the last long-range index (44099) from the random access memory 64, and compares them with each other to see whether or not the medium-range index (44099) is equal to or greater than the long-range index (44099). The positive answer at step S9 is indicative of wide variation in the medium range on the audio waveform expressed by the reference raw material at the point corresponding to the sampling point of (R(n), L(n)). In more detail, when the volume in the frequency range from 1 Hz and 100 Hz is abruptly enlarged on the audio waveform, the medium-range index becomes greater than the long-range index, and the answer at step S9 is given affirmative "Yes". Then, the digital signal processor 63 checks the internal clock for the present time at which the comparison results in the positive answer, and stores the present time in the random access memory 64.

Subsequently, the digital signal processor 63 reads out the time at which the previous positive answer was obtained from the random access memory 64, and subtracts the read-out time from the present time to see whether or not the difference is equal to or less than a predetermined value τ as by step S10. If the difference is greater than the predetermined value τ, it has been a long time from the production of the previous characteristic event. Thus, the data processing at step S10 prevents the central processing unit 62 from a lot of characteristic events produced at short intervals. If the characteristic events are too many, it is difficult to make characteristic events of pairs of audio music data codes (r(n), l(n)) read out from the compact disc CD-B exactly corresponding to the characteristic events produced from the pairs of audio music data codes (R(n), L(n)) stored in the compact disc CD-A. The predetermined value r is experimentally determined. Of course, when the digital signal processor 63 acquires the first positive answer, there is not any previous time in the random access memory 64. In this situation, the answer at step S10 is automatically given negative.

With the negative answer, the digital signal processor 63 produces the characteristic event as by step S11, and supplies the characteristic event to the central processing unit 62.

If the answer at step S9 is given negative, the digital signal processor proceeds to step S12. In case where the answer at step S10 is given affirmative, the digital signal processor 63 also proceeds to step S12. The digital signal processor 63 also proceeds to step S12 upon completion of the jobs at step S11. The digital signal processor 63 waits for the next pair of audio music data codes (R(n+1), L(N+1)). When the next pair of audio music data codes reaches the interface 65*a*, the central processing unit 62 transfers the pair of audio music data codes (R(n+1), L(n+1)) to the audio unit 4C, and stores it in the random access memory 64. The central processing unit 62 requests the digital signal processor 63 to repeat the data processing, again. Then, the digital signal processor 63 fetches the reference raw material (44100), i.e., (R(1), L(1)) to (R(44100), L(44100) from the random access memory 64, and returns to step S1.

Thus, the digital signal processor reiterates the loop consisting of steps S1 to S12 until the user terminates the fingering on the keyboard 31*a*. Thus, the digital signal processor 63 extracts plural characteristic events from the set of pairs of audio music data codes representative of the piece of music.

Figure 22:
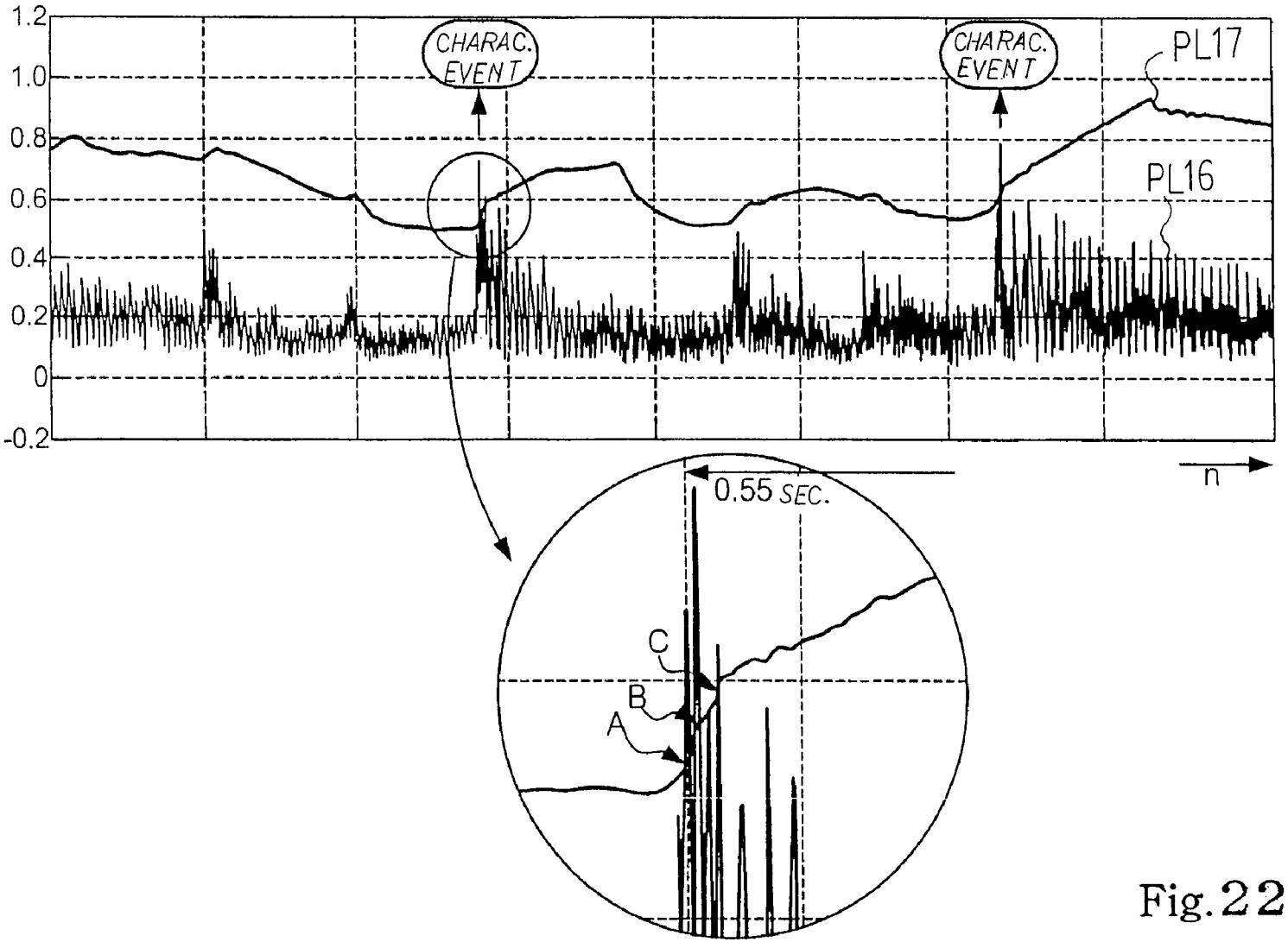
FIG. 22 is a graph showing characteristic events, a medium-range index and a long-range index produced during the playback through a compact disc driver.

The present inventor confirmed the data processing shown in FIG. 20. An IIR (Infinite Impulse Response) filter was used as the low pass filter at step S4. The constant "h" at step S7 was 4, and the time period τ was 0.55 second. The data processing resulted in plots PL16 and PL17 and the characteristic events shown in FIG. 22. Plots PL16 was representative of the medium-range index, and plots PL17 represented the long-range index. When the medium-range index PL16 became equal to or exceeded over the long-range index PL17, the digital signal processor 63 produced the characteristic events. Although the medium-range index trice exceeds the long-range index at A, B and C as shown in a large circle, the digital processor 63 produced the characteristic events only at A, because the predetermined time of 0.55 second was not expired until points B and C (see step S11 in FIG. 20).

When the compact disc driver 1C starts to transfer the audio music data codes through the controller 6C to the audio unit 4C, the user gets ready to perform the piece of music. While the electric tones are being produced through the audio unit 4C, the user selectively depresses and releases the black/white keys, and steps on the pedals 31*e*. The acoustic piano tones are produced through the vibrations of the strings 31*d*, and the key sensors 32 and pedal sensors 33 report the key motion and pedal motion to the controller 34. The controller 34 produces the event codes representative of the note-on event, note-off event and effects to be imparted to the acoustic piano tones, and supplies the event codes to the interface 65*a*. Thus, the central processing unit 62 receives not only the characteristic event codes from the digital signal processor 63 but also the event codes from the automatic player piano 3C.

Figure 23:
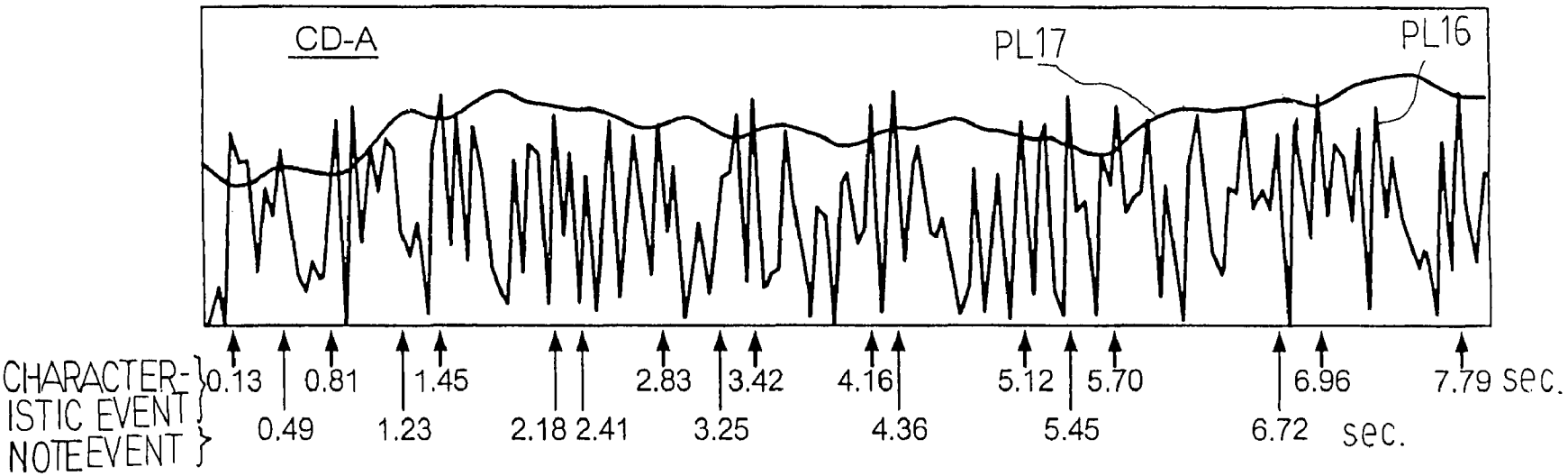
FIG. 23 is a graph showing the characteristic events and MIDI events produced during an ensemble between the compact disc driver and an automatic player piano.

FIG. 23 shows the characteristic events and note events produced during an ensemble. The medium-range index and long-range index are respectively varied as indicated by plots PL16 and plots PL17, and the time rightward runs along the axis of abscissa. The first characteristic event took place at 0.13 second from the arrival of the first pair of audio music data codes, and the other characteristic events took place at 0.81 second, 1.45 seconds, . . . On the other hand, the central processing unit 62 received the first event code at 0.49 second, and the other event codes are fetched by the central processing unit 62 at 1.23 seconds, 2.18 second, . . . Thus, the characteristic event codes and note event codes were produced in a real time fashion during the ensemble.

When the central processing unit 62 fetches the characteristic event code, the central processing unit 62 produces the system exclusive event code for storing the characteristic event therein, and checks the internal clock to see what time the characteristic event reaches there. The central processing unit 62 produces the delta time code indicative of the arrival time, and stores the delta time code and characteristic event code in the random access memory 64.

Similarly, when the central processing unit 62 fetches the note event code, the central processing unit 62 checks the internal clock to see what time the note event code reaches there. The central processing unit 62 produces the delta time code indicative of the arrival time, and stores the delta time code and note event code in the random access memory 64.

When the user completes the performance on the keyboard 31*a*, the user instructs the controller 6C to terminate the preliminary recording thereat. The controller 6C is responsive to the user's instruction so that the central processing unit 62 notifies the compact disc driver 1C of the completion of the preliminary recording. Then, the compact disc driver 1C stops the data transfer from the compact disc CD-A to the interface 65*a*.

Figure 24:
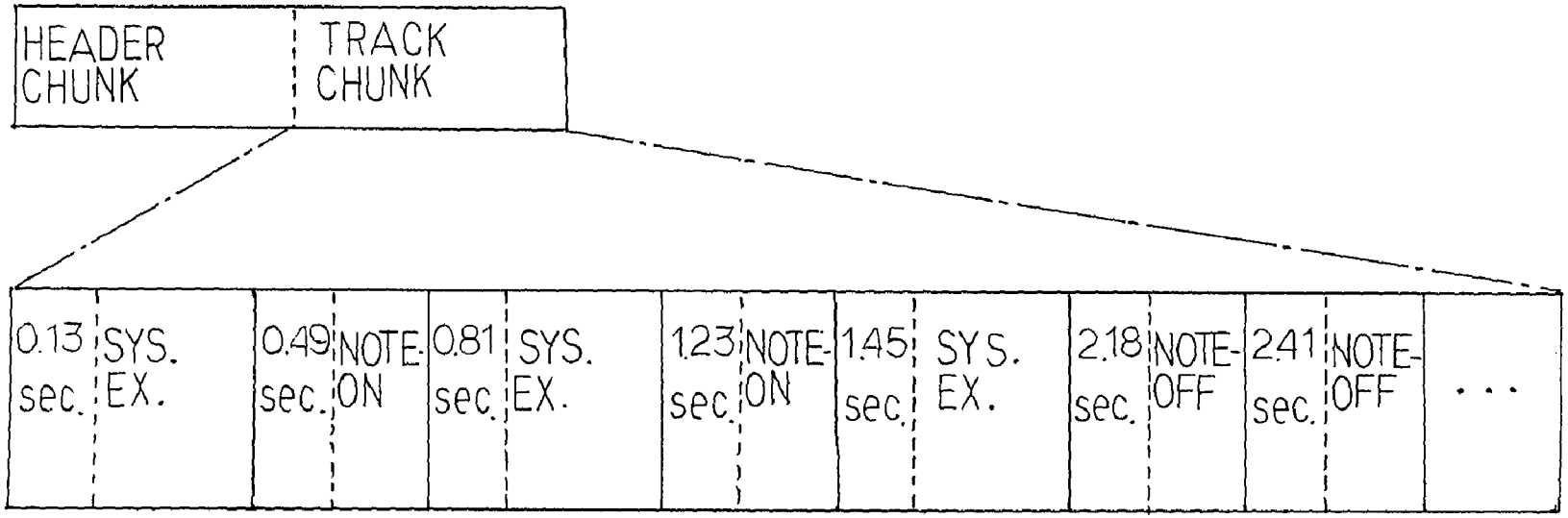
FIG. 24 is a view showing the data structure of a standard MIDI file created by the synchronous player system.

Subsequently, the central processing unit 62 constructs the track chunk from the system exclusive event codes, associated delta time codes, note event codes and associated delta time codes, and adds the header chunk to the track chunk. Thus, the system exclusive event codes are mixed with the note event codes in the track chunk as shown in FIG. 24. When the standard MIDI file is completed, the central processing unit 62 supplies the standard MIDI file to the floppy disc driver 2C, and requests the floppy disc driver 2C to store the standard MIDI file in the floppy disc FD.

Synchronous Playback

The user wishes to reproduce the performance on the keyboard 31*a* in ensemble with a playback through the compact disc driver/audio unit 1C/4C. The user loads the compact disc CD-B into the compact disc CD-B and the floppy disc FD into the floppy disc driver 2C. As described hereinbefore, the piece of music recorded in the compact disc CD-B is different in tempo, reverberation and dynamic range from the corresponding piece of music recorded in the compact disc CD-A.

The user is assumed to instruct the controller 6C to reproduce the performance recorded in the floppy disc FD in ensemble with the playback through the compact disc driver/audio unit 1C/4C through the manipulating panel/display 5C. When the controller 6C acknowledges the user's instruction, the central processing unit 62 requests the floppy disc driver 2C to transfer the standard MIDI file from the floppy disc FD to the interface 65*a*. Then, the floppy disc driver FD reads out the standard MIDI file from the floppy disc FD, and transfers the standard MIDI file to the interface 65*a*. The central processing unit 62 stores the standard MIDI file in the random access memory 64.

The central processing unit 62 requests the compact disc driver 1C to successively transfer the audio music data codes (r(n), l(n)) to the interface 65*a*. The pairs of audio music data codes (r(n), l(n)) arrive at the interface 65*a* at regular intervals of $1/44100$ second.

When the first pair of audio music data codes is fetched by the central processing unit 62, the central processing unit 62 starts the internal clock for measuring the lapse of time the arrival of the first pair of audio music data code (r(0), l(0)). The lapse of time is expressed as "time T". The central processing unit 62 successively fetches the pairs of audio music data codes (r(n), l(n)) from the interface 65*a*, and transfers the pairs of audio music data codes (r(n), l(n)) to the audio unit 4C so that the pairs of audio music data codes are converted to the electric tones through the laud speakers 44. The central processing unit 62 further transfers the pairs of audio music data codes (r(n), l(n)) to the random access memory 64, and stores them in the random access memory 64.

When the predetermined number of pairs of audio music data codes is accumulated in the random access memory 64, the central processing unit 62 requests the digital signal processor 63 to carry out the data processing shown in FIG. 20. Upon completion of the data processing along the loop consisting of steps S1 to S11, the digital signal processor 63 reconstructs the reference raw material (n) by introducing a new pair of audio music data code (r(n+1), l(n+1)) instead of the oldest pair of audio music data code. Thus, the digital signal processor 63 repeats the data processing along the loop, and produces the characteristic event code when the answer at step S10 is given negative. When each characteristic event code is produced, the digital signal processor 63 supplies the characteristic event code to the central processing unit 62.

When starting the internal clock, the central processing unit 62 accesses the standard MIDI file already transferred to the random access memory 64, and fetches the first delta time code from the standard MIDI file. The central processing unit 62 periodically compares the lapse of time expressed by the first delta time code with the lapse of time T to see whether or not the lapse of time T is equal to the lapse of time expressed by the first delta time code. When the central processing unit 62 finds the lapses of time to be equal, the central processing unit 62 checks the associated event code to see whether the note event or system exclusive event is to take place at the time expressed by the delta time code.

If the first delta time code is indicative of the lapse of time at which the note event is to take place, the central processing unit 62 supplies the note event code to the automatic player piano 3C so that the acoustic piano tone or the electronic tone is generated through the vibrations of the string 31*d* or the laud speaker 44. Upon completion of the data transfer to the automatic player piano 3C, the central processing unit 62 fetches the next delta time code, and periodically compares the lapse of time T with the lapse of time expressed by the delta time code for the timing to execute the next job on the associated event code. Thus, the note event codes are intermittently supplied to the automatic player piano 3C so that the performance recorded in the floppy disc FD is reproduced in ensemble with the playback through the compact disc driver/audio unit 1C/4C.

On the other hand, if the associated code is the system exclusive event, the central processing unit 62 carries out a timing regulation described hereinafter so as to keep the performance of the automatic player piano 3C in good ensemble with the playback through the compact disc driver/audio unit 1C/4C.

As described hereinbefore, the piece of music was recorded in the compact disc CD-B at a tempo slightly different from the tempo of the piece of music recorded in the compact disc CD-A. If the central processing unit 62 transfers the note event codes to the automatic player piano 3C without any timing regulation, a time lag takes place between the progression of the performance through the automatic player piano 3C and the progression of the playback through the compact disc driver/audio unit 1C/4C.

Figure 25:
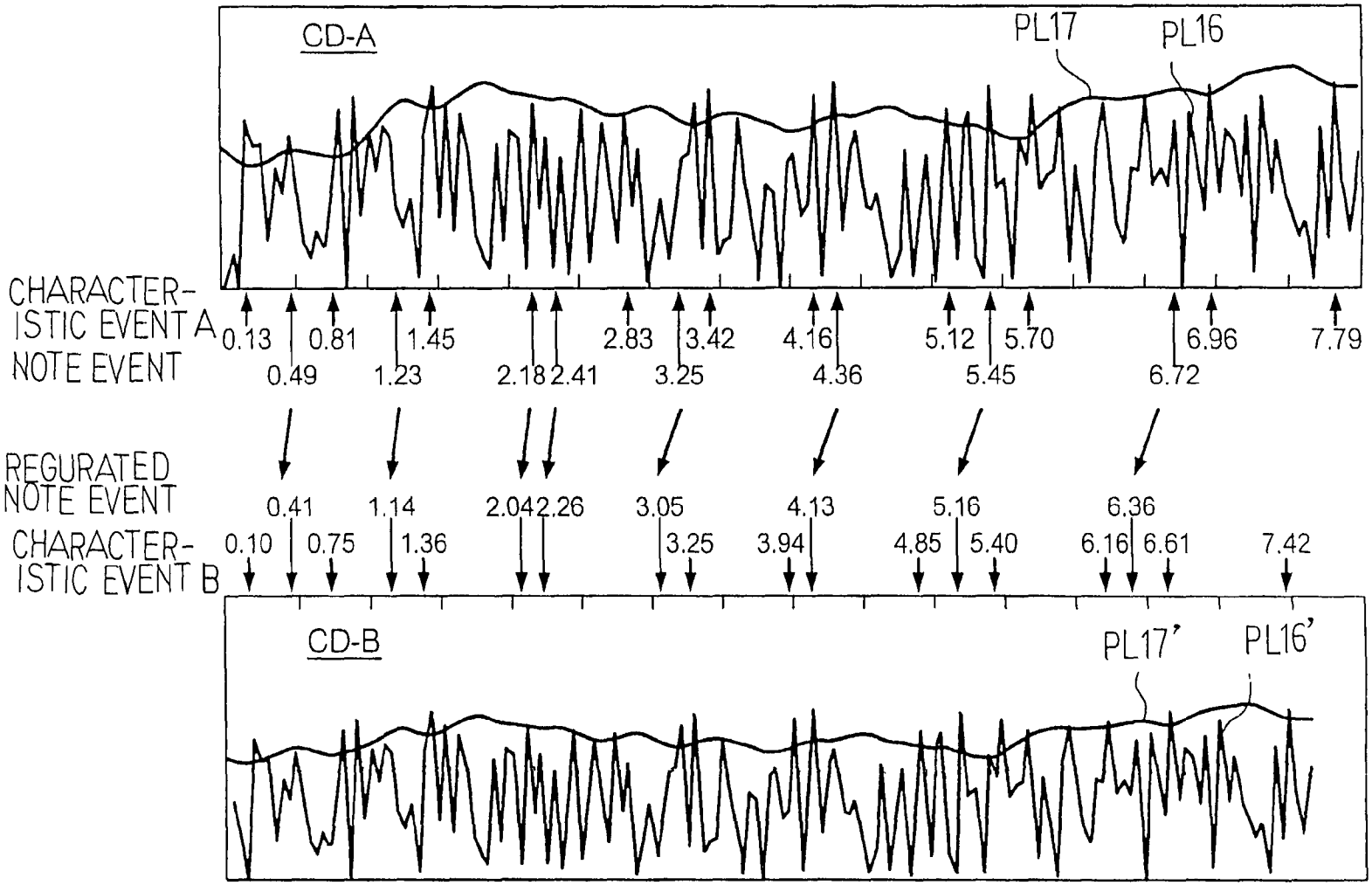
FIG. 25 is a graph showing a relation between the progression of a piece of music stored in a compact disc and the progression of the piece of music stored in another compact disc.

FIG. 25 illustrates the timing regulation. While the compact disc driver 1C is successively transferring the pairs of audio music data codes (R(n), L(n)) from the compact disc CD-A to the interface 65*a*, the digital signal processor 63 produces the characteristic event codes on the basis of the medium-range index PL16 and long-range index PL17, and the automatic player piano 3C supplies the note event codes to the central processing unit 62. The characteristic events at 0.13 second, 0.81 second, . . . are stored in the system exclusive event codes, and the system exclusive event codes are stored in the standard MIDI file together with the note event codes at 0.49 second, 1.23 seconds, . . .

When the standard MIDI file is transferred from the floppy disc FD to the random access memory 64 in the synchronous playback mode, the characteristic event codes and note event codes are accompanied with the delta time codes indicative of 0.13 second, 0.81 second, . . . and the delta time codes indicative of 0.49 second, 1.23 seconds, . . . , respectively. The characteristic event codes stored in the random access memory 64 are hereinafter referred to as "characteristic event codes A", and the characteristic events as "characteristic events A".

The tempo of the piece of music recorded in the compact disc CD-B is faster than the tempo of the piece of music recorded in the compact disc CD-A. While the compact disc driver 1C is transferring the pairs of audio music data codes (r(n), l(n)) to the interface 65*a*, the digital signal processor 63 produces characteristic events B at 0.10 second, 0.75 second, 1.36 seconds . . . on the basis of the medium-range index PL16' and the long-range index PL17'. The characteristic event codes produced in the synchronous playback mode are hereinafter referred to as "characteristic event codes B", and the characteristic events as "characteristic events B".

If the central processing unit 62 simply compares the lapse of time expressed by the delta time codes with the lapse of time T, the progression of the piece of music reproduced through the automatic player piano 3C is delayed from the progression of the piece of music reproduced through the compact disc driver/audio unit 1C/4C. In order to keep the playback through the automatic player piano 3C synchronous with the playback through the compact disc driver/audio unit 1C/4C, the lapse of time expressed by the delta time codes is changed to a different lapse of time appropriate to good ensemble as follows.

When the central processing unit 62 receives each of the characteristic event codes B from the digital signal processor 63, the central processing unit 62 checks the internal clock for the arrival time, and stores a time data code representative of the arrival time in the random access memory 64. The time data codes are indicative of 0.10 second, 0.75 second, 1.36 second, . . . as shown.

When the central processing unit 62 receives the delta time code, the central processing unit waited for the time T equal to the time expressed by the delta time code as described hereinbefore. If the note event code is accompanied with the delta time code, the central processing unit 62 supplies the note event code to the automatic player piano 3C. However, if the characteristic event A is accompanied with the delta time code, the central processing unit 62 checks the random access memory 64 to see whether or not the digital signal processor 62 has produced or will produce the characteristic events B within a predetermined time period before and after the time expressed by the accompanied delta time code. In this instance, the predetermined time period is assumed to be 0.2 second. For this reason, the central processing unit 62 checks the random access memory 64 to see whether or not the characteristic event B was produced within 0.2 second, and monitors the data port assigned to the digital signal processor 63 to see whether or not the digital signal processor 63 will produce the characteristic event code B within 0.2 second. When the central processing unit 62 finds the characteristic event code B within the predetermined time period, i.e., ±0.2 second, the central processing unit 62 assumes that the characteristic event code B is corresponding to the characteristic event code A. In other words, the part of the piece of music in which the characteristic event A occurred is corresponding to the part of the piece of music in which the characteristic event B occurs. Then, the central processing unit 62 divides the arrival time by the time expressed by the delta time code associated with the characteristic event A, i.e., (arrival time of the characteristic event B/time expressed by the delta time code for the characteristic event A). Subsequently, the central processing unit 62 multiplies the lapse of time expressed by the non-executed delta time codes by the quotient so that the timing to supply the note event codes are rescheduled. The products are representative of the lapse of time at which the regulated note events are to be supplied to the automatic player piano 3C. When the present time T catches the time expressed the product, the central processing unit 62 supplies the associated regulated note event code to the automatic player piano 3C. The above-described timing regulation is repeated until the last note event code is supplied to the automatic player piano 3C.

Thus, the note events at 0.49 second, 1.23 seconds, . . . are changed to the regulated note events at 0.41 second, 1.14 second . . . , and the performance recorded in the floppy disc FD is reproduced through the automatic player piano 3C in good ensemble with the playback of the piece of music recorded in the compact disc CD-B.

FIG. 26 shows a sequence of the timing regulation. First, the central processing unit 62 finds the internal clock to catch up the first delta time code at 0.13 second. The central processing unit 62 checks the random access memory 64 to see whether or not any characteristic event B has been received from the digital signal processor 63 within 0.2 second. The central processing unit 62 finds the characteristic event B to be received at 0.11 second, and assumes that the characteristic event B at 0.11 second is corresponding to the characteristic event at 0.13 second. Then, the central processing unit 62 divides 0.11 by 0.13, and multiplies the lapse of time expressed by the delta time codes by the quotient (0.11/0.13). This is the first timing regulation, and the lapse of time is changed from 0.13 second, 0.49 second, 0.81 second . . . to 0.11 second, 0.41 second, 0.69 second . . . As a result, the internal clock catches up the next delta time code at 0.41 second, and the central processing unit 62 supplies the associated note event to the automatic player piano 3C.

The internal clock catches up the next delta time code at 0.69 second, and the central processing unit 62 checks the random access memory 64 to see whether or not any characteristic event B has been received within 0.2 second. However, the answer is given negative. Then, the central processing unit 62 waits for 0.2 second, and receives the next characteristic event B from the digital signal processor 63 at 0.75 second. The arrival time is 0.06 second after the time expressed by the delta time code associated with the second characteristic event A. Then, the central processing unit 62 assumes the characteristic event B at 0.75 second is corresponding to the characteristic event A. Then, the central processing unit divides 0.75 by 0.69, and multiplies the lapse of time expressed by the delta time codes by the quotient (0.75/0.69). As a result, the lapse of time is changed from 0.69 second, 1.04 seconds, 1.23 seconds, 1.84 seconds . . . to 0.75 second, 1.14 second, 1.34 seconds, 2.02 seconds . . . through the second timing regulation. When the internal clock reaches 1.14 seconds, the central processing unit 62 supplies the second note event to the automatic player piano 3C.

Thus, whenever the internal clock catches up the delta time code associated with the characteristic event A, the central processing unit 62 repeats the timing regulation, and reschedules the timing to supply the note event codes to the automatic player piano 3C. Although the central processing unit checks the random access memory 64 for the characteristic event B corresponding to the fourth characteristic event A and waits for 0.2 second, the central processing unit 62 can not find any characteristic event B within ±0.2 second, and, for this reason, skips the timing regulation for the fourth characteristic event A. On the other hand, although the eighth characteristic event B takes place, there is not any characteristic event A within ±0.2 second, and the central processing unit 62 ignores the eighth characteristic event B.

While the piece of music recorded in the compact disc CD-B is being reproduced through the laud speakers 44, the digital signal processor 62 repeats the timing regulation, and reschedules the timing to supply the note events to the automatic player piano 3C. For this reason, the note events are supplied to the automatic player piano 3C as indicated by "REGULATED NOTE EVENT" in FIG. 25, and the piece of music is reproduced through the automatic player piano 3C in good ensemble with the playback of the piece of music recorded in the compact disc CD-B.

In case where the piece of music was recorded in the compact disc CD-B at lower tempo, the data processing unit 62 reschedules the timing to supply the note events to the automatic player piano through the timing regulation. The timing regulation is similar to that described hereinbefore. For this reason, description is omitted for avoiding undesirable repetition.

As will be appreciated from the foregoing description, the synchronous player system embodying the second embodiment determines the characteristic event, at which the volume in the low frequency range is abruptly varied, in the preliminary recording, and the characteristic events A are stored in the standard MIDI file in the form of the system exclusive event codes together with the note event codes. While the piece of music is being reproduced from another compact disc CD-B in the synchronous playback, the synchronous player system determines the characteristic events B on the basis of the pairs of audio music data codes (r(n), l(n)), and reschedules the timing to supply the note events to the automatic player piano 3C through the timing regulation between the characteristic events A and the corresponding characteristic events B. As a result, even if the piece of music is reproduced at a certain tempo different from that of the piece of music recorded in the compact disc CD-A, the performance is reproduced through the automatic player piano in good ensemble with the playback of the piece of music recorded in the compact disc CD-B.

First Modification

Figure 27:
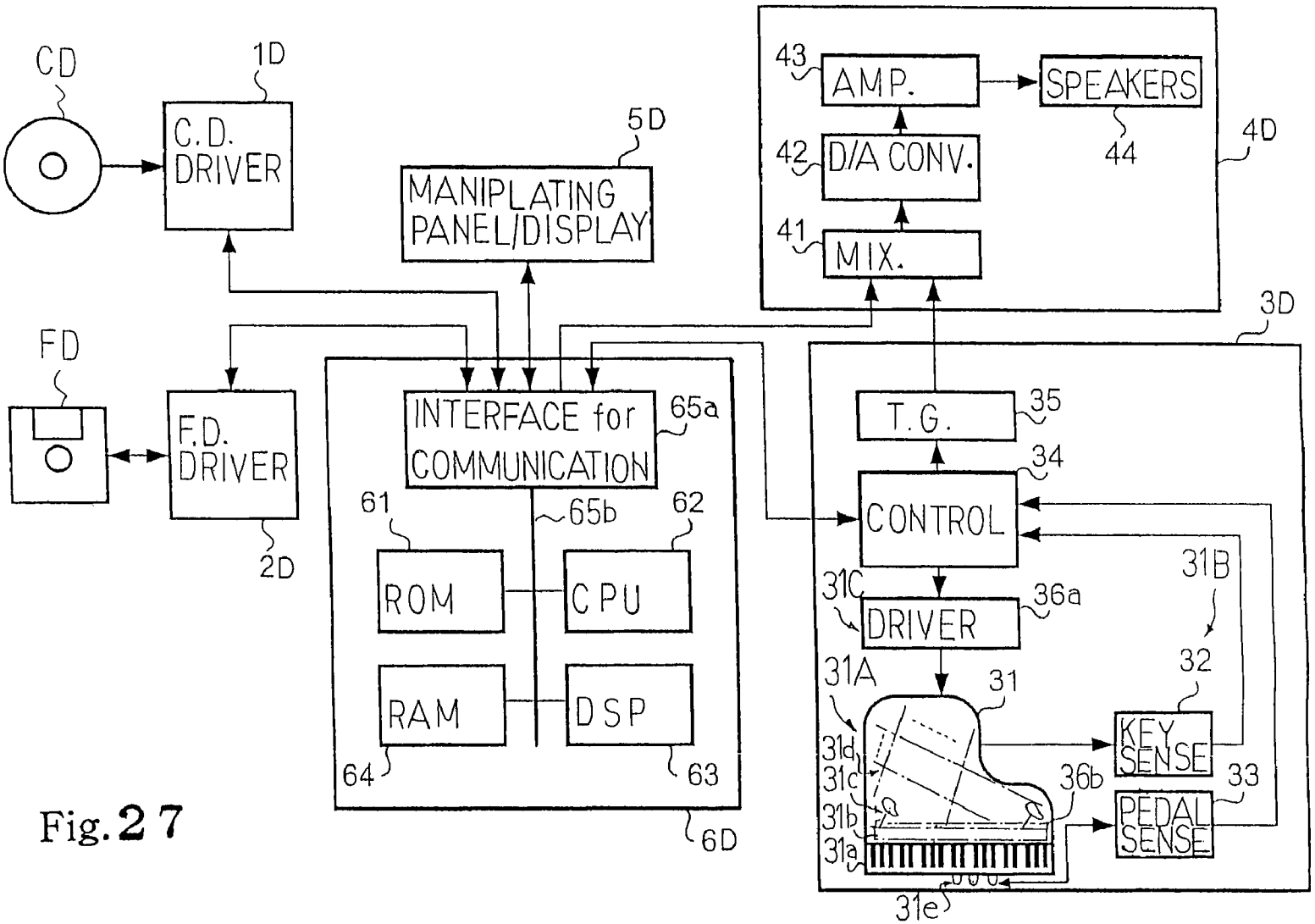
FIG. 27 is a block diagram showing the system configuration of the first modification of the synchronous player system.

FIG. 27 shows the first modification of the second embodiment. The synchronous player system of the first modification largely comprises a compact disc driver 1D, a floppy disc driver 2D, an automatic player piano 3D, an audio unit 4D, a manipulating panel/display 5D and a controller 6D. The floppy disc driver 2D, automatic player piano 3D, audio unit 4D and manipulating panel/display 5D are similar in system configuration and behavior to those of the synchronous player system implementing the second embodiment, and the component parts are labeled with the references designating the corresponding component parts shown in FIG. 17. Although the controller 6D is different in data processing from the controller 6C, the system configuration is similar to that of the controller 6C, and, for this reason, the component parts are labeled with references designating the corresponding component parts of the controller 6C without detailed description.

The first modification also selectively enters the preliminary recording mode and synchronous playback mode, and the behavior in those modes of operation is generally identical with that of the synchronous playback system. For this reason, description is focused on differences for the sake of simplicity.

The controller 6C includes the internal timer, and carries out the timing regulation when the internal clock catches up the time expressed by the delta time code associated with the characteristic events A. This feature is modified in the first modification. In the first modification, the controller 6D compares the present time expressed by the audio time data codes with the time expressed by the delta time codes for the timing regulation and data supply to the automatic player piano 3D. For this reason, the compact disc driver 1D transfers not only the audio music data codes but also audio time data codes from the compact discs to the interface 65*a*. Another difference from the second embodiment is that the timing regulation is carried out after the analysis on the pairs of audio music data codes for producing the characteristic event codes B.

A difference in the preliminary recording is that the lapse of time expressed by the audio time data codes is memorized in the delta time codes. The delta time codes are stored in a standard MIDI file together with the associated note event codes and characteristic event codes A as similar to the standard MIDI file shown in FIG. 24.

On the other hand, differences in the synchronous playback are as follows. All the pairs of audio music data codes (r(n), l(n)) are transferred from the compact disc CD-B to the interface 65*a*, and the central processing unit 62 determines the characteristic events B through the data processing shown in FIG. 20. When the characteristic event codes B are obtained, the central processing unit 62 determines a regression line between the characteristic events A and the characteristic events B, and changes the timing to supply the note events to the automatic player piano 3D on the basis of the regression line. Upon completion of the rescheduling, the controller 6D requests the compact disc driver 1D to transfer the audio data codes from the compact disc CD-B to the interface 65*a*, again, and the central processing unit 62 supplies the note events to the automatic player piano 3D along the lapse of time expressed by the associated delta time codes.

In order to determine the timing at which the note event codes are supplied to the automatic player piano 3D, the compact disc driver 1D supplies a time clock to the controller 6D.

Assuming now that a user instructs the controller 6D to preliminary record his or her performance on the keyboard 31*a* in ensemble with the playback of a piece of music recorded in the compact disc CD-A, the central processing unit 62 requests the compact disc driver 1D to transfer the audio data codes, i.e., the audio music data codes and audio time data codes from the compact disc CD-A to the interface 65*a*.

While the audio data codes are successively reaching the interface 65*a*, the central processing unit 62 stores the pairs of audio music data codes (R(n), L(n)) in the random access memory 64 together with the audio time data codes, and supplies the audio music data codes (R(n), L(n)) to the audio unit 4D. The pairs of audio time data codes are converted to electric tones through the audio unit 4D.

When the predetermined number of pairs of audio music data codes (R(n), L(n)) is stored in the random access memory 64, the central processing unit 62 requests the digital signal processor 63 to start the data processing shown in FIG. 20. The digital signal processor reiterates the loop consisting of steps S1 to S12, and notifies the central processing unit 62 of the characteristic event A with the negative answer at step S1. When the central processing unit 62 receives the notification from the digital signal processor 63, the central processing unit 62 memorizes the characteristic event A in the system exclusive event code, and the time expressed by the audio time data code received immediately before the notification in the delta time code. Thus, the central processing unit 62 stores the system exclusive event codes and the associated delta time codes in the random access memory 64.

While the electric tones are being reproduced through the laud speakers 44, the user selectively depresses and releases the black/white keys, and steps on the pedals 31*e*. The key sensors 32 and pedal sensors 33 report the key motion and pedal motion to the controller 34, and the controller 34 supplies the note event codes representative of the key motion and effect to be imparted to the tones to the interface 65*a*.

The note event codes are fetched by the central processing unit 62. The central processing unit 62 memorizes the time expressed by the audio time data code received immediately before the arrival of each note event, and stores the note event codes and associated delta time codes in the random access memory 64.

When the user completes the performance, the user instructs the controller 6D to terminate the preliminary recording. The central processing unit 62 requests the compact disc driver 1D to stop the playback. Furthermore, the central processing unit 62 creates the standard MIDI file where the note event codes, associated delta time codes, characteristic codes and associated delta time codes are stored, and requests the floppy disc driver 2D to store the standard MIDI file in a floppy disc FD. As a result, the standard MIDI file is stored in the floppy disc FD. The standard MIDI file is identical with that shown in FIG. 24.

The user is assumed to instruct the controller 6D to reproduce the performance in good ensemble with the playback of the pieces of music recorded in the compact disc CD-B. The central processing unit 62 requests the floppy disc driver 2D to transfer the standard MIDI file from the floppy disc FD to the interface 65*a*, and stores the standard MIDI file in the random access memory 64.

Subsequently, the central processing unit 62 requests the compact disc driver 1D to read out and transfer the audio data codes from the compact disc CD-B to the interface 65*a*. The pairs of audio music data codes (r(n), l(n)) and audio time data codes are successively transferred to the compact disc CD-B, and the central processing unit 62 stores the audio music data codes (r(n), l(n)) and audio time data codes in the random access memory 64. However, the audio music data codes are not supplied to the audio unit 4D. For this reason, any electric tone is never radiated from the laud speakers 44.

When the predetermined number of pairs of audio music data codes, i.e., the reference raw material is accumulated in the random access memory 64, the central processing unit 62 requests the digital signal processor 63 to find the characteristic events B through the data processing shown in FIG. 20. When the digital signal processor 63 finds the medium-range index and long range index to indicate the abrupt change or the characteristic event B, the digital signal processor 63 notifies the central processing unit 62 of the characteristic event B. Then, the central processing unit 62 checks the random access memory 64 for the audio time data code received immediately before the notification, and produces the delta time code representative of the arrival time of the notification. The characteristic event code B and associated delta time code are stored in the random access memory 64.

When the data processing is once completed, the digital signal processor eliminates the earliest pair of audio music data codes from the reference raw material, and adds the next pair of audio music data code to the reference raw material. The digital signal processor 63 carries out the data processing for another characteristic event B, again, and notifies the central processing unit 62 of the characteristic event. Then, the central processing unit 62 produces the delta time code indicative of the arrival time of the notification, and stores the characteristic event code B and associated delta time code in the random access memory 64.

Thus, the central processing unit 62 cooperates with the digital signal processor 63, and repeats the data processing on the reference raw material periodically renewed. When the data processing is completed on the reference raw material containing the last pair of audio music data code, a set of characteristic event codes B and associated delta time codes are accumulated in the random access memory 64, and the central processing unit 62 requests the compact disc driver 1D to stop the data transfer from the compact disc CD-B to the interface 65*a*.

Upon completion of the data processing on all the pair of audio music data codes, the central processing unit 62 carries out the timing regulation. FIG. 28 shows the timing regulation. The first to tenth characteristic event codes B a r e respectively accompanied with the delta time codes indicative of 0.11 second, 0.75 second, 1.36 seconds, 3.25 seconds, 3.94 seconds, 4.85 seconds, 5.40 seconds, 6.16 seconds, 6.61 seconds and 7.24 seconds. On the other hand, the first to tenth characteristic event codes A are respectively accompanied with the delta time codes indicative of 0.13 second, 0.81 second, 1.45 seconds, 2.83 seconds, 3.42 seconds, 4.16 seconds, 5.12 seconds, 5.70 seconds, 6.96 seconds and 7.79 seconds, respectively. In the following description, "characteristic event code A(n)" and "characteristic event B(n)" are representative of the $n^{th}$ characteristic event code A and the $n^{th}$ characteristic event code B, respectively. The characteristic event codes A are respectively paired with the characteristic event codes B, and the lapse of time of the delta time codes are expressed as (A81), B(1))=(0.13, 0.11), (A(2), B(2))=(0.81, 0.75), (A(3), B(n))=(1.45, 1.36), . . . Although the lapse of time after the timing regulation is shown in FIG. 28, the timing regulation is not carried out at this stage.

Figures 29, 30:
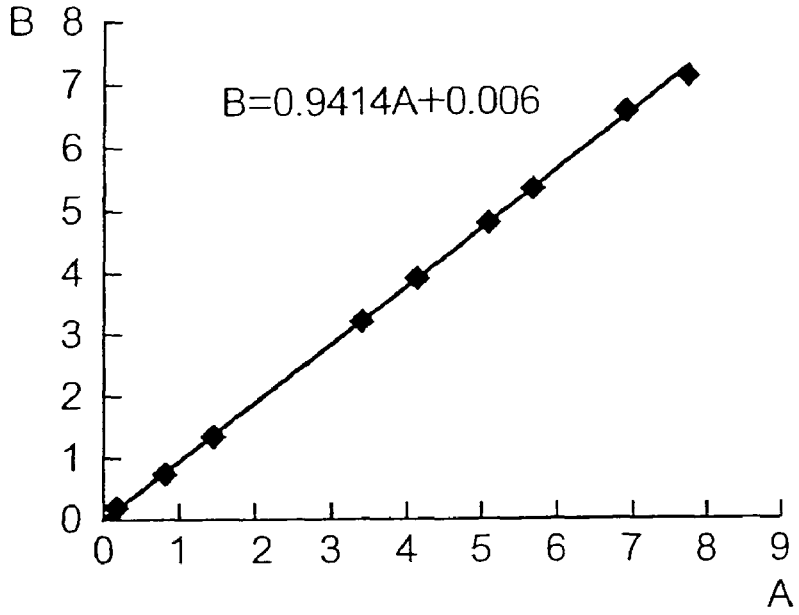
FIG. 29 is a graph showing plots representative of the regression line for the pairs of characteristic events.
FIG. 30 is a table showing a timing regulation for note events.

The central processing unit 62 determines the regression line for (A(n), B(n)) through the least square method. When the regression line was determined for the nine pairs of characteristic event codes (A(n), B(n)), the regression lines were plotted as shown in FIG. 29. The plots was expressed as B=0.9414A−0.006. From the plots, it was understood that the initiation of the playback of the piece of music recorded in the compact disc CD-A had been delayed from the initiation of the playback of the piece of music recorded in the compact disc CD-B by 0.006 second and that the tempo of the piece of music recorded in the compact disc CD-A had been lower than that of the piece of music recorded in the compact disc CD-B at 5.86%

The central processing unit 62 substitutes the time expressed by the delta time code associated with each note event for A in the equation. FIG. 30 shows the lapse of time before the timing regulation and the lapse of time after the timing regulation. The timing is advanced by 0.06 second and at 5.86%.

Figure 31:
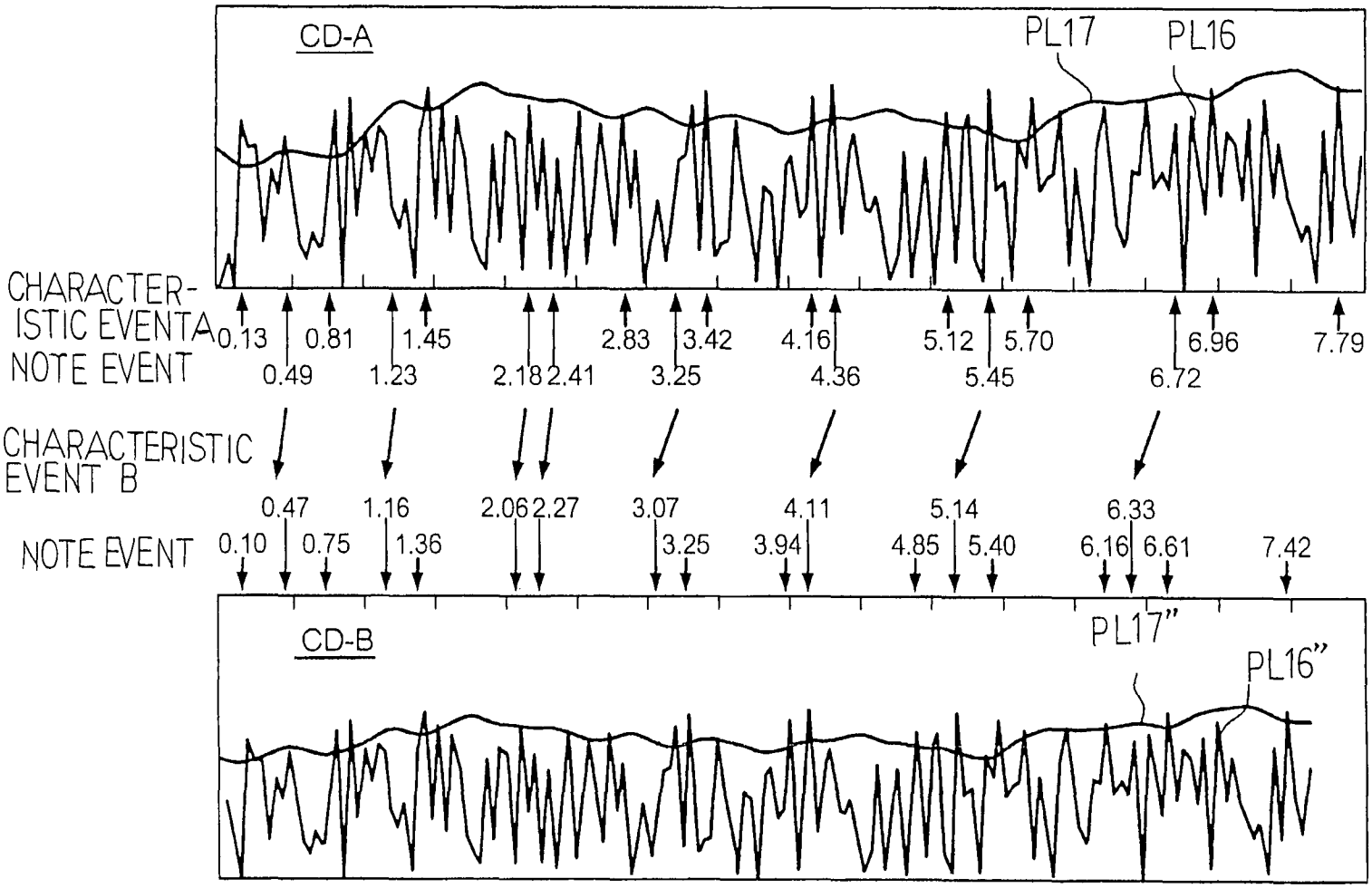
FIG. 31 is a graph showing a synchronous playback between the automatic player piano and compact disc driver/audio unit.

Upon completion of the timing regulation, the central processing unit 62 requests the compact disc driver 1D to transfer the audio music data codes and audio time data codes from the compact disc CD-B to the interface 65*a*. While the compact disc driver 1D is transferring the audio data codes to the interface 65*a*, the central processing unit 62 transfers the audio music data codes to the audio unit 4D, and compares the lapse of time expressed by the audio time data codes with the lapse of time expressed by the delta time codes. When the lapses of time become equal, the central processing unit 62 supplies the note events to the automatic player 3D to the automatic player piano 3D as shown in FIG. 31. This results in good ensemble between the performance reproduced through the automatic player piano 3D and the playback of the piece of music recorded in the compact disc CD-B.

Other Modifications

In the above-described second embodiment and one modification, the system components 1C/1D, 2C/2D, 4C/4D, 5C/5D and 6C/6D are accommodated in the automatic player piano 3C/3D. However, a second modification is constituted by plural components physically separated from one another. The synchronous player system implementing the third modification may be physically separated into plural components such as 8. Compact disc driver 1C/1D,
9. Floppy disc driver 2C/2D,
10. Automatic player piano 3C/3D,
11. Mixer/digital-to-analog converter 41/42,
12. Amplifiers 43,
13. Laud speakers 44, and
14. Manipulating panel/display and controller 5C/5D and 6C/6D.

Moreover, the controller 6C/6D may be physically separated into a recording section and a playback section.

These system components may be connected through audio cables, MIDI cables, optical fibers for audio signals, USB (Universal Serial Bus) cables and/or cable newly designed for the synchronous playback system. Standard floppy disc drivers, standard amplifiers and standard laud speakers, which are obtainable in the market, may be used in the synchronous playback system according to the present invention.

The separate type synchronous playback system is desirable for users, because the users constitute their own systems by using some system components already owned.

The third modification of the synchronous playback system does not include the compact disc driver 1C/1D and floppy disc driver 2C/2D, but the controller 6C/6D has a hard disc and an interface connectable to a LAN (Local Area Network), WAN or an internet. In this instance, the audio data codes are supplied from a suitable data source through the interface, and are stored in the hard disc. Similarly, a standard MIDI file is transferred from the external data source through the interface, and is also stored in the hard disc. While a user is fingering on the keyboard 31A, the audio music data codes are read out from the hard disc, and are transferred to the audio unit 4C/4D for converting them to electric tones. The event codes and delta time codes are stored in the track chunk, and the standard MIDI file is left in the hard disc.

As will be appreciated from the foregoing description, the synchronous player system according to the present invention reproduces the performance through the musical instrument, i.e., acoustic piano 31A in good ensemble with the playback through the audio system, i.e., the compact disc driver/audio unit 1C/4D or 1C/4D regardless of the difference between the compact discs CD-A and CD-B. In other words, even if a piece of music is recorded in the compact discs CD-A and CD-B at different tempo, the synchronous player system finds the characteristic events on the basis of the volume in the predetermined frequency ranges extracted from the audio music data codes representative of the piece of music, and reschedules the timing at which each note event is to be transferred to the automatic player piano. As a result, the performance on the keyboard is reproduced through the automatic player piano in good ensemble with the playback of the piece of music through the compact disc driver/audio unit.

Third Embodiment

System Configuration

Figure 32:
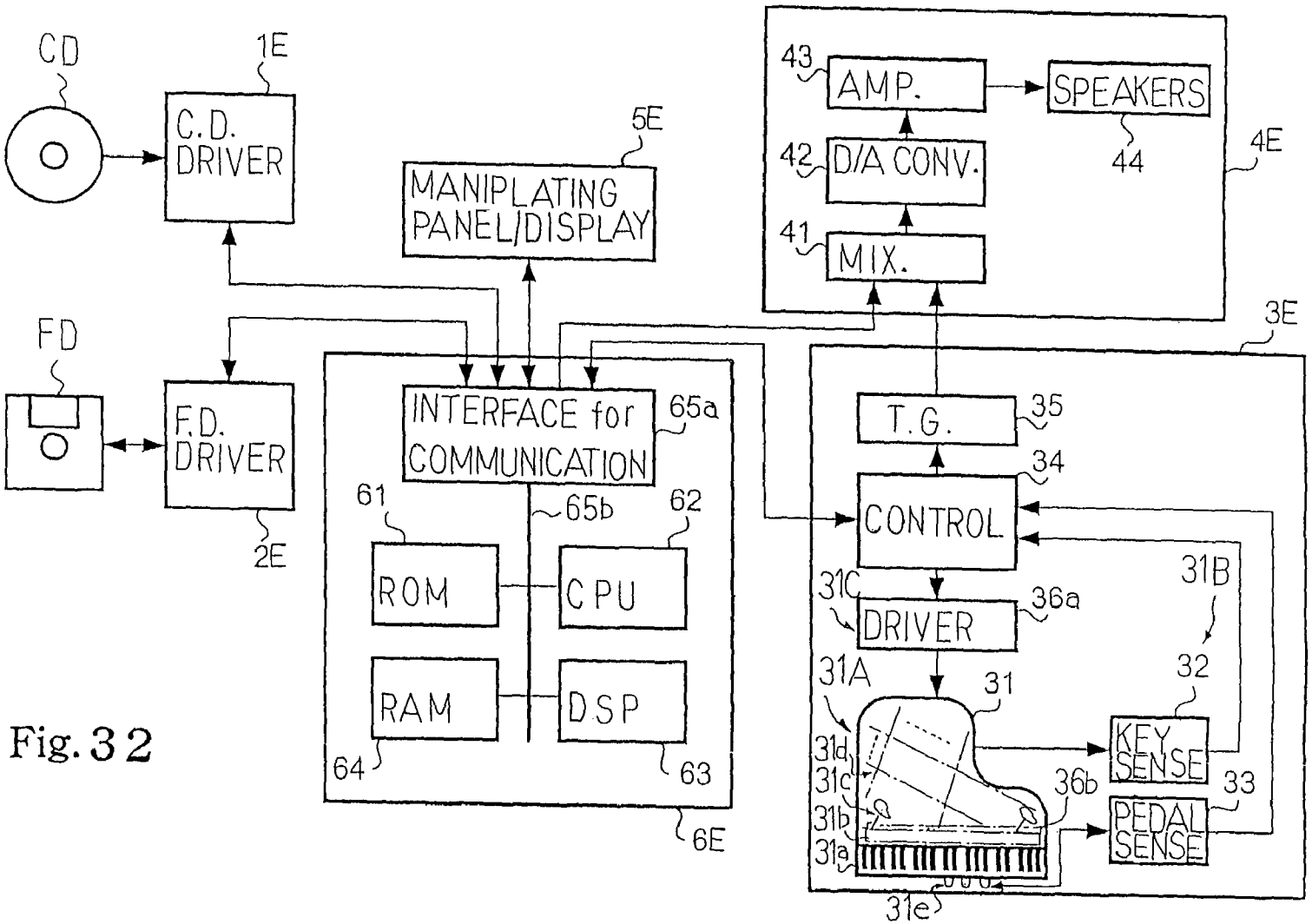
FIG. 32 is a block diagram showing the system configuration of yet another synchronous player system according to the present invention.

Referring to FIG. 32 of the drawings, a synchronous player system embodying the present invention largely comprises a compact disc driver 1E, floppy disc driver 2E, an automatic player piano 3E, an audio unit 4E, a manipulating panel/display 5E and a controller 6E. The compact disc driver 1E, floppy disc driver 2E, automatic player piano 3E, audio unit 4E and manipulating panel/display 5E are connected to one another through signal lines, and the automatic player piano 3E and audio unit 4E are directly connected to each other through signal lines.

The synchronous playback system has at least a preliminary recording mode and a synchronous playback mode. The synchronous playback system preliminarily prepares a MIDI standard file in a floppy disc FD where pieces of note event data and pieces of delta time data are stored together with pieces of reference correlation data at the head portion of a piece of music, pieces of administrative data representative of reference characteristic events and pieces of reference ending audio data and time data representative of a reference starting time and reference ending time in the preliminary recording mode. The pieces of delta time data are indicative of the lapse of time from the initiation of ensemble, and the pieces of reference correlation data at the head portion and reference characteristic events are similar to those of the first and second embodiments. The pieces of administrative data may not be stored in the standard MIDI file.

The pieces of reference ending audio data are representative of the waveform of an analog audio signal at the end portion of the piece of music. The reference starting time is indicative of the timing at which the piece of music starts, and the reference ending time is indicative of the timing at which the piece of music is finished.

On the other hand, the synchronous playback system receives the pieces of note event data, pieces of delta time data, pieces of reference correlation data at he head portion, pieces of administrative data, pieces of reference ending audio data and time data indicative of the reference starting time and reference ending time from the floppy disc FD, and audio music data from the compact disc driver 1E. The synchronous playback system produces objective correlation data from the pieces of audio music data supplied from the compact disc driver 1E, and carries out the correlation analysis on the pieces of reference correlation data at the head portion and the objective correlation data for determining an objective starting time and further on the pieces of reference ending audio data and pieces of objective correlation data for determining an objective ending time. The objective starting time and objective ending time are corresponding to the reference starting time and reference ending time, and are indicative of the timing to initiate the playback of the piece of music and the timing to complete the playback of the piece of music.

When the controller 6E acquires the objective starting time and objective ending time through the correlation analysis, the controller 6E reschedules the timing at which the note events are to be reproduced on the basis of the ratio between the recording time, i.e., from the reference starting time to the reference ending time and the time period from the objective starting time to the objective ending time. The delta time codes for the note event codes are modified through the rescheduling, if necessary. The compact disc driver 1E reproduces the electric tones from the audio music data codes stored in the compact disc CD-B, and the controller 6E supplies the note event codes to the automatic player piano 3E at the appropriate timing so that the performance through the automatic player piano 3E proceeds in good ensemble with the playback through the compact disc driver/audio unit 1E/4E.

The manipulating panel/display 5E is connected to the controller 6E. A user gives instructions to the controller 6E through the manipulating panel, and the controller 6E notifies the user of the current status of the synchronous playback system through visual images produced on the display. The controller 6E is further connected to the compact disc driver 1E, floppy disc driver 2E, automatic player piano 3E and audio unit 4E, and the automatic player piano 3E is directly connected to the audio unit 4E. The pieces of MIDI data, pieces of audio music data, pieces of delta time data, pieces of reference correlation data and other sorts of data are selectively transferred between these system components 1E, 2E, 3E, 4E, 5E and 6E in the preliminary recording mode and synchronous playback mode. The behavior of these system components 1E, 2E, 3E, 4E, 5E and 6E will be described hereinlater in detail.

Compact Disc Driver

A read-in, plural frames and a read-out are stored in series in the compact disc CD for music passages, and the pieces of audio time data and pieces of audio music data form the frames together with predetermined sorts of control data. Indexes such as an initiation of each piece of music are further stored in the compact disc. The pieces of audio music data and pieces of audio time data are found in the form of binary code, and are stored in the audio music data codes and audio time data codes, respectively. The audio music data codes were produced from analog audio signals. The analog audio signals, which are assigned the right channel and left channel, are sampled at 44,100 Hz, and the sampled discrete values are quantized into the 16-bit audio music data codes for right and left channels. The audio music data codes are partially produced from the right-channel analog audio signal, and are referred to as "right-channel audio music data codes". The remaining audio music data codes are produced from the left-channel analog audio signal, and are referred to as "left-channel audio music data codes".

The compact disc CD is loaded into and unloaded from the compact disc driver 1E, and the compact disc driver 1E is responsive to user's instructions given through the manipulating panel/display 5E so as to start and stop the reproduction of the music passages. While a music passage is being reproduced, only the audio music data codes are supplied from the compact disc driver 1E to the controller 6E. The compact disc driver 1E is of a standard type, and includes a disc tray, a motor for the disc tray, a servo-mechanism for the motor, an optical pickup unit, a focus servo-mechanism for the optical pickup unit, a synchronizing circuit for the servo-mechanisms and an error correcting system. These components are well known to the skilled person, and no further description is hereinbelow incorporated.

Floppy Disc Driver

The floppy disc driver 2E includes a microprocessor, which runs on a computer program so that the floppy disc driver 2E has a data processing capability. The floppy disc driver 2E receives the event codes, delta time codes, reference correlation data codes representative of the pieces of reference correlation data at the head portion, pieces of administrative data representative of reference characteristic events and reference correlation codes representative of the pieces of reference correlation data at the end portion from the controller 6E, and creates a standard MIDI file in a floppy disc FD.

The floppy disc driver 2E reads out the MIDI music data codes, associated delta time data, pieces of reference correlation data at the head portion, pieces of administrative data and associated delta time data and pieces of reference correlation data at the end portion from the standard MIDI file, and supplies the MIDI music data codes, delta time codes, pieces of reference correlation data at the head portion, pieces of administrative data, associated delta time codes and pieces of reference correlation data at the end portion to the controller 6E.

Figure 33:
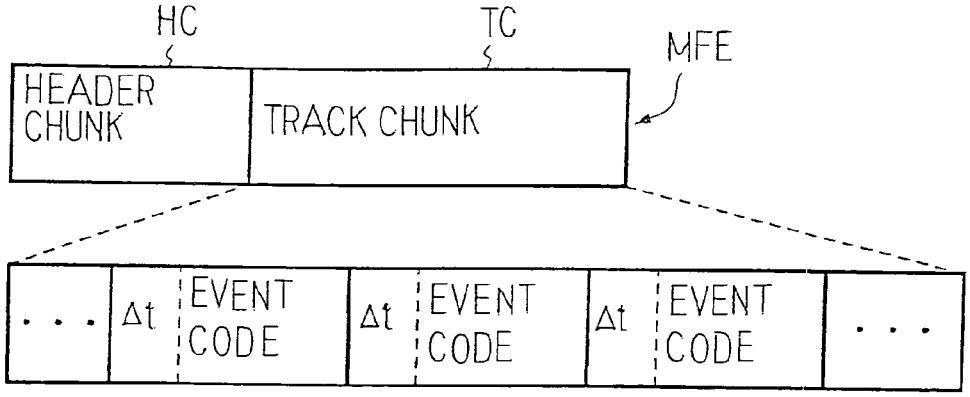
FIG. 33 is a view showing the data structure of a standard MIDI file.

FIG. 33 shows a standard MIDI file MFE. The standard MIDI file MFE is broken down into a header chunk HC and a track chunk TC. The header chunk HC is assigned to pieces of control data representative of the format for the music data to be stored in the track chunk TC and the unit of time. The track chunk TC is assigned to the MIDI music data codes, i.e., the note event codes, system exclusive event codes and delta time codes. The delta time code is representative of a time interval between an event code and the next event code or the lapse of time from the initiation of the playback. In this instance, the delta time codes are indicative of the lapse of time from the initiation of playback in second. However, the delta time code may be indicative of a time interval between an event and the next event in another system.

Figure 34A:
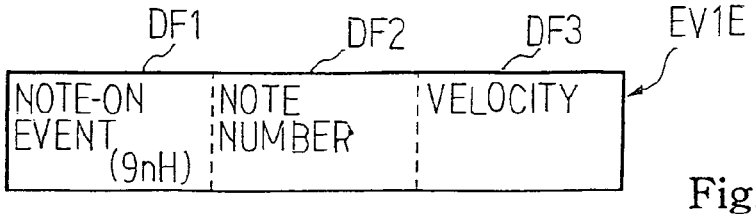
FIGS. 34A, 34B and 34C are views showing the data formats for note event codes.
Figure 34B:
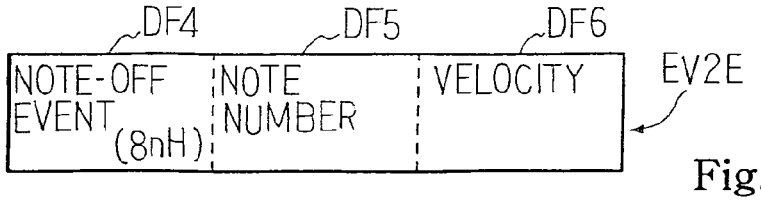
Figure 34C:
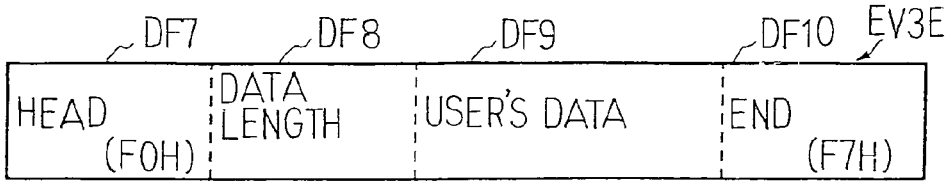

FIGS. 34A, 34B and 34C show formats for the MIDI music data codes. FIG. 34A shows data fields DF1/DF2/DF3 of the note-on event code EV1E, FIG. 34B shows data fields DF4/DF5/DF6 of the note-off event code EV2E, and FIG. 34C shows data fields DF7/DF8/DF9/DF10 of the system exclusive event code EV3E. In order to make the other event codes except for the system exclusive event codes distinguishable, the other event codes are hereinafter referred to as "note event codes". The contents of the data fields FD1 to DF10 are same as those of the event codes described in conjunction with the first embodiment, and, for this reason, no further description is hereinafter incorporated for avoiding undesirable repetition.

The event codes EV1E, EV2E and EV3E do not have any piece of time data, and used for a tone generation, a tone decay and other controls. In other words, the event codes EV1 and EV2 are immediately executed for controlling the tones, and the user's data are also immediately processed. Those sorts of event codes EV1E, EV2E and EV3E form the track chunk of the standard MIDI file MF.

Automatic Player Piano

The automatic player piano 3E largely comprises an acoustic piano 31A, a coding system 31B and an automatic playing system 31C. A user plays a music passage on the acoustic piano 31A, and acoustic piano tones are generated through the acoustic piano 31A. The coding system 31B and automatic playing system 31C are associated with the acoustic piano 31A. While the user is playing the tune, the key action and pedal action are memorized in the event codes through the coding system 31B, and the event codes are transferred from the coding system 31B to the controller 6E, which in turn transfers the event codes to the floppy disc driver 2E for creating the standard MIDI file SMF in a floppy disc FD. On the other hand, when the user requests the automatic playing system 31C to reproduce the music passage on the basis of the event codes. The MIDI music data codes are supplied through the controller 6E to the automatic playing system 31C, and the acoustic piano tones are reproduced through the acoustic piano 31A along the music passage. The automatic player piano 31C is further operative to produce a digital audio signal on the basis of the MIDI music data codes, and the digital audio signal is supplied to the audio unit 4E for reproducing electronic tones from the digital audio signal.

The acoustic piano 31A is a standard grand piano, and includes a keyboard 31*a*, action units 31*b*, hammers 31*c*, strings 31*d*, dampers (not shown) and pedals 31*e*. Black keys and white keys form parts of the keyboard 31*a*, and are selectively depressed and released by the user. The depressed keys make the action units 31*b* activated and the dampers spaced from the associated strings. The activated action units 31*b* drive the associated hammers 31*c* for rotation, and the hammers 31*c* strikes the associated strings 31*d* at the end of the rotation. The dampers have been already spaced from the strings so that the hammers 31*c* give rise to vibrations for generating the acoustic piano tones. The pedals 31*e* are linked with the keyboard 31*a* and dampers. When the user steps on the pedals in his or her performance, the dampers make the acoustic piano tones prolonged, and/or the keyboard 31*a* makes the loudness of the acoustic piano tones reduced.

The coding system 31B includes key sensors 32, pedal sensors 33 and a controller 34. The key sensors 32 monitor the black/white keys, respectively, and the pedal sensors 33 monitor the pedals 31*e*, respectively. The key sensors 32 produce key position signals representative of the current positions of the associated black/white keys 32, and supply the key position signals to the controller 34. Similarly, the pedal sensors 33 produce pedal position signals representative of the current positions of the associated pedals 31*e*, and supply the pedal position signals to the controller 34. The controller 34 includes a microprocessor, and the microprocessor periodically fetches the pieces of positional data represented by the key position signals and pedal position signals. The microprocessor analyzes the pieces of positional data to see whether or not the user depresses any one of the keys/pedals. The user is assumed to depress a black key and step on one of the pedals. The microprocessor specifies the depressed black key and pedal, and calculates the velocity. The microprocessor memorizes these pieces of music data in the event codes, and supplies the event codes to the controller 6E.

The automatic playing system 31C includes the controller 34, a tone generator 35, a driver unit 36*a* and an array of solenoid-operated key/pedal actuators 36*b*. The controller 34 receives the event codes from the controller 6E. If the user instructs the synchronous player system to produce the electronic tones, the controller 34 transfers the event codes to the tone generator 35, and the tone generator 35 produces a pair of digital audio signal for the right and left channels on the basis of the event codes. On the other hand, if the user instructs the synchronous playback system to produce the acoustic piano tones, the controller 34 determines the trajectories of the black/white keys to be moved, and instructs the driver unit 36*a* to energize the solenoid-operated key actuators 36*b* for moving the associated black/white keys along the trajectories. The driver units 36*a* selectively supplies a driving signal to the solenoid-operated key/pedal actuators 36*b* so that the solenoid-operated key/pedal actuators 36*b* give rise to the key motion and/or pedal motion for moving the black/white keys and pedals 31*e*. The black/white keys makes the action units 31*b* activated, and the hammers 31*c* strike the strings 31*d* at the end of the rotation. Thus, the automatic playing system 31C produces the acoustic piano tones or electronic tones on the basis of the event codes.

If the user instructs the controller 34 to supply the event codes to the tone generator 35 during the performance on the keyboard 31*a*, the controller 34 supplies the event codes to the tone generator 35, and the pair of digital audio signal is supplied from the tone generator 35 to the audio unit 4E.

Audio Unit

The audio unit 4E includes a mixer 41, a digital-to-analog converter 42, amplifiers 43 and loud speakers 44. The controller 6E and tone generator 35 are connected to the mixer 41, and the pair of digital audio signal and another pair of digital audio signals are supplied from the tone generator 35 and controller 6E to the mixer 41. The pair of digital audio signals supplied from the controller 6E was produced from the audio music data codes. The mixer 41 mixes the digital audio signals for the right channel and the digital audio signals for the left channels into a pair of digital audio signals through an arithmetic mean, and supplies the pair of digital audio signals to the digital-to-analog converter 42. The digital audio signals are converted to an analog audio signal for the right channel and another analog audio signal for the left channel, and supplies the analog audio signals to the amplifiers 43. The analog audio signals are equalized and amplified through the amplifiers 43, and are, thereafter, supplied to the loud speakers 44. The loud speakers 44 convert the analog audio signals to the stereophonic electric tones.

Manipulating Panel/Display

The manipulating panel/display 5E includes an array of keys, switches, indicators and a display window. The user gives his or her instructions to the controller 6E through the keys and switches, and the controller 6E reports the current status to the user through the indictors and display window. When the controller 6E supplies a digital control signal representative of pieces of bit map data, the manipulating panel/display produces characters and/or other sorts of visual images on the display window.

Controller

The controller 6E includes a read only memory 61 abbreviated as "ROM", a central processing unit 62 abbreviated as "CPU", a digital signal processor 63 abbreviated as "DSP", a random access memory 64 abbreviated as "RAM", an interface 65 for communicating with the other system components 1, 2, 3 and 4 and a bus system 65*b*. The read only memory 61, central processing unit 62, digital signal processor 63, random access memory 64 and interface 65*a* are connected to the bus system 65*b*, and are communicable with one another through the bus system 65*b*. Though not shown in the drawings, a clock generator is incorporated in the controller 6E, and makes the other system components synchronous with one another.

The read only memory 61 is a sort of the non-volatile memory, and instruction codes, which form computer programs, are stored in the read only memory 61. The central processing unit 62 is implemented by a general-purpose microprocessor. The central processing unit 62 sequentially fetches the instruction codes, and executes the instruction codes for achieving given jobs. As will be hereinafter described in detail, the central processing unit 62 runs on certain computer programs in the preliminary recording mode and synchronous playback mode.

The digital signal processor 63 is a high-speed special-purpose microprocessor, and can process the audio music data codes at high speed under the control of the central processing unit 62. The digital signal processor 63 works on reference raw material for producing pieces of reference correlation data at the head portion in the preliminary recording mode, and executes a data processing equivalent to filter circuits also in the preliminary recording mode. The digital signal processor 63 reports the result obtained through those sorts of data processing to the central processing unit 62 as will be hereinafter described in detail.

The random access memory 64 is a sort of the volatile memory, and offers a temporary data storage to the central processing unit 62. In other words, the random access memory 64 serves as a working memory. The interface 65*a* transfers digital codes between the system components 1, 2, 3, 4 and 5. In case where the data format is different between the system components, the interface 65*a* changes the digital codes from the data format to another data format.

Preliminary Recording

A user performs a piece of music in ensemble with a playback of the piece of music recorded in a compact disc CD-A. Although plural pieces of music are recorded in the compact disc CD-A, the user selects one of the plural pieces of music, and the selected one of the plural pieces of music is hereinafter referred to as "piece of music N", and the set of audio music data codes representative of the piece of music N is referred to as NA.

The user firstly loads the compact disc CD-A into the compact disc driver 1E and the floppy disc FD, which has a recording capacity much enough to store a standard MIDI file to be created through the preliminary recording, into the floppy disc driver 2E. The user pushes the instruction key on the manipulating panel/display 5E so that the central processing unit 62 acknowledges the user's instruction to start the preliminary recording. Then, the central processing unit 62 supplies a control signal representative of a request for playback through the interface 65*a* to the compact disc driver 1E.

The compact disc driver 1E drives the compact disc CD-A for rotation, and supplies the audio music data codes to the interface 65*a*. A pair of audio music data codes is transferred to the interface 65*a* for the right channel and left channel at every interval of $1/44100$ second. The pair of audio music data codes is expressed as (R(n), L(n)), and the value of the audio music data code R(n)/L(n) is hereinafter referred to as "sampled value (n)". "n" represents the place of the pair of audio music data codes (R(n), L(n)) counted from the head of the set of audio music data codes NA. The first pair of audio music data codes is expressed as (R(0), L(0)), and "n" is increased through "1", "2", "3" . . . The sampled value is an integer, and all the sampled values are fallen within the range from −32768 to +32767. "n" is indicative of the place of the audio music data code in the track.

When the first pair of audio music data codes (R(0), L(0)) reaches the interface 65*a*, the central processing unit 62 fetches the pair of audio music data codes (R(0), L(0)) from the interface 65*a*, and starts to count the clocks of the clock signal. In other words, the central processing unit starts the internal clock for measuring the lapse of time from the arrival time of the first pair of audio music data codes (R(0), L(0)). The arrival time of the first pair of audio music data codes (R(0), L(n)) is 0.00 second.

While the pairs of audio music data codes (R(0), L(0)), (R(1), L(1)), (R(2), L(2)), . . . are reaching the interface 65*a*, the central processing unit 62 successively transfers the pairs of audio music data codes (R(n), L(n)) to the automatic player piano 3E, and are converted to electric signal along the piece of music N. The compact disc player 1E continues to transfer all the pairs of audio music data code until the end of the piece of music N.

The central processing unit 62 is further operative to store the pairs of sampled values (n) of the pairs of audio music data codes in the random access memory 64 together with the arrival times of the pairs of audio music data codes (R(n), L(n)). The arrival time of the pair of audio music data codes (R(n), L(n)) is expressed as "arrival time (n)". The pair of sampled values (n) and associated arrival times (n) successively join a queue. In this instance, 1323000 pairs of sampled values and the arrival times (n) thereof are accommodated in the queue at the maximum. When the pair of sampled values (1323001) and arrival time (1323001) reach the queue, the first pair of sampled values (0) and arrival time (0) are pushed out from the queue, and the new pair of sampled values (1323001) and arrival time (1323001) join the queue at the tail. The 1323000 pairs of sampled values are equivalent to the electric tones continued for 30 minutes. The central processing unit 62 continuously makes the pair of sampled values (n) and its arrival time (n) join the queue until the last pair of sampled values and its arrival time, and keeps the length of the queue constant.

The central processing unit 62 is further operative to store $2^{16}$ pairs of sampled values after the silent time, i.e., from the initiation of the generation of the first electric tone in the random access memory 64. The $2^{16}$ sampled values, i.e., 65536 pairs of audio music data codes are equivalent to the electric tones continued for 1.49 seconds. The $2^{16}$ pairs of sampled values are hereinafter referred to as "reference raw material at the head portion".

In detail, when the first pair of audio music data code (R(0), L(0)) reaches the central processing unit 62, the central processing unit 62 starts to check the pairs of audio music data codes (R(0), L(0)) to (R(65535) to see whether or not the sampled values of the pair exceed a threshold value. The threshold value is representative of the boundary between the silence and the tone. In this instance, the threshold is assumed to be 1000. At least one sampled value of the pair of audio music data codes (R(50760), L(50760)) is assumed to exceed the threshold. While "n" is being incremented from zero to 50759, the answer is given negative, and the central processing unit 62 ignores these pairs of audio music data codes (R(0), L(0)) to (R(50759), L(50759). In other words, the central processing unit 62 does not accumulate the pairs of audio music data codes (R(0), L(0)) to (R(50759), L(50759)) in the random access memory 64. The silent time period is about 1.15 seconds.

When "n" reaches 50760, the central processing unit 62 changes the answer to affirmative. With the positive answer, the central processing unit 62 decides a reference starting time at which the sampled value exceeded the boundary, and stores the pair of sampled values (50760) in the random access memory 64 together with the reference starting time. The central processing unit 62 successively transfers the 65536 pairs of sampled values to the random access memory 64 so that the sampled values of the pairs of audio music data codes (R(50760), L(50760)) to (R(116295), L(116295)) are accumulated in the random access memory 64 without comparison with the threshold. Thus, the sampled values of the pairs of audio music data codes representative of the silence or almost silence are not accumulated in the random access memory 64. The sampled values of those pairs of audio music data codes (R(50760), L(50760)) to (R(116295), L(116295)) serve as the reference raw material at the head portion, and the reference starting time is 1.15 seconds.

When the central processing unit 62 completes the accumulation of the reference raw material at the head portion, the central processing unit 62 requests the digital signal processor 63 to produce pieces of reference correlation data at the head portion from the reference raw material at the head portion. Pieces of correlation data at the head portion are equivalent to the pieces of audio data sampled at 172.27 Hz. The digital signal processor 63 produces the pieces of reference correlation data at the head portion from the pieces of raw material at the head portion. The pieces of reference correlation data at the head portion are used in a correlation analysis between the pairs of audio music data codes and other pairs of audio music data codes.

Figure 35:
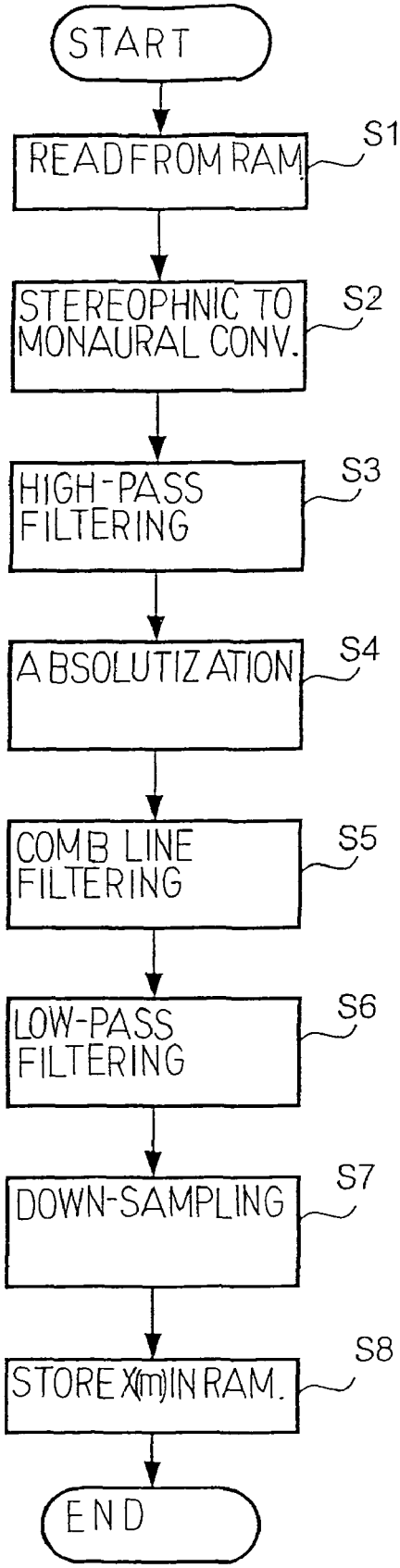
FIG. 35 is a flowchart showing a method for producing pieces of reference correlation data.

FIG. 35 shows a method for producing the pieces of reference correlation data at the head portion from the reference raw material at the head portion or pairs of sampled values (n). The method is stored in the program memory in the form of a computer program. When the digital signal processor 63 acknowledges the request, the digital signal processor 63 firstly reads out the pieces of reference raw material, i.e., the sampled values of the pairs of audio music data codes (R(n), L(n)) from the random access memory 64 as by step S1, and calculates the arithmetic mean of the sampled values of each pair of audio music data codes (R(n), L(n)) for converting the stereophonic audio music data to the monophonic audio music data as by step S2. The conversion from the stereophonic audio music data to the monophonic audio music data makes the load on the digital signal processor 63 light.

Subsequently, the digital signal processor 63 eliminates a value representative of the direct current component of the analog audio signal from the values of the arithmetic mean through a data processing equivalent to a high-pass filtering as by step S3. The calculated values are plotted in both positive and negative domains. It is preferable from the viewpoint of accuracy in the correlation analysis that the calculated values are dispersed in both positive and negative domains. Thus, the data processing equivalent to the high-pass filter makes the correlation analysis highly reliable.

Subsequently, the calculated values are absolutized as by step S4. Substitute values of the power of the sampled values are determined for the calculated values through the absolutization. The absolute values are less than the square numbers representative of the power, and are easy to handle in the following data processing. Nevertheless, if the digital signal processor 63 has an extremely large data processing capability, the digital signal processor 63 may calculate the square numbers instead of the absolute values.

Subsequently, the digital signal processor 63 extracts a low frequency component representative of a tendency in the variation of the waveform of the original audio signal from the absolute values through a data processing equivalent to a comb line filter as by step S5. Although the low frequency component is usually extracted through a data processing equivalent to a low pass filter, the data processing equivalent to the comb line filter is lighter in load than the data processing equivalent to the low pass filter. For this reason, the data processing equivalent to the comb line filter, i.e., the comb line filtering is employed.

Figure 36:
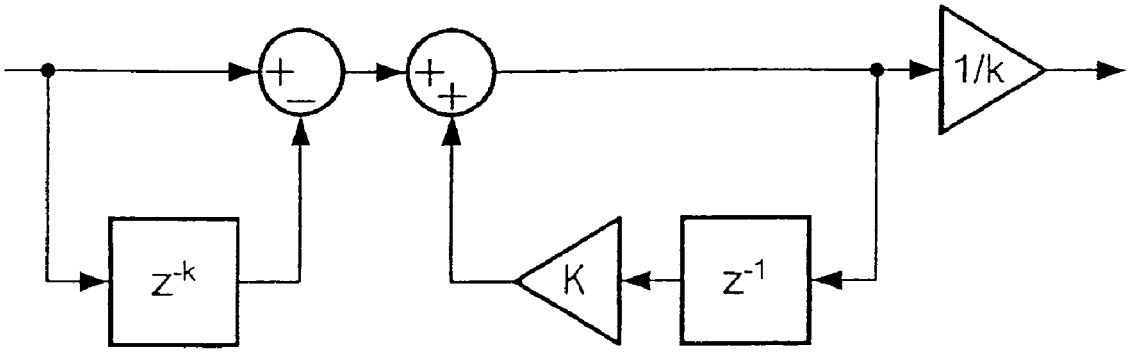
FIG. 36 is a block diagram showing the circuit configuration of a comb line filter.

FIG. 36 shows the circuit configuration of a comb line filter. Boxes stand for delay circuits, and triangles stand for the multiplication. "$Z^{-k}$" is put in the left box, and "k" represents that the delay time is equal to (sampling period×k). The sampling frequency is 44100 Hz so that the sampling period is equal to $1/44100$ second. The multipliers are put in the triangles, respectively. In FIG. 36, "k" is given as follows $$k=(44100-\pi\times f)/(44100+\pi\times f) \qquad \text{expression 6}$$

The data processing through the multiplication with the multiplier "k" makes the comb line filter achieve a high pass filtering at frequency f, and the direct current component is perfectly eliminated from the absolute values. It is desirable to experimentally optimize "k" and "f" so as to enhance the accuracy in the correlation analysis.

Turning back to FIG. 35, the digital signal processor 63 carries out a data processing equivalent to a low pass filter as by step S6 for preventing the sampled data through a down sampling at the next step from the fold-over noise. As will be described in conjunction with the next step S7, the digital signal processor 63 converts the sampled values at 44100 Hz to down-sampled values at 172.27 Hz, and the fold-over noise takes place. In order to prevent the down-sampled values from the fold-over noise, it is necessary to eliminate the frequency components higher than 86.13 Hz, i.e., half of 172.27 Hz. Although the comb line filter fairly eliminates the high frequency components from the pairs of sampled values, the high frequency components are still left in the sampled values. For this reason, the digital signal processor 63 perfectly eliminates the high frequency components from the sampled values before the down-sampling. In case where the digital signal processor 63 has a large data processing capability, the digital signal processor 63 may carry out a data processing equivalent to a high-precision low pass filtering instead of the two sorts of data processing at steps S5 and S6.

Subsequently, the digital signal processor 63 takes out a sample from every 256 samples as by step S7. Namely, the digital signal processor 63 carries out the down-sampling at 1/256. Upon completion of the down-sampling, the amount of data is reduced from 65536 to 256. The samples after the down-sampling serve as the pieces of reference correlation data at the head portion. The load on the digital signal processor 63 is lightened through the down-sampling. If the digital signal processor 63 has a large data processing capability, the digital signal processor 63 directly proceeds from step S6 to step S8. Finally, the digital signal processor 63 stores the pieces of reference correlation data at the head portion in the random access memory 64 as by step S8. Thus, the digital signal processor 63 produces the pieces of reference correlation data at the head portion from the pieces of raw material at the head portion, and stores the pieces of reference correlation data at the head portion in the random access memory 64.

When the first piece of reference raw material at the head portion reaches the interface 65*a*, the central processing unit 62 further requests the digital signal processor 63 to find characteristic events in the pieces of reference raw material. The digital signal processor 63 extracts low frequency components from the pairs of sampled values in the queue through a data processing equivalent to a low pass filtering at a predetermined frequency, and further extracts extremely low frequency components from the pairs of sampled values in the queue through a data processing equivalent to a low pass filtering at another predetermined frequency, which is lower than the predetermined frequency. Upon completion of the data processing equivalent to the low pass filtering at the different frequencies, the digital signal processor 63 compares the low frequency components with the extremely low frequency components to see whether or not the characteristic event takes place. The characteristic events are a sort of flag or timing data used in the timing regulation.

Figure 37:
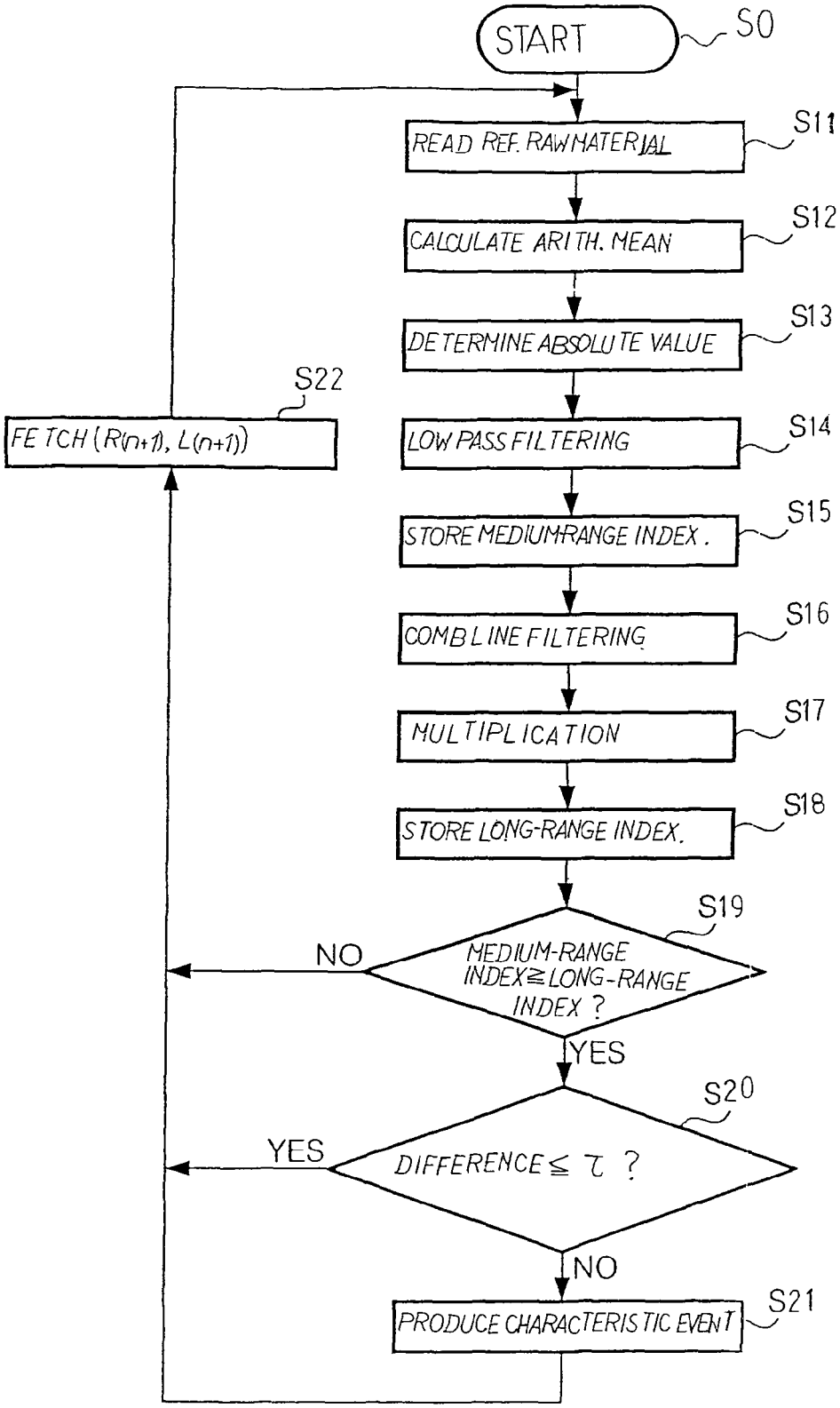
FIG. 37 is a flowchart showing a method for finding characteristic events in sampled values.

FIG. 37 shows a method for producing the pieces of administrative information representative of the characteristic events. The method is expressed as a computer program executed by the digital signal processor 63.

When the digital signal processor 63 receives the request for producing the administrative information, the digital signal processor 63 starts the computer program at step S0. The digital signal processor 63 reads out a predetermined number of pairs of sampled values from the queue in the random access memory 64 as by step S11. The data transfer is carried out from the tail of the queue. In this instance, the predetermined number is 44100. In the following description, the pairs of sampled values read out from the queue are referred to as "pieces of raw material", and the set of pieces of raw material, which contains the pair f sampled value (n) at the tail, is referred to as "pieces of raw material (n)". If the pair of sampled material (50760) occupies the tail of the queue at the reception of the request for producing the administrative information, the pairs of sampled values (6601) to (50760) are read out from the random access memory 64, and form the raw material.

Subsequently, an arithmetic mean is calculated from the sampled values of each pair as by step S12. This arithmetic operation is equivalent to the conversion from the stereophonic sound to the monophonic sound. The arithmetic mean makes the load on the digital signal processor 63 light.

Subsequently, the digital signal processor 63 determines the absolute values of the arithmetic mean as by step S13. Substitute values for the power are obtained through the through the absolutization. The absolute values are less than the square numbers representative of the power, and are easy to handle in the following data processing. Nevertheless, if the digital signal processor 63 has an extremely large data processing capability, the digital signal processor 63 may calculate the square numbers of the calculated values instead of the absolute values.

Subsequently, the digital signal processor 63 carries out a data processing equivalent to the low pass filtering on the absolute values as by step S14. The cut-off frequency is assumed to be 100 Hz in this instance. Upon completion of the data processing equivalent to the low pass filtering, a medium-range index is obtained for the sampled values. The medium-range index for the sampled value (n) is expressed as "medium-range index (n)". The medium-range index (n) is representative of the tendency of the variation at the time corresponding to the pair of sampled value (n) in the audio waveform in a medium range. In general, the audio waveform is frequently varied in a short range. The variation in the short range is eliminated from the series of pairs of sampled values through the data processing equivalent to the low pass filtering, because the short-range variation is restricted by the previous pairs of sampled values. As a result, data information representative of the middle-range variation and long-range variation are left in the digital signal processor 63. In other words, the medium-range index . . . (n−2), (n−1), (n) is left in the digital signal processor 63. The digital signal processor 63 transfers the medium-range index to the random access memory 64 for storing the index in the random access memory 64 as by step S15.

Subsequently, the digital signal processor 63 carries out a data processing equivalent to a low pass filtering through a comb line filter as by step S16. T h e cut-off frequency at step S16 is lower than the cut-off frequency at step S14. This is equivalent to an extraction of extremely low frequency components from the waveform expressed by the medium-range index. The comb line filter is desirable for the digital signal processor 63, because the data processing equivalent to the comb line filter is lighter than the data processing equivalent to the low pass filter.

Figure 38:
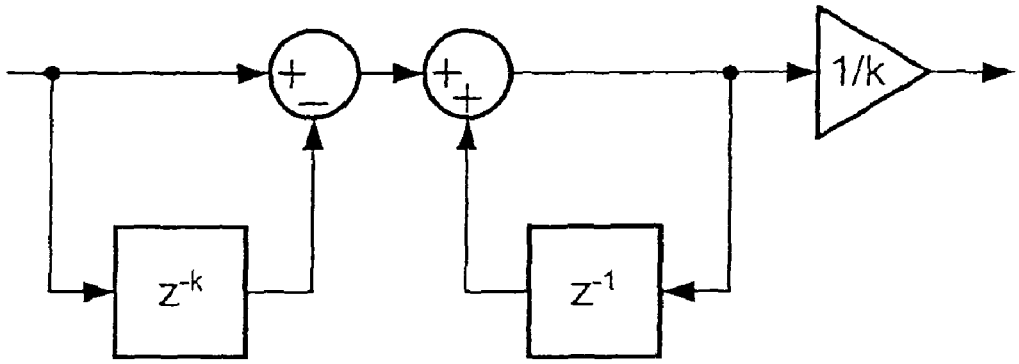
FIG. 38 is a block diagram showing the circuit configuration of a comb line filter.

FIG. 38 shows the digital processing equivalent to the comb line filter. Boxes and circles form two loops connected in series, and a triangle is connected between the second loop and a data output port. The boxes introduce delay into the signal propagation, and "$Z^{-k}$" represents that the delay time is equal to the product between the sampling period and constant k. As described hereinbefore, the sampling frequency is 44100 Hz. This means that the sampling period is $1/44100$ second. The triangle is representative of a multiplication, and "1/k" is the multiplier. In the following description, "k" is assumed to be equal to 22050. The frequency components higher than 1 Hz are almost eliminated from the medium-range index through the data processing equivalent to the comb line filter. Thus, the components representative of the long-range variation are left in the digital signal processor 63 upon completion of the data processing at step S16.

Subsequently, the digital signal processor 63 multiplies the series of components representative of the long-range variation by a positive constant "h". The frequency with a positive answer at the next step S19 is adjusted to an appropriate value through the multiplication at step S17. If "h" is small, the time intervals between a positive answer and the next positive answer is narrow. In case where the time intervals of the positive answers are too wide, the characteristic events are produced at long time intervals at step S11, and the accuracy of timing regulation is lowered. On the other hand, if the time intervals of the positive answers are narrow, the positive answers tend to be canceled at step S20, and the characteristic events are obtained at long time intervals. This results in the accuracy of the timing regulation is lowered. In this situation, the multiplier "h" is experimentally determined. Upon completion of the multiplication at step S17, long-range index is left in the digital signal processor 63. The long-range index corresponding to the sampled value (n) is hereinafter referred to as "long-range index (n)". Thus, the long-range index . . . (n−2), (n−1) and (n) is left in the digital signal processor 63 upon completion of the data processing at step S17. The digital signal processor 63 transfers the long-range index to the random access memory 64, and the long-range index is stored in a predetermined memory area of the random access memory 64 as by step S18.

Subsequently, the digital signal processor reads out the medium-range index (n) and long-range index (n) from the random access memory 64, and compares them with each other to see whether or not the medium-range index (n) is equal to or greater than the long-range index (n) as by step S19. The positive answer at step S19 is indicative of abrupt variation in the medium range on the audio waveform expressed by the reference raw material at the point corresponding to the sampled point (n). In more detail, when the volume in the frequency range between 1 Hz and 100 Hz is abruptly enlarged on the audio waveform, the medium-range index becomes greater than the long-range index, and the answer at step S19 is given affirmative "Yes". Then, the digital signal processor 63 checks the internal clock for the present time at which the comparison results in the positive answer, and stores the present time in the random access memory 64.

Subsequently, the digital signal processor 63 reads out the time at which the previous positive answer was obtained from the random access memory 64, and subtracts the time of the previous positive answer from the present time to see whether or not the difference is equal to or less than a predetermined value $\tau$ as by step S20. If the difference is greater than the predetermined value $\tau$, it has been a long time from the production of the previous characteristic event. Thus, the data processing at step S20 prevents the central processing unit 62 from a lot of characteristic events produced at short intervals. If the characteristic events are too many, it is difficult to make characteristic events in the series of sampled values of the audio music data codes read out from the compact disc CD-B exactly corresponding to the characteristic events produced from the sampled values of the audio music data codes (R(n), L(n)) stored in the compact disc CD-A. The predetermined value T is experimentally determined. Of course, when the digital signal processor 63 acquires the first positive answer, there is not any time in the random access memory 64. In this situation, the answer at step S20 is automatically given negative.

With the negative answer at step S20, the digital signal processor 63 produces the characteristic event as by step S21, and notifies the central processing unit 62 of the characteristic event.

If the answer at step S19 is given negative, the digital signal processor proceeds to step S22. In case where the answer at step S20 is given affirmative, the digital signal processor 63 also proceeds to step S22. The digital signal processor 63 also proceeds to step S22 upon completion of the jobs at step S21. The digital signal processor 63 waits for the next pair of audio music data codes (R(n+1), L(N+1)). When the next pair of audio music data codes reaches the interface 65*a*, the central processing unit 62 transfers the pair of sampled values (n+1) to the audio unit 4C, and the sampled values (n+1) and arrival time join the queue in the random access memory 64. The central processing unit 62 requests the digital signal processor 63 to repeat the data processing, again. Then, the digital signal processor 63 fetches the reference raw material containing the pair of sampled values (n+1) at the tail from the random access memory 64, and returns to step S11.

Thus, the digital signal processor reiterates the loop consisting of steps S11 to S22 until the raw material containing the last pair of sampled values. Thus, the digital signal processor 63 extracts plural characteristic events from the raw material or the set of pairs of audio music data codes during the progression of the piece of music.

Figure 39:
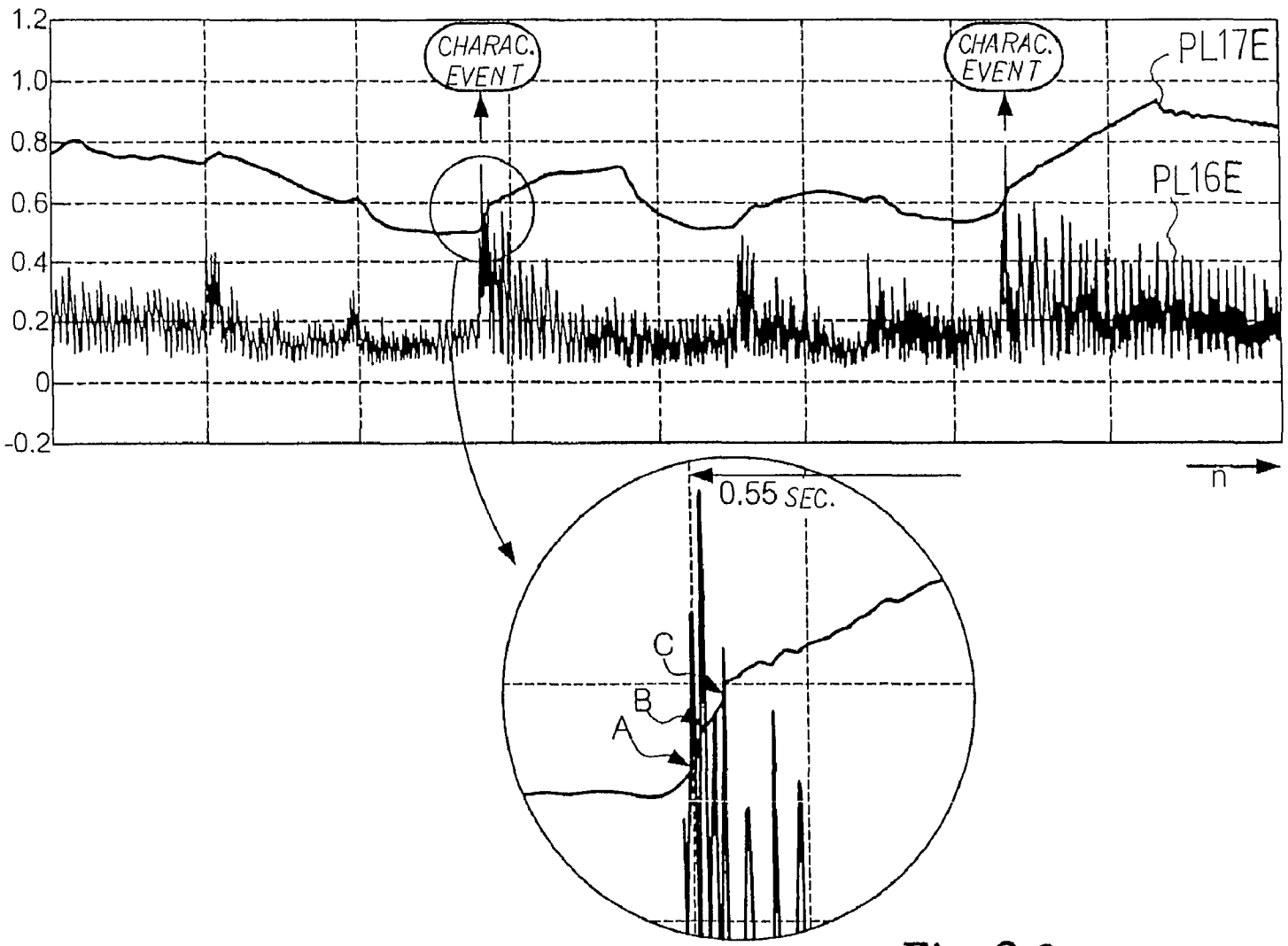
FIG. 39 is a graph showing a medium-range index and a long-range index.

The present inventor confirmed the data processing expressed by the computer program shown in FIG. 37. An IIR (Infinite Impulse Response) filter was used as the low pass filter at step S14. The constant "h" at step S17 was 4, and the time period $\tau$ was 0.55 second. The data processing resulted in plots PL16E and PL17E and the characteristic events shown in FIG. 39. Plots PL16E was representative of the medium-range index, and plots PL17E represented the long-range index. When the medium-range index PL16E became equal to or exceeded over the long-range index PL17E, the digital signal processor 63 produced the characteristic events. Although the medium-range index trice exceeds the long-range index at A, B and C as shown in a large circle, the digital processor 63 produced the characteristic events only at A, because the predetermined time of 0.55 second was not expired until points B and C (see step S21 in FIG. 37). The characteristic events extracted from the piece of music NA are referred to as "reference characteristic events".

When the compact disc driver 1E starts to transfer the audio music data codes through the controller 6E to the audio unit 4E, the user gets ready to perform the piece of music. While the electric tones are being produced through the audio unit 4E, the user selectively depresses and releases the black/white keys, and steps on the pedals 31*e*. The acoustic piano tones are produced through the vibrations of the strings 31*d*, and the key sensors 32 and pedal sensors 33 report the key motion and pedal motion to the controller 34. The controller 34 produces the event codes representative of the note-on event, note-off event and effects to be imparted to the acoustic piano tones, and supplies the note event codes to the interface 65*a*. Thus, the central processing unit 62 receives not only the characteristic event codes from the digital signal processor 63 but also the note event codes from the automatic player piano 3E.

Figure 40:
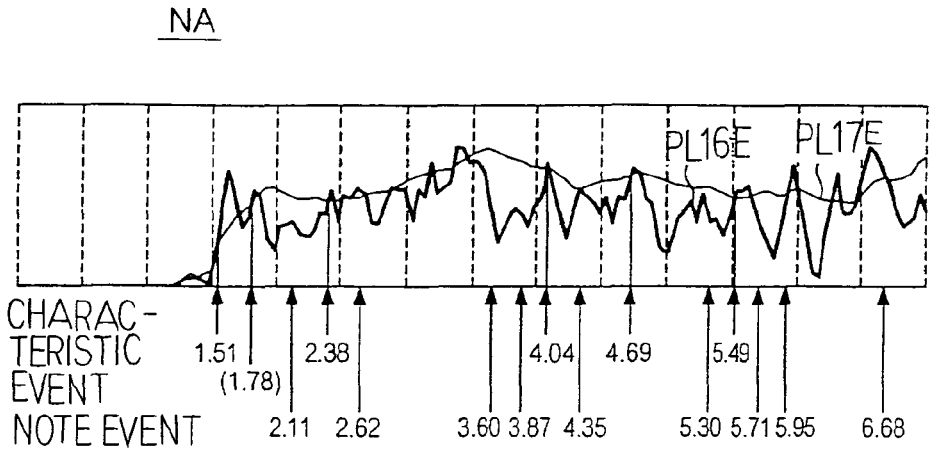
FIG. 40 is a graph showing the characteristic events and note events.

FIG. 40 shows the characteristic events and note events produced during an ensemble in the preliminary recording mode. The medium-range index and long-range index were respectively varied as indicated by plots PL16E and plots PLI7E, and the time rightward went along the axis of abscissa. The first characteristic event took place at 1.51 seconds from the arrival of the first pair of audio music data codes, i.e. the reference starting time, and the other characteristic events took place at 2.38 second, 4.04 seconds, . . . On the other hand, the central processing unit 62 received the first event code at 2.11 second, and the other event codes arrived at the interface 65*a* at 2.62 seconds, 3.06 second . . . Thus, the characteristic event codes and note event codes were produced in a real time fashion during the ensemble. Although the medium-range index PL16E exceeded the long-range index 17E at 1.78 seconds, the central processing unit 62 did not receive any characteristic event, because the predetermined period of 0.55 second had not been expired.

When the central processing unit 62 is notified of the reference characteristic event code, the central processing unit 62 produces the system exclusive event code for storing the reference characteristic event therein, and checks the internal clock to see what time the reference characteristic event reaches there. The central processing unit 62 produces the delta time code indicative of the arrival time, and stores the delta time code and reference characteristic event code in the random access memory 64.

Similarly, when the central processing unit 62 fetches the note event code, the central processing unit 62 checks the internal clock to see what time the note event code reaches there. The central processing unit 62 produces the delta time code indicative of the arrival time, and stores the delta time code and note event code in the random access memory 64.

Assuming now that the compact disc driver 1E supplies the last pair of audio music data codes, the sampled values of the last pair of audio music data codes join the queue at the tail together with the arrival time, and the digital signal processor 63 carries out the data processing on the raw material containing the last pair of sampled values at the tail position for finding the reference characteristic event. Upon completion of the last data processing, the central processing unit 62 branches to a computer program for finding the end of the piece of music N in the set of pairs of audio music data codes.

In detail, when the central processing unit 62 completes the data processing for the characteristic event, the last pair of sampled values and other 1322999 pairs of sampled values are left in the queue together with the arrival times. If the last pair of sampled value is expressed as the pair of sampled values (7673399), the pair of sampled values (6350400) to the last pair of sampled value (7673399) have joined the queue together with their arrival times.

The central processing unit 62 reads out the pair of sampled values at the tail of the queue, and checks the pair of sampled values to see whether or not at least one of the sampled values of the pair exceeds the threshold, which is 1000 in this instance. If the answer is given negative, the central processing unit 62 reads out the pair of sampled values at one place before the tail, and checks the pair of sampled values to see whether or not at least one of the sampled values exceeds the threshold. While the answer is being given negative, the central processing unit 62 reads out the pair of sampled values toward the head of the queue, and repeats to compare the sampled values with the threshold.

One of the sampled values (7634297) is assumed to exceed the threshold. The pair of sampled values (7673399) to pair of sampled values (7634298) have not exceeded the threshold. This means that there is the silence continued for 0.89 second at the end of the set of pairs of audio music data codes. The pair of sampled value, which contains at least one sampled value greater than the threshold value, is hereinafter referred to as "pair of sampled value (Z)". The piece of music N is completed at the pair of sampled values (Z). When the central processing unit 62 finds the pair of sampled values (Z) in the set of pairs of audio music data codes, the central processing unit 62 does not continue the search for the end of the piece of music.

Figure 41:
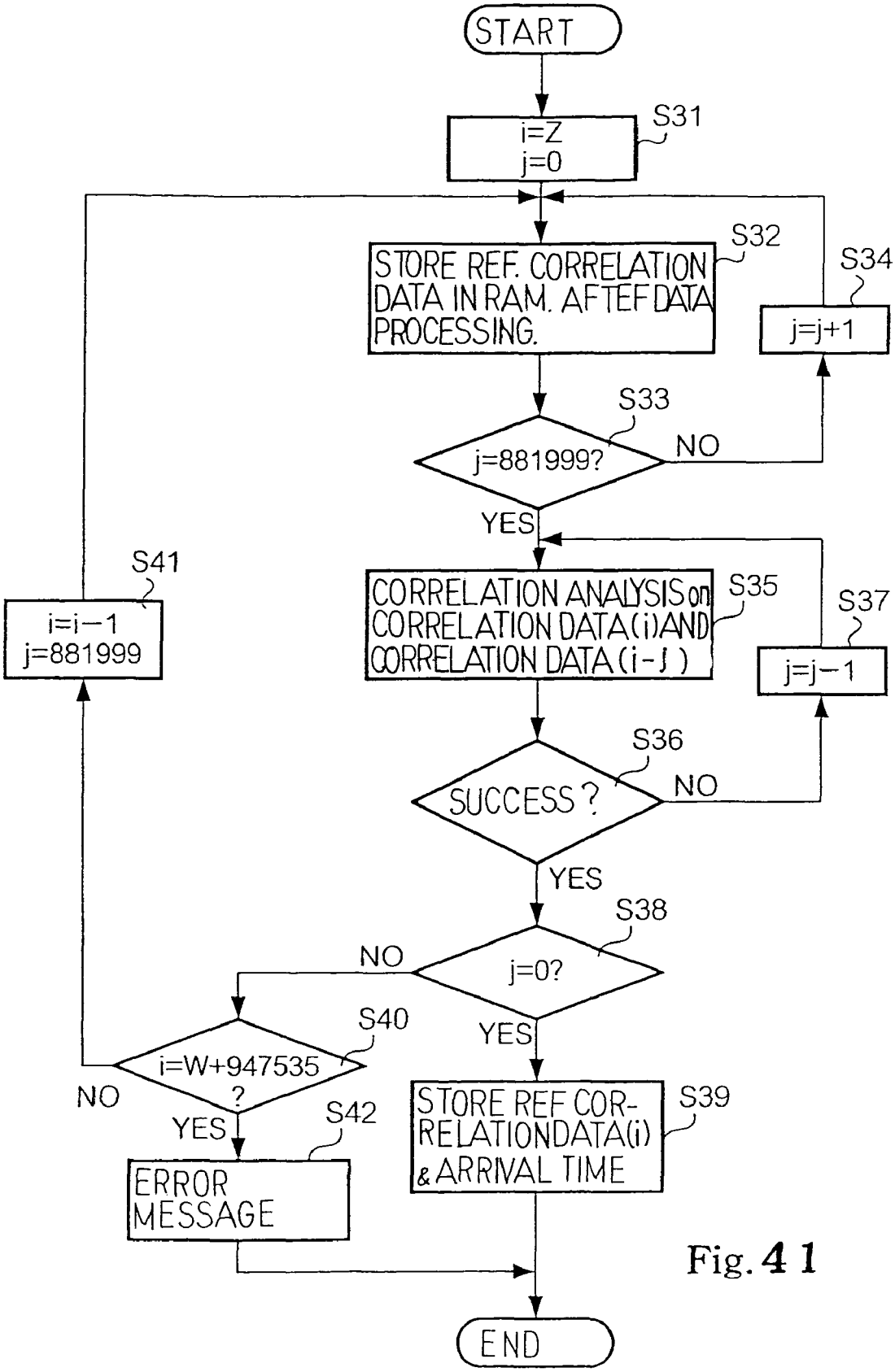
FIG. 41 is a flowchart showing a data processing for producing reference correlation data at the end portion of a piece of music from reference material.

Upon completion of the data processing for searching the queue for the end of the piece of music, the central processing unit 62 branches to a computer program for producing pieces of reference correlation data at the end portion or ending audio data. The central processing unit 62 produces pieces of reference correlation data at the end portion from raw material at the end portion, i.e., pairs of sampled values in the queue through the data processing expressed by the computer program. The computer program is illustrated in FIG. 41 together with several jobs to be executed by the digital signal processor 63.

In the following description, the pair of sampled values (W) occupies the head of the queue, and "W" and "Z" are assumed to be 6350400 and 7634297, respectively. This means that the pair of sampled values (6350400) to the pair of sampled values (7673399) have joined the queue together with the arrival times. The pair of sampled values (7634297) occupies the end of the piece of music N. 65536 pairs of sampled values are referred to as "pieces of raw material (n) at the end portion", and the pair of sampled values (n) occupies the end of the raw material at the end portion.

Firstly, the central processing unit 62 sets counters i and j to "Z", i.e., 7634297 and zero, respectively, as by step S31, and requests the digital signal processor to produce the pieces of reference correlation data at the end position from the reference raw material at the end position (i-j). The data processing for producing the pieces of reference correlation data at the end position is similar to that for producing the pieces of reference correlation data at the head portion already described hereinbefore. Upon completion of the data processing, the digital signal processor 63 stores 256 pieces of reference correlation data at the end portion in the random access memory as by step S32. Thus, 256 pieces of reference correlation data (n) at the end portion are acquired from the reference raw material (n) at the end portion. Since (i-j) is 7634297, the reference correlation data (7634297) at the end portion is stored in the random access memory 64.

Subsequently, the central processing unit 62 checks the counter j to see whether or not the counter j has reached 881999 as by step S33. The value stored in the counter j is less than 881999 so that the answer at step S33 is given negative, and the central processing unit 62 increments the counter j by 1 as by step S34. After incrementing the counter j, the central processing unit 62 returns to step S31. Thus, the central processing unit stepwise shifts the end of the raw material by 1, and repeats the data processing consisting of steps S32 to S34 881999 times for the pairs of sampled values equivalent to 20 seconds. In other words, the raw material at the end portion is renewed 882000 times. When the digital signal processor 63 completes the data processing on the $882000^{th}$ set of 65536 pairs of sampled values, the central processing unit 62 finds the counter j to be 881999, and the answer at step S33 is changed to affirmative. When the answer at step S33 is given affirmative, the reference correlation data (7634297), reference correlation data (7634296), . . . and reference correlation data (6752298) were stored in the random access memory 64.

Figure 42:
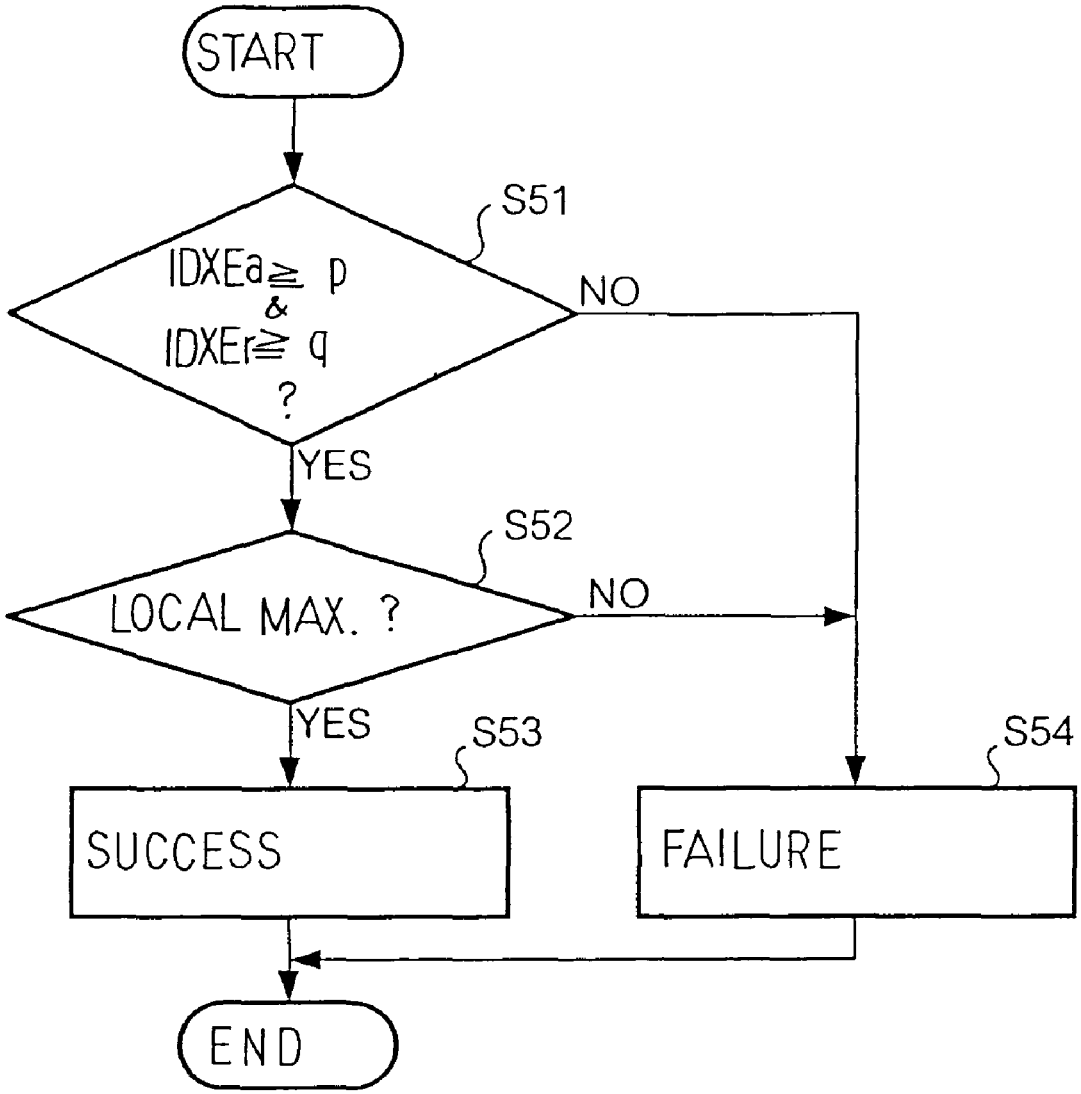
FIG. 42 is a flowchart showing a data processing for a correlation analysis.

Subsequently, the central processing unit 62 requests the digital signal processor 63 to carry out a correlation analysis between the reference correlation data (i) and the reference correlation data (i-j) as by step S35. The digital signal processor 63 determines the similarity between the two sets of audio data, and the data processing for the correlation analysis will be hereinafter described with reference to FIG. 42.

When the central processing unit 62 requests the digital signal processor 63 to carry out the correlation analysis, the central processing unit 62 specifies "source audio data" and "audio data to be analyzed". In this instance, the source audio data is the reference correlation data (i) at the end portion, and the audio data to be analyzed is the reference correlation data (i-j). The pieces of source audio data are expressed as X(0) to X(255), and the pieces of audio data to be analyzed are expressed as $Y_m(0)$ to $Y_m(255)$. "m" is (i-j), and is equal to "n" of the pair of sampled values (n) at the tail of the set of pairs of sampled values.

When the digital signal processor 63 acknowledges the request for the correlation analysis, the digital signal processor 63 reads out the pieces of reference correlation data (i) and the pieces of reference correlation data (i-j).

Subsequently, the digital signal processor 63 determines an absolute correlation index, and compares the absolute correlation index IDXEa with a constant p to see whether or not the absolute correlation index IDXEa is equal to or greater than the constant p.

$$\sum_{i=0}^{255}(x(i)\times Y_m(i))\Big/\sum_{i=0}^{255}(x(i)^2)\geq p \qquad \text{expression 7}$$

The left side of expression 7 is representative of the absolute correlation index IDXEa, and the constant p has a value ranging from zero to 1. In the first calculation, "i" is 7634297, and m is equal to (i-j), i.e., 6752298. When the source audio data X(0) to X(255) are respectively close to the audio data to be analyzed $Y_m(0)$ to $Y_m(255)$, the absolute correlation index IDXEa has a greater value close to 1. If expression 7 is satisfied, the result represents that a music passage is highly correlated with another music passage, and the music passages are corresponding to each other. In other words, even if a first music passage is different in edition from another music passage, the source audio data X(0) to X(255), which represents the part of the music passage, and the pieces of the audio data to be analyzed $Y_m(0)$ to $Y_m(255)$, which represents the other music passage, satisfy expression 7 in so far as the first music passage and second music passage are corresponding to each other. However, when a music passage and another music passage form different parts of a piece of music, the source audio data X(0) to X(255) and the audio data to be analyzed $Y_m(0)$ to $Y_m(255)$ do not satisfy expression 7. In short, the constant p is experimentally optimized in order to result the examination through expression 7 in the manner described hereinbefore.

The digital signal processor further determines a relative correlation index IDXEr, and compares the relative correlation index IDXEr with a constant q to see whether or not the relative correlation index IDXEr is equal to or greater than the constant q.

$$\left\{\sum_{i=0}^{255}(x(i)\times Y_m(i))\right\}^2 \Big/ \left\{\sum_{i=0}^{255}(x(i)^2)\times\sum_{i=0}^{255}(Y_m(i)^2)\right\} \geq q \qquad \text{expression 8}$$

The left side of expression 8 is representative of a relative correlation index IDXEr, and has a value ranging between zero and 1. The more analogous the audio waveform represented by the source audio data X(0) to X(255) is to the audio waveform represented by the audio data to be analyzed $Y_m(0)$ to $Y_m(255)$, the relative correlation Index IDXEr becomes closer to 1. Even if the audio waveform represented by the source audio data X(0) to X(255) is similar to the audio waveform represented by the audio data to be analyzed $Y_m(0)$ to $Y_m(255)$, the dynamic range may be different between those audio waveforms. In this situation, the value of the absolute correlation index IDXEa is varied. On the other hand, the difference in dynamic range does not have any influence on the relative correlation index IDXEr. In case where the audio waveforms are similar to one another, the relative correlation Index IDXEr becomes close to 1 regardless of the difference in dynamic range.

Both answers to expressions (7) and (8) are assumed to be changed to affirmative. The digital signal processor 63 proceeds to step S52, and calculates the rate of change as expressions (9) and (10).

$$d\left(\sum_{i=0}^{255}(x(i)\times Y_m(i))\right)/dm = 0 \qquad \text{expression 9}$$

$$d\left(\sum_{i=0}^{255}(x(i)\times Y_m(i))\right)/d^2m = 0 \qquad \text{expression 10}$$

The sum of products between X(0) to X(255) and $Y_m(0)$ to $Y_m(255)$ is hereinafter referred to as "correlation value RE". The left side of expression 9 is the rate of change of the correlation value RE at value (m). When the pieces of source audio data X(0) to X(255) are respectively paired with the pieces of audio data to be analyzed $Y_m(0)$ to $Y_m(255)$, the correlation value RE becomes large under the condition that the values of each pair are closer to each other. Moreover, when the correlation value RE is plotted in terms of m, the rate of change becomes zero at the extreme values on the function of correlation value RE. Thus, the digital signal processor 63 checks the correlation value RE for the extreme values through expression 9.

Subsequently, the digital signal processor 63 differentiates the function f(RE), again, and checks the function to see whether or not the extreme value is a local maximum MX. Thus, the digital signal processor 63 checks the audio data X(0) to X(255) and $Y_m(0)$ to $Y_m(255)$ to see whether or not the correlation value RE is the local maximum on the function at step S52.

In more detail, the pieces of audio data X(0) to X(255) and the pieces of audio data to be analyzed $Y_m(0)$ to $Y_m(255)$ are discrete values in this instance. It is rare that the left side of expression 9 is strictly equal to zero. For this reason, the decision at step S52 is carried out as follows. First, the digital signal processor 63 calculates the difference Dm between the sum product of X(0) to X(255) and $Y_m(0)$ to $Y_m(255)$ and the sum product of X(0) to X(255) and $Y_{m-1}(0)$ to $Y_{m-1}(255)$. Subsequently, the digital signal processor 63 checks the differences $D_m$ and $D_{m-1}$ to see whether or not the difference $D_{m-1}$ is greater than zero and whether or not the difference $D_m$ is equal to or less than zero. If both answers are given affirmative, i.e., $D_{m-1}$ is greater than zero and $D_m$ is equal to or less than zero, the rate of change is varied from a positive value to zero or across zero. Then, the digital signal processor 63 decides that the extreme value is a local maximum or in the vicinity of the local maximum. This results in the positive answer at step S52. On the other hand, If at least one of the answers is given negative, the answer at step S52 is given negative.

With the positive answer at step S52, the digital signal processor 63 notifies the central processing unit 62 of the success, which means that the audio data to be analyzed $Y_m(0)$ to $Y_m(255)$ are highly correlated with the source audio data X(0) to X(255) as by step S53. If the answer at S51 or S52 is given negative, the digital signal processor 63 notifies the central processing unit 62 of the failure, which means that the waveform corresponding to the audio data to be analyzed $Y_m(0)$ to $Y_m(255)$ is not analogous to the waveform corresponding to the source audio data X(0) to X(255) as by step S54.

Figure 43:
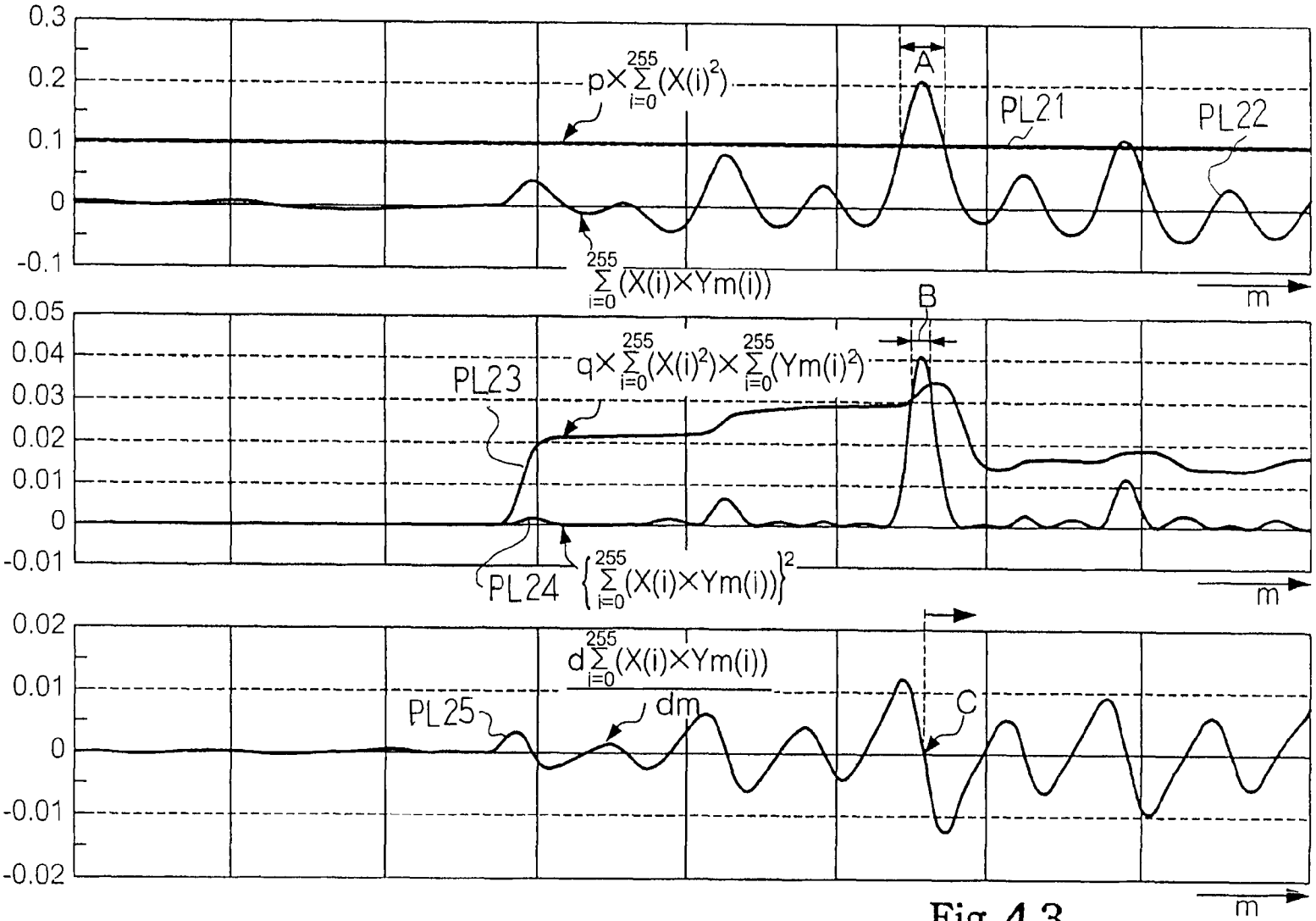
FIG. 43 is a graph showing an absolute correlation index, a relative correlation index and an extreme value thereof.

FIG. 43 shows the values calculated through the expressions used in steps S51 and S52. Plots PL21 are indicative of the product between the constant p and the denominator of the left side of expression 7, plots PL22 are indicative of the numerator of the left side of expression 7. Plots PL23 are indicative of the product between the constant q and the denominator of the left side of expression 8, and plots PL24 are indicative of the numerator of the left side of expression 8. Plots PL25 are indicative of the left side of expression 9. The experiment was carried out under the following conditions. A single stage IIR filter was used as the high-pass filter at 25 Hz (see step S3 of FIG. 35), k and f were 4410 and 1, respectively, in the comb line filter (see step 5). A single stage IIR filter was used as the low pass filter at 25 Hz (see step 6), and constants p and q were 0.5 and 0.8, respectively. Expression 7 was satisfied in so far as m was fallen within range A, and expression 8 was satisfied under the condition that m was fallen within range B, which was within the range A. When m was C, which was in the range B, expression 9 was satisfied, and expression 10 was also satisfied at C. Thus, the answer at step S52 was given affirmative at C.

Turning back to FIG. 41, if the digital signal processor 63 notifies the central processing unit 62 of the failure, the central processing unit 62 decrements "i-j" by one as by step S37, and requests the correlation analysis to the digital signal processor 63, again. On the other hand, when expressions 7, 8, 9 and 10 are satisfied, the digital signal processor 63 notifies the central processing unit 62 of the success, and the answer at step S36 is given affirmative. When the central processing unit 62 requests the digital signal processor 63 to carry out the correlation analysis for the first time, the source audio data is corresponding to the pieces of reference correlation data (7634297), and the audio data to be analyzed is corresponding to the pieces of reference correlation data (6752298). The correlation analysis usually results in the failure, and the central processing unit 62 returns to step S35 through step S37. Thus, the central processing unit 62 cooperates with the digital signal processor 63, and reiterates the loop consisting of steps S35 to S37.

If there is not any audio waveform analogous to the audio waveform represented by the source audio data in the end portion of the audio data NA equivalent to the tone and/silence for 20 seconds, the loop consisting of steps S35, S36 and S36 is repeated 881999 times, and the correlation analysis at step S35 is repeated 882000 times. Although the source audio data, i.e., "i" is unchanged, the audio data to be analyzed, i.e., "j" is changed. When the source audio data is corresponding to the pieces of reference correlation data (7634297), the audio data to be analyzed is changed from the pieces of reference correlation data (6752298), through the pieces of reference correlation data (6752299), the pieces of reference correlation data (6752300), . Upon completion of the $882000^{th}$ correlation analysis, "j" is equal to "i", and the audio data to be analyzed becomes same as the source audio data. This results in the positive answer at step S36.

With the positive answer at step S36, the central processing unit 62 checks "j" to see whether or not the audio data to be analyzed is same as the source audio data as by step S38. If there is not any audio waveform same as that represented by the source audio data in the end portion equivalent to 20 seconds, the answer at step S36 is continuously given negative until the audio data to be analyzed becomes same as the source audio data, and the answer at step S38 is given affirmative. Then, the central processing unit 62 stores the piece of correlation data (i) and its arrival time in the random access memory 64 as by step S39. In the following description, terms "reference ending audio data" and "reference ending time" mean the reference correlation data and its arrival time stored in the random access memory 64, respectively. If the digital signal processor 63 notifies the central processing unit 62 of the succeed at the correlation analysis for the first time, "i" is 7634297, and the arrival time of the pair of sampled value (7634297), i.e., 173.11 seconds is stored in the random access memory 64 as the reference ending time.

If, on the other hand, the digital signal processor 62 finds an audio waveform to be analogous to the audio waveform represented by the source audio data within the audio data to be analyzed equivalent to 20 seconds, expressions 7, 8, 9 and 10 are satisfied in the correlation analysis before the loop consisting of steps S35 to S37 repeated 881999 times, and the digital signal processor 63 notifies the central processing unit 62 of the succeed. Then, the answer at step S36 is changed to affirmative. However, the answer at step S38 is given negative. With the negative answer at step S38, the central processing unit 62 investigates whether or not "i", i.e., the sum of W+65536+881999 or the sum of W+947535 is equal to 7297935 as by step S40. If the source audio data is the $882000^{th}$ reference correlation data counted from the head of the queue, the answer at step S40 is given affirmative. When the central processing unit 62 investigates the source audio data for the first time, "i" is equal to Z, which is equal to 7634297, and the answer at step S40 is given negative. Then, the central processing unit decrements "i" by one, and changes "j" to 881999 as by step S41. The central processing unit 62 returns to step S32. The pieces of reference raw material (i-j) has been shifted to the head of the queue by one, because "i" was decremented by one and "j" was changed to 88199.

The central processing unit 62 is assumed to achieve the job at step S41 for the first time. The central processing unit 62 carries out the correlation analysis on the reference correlation data (6752297) at step S32, because "i" is 7634296. This means that the piece of correlation data (6752297) is newly stored in the random access memory 64 together with the pieces of correlation data (7634297)-(6752298). Since j is 881999, the answer at step S33 is given affirmative. The central processing unit 62 proceeds to step S35, and reiterates the loop consisting of steps S35 to S37. When the digital signal processor 63 notifies the central processing unit 62 of the succeed, the answer at step S36 is given affirmative, and the central processing unit 62 proceeds to step S38. As described hereinbefore, in case where there is not any other waveform analogous to the audio waveform represented by the source audio data having the sampled value (i) at the tail in the end portion of the audio data NA equivalent to 20 seconds, "j" is zero, and the central processing unit 62 proceeds to step S39 for storing the reference ending audio data and reference ending time in the random access memory 64.

If, on the other hand, the answer at step S38 is given negative, the central processing unit 62 proceeds to step S40. Thus, the central processing unit 62 and digital signal processor 63 reiterate the loop consisting of steps S32 to S38, S40 and S41 until the answer at step S38 is changed to affirmative. While the central processing unit 62 and digital signal processor 63 are repeating the loop, the central processing unit 62 decrements "i" by one at step S41. If the sampled values in the queue are representative of a constant audio waveform, the answer at step S38 is never changed to affirmative. As a result, "i" becomes equal to the sum of W and 947535, i.e., 7297935. Then, the answer at step S40 is changed to affirmative. With the positive answer at step S40, the central processing unit 62 requests the manipulating panel/display 5 to produce an error message as by step S42. The error message means that the data processing for the reference ending audio data and reference ending time has resulted in failure.

The central processing unit 62 is assumed to successfully complete the data processing for producing the reference ending audio data and reference ending time. The central processing unit 62 reads out (1) the reference correlation data at the head portion, (2) reference starting time, (3) note events, (4) reference ending audio data and (5) reference ending time from the random access memory 64, and fabricates the track chunk from these data codes. The central processing unit 62 adds the header chunk to the track chunk. When the standard MIDI file is completed, the central processing unit 62 supplies the standard MIDI file to the floppy disc driver 2C, and requests the floppy disc driver 2C to store the standard MIDI file in the floppy disc FD.

Figure 44:
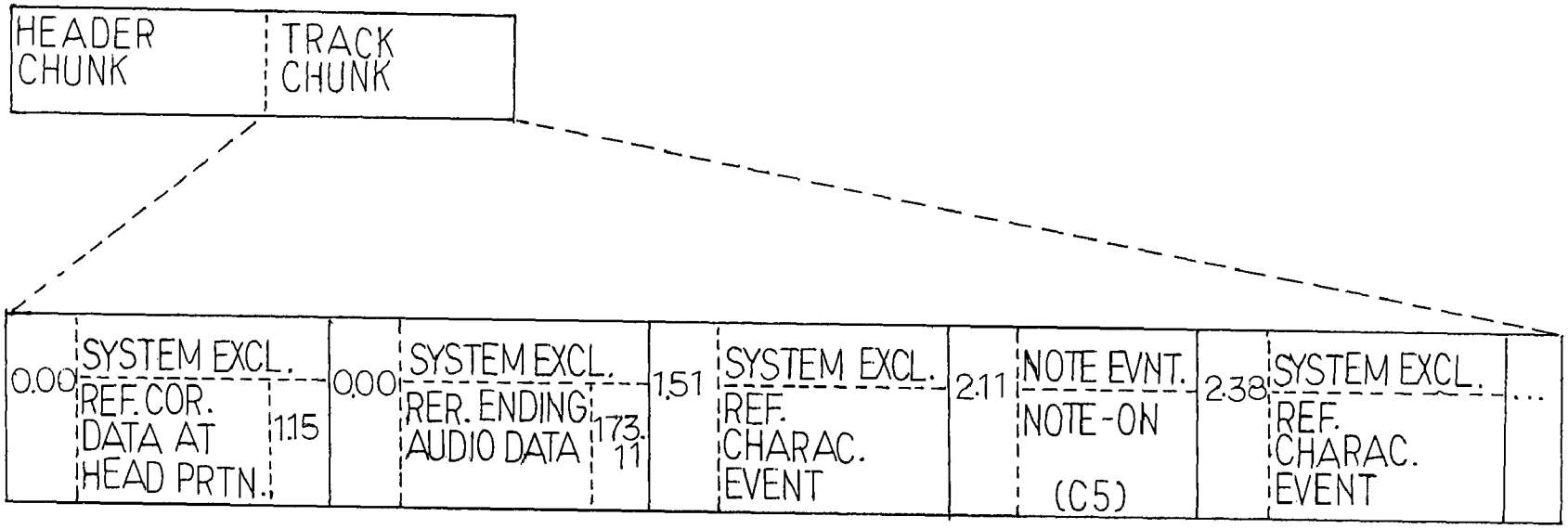
FIG. 44 is a view showing the data structure of a standard MIDI file.

FIG. 44 shows the data structure of the standard MIDI file. The standard MIDI file is broken down into a header chunk and a track chunk. System exclusive event codes and note event codes are respectively associated with the delta time codes, and are stored in the track chunk. The first system exclusive event code is assigned to the pieces of reference correlation data at the head portion and reference starting time indicative of 1.15 seconds. The second exclusive event code is assigned to the reference ending audio data and reference ending time indicative of 173.11 seconds. Although the delta time codes are indicative of 0.00 second for the first and second system exclusive event codes, those system exclusive event codes may be moved to another place or places in the track chunk, and the delta time codes are indicative of other lapses of time. The third to last system exclusive event codes are mixed with the note event codes, and these system exclusive event codes and note event codes are respectively accompanied with the delta time codes. In this instance, the third system exclusive event code and fourth system exclusive event codes are representative of the reference characteristic events, and these reference characteristic events take place at 1.51 seconds and 2.38 seconds, respectively. The first note event takes place at 2.11 seconds, and the acoustic piano tone is to be generated at C5.

Figure 45:
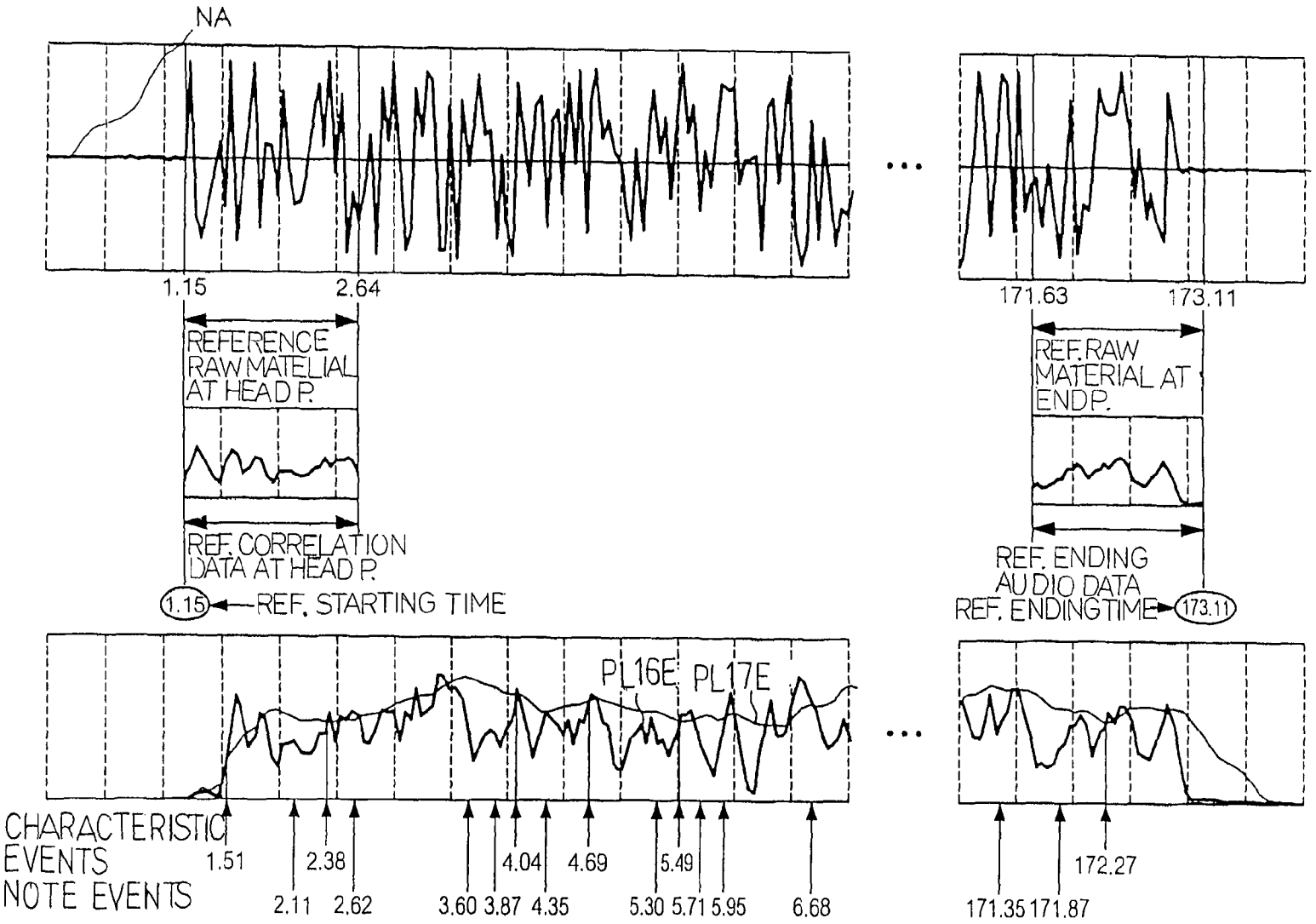
FIG. 45 is a view showing a relation between an audio waveform represented by audio data and characteristic/note events.

FIG. 45 shows a relation between an audio waveform represented by the audio data NA and the system exclusive/note events stored in the standard MIDI file. Plots NA designate the audio waveform represented by the audio data recorded in the compact disc CD-A, and the time goes rightward. The audio waveform expresses the silence until 1.15 seconds, and the electric tones are produced after the silence. In this instance, the reference starting time is 1.15 seconds.

The pairs of audio music data codes from 1.1.5 seconds to 2.64 seconds serve as the reference raw material, and the reference correlation data at the head portion are produced from the reference raw material at the head portion. The characteristic events are extracted from the reference raw material at the head portion. Plots PL16E and plots PL17E are indicative of the medium-range index and long-range index, respectively.

The pairs of audio music data codes from 171.63 seconds to 173.11 seconds serve as the reference raw material at the end portion, and the reference ending audio data is produced from the reference raw material at the end portion. In this instance, one of the pairs of sampled values becomes lower than the threshold at 173.11 seconds so that the lapse of time 173.11 seconds is stored in the standard MIDI file as the reference ending time.

Synchronous Playback

Description is hereinafter made on the synchronous playback mode. The compact disc CD-B is used in the synchronous playback. Although the piece of music was also recorded in the compact disc CD-B, the piece of music in the compact disc CD-B was edited differently from the piece of music recorded in the compact disc CD-A. This means that the silent time, dynamic range and time intervals between the tones are different between the piece of music recorded in the compact disc CD-A and the same piece of music recorded in the compact disc CD-B. For this reason, the audio data stored in the compact disc CD-B is hereinafter referred to as "audio data NB".

The user loads the compact disc CD-B into the compact disc driver 1E, and the floppy disc FD, in which the standard MIDI file was stored, into the floppy disc driver 2E. Subsequently, the user instructs the controller 6E to reproduce the performance on the keyboard 31*e* in good ensemble with the playback of the piece of music recorded in the compact disc CD-B.

When the central processing unit 62 acknowledges the user's instruction, the central processing unit 62 requests the floppy disc driver 2E to transfer the system exclusive event codes, delta time codes thereof, note event codes and delta time codes thereof from the floppy disc FD to the interface 65*a*. While the floppy disc driver 65*a* is transferring the data codes to the interface 65*a*, the central processing unit 62 transfers the system exclusive event codes, their delta time codes, note event codes and their delta time codes to the random access memory 64 for storing them therein.

First, the central processing unit 62 cooperates with the digital signal processor 63 for rescheduling the note events. The silence before the performance and silence after the performance are different in length between the audio data NA and the audio data NB. Moreover, the tempo is different between the performance recorded in the compact disc CD-A and the performance recorded in the compact disc CD-B. Nevertheless, the controller 6E eliminates the differences from between the lapse of time represented by the delta time codes in the standard MIDI file and the lapse of time represented by the audio time codes transferred from the compact disc driver 1E, and reschedules the note events to be reproduced in the synchronous playback.

Figure 46:
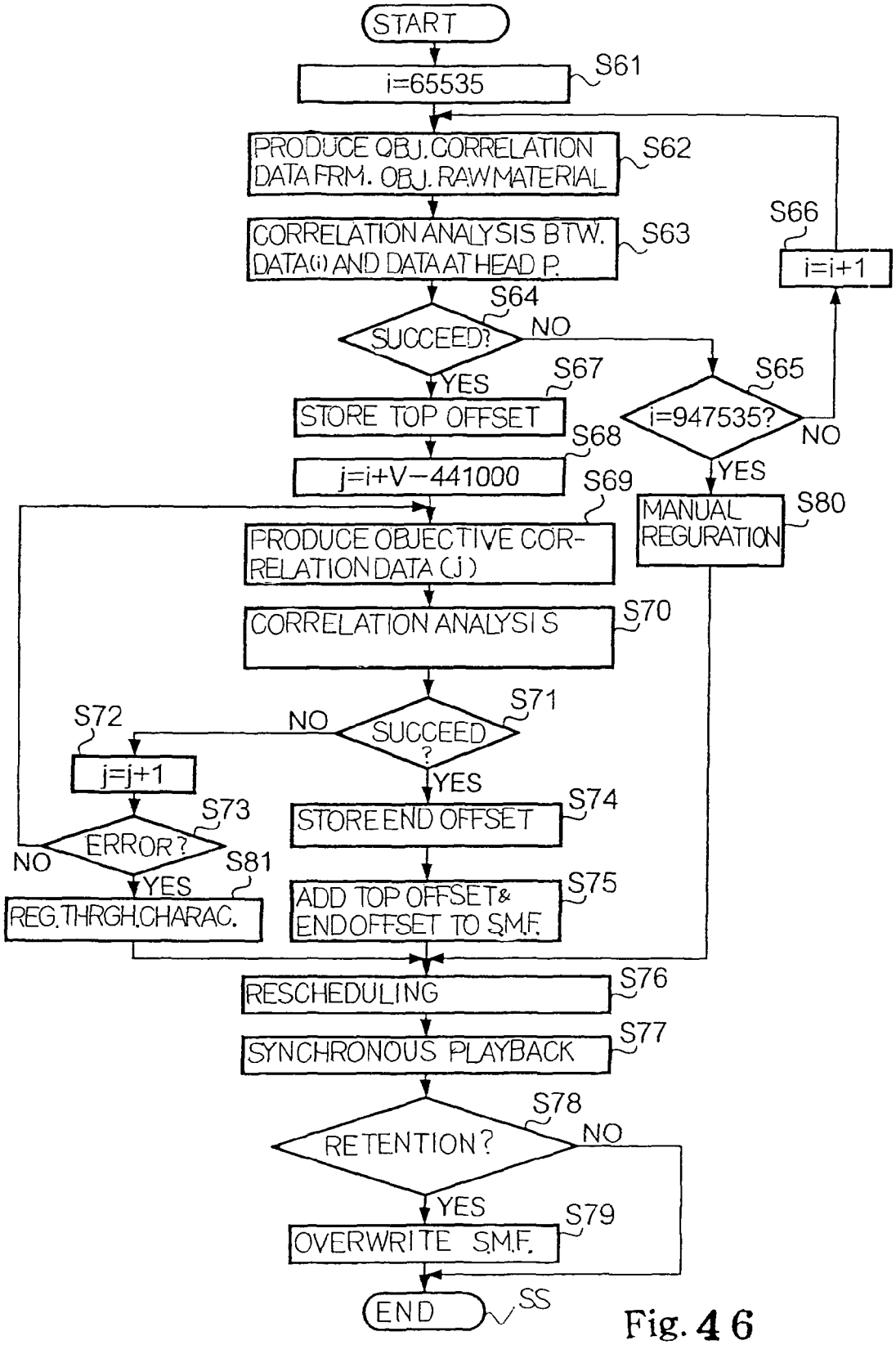
FIG. 46 is a flowchart showing a method for rescheduling note events in the synchronous playback.

FIG. 46 shows a method for rescheduling the note events. First, the central processing unit 62 defines a counter "i", and adjusts the counter "i" to 65535 as by step S61. Subsequently, the central processing unit 62 requests the compact disc driver 1E to transfer the audio data NB from the compact disc CD-B to the interface 65*a*. The compact disc driver 1E transfers the pairs of audio music data codes at time intervals of 1/44100 second to the interface 65*a*, and the central processing unit 62 stores the pairs of sampled values and arrival time of each pair of audio music data codes in the random access memory 64. When the first pair of audio music data codes arrives at the interface 65*a*, the central processing unit 62 starts to count the clock pulses of the clock signal. The number of clock pulses is indicative of a lapse of time from the arrival of the first pair of audio music data codes, i.e., initiation time Q. The first pair of audio music data codes expresses the first pair of sampled values (0), and the next pair of audio music data codes expresses the pair of sampled values (1). Thus, the pairs of sampled values (0), (1), (2), . . . intermittently arrive at the interface 65*a*, and joins a queue together with their arrival times. The queue is formed in the random access memory 64. The arrival time is equal to the lapse of time from the initiation time Q. The arrival time of a pair of sampled values (n) is expressed as "arrival time (n)". In this instance, 1323000 pairs of sampled values and their arrival times join the queue at the maximum.

A pair of sampled values (i) is assumed to join the queue together with the arrival time (i). Then, the central processing unit 62 requests the digital signal processor 63 to produce pieces of objective correlation data from the 65536 pairs of sampled values, which are hereinafter referred to as "objective raw material". The pair of sampled values (i) occupies the tail of the objective raw material. The digital signal processor 63 carries out the data processing for producing the pieces of correlation data from the raw material as by step S62. The data processing for producing the objective correlation data is similar to that shown in FIG. 35, and description is omitted for avoiding repetition. Upon completion of the data processing, the pieces of objective correlation data (i) are stored in the random access memory 64.

Subsequently, the central processing unit 62 requests the digital signal processor 63 to carry out the correlation analysis between the reference correlation data at the head portion and the objective correlation data (i). The digital signal processor 63 reads out the reference correlation data at the head portion already stored in the standard MIDI file transferred to the random access memory 64 and the objective correlation data stored in the random access memory at step S62, and investigates whether or not the objective correlation data (i) is highly correlated with the reference correlation data at the head portion as by step S63. The data processing for the correlation analysis is similar to the data processing shown in FIG. 42, and no further description is hereinafter incorporated for the sake of simplicity.

When the data processing for the correlation analysis is completed, the digital signal processor 63 notifies the central processing unit 62 of the result of the data processing, i.e., succeed or failure. Then, the central processing unit 62 checks the notification to see whether or not the data processing is successfully completed as by step S64. If the objective correlation data (i) is highly correlated with the reference correlation data at the head portion, the answer is given affirmative. However, it is rare to initiate the performance without silence. The answer at step S64 is usually given negative upon completion of the data processing for the first time.

With the negative answer at step S64, the central processing unit 62 checks the counter (i) to see whether or not "i" is 947535, i.e., 65535+882000 as by step S65. If the digital signal processor 63 fails to find all the objective correlation data equivalent to 20 seconds from the initiation to be less correlated with the reference correlation data at the head, the answer at step S65 is given affirmative, and the central processing unit 62 gives up the correlation analysis. Thus, the data processing at step S65 prevents the digital signal processor 63 from the correlation analysis endlessly.

When the digital signal processor 63 completes the correlation analysis for the first time, the counter (i) is indicative of 65535, and, accordingly, the answer at step S65 is given negative. Then, the central processing unit 62 increments the counter (i) by 1 as by step S66, and returns to step S62. Thus, the central processing unit 62 cooperates with the digital signal processor 63, and reiterates the loop consisting of steps S62 to S66 until the digital signal processor 63 finds the objective correlation data (i) to be highly correlated with the reference correlation data at the head portion.

The digital signal processor 63 is assumed to notify the central processing unit 62 that the objective correlation data, which has been produced from the objective raw material having the pair of sampled values (28740) occupying at the head thereof, is highly correlated with the reference correlation data. Although the central processing unit 62 and digital signal processor 63 fails to find the objective correlation data highly correlated with the reference correlation data 28740 times, the digital signal processor 63 notifies the central processing unit 62 of the successful result upon completion of the $28741^{st}$ data processing. The reference correlation data and objective correlation data were produced from the reference raw material at the head portion and objective raw material representative of a part of the piece of music through the same data processing. This means that the music passage represented by the set of pieces of objective raw material (97275) is corresponding to the music passage represented by the pieces of reference correlation data at the head portion.

With the positive answer at step S64, the central processing unit 62 divides the difference (i−65535) by 44100, and determines an objective starting time corresponding to the reference starting time. The pair of sampled values, which exceeds the threshold, occupies the place at the objective starting time. The answer at step S64 is assumed to be changed at "i"=94275. The calculation on (94275−65535)/44100 results in 0.65. This means that the pair of sampled values exceeds the threshold at 0.65 second from the initiation of the playback. Subsequently, the central processing unit 62 reads out the reference starting time from the random access memory 64, and calculates the difference between the objective starting time and the reference starting time. The time difference is hereinafter referred to as "top offset". The top offset takes a negative value if the initiation of the piece of music NB is earlier than the initiation of the piece of music NA. On the other hand, when the initiation of the piece of music NB is delayed from the initiation of the piece of music NA, the top offset takes a positive value. The objective starting time and reference starting time are assumed to be 0.65 second and 1.15 seconds, respectively. The top offset is calculated through the subtraction of the reference starting time from the objective starting time, i.e., (0.65−1.15), and is −0.50 second. The central processing unit 62 stores the top offset in the random access memory 64 as by step S67.

Subsequently, the central processing unit 62 reads out the reference starting time and the reference ending time from the random access memory 64, and subtracts the reference ending time from the reference starting time. The central processing unit 62 multiplies the difference between the reference starting time and the reference ending time by 441000 so as to determine the number of pairs of audio music data codes between the reference starting time and the reference ending time. The number of the pairs of audio music data codes between the reference starting time and the reference ending time is equal to the number of the pairs of audio music data codes between the first piece of reference correlation data at the head portion and the last piece of reference ending audio data. Subsequently, the central processing unit 62 subtracts 65536 from the number of the pairs of audio music data codes. The difference "V" is equal to the number of the pairs of audio music data codes between the last piece of reference correlation data and the last piece of ending audio data.

For example, the reference starting time and reference ending time are assumed to be 1.15 seconds and 173.11 seconds. The time period between the reference starting time and the reference ending time is given as (173.11−1.15), i.e., 171.96 seconds. Then, the number of the pairs of audio music data codes is given as 171.96×44100, which results in 7583436. The difference "V" is given as 7583436−65536=7517900.

Subsequently, the central processing unit 62 defines a counter "j", and adjusts the counter "j" to (i+V−441000) as by step S68. The pieces of objective raw material (i) at the head portion recorded in the compact disc CD-B are corresponding to a passage of the piece of music N for 1.49 seconds. The audio data representative of the last part of the piece of music N for 1.49 seconds is presumed to be around the objective raw material (i+V). The pieces of objective raw material (j), i.e., (i+V−441000) are to be found 10 seconds before the objective raw material (i+V).

Subsequently, the central processing unit 62 requests the compact disc driver 1E to transfer the pairs of audio music data codes (j−65535), (j−65534), . . . From the compact disc CD-B to the interface 65*a*. While the compact disc driver 1E is transferring the pairs of audio music data codes (j−65535), (j−65534), . . . to the interface 65*a*, the central processing unit 62 determines the arrival time for each pair of audio music data codes, and stores the pairs of sampled values in the random access memory 64 together with the arrival times. The pairs of sampled values and arrival times join a queue in the random access memory 64.

When the pair of sampled values (j) joins the queue, the central processing unit 62 requests the digital signal processor 63 to produce the objective correlation data from the objective raw material (j). Then, the digital signal processor 63 starts to produce the objective correlation data from the objective raw material (j) as by step S69. The data processing for producing the objective correlation data is similar to that shown in FIG. 35. Upon completion of the data processing, the objective correlation data (j) is stored in the random access memory 64.

Subsequently, the central processing unit 62 requests the digital signal processor 63 to carry out the correlation analysis between the reference ending audio data, which was stored in the standard MIDI file, and the objective correlation data (j) stored in the random access memory at step S69. The digital signal processor 63 reads out the reference ending audio data and the objective correlation data (j) from the random access memory 64, and carries out the correlation analysis for the objective correlation data (j) highly correlated with the reference ending audio data as by step S70. The data processing for the correlation analysis is similar to that shown in FIG. 42. When the digital signal processor 63 completes the data processing for the correlation analysis, the digital signal processor 63 notifies the central processing unit 62 of the result of the correlation analysis.

The digital signal processor 63 checks the notification to see whether or not the correlation analysis results in the succeed as by step S71. It is rare that the time for reproducing the piece of music NB is different from the time for reproducing the piece of music NA by 10 seconds. For this reason, when the digital signal processor 63 completes the data processing for the first time, the answer at step S71 is given negative "No". Then, the central processing unit 62 increments the counter (j) by 1 as by step S72, and requests the digital signal processor 63 to produce the next objective correlation data from the new objective raw material. If the counter (j) is greater than the total number of the pairs of sampled values of the audio data NB, i.e., the objective raw material has already reached the end of the audio data NB, the digital signal processor 63 fails to read out the objective raw material (j) from the queue, and notifies the central processing unit 62 of the failure. For this reason, the central processing unit 62 checks the register to see whether or not the digital signal processor 63 has sent the error message as by step S73. When the central processing unit 62 increments the counter (j) for the first time, the objective raw material (j) does not reach the end of the audio data NB, and the answer at step S73 is given negative.

With the negative answer at step S73, the central processing unit 62 returns to step S69, and requests the digital signal processor 63 to produce the next objective correlation data (j) from the objective raw material. Thus, the central processing unit 62 and digital signal processor 63 reiterates the loop consisting of steps S69 to S73, and searches the audio data NB for the objective correlation data (j) highly correlated with the reference ending audio data.

When the digital signal processor 63 finds the objective correlation data to be highly correlated with the reference ending audio data, the digital signal processor 63 notifies the central processing unit 62 of the succeed, and the answer at step S69 is changed to affirmative "Yes". Then, the central processing unit 62 requests the compact disc driver 1E to stop the data transfer from the compact disc CD-B to the interface 65*a*.

Subsequently, the central processing unit 62 divides the number "j" by 44100, and determines the objective ending time, at which the playback of the piece of music NB is to be completed. If the counter (j) is indicative of 7651790, the objective ending time is 7651790/44100, i.e., 173.51 seconds. Subsequently, the central processing unit 62 reads out the reference ending time from the random access memory 64, and determines an end offset, i.e., the difference between the objective ending time and the reference ending time. In this instance, the end offset is 0.40 second, i.e., 173.51−173.11. The central processing unit 62 stores the end offset in the random access memory 64 as by step S74. Furthermore, the central processing unit 62 adds the top offset and end offset to the standard MIDI file already transferred to the random access memory 64 as by step S75.

Figure 47:
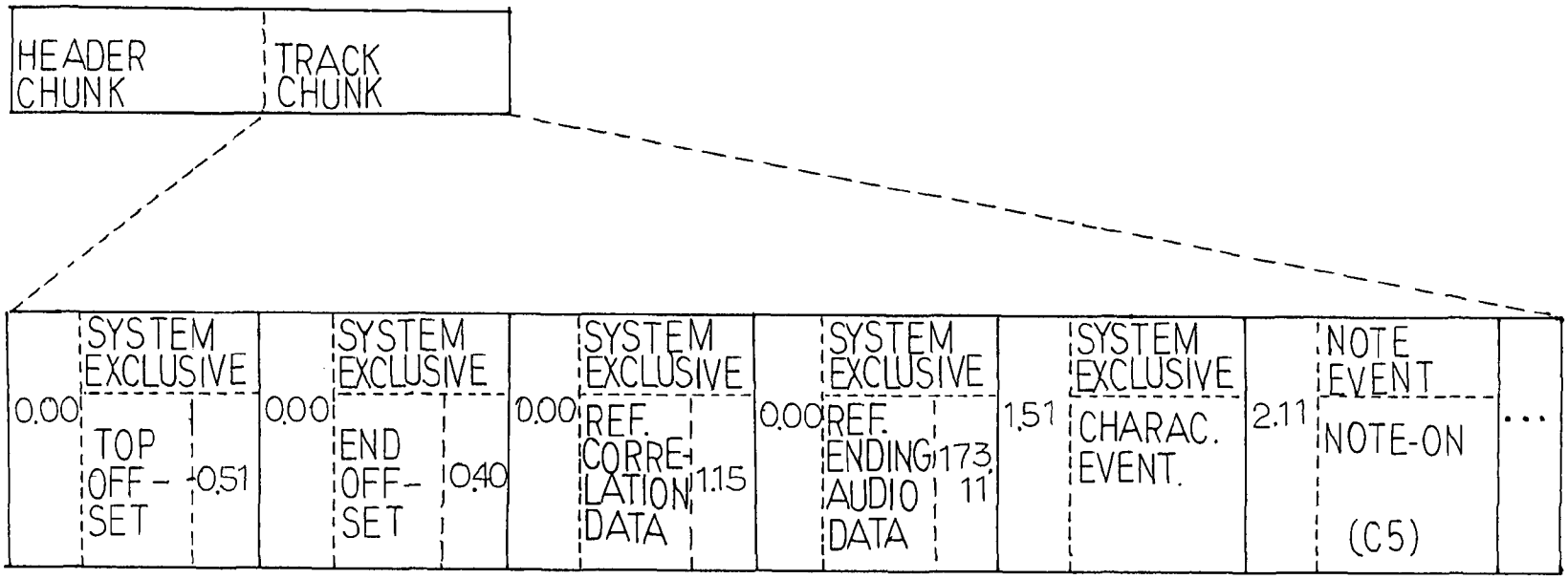
FIG. 47 is a view showing the data structure of a standard MIDI file created after the correlation analysis for a top offset time and an end offset time.

FIG. 47 shows the top offset and end offset added to the standard MIDI file. The top offset and end offset are stored in the system exclusive event codes. The first, second, third and fourth system exclusive event codes are respectively assigned to the top offset, end offset, reference correlation data at the head portion and reference ending audio data, and the system exclusive event codes, which are assigned to the reference characteristic events, are mixed with the note event codes. All the system exclusive/note event codes are associated with the delta time codes. In this instance, the first to fourth system exclusive event codes are associated with the delta time codes indicative of zero. However, other delta time codes may be added to these system exclusive event codes.

Upon completion of the addition of the system exclusive event codes representative of the top offset and end offset to the standard MIDI file, the central processing unit 62 reads out all the note event codes from the standard MIDI file stored in the random access memory 64, and reschedules the note events as by step S76. The rescheduling is carried out through the following expression.

$$d=(N_T+O_T)+(D-N_T)\times\{(N_E+O_E)-(N_T+O_T)\}/(N_E-N_T) \quad \text{Expression 11}$$

where d is the delta time after the rescheduling, D is the delta time before the rescheduling, $N_T$ is the reference starting time, $N_E$ is the reference ending time, $O_T$ is the top offset and $O_E$ is the end offset.

In expression 11, $(N_T+O_T)$ is indicative of the timing to start the playback on the audio data NB with respect to the timing to reproduce the first pair of sampled values, and $(D-N_T)$ is indicative of the timing to reproduce a note event with respect to the initiation of the playback on the audio data NA representative of the piece of music N. $\{(N_E+O_E)-(N_T+O_T)\}$ is indicative of the time to be consumed for reproducing the piece of music N represented by the audio data NB, and $(N_E-N_T)$ is indicative of the time to be consumed for reproducing the piece of music N represented by the audio data NA. The second term $(D-N_T)\times\{(N_E+O_E)-(N_T+O_T)\}/(N_E-N_T)$ is indicative of the timing to reproduce a corresponding note event with respect to the initiation of the playback on the audio data NB. Therefore, d is indicative of the timing to reproduce the corresponding note event with respect to the timing to reproduce the first pair of sampled values of the audio data NB.

The first note event is representative of the note-on at C5 (see FIG. 47). The note-on at C5 is rescheduled through the calculation of expression 11. D is 2.11, $N_T$ is 1.15, $N_E$ is 173.11, $O_T$ is −0.50, and $O_E$ is 0.40. The note-on is rescheduled at 1.62 seconds through the calculation of expression 11. All the event codes are rescheduled, and regulated delta time codes, which are indicative of the timing to produce the note events in the synchronous playback, are stored in the random access memory 64.

Upon completion of the rescheduling, the central processing unit 62 start the synchronous playback, i.e., synchronously reproducing the performance expressed by the note events and the piece of music represented by the audio data NB as by step S77. In detail, the central processing unit 62 requests the compact disc driver 1E to transfer the pairs of audio music data codes from the compact disc CD-B to the interface 65*a*. The compact disc driver 1E starts to transfer the pairs of audio music data codes from the compact disc CD-B to the interface 65*a* at regular intervals of $1/44100$ second. When the first pair of audio music data code (0) reaches the interface 65*a*, the central processing unit 62 determines the arrival time on the basis of the clock signal, and the arrival time of the first pair of audio music data codes as the reference time R. The central processing unit 62 starts to measure the lapse of time from the reference time R.

The central processing unit 62 intermittently receives the pair of audio music data codes (0), (1), (2), . . . , and transfers them to the audio unit 4E. The pairs of audio music data codes are converted to the electric tones through the laud speakers 44. Thus, the user hears the piece of music NB through the audio unit 4E.

The central processing unit 62 sequentially reads out the regulated delta time codes from the random access memory 64, and compares the lapse of time with the time expressed by each regulated delta time code to see whether or not the associated note event code is to be supplied to the automatic player piano 3E. When the lapse of time becomes equal to the time expressed by the regulated delta time code, the central processing unit 62 supplies the note event code to the controller 34.

When the controller 34 receives the note event code, the controller 34 checks an internal flag for the user's option, i.e., acoustic piano 31A or the audio unit 4E. If the user's option is the audio unit 4E, the controller 34 supplies the note event code to the tone generator 35. The tone generator produces the digital audio signal on the basis of the note event code, and supplies the digital audio signal to the mixer 41. Thus, the synchronous playback is achieved through only the audio unit 4E. On the other hand, if the user's option is the acoustic piano 3E, the controller 34 determines a trajectory along which the black/white key is moved. The controller 34 notifies the driver 36*a* of the trajectory, and driver 36*a* produces the driving signal on the basis of the notification. The driver 36*a* supplies the driving signal to the solenoid-operated key actuator 36*b* so that the solenoid-operated key actuator 36*b* gives rise to the rotation of the black/white key. The black/white key actuates the action unit 31*b*, which in turn drives the hammer 31*c* for rotation. The hammer strikes the string 31*d* at the end of the rotation, and the acoustic piano tone is radiated from the vibrating string 31*d*. Since the note events have been already regulated to appropriate timing for the synchronous playback, the user feels the acoustic piano tones and electric tones to be in good ensemble with each other.

When the central processing unit 62 supplies the last pair of audio music data codes and the last note event to the audio unit 4E and automatic player piano 3E, respectively, the central processing unit 62 requests the manipulating panel/display to produce a prompt message such as, for example, "Do you want to store the top offset and end offset ?" The prompt message is produced on the display, and the central processing unit 62 waits for the user's instruction as by step S78.

If the user gives the negative answer "No", the central processing unit 62 terminates the data processing for the synchronous playback at step SS. When the user instructs the controller 6E to store the top offset and end offset in the floppy disc FD, the central processing unit 62 supplies the standard MIDI file from the random access memory 64 to the floppy disc driver 2E, and requests the floppy disc driver 2E to overwrite the standard MIDI file. The floppy disc driver 2E overwrites the new standard MIDI file as by step S79, and the new standard MIDI file is stored in the floppy disc FD. Upon completion of the retention, the central processing unit 62 terminates the data processing for the synchronous playback at step SS. The standard MIDI file overwritten by the floppy disc driver 2E is hereinafter referred to as "Standard MIDI File B".

The central processing unit 62 successfully completes the data processing for the synchronous playback in so far as the audio data NB is not widely different from the audio data NA. However, if the difference between the audio data NB and the audio data NA is serious, the central processing unit 62 fails to find the objective correlation data at steps S63 and/or S70. In this situation, the central processing unit 62 reschedules the note events as follows.

First, the central processing unit 62 is assumed not to find any objective correlation data (i) highly correlated with the reference correlation data at the head portion. In this situation, the central processing unit 62 repeats the negative answer at step S64, and, the counter (i) finally reaches 947535. Then, the answer at step S65 is given affirmative "Yes", and the user starts to manually regulate the delta time codes as by step S80.

Figure 48:
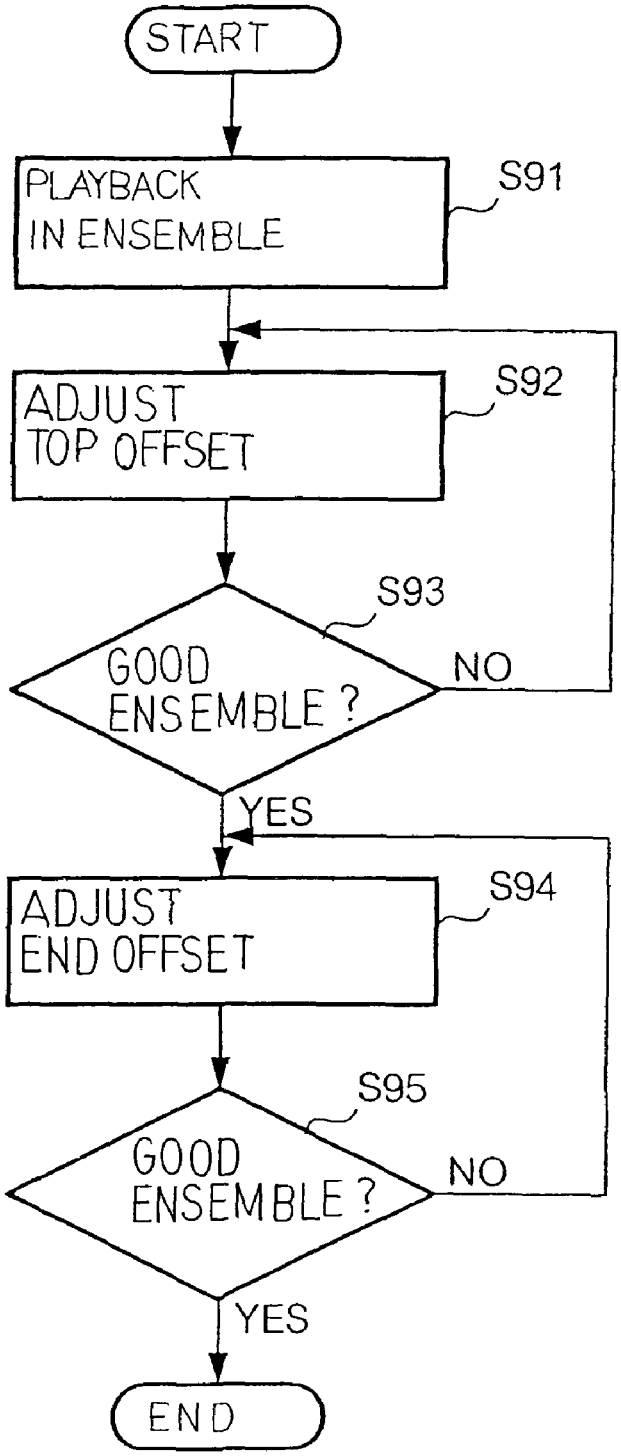
FIG. 48 is a flowchart showing a method for manually rescheduling timing to produce event codes.

The manual regulation proceeds as shown in FIG. 48. Firstly, the central processing unit 62 defines counters $O_T$ and $O_E$, and adjusts the counters $O_T$ and $O_E$ to zero. The counter $O_T$ is assigned to the top offset, and the counter $O_E$ is assigned to the end offset. Subsequently, the central processing unit 62 requests the compact disc driver 1E to stop the data transfer and restart the data transfer at the head of the audio data NB. When the first pair of audio music data codes reaches the interface 65*a*, the central processing unit 62 starts to measure the lapse of time. While the compact disc driver 1E is transferring the pairs of audio music data codes to the interface 65*a* at the regular intervals of $1/44100$ second, the central processing unit 62 supplies the pairs of sampled values to the audio unit 4E. The pairs of sampled values are converted to the electric tones through the laud speakers 44. When the central processing unit 62 starts to measure the lapse of time, the central processing unit 62 reads out the first delta time code from the standard MIDI file already stored in the random access memory 64, and compares the time expressed by the first delta time code with the internal clock to see whether or not the internal clock catches up the delta time code. When the answer is given affirmative, the central processing unit 62 supplies the associated note event to the automatic player piano 3E. The acoustic piano tone or electric tone is reproduced through the acoustic piano 31A or audio unit 4E. Thus, the synchronous player system reproduces the piece of music N in ensemble as by step S91.

While the central processing unit 62 is transferring the pairs of sampled values and note event codes to the audio unit 4E and automatic player piano 3E, respectively, the central processing unit 62 requests the manipulating panel/display 5E to produce a prompt message prompting the user to adjust the top offset. When the user feels the acoustic piano tones to be earlier than the electric tones, the user pushes a key pad "−" for delay. On the other hand, if the user feels the acoustic piano tones to be delayed from the electric tones, the user pushes a key pad "+" for advance. The manipulation on the manipulating panel/display 5E is reported to the controller 6E. When the manipulating panel/display 5E reports the manipulation on the key pad "−", the central processing unit increases the counter $O_T$ by $1/75$ second. On the other hand, when the user pushes the key pad "+", the central processing unit 62 decreases the counter $O_T$ by $1/75$ second. The increment and decrement, i.e., $1/75$ second is equivalent to the time period for a single frame of the audio data. Thus, the user manually adjusts the top offset by hearing the piece of music.

When the user manually makes the performance through the automatic player piano 3E in good ensemble with the playback of the piece of music NB, the central processing unit 62 reschedules the timing to reproduce the note events by using the expression 11. Upon completion of the regulation of the delta time codes, the central processing unit 62 stores the regulated delta time codes in the random access memory 64. Upon completion of the regulation of the delta time codes, the central processing unit 62 compares the internal clock with the regulated delta time code to see whether or not the note event code is to be supplied to the automatic player piano 3E. As a result, the progression of the piece of music reproduced through the automatic player piano 3E is either advanced or delayed, and the user checks the synchronous playback to see whether or not the performance through the automatic player piano 3E is in good ensemble with the playback of the piece of music NB, again, as by step S93.

If the performance is still advanced or delayed, the central processing unit 62 returns to step S92, and prompts the user to change the top offset, again. Thus, the user repeatedly adjusts the top offset until the answer at step S93 is changed to affirmative. When the user feels the playback to be in good ensemble, the user pushes a key pad "ENTER", the central processing unit 62 proceeds to step S94.

With the positive answer at step S93, the central processing unit 62 prompts the user to adjust the end offset through the message produced on the display as by step S94. If the user feels the performance through the automatic player piano 3E to be getting earlier and earlier than the playback through the audio unit 4E, the user pushes the key pad "−". On the other hand, when the user feels the performance through the automatic player piano 3E to be getting latter and latter than the playback through the audio unit 4E, the user pushes the key pad "+". When the user pushes the key pad "−", the central processing unit 62 increments the counter $O_E$ by 1/75 second. On the other hand, if the user pushes the key pad "+", the central processing unit 62 decreases the counter $O_E$ by 1/75 second. Thus, the user manually adjusts the end offset as by step S94.

When the counter $O_E$ is regulated, the central processing unit 62 reschedules the timing to reproduce the note events by using the expression 11, and stores the regulated delta time codes in the random access memory 64. After the rescheduling, the central processing unit 62 compares the internal clock with the regulated delta time code to see whether or not the associated note event code is supplied to the automatic player piano 3E. Thus, the timing to produce the note events is rescheduled, and the progression of the piece of music is controlled with the regulated delta time codes. When the user feels the performance through the automatic player piano 3E to be in good ensemble with the playback through the audio unit 4E, the user pushes the key pad "ENTER", and the central processing unit 62 finds the answer at step S95 to be affirmative. On the other hand, if the user feels the automatic player piano 3E to be out of the synchronization with the audio unit 4E, the central processing unit 62 returns to step S94, and repeats the data processing at step S94 until the user pushes the key pad "ENTER". With the positive answer at step S95, the central processing unit 62 completes the manual regulation at step S80, and proceeds to step S76.

The central processing unit 62 rescheduling the timing to reproduce the note events at step S76 by using the top offset and end offset manually adjusted at step S80, and starts the synchronous playback at step S77. Thus, even if the difference between the audio data NA and audio data NB is serious, the synchronous playback system implementing the third embodiment achieves good ensemble between the automatic player piano 3E and the audio unit 4E.

The correlation analysis at step S70 is assumed to result in the failure. This means that the central processing unit can not find the objective correlation data highly correlated with the reference ending audio data in the series of objective correlation data at the end portion equivalent to 10 seconds measured from the last pair of audio music data code. Then, the answer at step S73 is given affirmative.

With the positive answer at step S73, the central processing unit 62 starts to reschedule the timing to produce the note events by using the reference characteristic event codes as by step S81.

First, the central processing unit 62 requests the compact disc driver 1E to transfer the audio data NB from the compact disc CD-B to the interface 65*a*. The compact disc driver 1E reads out the pairs of audio music data codes (0), (1), . . . from the compact disc CD-B, and transfers them to the interface 65*a* at the regular intervals of 1/44100 second. When the first pair of audio music data codes (0) reaches the interface 65*a*, the central processing unit 62 starts the internal clock, and measures the lapse of time. While the compact disc driver 1E is transferring the pairs of audio music data codes to the interface 65*a*, the central processing unit 62 determines the arrival time for each pair of audio music data codes, and makes the pairs of sampled values and their arrival times join a queue in the random access memory 64. Moreover, the central processing unit 62 checks the pairs of audio music data codes to see whether or not at least one of the pairs of sampled values exceeds the threshold. In this instance, the threshold is adjusted to 1000.

When the central processing unit 62 finds at least one of the pair of sampled values to be greater than the threshold, the central processing unit 62 requests the digital signal processor 63 to find the characteristic events in the pairs of sampled values. The data processing for the characteristic events is similar to that shown in FIG. 37, and is not described for avoiding the repetition. When the digital signal processor 63 finds each characteristic event, the digital signal processor 63 notifies the central processing unit 62 of the characteristic event. Then, the central processing unit 62 determines the arrival time for each notification, and stores the characteristic event code and its arrival time code in the random access memory 64. The characteristic events already stored in the standard MIDI file and the characteristic events found through the data processing are respectively referred to as "characteristic event A" and "characteristic event B".

Upon completion of the data processing on the last pair of sampled values read out from the compact disc CD-B, the central processing unit 62 compares the delta time codes associated with the characteristic event codes A with the arrival time codes for the characteristic event codes B, and makes the characteristic events A paired with the characteristic events B as shown in FIG. 49.

The reference starting time occupies the head of the left column, and the characteristic events A follow the reference starting time in the left column. The first characteristic event A, second characteristic event A, . . . are hereinafter labeled with "A1", "A2" . . . On the other hand, the total time of the objective starting time and the top offset occupies the head of the right column, and the characteristic events B follow the total time in the right column. The first row of the left column is corresponding to the first row of the right column, and the pieces of time data information indicated by the first rows of the left and right columns are hereinafter referred to as "time data information A" and "time data information B".

The central processing unit 62 firstly calculates (characteristic event A1−time data information A)/(characteristic event B1−time data information B), and the calculation results in (1.51−1.15)/(1.01−0.65)=1.00.

Subsequently, the central processing unit 62 checks the quotient to see whether or not the quotient is fallen within a predetermined range. In this instance, the predetermined range is assumed to be from 0.97 to 1.03, i.e., ±3%. If the quotient is fallen within the predetermined range, the central processing unit 62 presumes that the characteristic event A is corresponding to the characteristic event B. The predetermined range of ±3% is changeable.

The quotient means that the difference in time between the characteristic events A1 and B1 is at zero. Then, the central processing unit 62 decides that the characteristic event A1 is corresponding to the characteristic event B1. If the quotient is less than 0.97, the characteristic event A1 is too early for the characteristic event B1, and the central processing unit 62 decides that any characteristic event B does not correspond to the characteristic event A1. Then, the central processing unit 62 checks the characteristic event A2 and characteristic event B1 to see whether or not the error is fallen within the predetermined range. On the other hand, if the quotient is greater than 1.03, the characteristic event A1 is too late for the characteristic event B1, and the central processing unit 62 decides that any characteristic event A does not correspond to the characteristic event B1. Then, the central processing unit 62 checks the characteristic event A1 and characteristic event B2 to see whether or not the difference in time is fallen within the predetermined range.

The central processing unit 62 sequentially checks the characteristic events A and B to see whether or not the difference in time is fallen within the predetermined range. The last characteristic events A and B, which are corresponding to each other, are hereinafter referred to as "characteristic events An and Bn".

Subsequently, the central processing unit 62 presumes arrival times of the characteristic events B, at which the characteristic event codes B were expected to arrive at the interface 65*a*, on the basis of the lapse of time expressed by the associated delta time code by using {(time data information B+(characteristic event An+1−time data information A)× (characteristic event B−time data information B)/(characteristic event An−time data information A)}.

FIG. 50 shows the presumed arrival times of the characteristic events B. The presumed arrival times are equivalent to the regulated In case where characteristic events A1 and B1 serve as the characteristic events An and Bn, respectively, the presumed arrival time is calculated as {0.65+(2.38−1.15)(1.01−0.65)/(1.51−1.15)}=1.88.

The central processing unit 62 checks the result of the calculation to see whether or not the difference between the arrival time of the characteristic event B and the presumed arrival time is fallen within the range between 0.20 second and +0.20 second. When the central processing unit 62 confirmed that the difference is fallen within the range, the central processing unit 62 determines that the characteristic event Bn+1 is corresponding to the characteristic event An+1. The range ±0.20 is changeable.

If the difference is less than −0.20 second, the central processing unit 62 presumes that any characteristic event B does not correspond to the characteristic event An+1, and changes the characteristic event An+1 to the next characteristic event An+2 for the above-described data processing. On the other hand, if the difference is greater than +0.20 second, the central processing unit 62 presumes that any characteristic event A does not correspond to the characteristic event Bn+1, and changes the characteristic event Bn+1 to the next characteristic event Bn+2 for repeating the above-described data processing.

In case where the characteristic events A5 and B5 serve as the characteristic events An and Bn, respectively, the central processing unit 62 presumes that the characteristic event B arrived at 8.25 seconds on the basis of the lapse of time expressed by the delta time code associated with the characteristic event A6. The actual arrival time of the characteristic event B6 is 9.76 seconds, and the difference in time is −1.51 seconds, which is out of the range of ±0.20 second. For this reason, the central processing unit 62 determines that any characteristic event B does not correspond to the characteristic event A6.

In case where the characteristic events A9 and B8 serve as the characteristic events An and Bn, respectively, the central processing unit 62 presumes that the characteristic event B arrived at 17.79 seconds on the basis of the lapse of time expressed by the delta time code associated with the characteristic event A10. The actual arrival time of the characteristic event B9 is 15.57 seconds, and the difference in time is 2.22 seconds, which is out of the range of ±0.20 second. For this reason, the central processing unit 62 determines that any characteristic event A does not correspond to the characteristic event B9.

Figure 51:
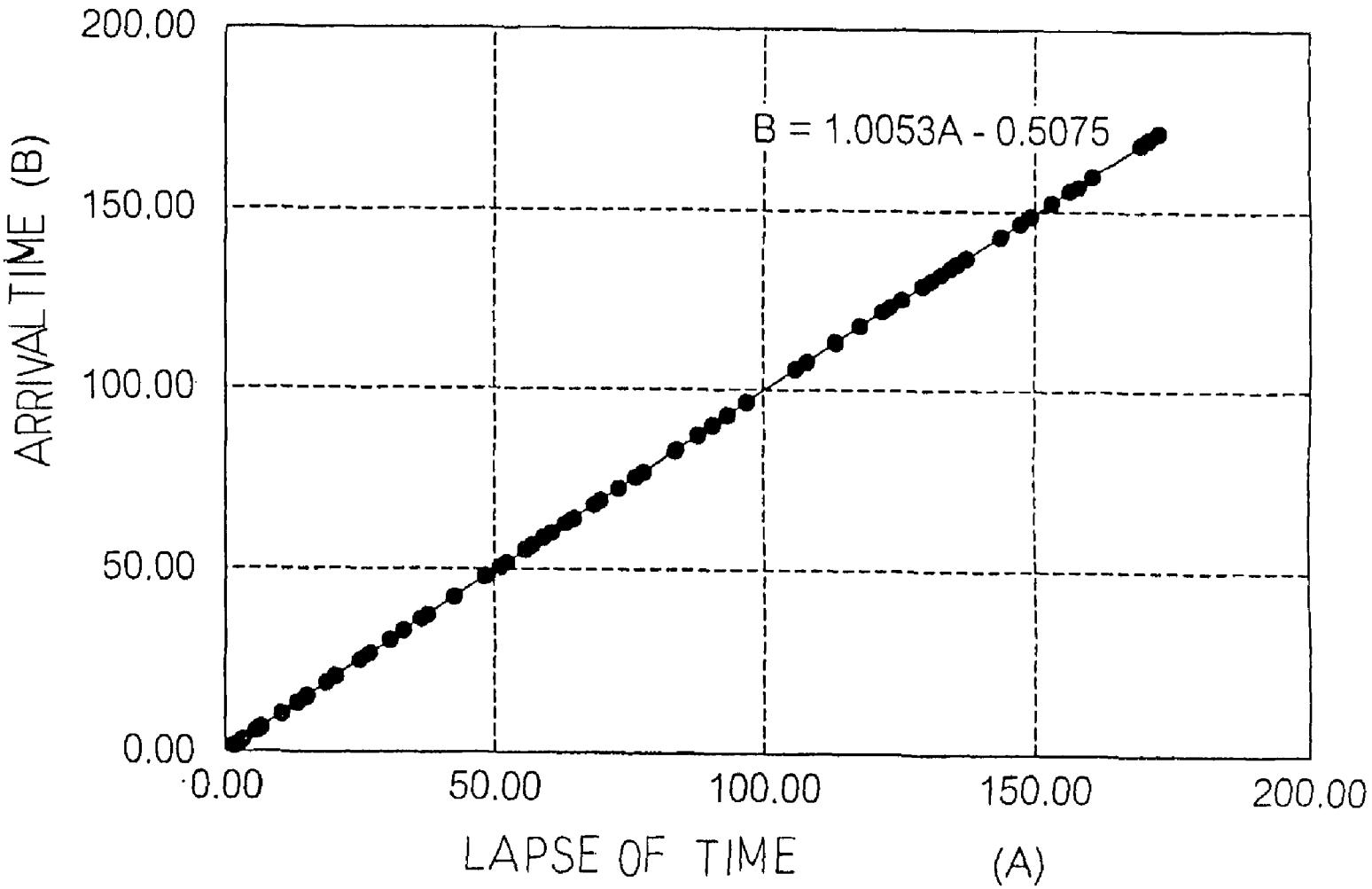
FIG. 51 is a graph showing a regression line presumed between the lapse of time and the presumed arrival time.
Figure 52:
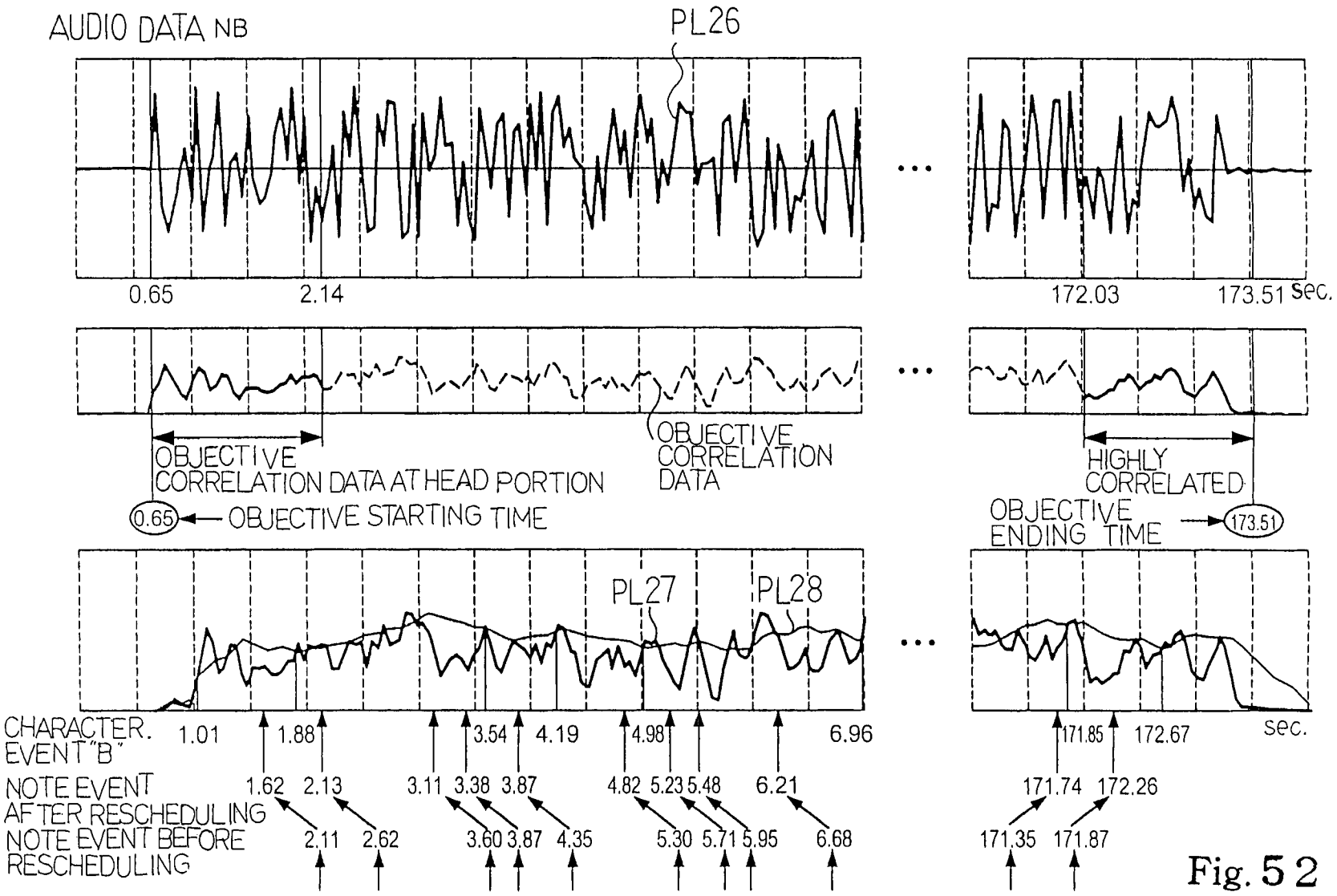
FIG. 52 is a timing chart showing audio data, objective correlation data, indexes and note events before and after rescheduling.

Upon completion of the above-described data processing for making the characteristic events A correspond to the characteristic events B, the central processing unit presumes the relation between the lapse of time expressed by the delta time codes and the arrival times of the characteristic events B. The central processing unit 62 may use the least square method for the presumption. FIG. 51 shows a regression line presumed through the least square method between the lapse of time (A) and the arrival time (B). The regression line is expressed as B=1.0053A−0.5075.

Subsequently, the central processing unit 62 reads out the reference ending time from the standard MIDI file already transferred to the random access memory 64, and substitutes the reference ending time, i.e., 173.11 seconds for A. Then, the objective ending time is presumed to be 173.52 seconds.

Subsequently, the central processing unit 62 subtracts the reference ending time from the objective ending time for presuming the end offset. The central processing unit 62 stores the end offset in the random access memory 64. The central processing unit 62 produces the system exclusive event codes for storing the top offset and end offset, and adds the system exclusive event codes to the standard MIDI file in the random access memory 64.

When the central processing unit 62 stores the system exclusive events representative of the top offset and end offset in the standard MIDI file, the central processing unit 62 proceeds to step S76 (see FIG. 46), and reschedules the note events through the data processing at steps S76 to S79. This results in the perfect synchronization between the performance through the automatic player piano 3E and the playback through the compact disc driver/audio unit 1E/4E.

The present inventors confirmed that the note events were rescheduled through the data processing described hereinbefore. The audio analog signal PL26 was produced from the pairs of audio music data codes recorded in the compact disc CD-B. The objective correlation data was produced from the pairs of audio music data codes, and the medium-range index PL27 and long-range index 28 were produced from the pairs of sampled values stored in the pairs of audio music data codes. The characteristic events "B" were extracted from the medium-range/long-range indexes PL27/PL28. The note events had been scheduled at 2.11 seconds, 2.62 seconds, 3.60 seconds, . . . However, the silent time period before the piece of music NB was shorter than the silent time period before the piece of music NA. Moreover, the time period consumed by the playback of the piece of music NB was longer than the time period consumed by the playback of the piece of music NA. This meant that the playback of the piece of music NB was initiated earlier than the playback of the piece of music NA and that the performance through the automatic player piano 3E was faster than the playback of the piece of music NB.

The present inventors rescheduled the note events through the data processing shown in FIG. 46. Then, the note events were rescheduled at 1.62 seconds, 2.13 seconds, 3.11 seconds, . . . By using expression 11. The present inventors confirmed that the automatic player piano 3E was perfectly synchronized with the compact disc driver/audio unit 1E/4E. This means that the piece of music is performed through the automatic player piano 3E in good ensemble with the piece of music recorded in the compact disc CD-B.

Playback from Standard MIDI File B

When the user requests the controller 6E to reproduce the performance in good ensemble with the playback of the piece of music NB, the user may loads the floppy disc, which stores the standard MIDI file B, in the floppy disc driver 2E. In this situation, the controller 6E is not expected to carry out the data processing shown in FIG. 46. The central processing unit 62 behaves as follows.

Firstly, the central processing unit 62 requests the floppy disc driver 2E to transfer the standard MIDI file B from the floppy disc FD to the interface 65*a*, and stores the standard MIDI file in the random access memory 64.

Subsequently, the central processing unit 62 reads out the top offset and end offset from the standard MIDI file B, and reschedules the note events through the expression 11. The regulated delta time codes are stored in the random access memory 64.

Subsequently, the central processing unit 62 requests the compact disc driver 1E to transfer the pairs of audio music data codes from the compact disc CD-B to the interface 65*a*. When the first pair of audio music data codes (0) arrives at the interface 65*a*, the central processing unit 62 starts the internal clock so as to measure the lapse of time. The central processing unit 62 supplies the pairs of sampled values to the audio unit 4E so that the electric tones are radiated from the laud speakers 44.

The central processing unit 62 fetches the delta time associated with the first note event from the standard MIDI file B, and compares the internal clock with the delta time code to see whether or not the lapse of time becomes equal to the time indicated by the delta time code. When the internal clock catches up the delta time code, the central processing unit 62 supplies the first note event to the automatic player piano 3E, and fetches the delta time code associated with the next note event code from the standard MIDI file B. The central processing unit 62 sequentially fetches the delta time codes from the standard MIDI file B, and supplies the associated note event code or codes to the automatic player piano 3E when the internal clock catches up the delta time code. The acoustic piano tones are reproduced through the automatic player piano 3E, and the user feels the performance through the automatic player piano 3E to be in good ensemble with the playback through the compact disc driver/audio unit 1E/4E.

However, the user may feel the automatic player piano to be out of the synchronization with the compact disc player/audio unit 1E/4E. Then, the user manually regulates the timing to reproduce the note events. In detail, the user firstly pushes a key pad for the manual regulation. Then, the central processing unit 62 branches to step S80, and carries out the data processing shown in FIG. 48. The top offset and end offset are varied through the steps S91 to S95. When the user feels the performance in good ensemble with the playback, the user pushes the key pad "ENTER". Then, the central processing unit 62 stores the top offset and end offset in the standard MIDI file B in the random access memory 64.

If the user wishes to store the standard MIDI file B in the floppy disc FD, the user pushes the key pad assigned to the retention. Then, the central processing unit 62 supplies the data representative of the standard MIDI file B to the floppy disc driver 2E together with the request for the retention. The floppy disc driver 2E overwrites the standard MIDI file B received from the central processing unit 62.

As will be understood from the foregoing description, the synchronous player system stores at least the reference correlation data at the head portion, reference starting time, reference ending audio data and reference ending time together with the note events in the preliminary recording mode, and reschedules the note events in the synchronous playback mode. In the synchronous playback mode, the central processing unit carries out the correlation analysis on the objective correlation data and the reference correlation data at the head portion/reference ending audio data so as to determine the objective starting time and objective ending time for the piece of music NB recorded in the compact disc CD-B. When the objective starting time and objective ending time are known, the central processing unit 62 determines the top offset and end offset, the time difference between the reference starting time and the objective starting time and the time difference between the reference ending time and the objective ending time, and determines the timing to reproduce the note events by using the expression 11. Upon completion of the rescheduling, the controller 6E reproduces the performance through the automatic player piano 3E and the playback through the compact disc driver/audio unit 1E/4E in good ensemble with one another.

If the reference characteristic events are further extracted in the preliminary recording, the reference characteristic events are further stored in the memory together with the note event codes. In this instance, the controller 6E firstly extracts the objective characteristic events from the medium-range/long-range indexes, which are produced from the pairs of sampled values stored in the compact disc CD-B, and looks for the last objective event to be paired with the last reference characteristic event. When the last objective characteristic event is found, the central processing unit 62 determines the top offset and end offset, and reschedules the note events. Thus, even if the controller 6E fails to find the objective correlation data highly correlated with the reference ending audio data, the central processing unit 62 can determine the end offset through the data processing on the reference and objective events, and makes the automatic player piano 3E synchronously reproduce the performance together with the compact disc driver/audio unit 1E/4E.

First Modification

Figure 53:
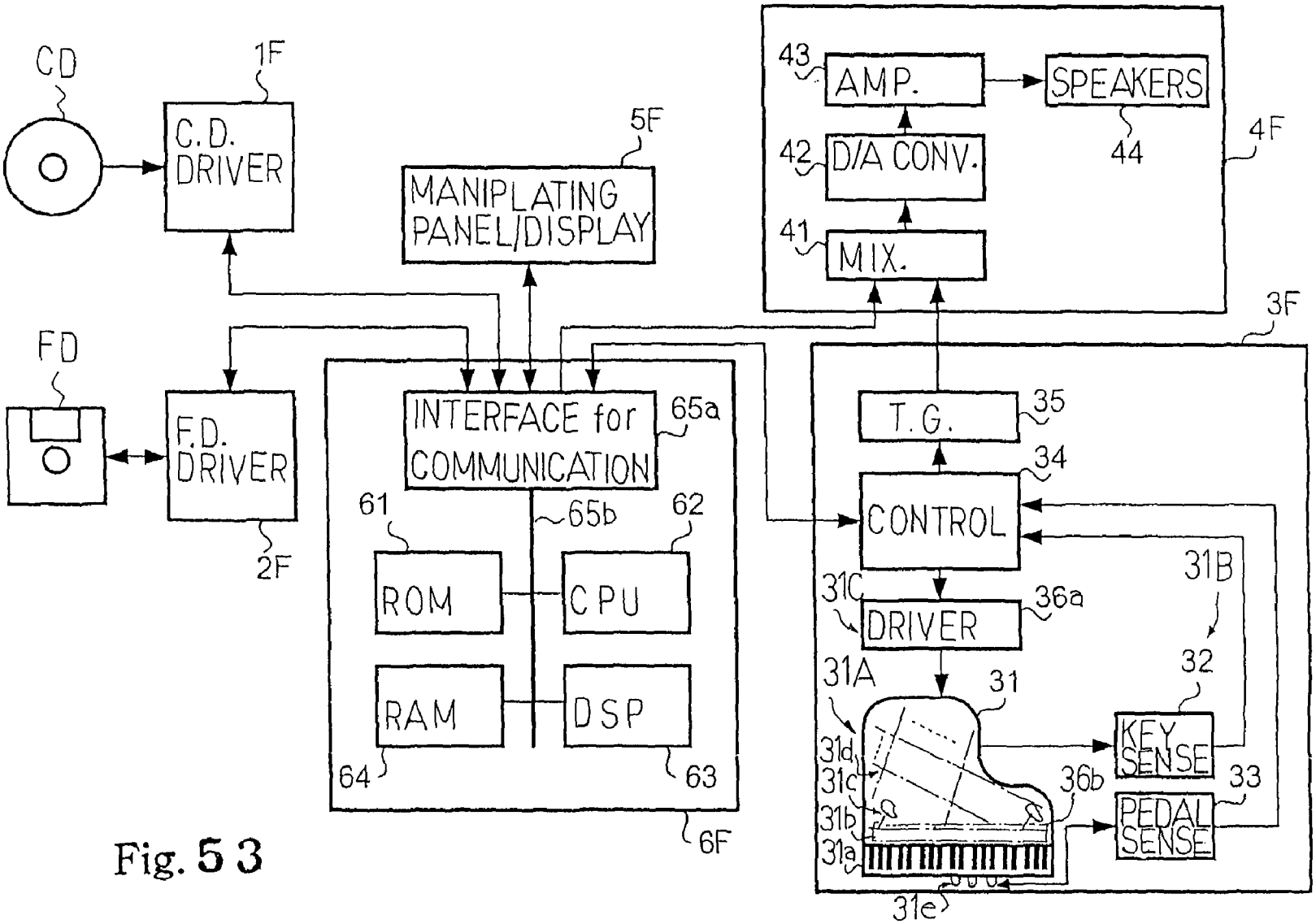
FIG. 53 is a block diagram showing the system configuration of a modification of the synchronous player system.

FIG. 53 shows the first modification of the synchronous player system. The first modification of the synchronous player system embodying the present invention also largely comprises a compact disc driver 1F, a floppy disc driver 2F, an automatic player piano 3F, an audio unit 4F, a manipulating panel/display 5F and a controller 6F. The floppy disc driver 2F, automatic player piano 3F, audio unit 4F and manipulating panel/display 5F are similar in configuration and behavior to those of the synchronous player system, and the component parts are labeled with the references designating the corresponding component parts shown in FIG. 32. Although the controller 6F is slightly different in data processing from the controller 6E, the system configuration is similar to that of the controller 6E, and, for this reason, the component parts are labeled with references designating the corresponding component parts of the controller 6E without detailed description.

The first modification also selectively enters the preliminary recording mode and synchronous playback mode, and the behavior in those modes of operation is generally identical with that of the synchronous playback system. For this reason, description is focused on differences from the digital processing executed by the synchronous playback system.

The compact disc driver 1F sequentially reads out the audio music data codes and audio time data codes from compact discs CD-A and CD-B, and transfers not only the audio music data codes but also the audio time data codes to the controller 6F. This is the difference from the behavior of the compact disc driver 1E. The audio time data code is provided for each frame, in which 588 pairs of audio music data codes are written, and the lapse of time from the initiation of playback is expressed by the audio time data codes.

The controller 6F supplies the clock signal to the compact disc driver 1F at all times, and the compact disc driver 1F transfers the audio music data codes to the controller 6F in synchronization with the clock signal. When the central processing unit 62 stores the pairs of sampled values in the random access memory 64, the central processing unit 62 duplicates the latest audio time data into the delta time code, and stores the delta time code together with the pairs of sampled values. If accurate time data is required for the data processing, the central processing unit 62 defines a counter, and increments the counter at the reception of each pair of audio music data codes so as to accurately determine the time through the proportional allotment on the time interval between the audio music data codes.

While the central processing unit 62 is extracting the characteristic events and receiving the note events, the audio time data codes intermittently arrives at the interface 65*a* so that the central processing unit 62 produces the delta time codes from the latest audio time code.

In the first modification, any internal clock, which is, by way of example, implemented by a counter or software timer, is not required for the data processing so that the system configuration or computer program is simplified.

Other Modifications

In the above-described third embodiment and its modification, the system components 1E/1F, 2E/2F, 4E/4F, 5E/5F and 6E/6F are accommodated in the automatic player piano 3E/3F. However, a second modification is constituted by plural components physically separated from one another. The synchronous player system implementing the second modification may be physically separated into plural components such as 15. Compact disc driver 1E/1F,
16. Floppy disc driver 2E/2F,
17. Automatic player piano 3E/3F,
18. Mixer/digital-to-analog converter 41/42,
19. Amplifiers 43,
20. Laud speakers 44, and
21. Manipulating panel/display and controller 5E/5F and 6E/6F.

Moreover, the controller 6E/6F may be physically separated into a recording section and a playback section.

These system components may be connected through audio cables, MIDI cables, optical fibers for audio signals, USB (Universal Serial Bus) cables and/or cable newly designed for the synchronous playback system. Standard floppy disc drivers, standard amplifiers and standard laud speakers, which are obtainable in the market, may be used in the synchronous playback system according to the present invention.

The separate type synchronous playback system is desirable for users, because the users constitute their own systems by using some system components already owned.

The third modification of the synchronous playback system does not include the compact disc driver 1E/IF and floppy disc driver 2E/2F, but the controller 6E/6F has a hard disc driver and an interface connectable to a LAN (Local Area Network), WAN or an internet. In this instance, the audio data codes are supplied from a suitable data source through the interface, and are stored in the hard disc. Similarly, a standard MIDI file is transferred from the external data source through the interface, and is also stored in the hard disc. While a user is fingering on the keyboard 31*a*, the audio music data codes are read out from the hard disc, and are transferred to the audio unit 4E/4F for converting them to electric tones. The event codes and delta time codes are stored in the track chunk, and the standard MIDI file is left in the hard disc.

In the synchronous playback system implementing the third embodiment, the digital signal processor 63 carries out the correlation analysis through the analysis on the absolute correlation index, analysis on the relative correlation index and analysis on the correlation value. Although the three sorts of analysis make the correlation analysis accurate, the three sorts of analysis may be too heavy. For this reason, the fourth modification carries out the correlation analysis through one of or two of the three sorts of analysis.

The fifth modification makes a decision at step S52 through only expression (10). In detail, the digital signal processor calculates the product between $D_{m-1}$ and $D_m$, and checks it to see whether or not the product is equal to or less than zero. When the product is equal to or less than zero, the rate of change in the function of correlation value is zero or is changed across zero. This means that the correlation value is at the maximum or in the vicinity of the maximum. For this reason, the answer at step S52 is given affirmative. In case where there is little possibility to have the minimum and maximum close to one another, the same answer is obtained through the simple data processing.

In the third embodiment, when the sampled value exceeds the threshold, the central processing unit 62 determines the reference starting time and reference ending time. Accordingly, the reference correlation data at the head portion and reference ending audio data are produced from the reference raw material at the head portion of the music NA and the reference raw material at the end portion of the music NA. On the other hand, the central processing unit determines the reference starting time and reference ending time an the basis of certain raw material at an arbitrary part of the music NA in the sixth modification. For example, the central processing unit may appoint a certain lapse of time from the initiation of the playback and another certain time before the end of the playback as the reference starting time and reference ending time, respectively for the sixth modification. This feature is desirable for music to be recorded in a live concert. Even though voice and/or hand clapping are mixed with the recorded music, the reference raw material is extracted from an appropriate part of the music without the influence of the voice and/or hand clapping. A passage may be repeated immediately after the initiation of the performance. Even so, the raw material is extracted from a middle part of the piece of music representative of a characteristic passage.

A particular feature of the seventh modification is directed to a tag or a piece of discriminative information stored in the standard MIDI file. The tag may be representative of the discriminative data exclusively used for the compact disc CD-B or a combination of the track numbers where the piece of music NB is recorded. The discriminative data is stored in the compact disc CD-B as the index so that the central processing unit 62 requests the compact disc driver to transfer the discriminative data from the index of the compact disc. The central processing unit 62 produces a system exclusive event code where composite data representative of the track number and the discriminative number are stored, and adds the system exclusive event code to the standard MIDI file. Upon completion of the standard MIDI file, the central processing unit 62 transfers it to the floppy disc driver, and requests the floppy disc driver to store it in a floppy disc.

The user is assumed to instruct the seventh modification to carry out the synchronous playback after loading a compact disc and the floppy disc in the compact disc driver and floppy disc driver, respectively. When the user specifies a piece of music stored in the compact disc, the central processing unit requests the compact disc driver to transfer the discriminative data assigned to the compact disc and the track number where the piece of music is recorded to the interface.

Subsequently, the central processing unit supplies the discriminative data and the track number to the floppy disc driver, and requests the floppy disc driver to search the floppy disc for the standard MIDI file where the system exclusive event representative of the same discriminative data and same track number are stored. If the floppy disc driver successfully completes the search, the floppy disc driver transfers the standard MIDI file to the controller, and the controller starts the synchronous playback. On the other hand, if the floppy disc driver can not find the standard MIDI file in the floppy disc, the floppy disc driver reports the failure to the controller, and the controller requests the manipulating panel/display to produce an error message.

The seventh modification makes the management on the floppy discs easy. Moreover, the seventh modification automatically searches the floppy discs for the piece of music so that the user can easily enjoy the synchronous playback.

Fourth Embodiment

Figure 54:
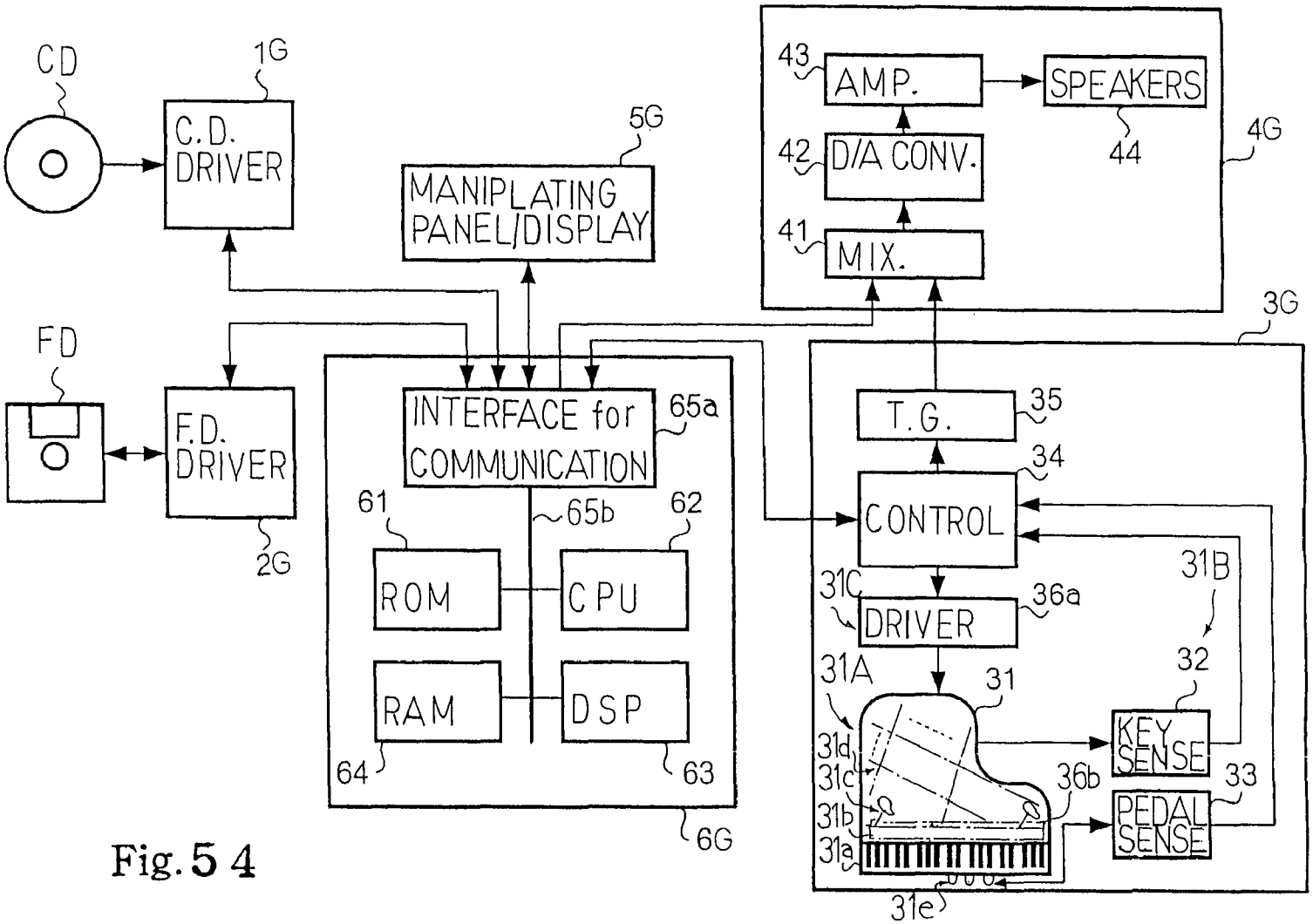
FIG. 54 is a block diagram showing the system configuration of still another synchronous player system according to the present invention.

FIG. 54 shows still another synchronous player system according to the present invention. The synchronous player system embodying implementing the fourth embodiment also largely comprises a compact disc driver 1G, a floppy disc driver 2G, an automatic player piano 3G, an audio unit 4G, a manipulating panel/display 5G and a controller 6G. The compact disc driver 1G, floppy disc driver 2G, automatic player piano 3G, audio unit 4G and manipulating panel/display 5G are similar in configuration and behavior to those 1E/2E/3E/4E/5E of the synchronous player system, and the component parts are labeled with the references designating the corresponding component parts shown in FIG. 32. Although the controller 6G is slightly different in data processing from the controller 6E, the system configuration is similar to that of the controller 6E, and, for this reason, the component parts are labeled with references designating the corresponding component parts of the controller 6E without detailed description.

Figure 55:
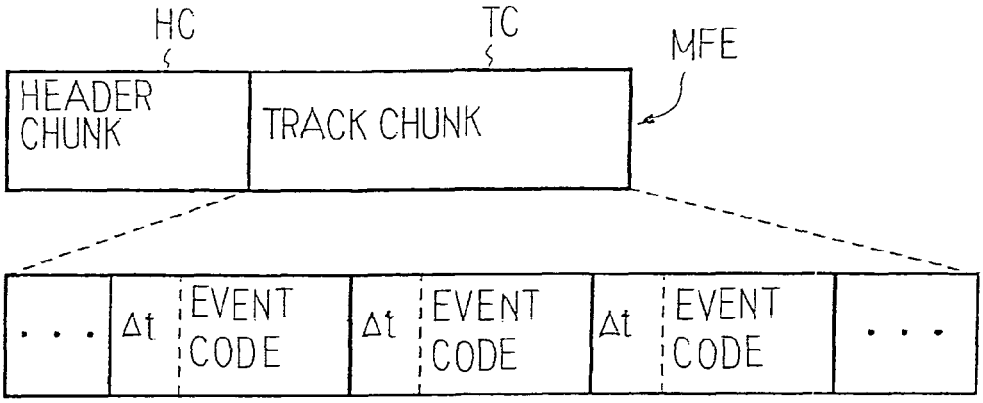
FIG. 55 is a view showing the data structure of a standard MIDI file.

FIG. 55 shows a standard MIDI file MFE, which is available for the synchronous player system implementing the fourth embodiment. The standard MIDI file MFE is broken down into a header chunk HC and a track chunk TC. The header chunk HC is assigned to pieces of control data representative of the format for the music data to be stored in the track chunk TC and the unit of time. The track chunk TC is assigned to the MIDI music data codes, i.e., the note event codes, system exclusive event codes and delta time codes. The delta time code is representative of a time interval between an event code and the next event code or the lapse of time from the initiation of the playback. In this instance, the delta time codes are indicative of the lapse of time from the initiation of playback in second. However, the delta time code may be indicative of a time interval between an event and the next event in another system.

Figure 56A:
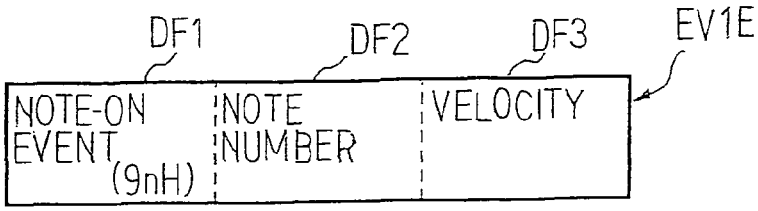
FIGS. 56A, 56B and 56C are views showing the data formats for note event codes.
Figure 56B:
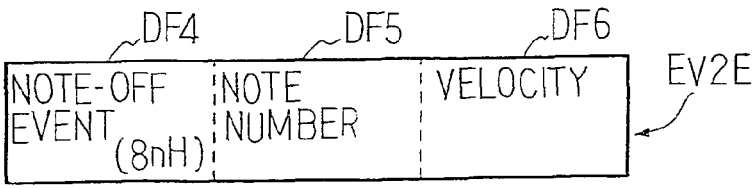
Figure 56C:
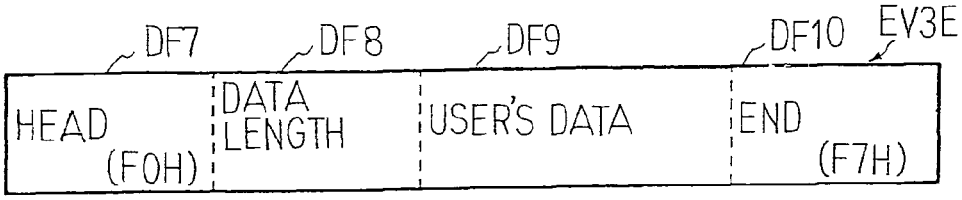

FIG. 56A, 56B and 56C show formats for the MIDI music data codes. FIG. 56A shows data fields DF1/DF2/DF3 of the note-on event code EV1E, FIG. 56B shows data fields DF4/DF5/DF6 of the note-off event code EV2E, and FIG. 56C shows data fields DF7/DF8/DF9/DF10 of the system exclusive event code EV3E. In order to make the other event codes except for the system exclusive event codes distinguishable, the other event codes are hereinafter referred to as "note event codes". The contents of the data fields FD1 to DF10 are same as those of the event codes described in conjunction with the first embodiment, and, for this reason, no further description is hereinafter incorporated for avoiding undesirable repetition.

The event codes EV1E, EV2E and EV3E do not have any piece of time data, and used for a tone generation, a tone decay and other controls. In other words, the event codes EV1 and EV2 are immediately executed for controlling the tones, and the user's data are also immediately processed. Those sorts of event codes EV1E, EV2E and EV3E form the track chunk of the standard MIDI file MF.

Preliminary Recording

A user performs a piece of music in ensemble with a playback of the piece of music recorded in a compact disc CD-A. Although plural pieces of music are recorded in the compact disc CD-A, the user selects one of the plural pieces of music, and the selected one of the plural pieces of music is hereinafter referred to as "piece of music N", and the set of audio music data codes representative of the piece of music N is referred to as NA.

The user firstly loads the compact disc CD-A into the compact disc driver 1G and the floppy disc FD, which has a recording capacity much enough to store a standard MIDI file to be created through the preliminary recording, into the floppy disc driver 2G. The user pushes the instruction key on the manipulating panel/display 5G so that the central processing unit 62 acknowledges the user's instruction to start the preliminary recording. Then, the central processing unit 62 supplies a control signal representative of a request for playback through the interface 65*a* to the compact disc driver 1G.

The compact disc driver 1G drives the compact disc CD-A for rotation, and transfers the audio music data codes to the interface 65*a*. A pair of audio music data codes is transferred to the interface 65*a* for the right channel and left channel at every interval of $1/44100$ second. The pair of audio music data codes is expressed as (R(n), L(n)), and the value of the audio music data code R(n)/L(n) is hereinafter referred to as "sampled value (n)". "n" represents the place of the pair of audio music data codes (R(n), L(n)) counted from the head of the set of audio music data codes NA. The first pair of audio music data codes is expressed as (R(0), L(0)), and "n" is increased through "1", "2", "3", . . . The sampled value is an integer, and all the sampled values are fallen within the range from −32768 to +32767. "n" is indicative of the place of the audio music data code in the track.

When the first pair of audio music data codes (R(0), L(0)) reaches the interface 65*a*, the central processing unit 62 fetches the pair of audio music data codes (R(0), L(0)) from the interface 65*a*, and starts to count the clocks of the clock signal. In other words, the central processing unit 62 starts the internal clock for measuring the lapse of time from the arrival time of the first pair of audio music data codes (R(0), L(0)). The arrival time of the first pair of audio music data codes (R(0), L(n)) is 0.00 second.

While the pairs of audio music data codes (R(0), L(0)), (R(1), L(1)), (R(2), L(2)), . . . are reaching the interface 65*a*, the central processing unit 62 successively transfers the pairs of audio music data codes (R(n), L(n)) to the automatic player piano 3G, and are converted to an electric signal along the piece of music N. The compact disc player 1G continues to transfer all the pairs of audio music data code until the end of the piece of music N.

The central processing unit 62 is further operative to store the pairs of sampled values (n) of the pairs of audio music data codes in the random access memory 64 together with the arrival times of the pairs of audio music data codes (R(n), L(n)). The arrival time of the pair of audio music data codes (R(n), L(n)) is expressed as "arrival time (n)".

The pair of sampled values (n) and associated arrival times (n) successively join a queue. In this instance, 1323000 pairs of sampled values and the arrival times (n) thereof are accommodated in the queue at the maximum. When the pair of sampled values (1323001) and arrival time (1323001) reach the queue, the first pair of sampled values (0) and arrival time (0) are pushed out from the queue, and the new pair of sampled values (1323001) and arrival time (1323001) join the queue at the tail. The 1323000 pairs of sampled values are equivalent to the electric tones continued for 30 minutes. The central processing unit 62 continuously makes the pair of sampled values (n) and its arrival time (n) join the queue until the last pair of sampled values and its arrival time, and keeps the length of the queue constant.

The central processing unit 62 is further operative to store $2^{16}$ pairs of sampled values after the silent time, i.e., from the initiation of the generation of the first electric tone in the random access memory 64. The $2^{16}$ sampled values, i.e., 65536 pairs of audio music data codes are equivalent to the electric tones continued for 1.49 seconds. The $2^{16}$ pairs of sampled values are hereinafter referred to as "reference raw material at the head portion".

In detail, when the first pair of audio music data code (R(0), L(0)) reaches the central processing unit 62, the central processing unit 62 starts to check the pairs of audio music data codes (R(0), L(0)) to (R(65535) to see whether or not the sampled values of the pair exceed a threshold value. The threshold value is representative of the boundary between the silence and the first tone. In this instance, the threshold is assumed to be 1000. At least one sampled value of the pair of audio music data codes (R(50760), L(50760)) is assumed to exceed the threshold. While "n" is being incremented from zero to 50759, the answer is given negative, and the central processing unit 62 ignores these pairs of audio music data codes (R(0), L(0)) to (R(50759), L(50759). In other words, the central processing unit 62 does not accumulate the pairs of audio music data codes (R(0), L(0)) to (R(50759), L(50759)) in the random access memory 64. The silent time period is about 1.15 seconds.

When "n" reaches 50760, the central processing unit 62 changes the answer to affirmative. With the positive answer, the central processing unit 62 decides a reference starting time at which the sampled value exceeded the boundary, and stores the pair of sampled values (50760) in the random access memory 64 together with the reference starting time. The central processing unit 62 successively transfers the 65536 pairs of sampled values to the random access memory 64 so that the sampled values of the pairs of audio music data codes (R(50760), L(50760)) to (R(116295), L(116295)) are accumulated in the random access memory 64 without comparison with the threshold. Thus, the sampled values of the pairs of audio music data codes representative of the silence or almost silence are not accumulated in the random access memory 64. The sampled values of those pairs of audio music data codes (R(50760), L(50760)) to (R(116295), L(116295)) serve as the reference raw material at the head portion, and the reference starting time is 1.15 seconds.

When the central processing unit 62 completes the accumulation of the reference raw material at the head portion, the central processing unit 62 requests the digital signal processor 63 to produce pieces of reference correlation data at the head portion from the reference raw material at the head portion. Pieces of correlation data at the head portion are equivalent to the pieces of audio data sampled at 172.27 Hz. The digital signal processor 63 produces the pieces of reference correlation data at the head portion from the pieces of raw material at the head portion. The pieces of reference correlation data at the head portion are used in a correlation analysis between the pairs of audio music data codes and other pairs of audio music data codes.

Figure 57:
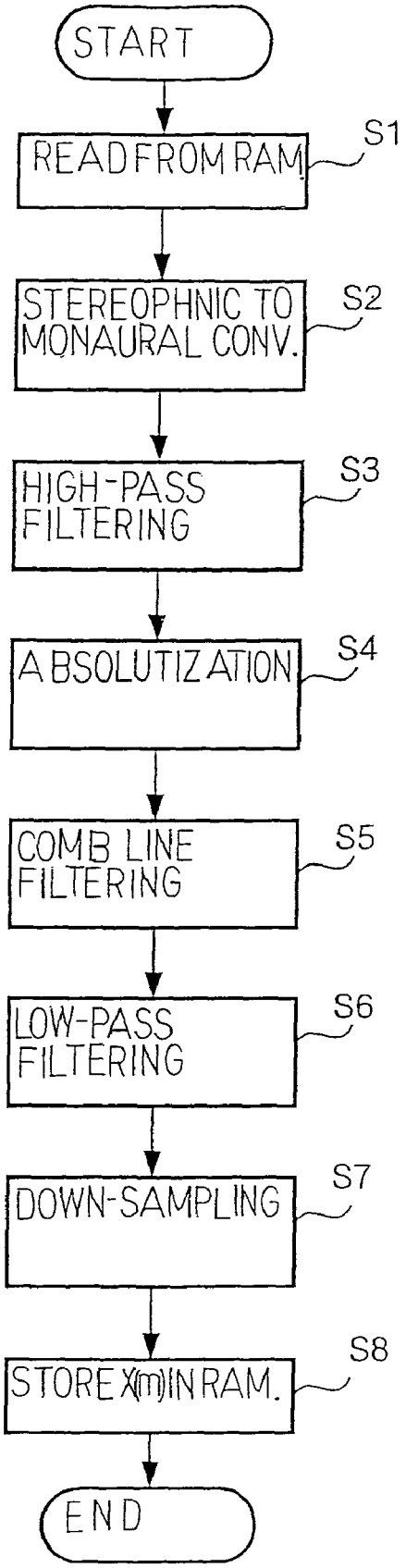
FIG. 57 is a flowchart showing a method for producing pieces of reference correlation data.

FIG. 57 shows a method for producing the pieces of reference correlation data at the head portion from the reference raw material at the head portion or pairs of sampled values (n). The method is stored in the program memory in the form of a computer program. When the digital signal processor 63 acknowledges the request, the digital signal processor 63 firstly reads out the pieces of reference raw material, i.e., the sampled values of the pairs of audio music data codes (R(n), L(n)) from the random access memory 64 as by step S1, and calculates the arithmetic mean of the sampled values of each pair of audio music data codes (R(n), L(n)) for converting the stereophonic audio music data to the monophonic audio music data as by step S2. The conversion from the stereophonic audio music data to the monophonic audio music data makes the load on the digital signal processor 63 light.

Subsequently, the digital signal processor 63 eliminates a value representative of the direct current component of the analog audio signal from the values of the arithmetic mean through a data processing equivalent to a high-pass filtering as by step S3. The calculated values are plotted in both positive and negative domains. It is preferable from the viewpoint of accuracy in the correlation analysis that the calculated values are dispersed in both positive and negative domains. Thus, the data processing equivalent to the high-pass filter makes the correlation analysis highly reliable.

Subsequently, the calculated values are absolutized as by step S4. Substitute values of the power of the sampled values are determined for the calculated values through the absolutization. The absolute values are less than the square numbers representative of the power, and are easy to handle in the following data processing. Nevertheless, if the digital signal processor 63 has an extremely large data processing capability, the digital signal processor 63 may calculate the square numbers instead of the absolute values.

Subsequently, the digital signal processor 63 extracts a low frequency component representative of a tendency in the variation of the waveform of the original audio signal from the absolute values through a data processing equivalent to a comb line filter as by step S5. Although the low frequency component is usually extracted through a data processing equivalent to a low pass filter, the data processing equivalent to the comb line filter is lighter in load than the data processing equivalent to the low pass filter. For this reason, the data processing equivalent to the comb line filter, i.e., the comb line filtering is employed.

Figure 58:
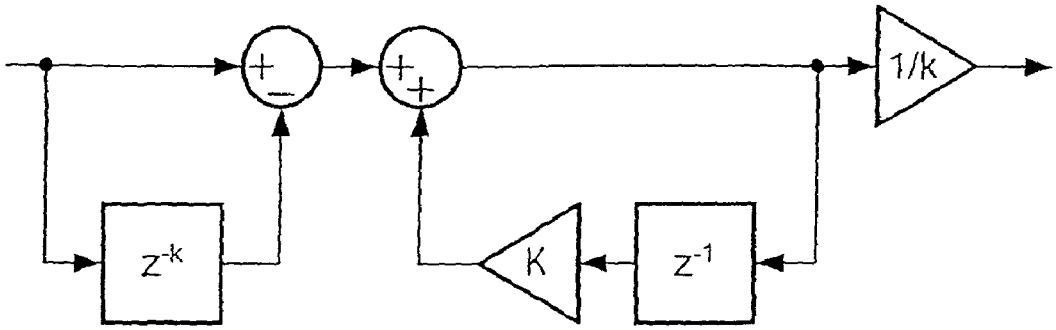
FIG. 58 is a block diagram showing the circuit configuration of a comb line filter.

FIG. 58 shows the circuit configuration of a comb line filter. Boxes stand for delay circuits, and triangles stand for the multiplication. "$Z^{-k}$" is put in the left box, and "k" represents that the delay time is equal to (sampling period×k). The sampling frequency is 44100 Hz so that the sampling period is equal to $1/44100$ second. The multipliers are put in the triangles, respectively. In FIG. 58, "k" is given as follows $$k=(44100-\pi\times f)/(44100+\pi\times f) \qquad \text{expression 12}$$

The data processing through the multiplication with the multiplier "k" makes the comb line filter achieve a high pass filtering at frequency f, and the direct current component is perfectly eliminated from the absolute values. It is desirable to experimentally optimize "k" and "f" so as to enhance the accuracy in the correlation analysis.

Turning back to FIG. 57, the digital signal processor 63 carries out a data processing equivalent to a low pass filter as by step S6 for preventing the sampled data through a down sampling at the next step from the fold-over noise. As will be described in conjunction with the next step S7, the digital signal processor 63 converts the sampled values at 44100 Hz to down-sampled values at 172.27 Hz, and the fold-over noise takes place. In order to prevent the down-sampled values from the fold-over noise, it is necessary to eliminate the frequency components higher than 86.13 Hz, i.e., half of 172.27 Hz. Although the comb line filter fairly eliminates the high frequency components from the pairs of sampled values, the high frequency components are still left in the sampled values. For this reason, the digital signal processor 63 perfectly eliminates the high frequency components from the sampled values before the down-sampling. In case where the digital signal processor 63 has a large data processing capability, the digital signal processor 63 may carry out a data processing equivalent to a high-precision low pass filtering instead of the two sorts of data processing at steps S5 and S6.

Subsequently, the digital signal processor 63 selects a sample from every 256 samples as by step S7. Namely, the digital signal processor 63 carries out the down-sampling at 1/256. Upon completion of the down-sampling, the amount of data is reduced from 65536 to 256. The samples after the down-sampling serve as the pieces of reference correlation data at the head portion. The load on the digital signal processor 63 is lightened through the down-sampling. If the digital signal processor 63 has a large data processing capability, the digital signal processor 63 directly proceeds from step S6 to step S8. Finally, the digital signal processor 63 stores the pieces of reference correlation data at the head portion in the random access memory 64 as by step S8. Thus, the digital signal processor 63 produces the pieces of reference correlation data at the head portion from the pieces of raw material at the head portion, and stores the pieces of reference correlation data at the head portion in the random access memory 64.

When the first piece of reference raw material at the head portion reaches the interface 65*a*, the central processing unit 62 further requests the digital signal processor 63 to find characteristic events in all the pieces of reference raw material. The digital signal processor 63 extracts low frequency components from the pairs of sampled values in the queue through a data processing equivalent to a low pass filtering at a predetermined frequency, and further extracts extremely low frequency components from the pairs of sampled values in the queue through a data processing equivalent to a low pass filtering at another predetermined frequency, which is lower than the predetermined frequency. Upon completion of the data processing equivalent to the low pass filtering at the different frequencies, the digital signal processor 63 compares the low frequency components with the extremely low frequency components to see whether or not the characteristic event takes place. The characteristic events are a sort of flag or timing data used in the timing regulation.

Figure 59:
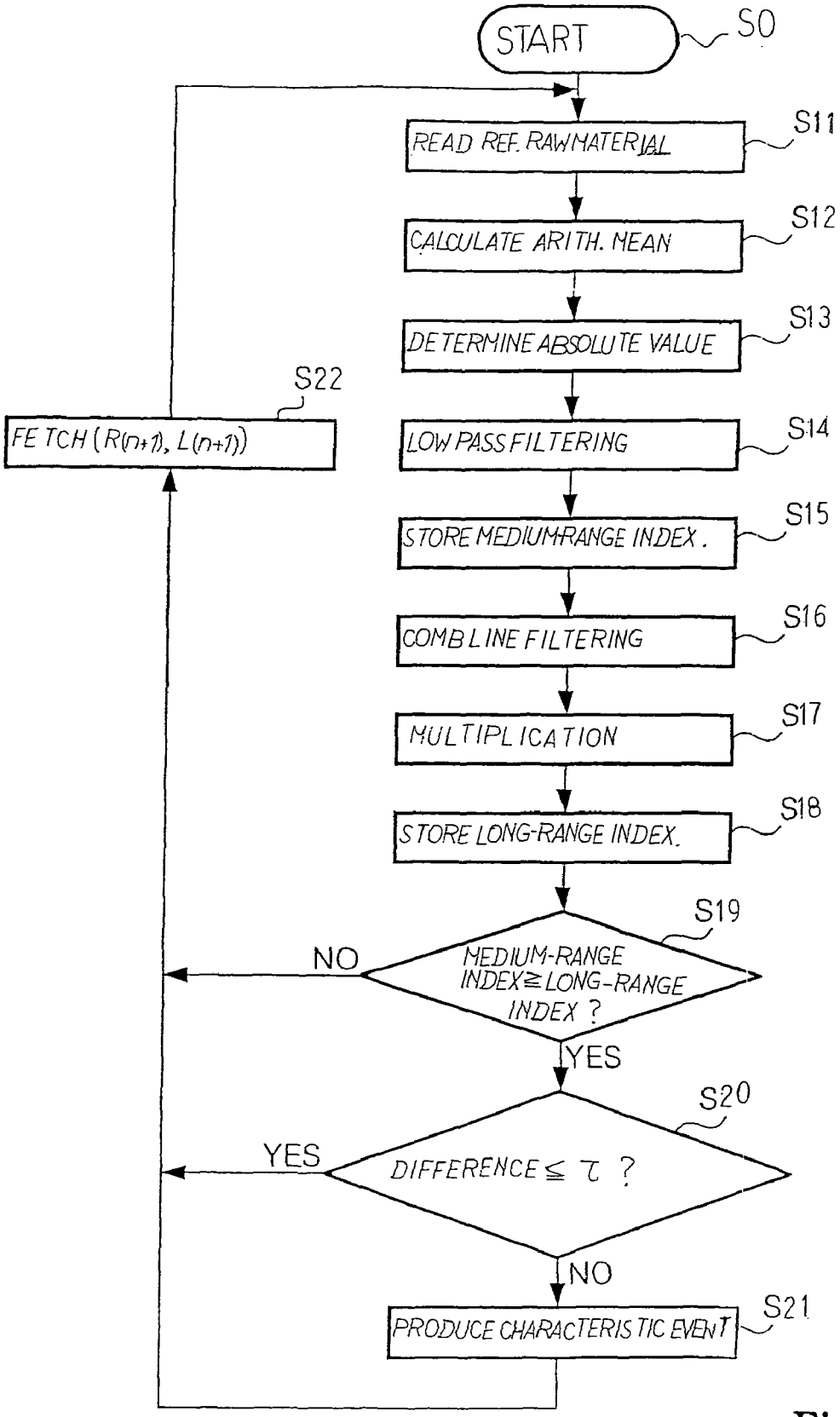
FIG. 59 is a flowchart showing a method for finding characteristic events in sampled values.

FIG. 59 shows a method for producing the pieces of administrative information representative of the characteristic events. The method is expressed as a computer program executed by the digital signal processor 63.

When the digital signal processor 63 receives the request for producing the administrative information, the digital signal processor 63 starts the computer program at step S0. The digital signal processor 63 reads out a predetermined number of pairs of sampled values from the queue in the random access memory 64 as by step S11. The data transfer is carried out from the tail of the queue. In this instance, the predetermined number is 44100. Of course, another natural number serves as the predetermined number. In the following description, the pairs of sampled values read out from the queue are referred to as "pieces of raw material", and the set of pieces of raw material, which contains the pair of sampled value (n) at the tail, is referred to as "pieces of raw material (n)". If the pair of sampled material (50760) occupies the tail of the queue at the reception of the request for producing the administrative information, the pairs of sampled values (6601) to (50760) are read out from the random access memory 64, and form the raw material.

Subsequently, an arithmetic mean is calculated from the sampled values of each pair as by step S12. This arithmetic operation is equivalent to the conversion from the stereophonic sound to the monophonic sound. The arithmetic mean makes the load on the digital signal processor 63 light.

Subsequently, the digital signal processor 63 determines the absolute values of the arithmetic mean as by step S13. Substitute values for the power are obtained through the through the absolutization. The absolute values are less than the square numbers representative of the power, and are easy to handle in the following data processing. Nevertheless, if the digital signal processor 63 has an extremely large data processing capability, the digital signal processor 63 may calculate the square numbers of the calculated values instead of the absolute values.

Subsequently, the digital signal processor 63 carries out a data processing equivalent to the low pass filtering on the absolute values as by step S14. The cut-off frequency is assumed to be 100 Hz in this instance. Of course, another frequency may serve as the cut-of frequency. Upon completion of the data processing equivalent to the low pass filtering, a medium-range index is obtained for the sampled values. The medium-range index for the sampled value (n) is expressed as "medium-range index (n)". The medium-range index (n) is representative of the tendency of the variation at the time corresponding to the pair of sampled value (n) in the audio waveform in a medium range. In general, the audio waveform is frequently varied in a short range. The variation in the short range is eliminated from the series of pairs of sampled values through the data processing equivalent to the low pass filtering, because the short-range variation is restricted by the previous pairs of sampled values. As a result, data information representative of the middle-range variation and long-range variation are left in the digital signal processor 63. In other words, the medium-range index . . . (n−2), (n−1), (n) is left in the digital signal processor 63. The digital signal processor 63 transfers the medium-range index to the random access memory 64 for storing the index in the random access memory 64 as by step S15.

Subsequently, the digital signal processor 63 carries out a data processing equivalent to a low pass filtering through a comb line filter as by step S16. The cut-off frequency at step S16 is lower than the cut-off frequency at step S14. This is equivalent to an extraction of extremely low frequency components from the waveform expressed by the medium-range index. The comb line filter is desirable for the digital signal processor 63, because the data processing equivalent to the comb line filter is lighter than the data processing equivalent to the low pass filter.

Figure 60:
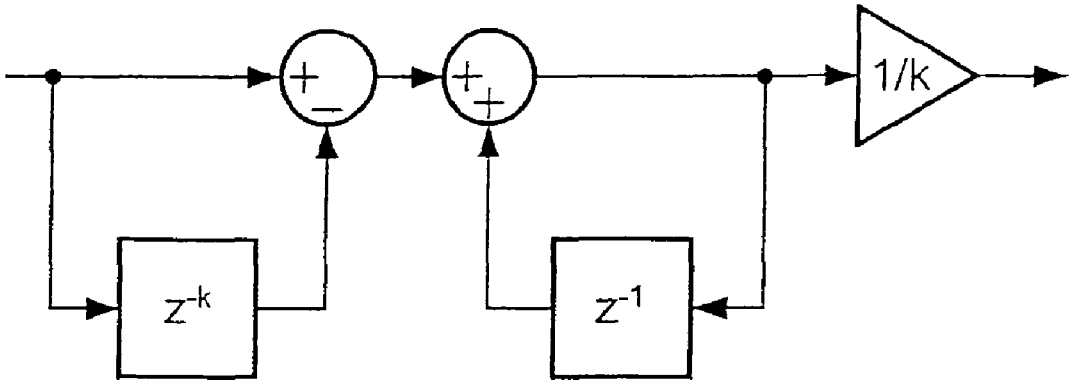
FIG. 60 is a block diagram showing the circuit configuration of a comb line filter.

FIG. 60 shows the digital processing equivalent to the comb line filter. Boxes and circles form two loops connected in series, and a triangle is connected between the second loop and a data output port. The boxes introduce delay into the signal propagation, and "$Z^{-k}$" represents that the delay time is equal to the product between the sampling period and constant k. As described hereinbefore, the sampling frequency is 44100 Hz. This means that the sampling period is $1/44100$ second. The triangle is representative of a multiplication, and "1/k" is the multiplier. In the following description, "k" is assumed to be equal to 22050. The frequency components higher than 1 Hz are almost eliminated from the medium-range index through the data processing equivalent to the comb line filter. Thus, the components representative of the long-range variation are left in the digital signal processor 63 upon completion of the data processing at step S16.

Subsequently, the digital signal processor 63 multiplies the series of components representative of the long-range variation by a positive constant "h". The frequency with a positive answer at the next step S19 is adjusted to an appropriate value through the multiplication at step S17. If "h" is small, the time intervals between a positive answer and the next positive answer is narrow. In case where the time intervals of the positive answers are too wide, the characteristic events are produced at long time intervals, and the accuracy of timing regulation is lowered. On the other hand, if the time intervals of the positive answers are narrow, the positive answers tend to be canceled at step S20, and the characteristic events are obtained at long time intervals. This results in the accuracy of the timing regulation is lowered. In this situation, the multiplier "h" is experimentally determined. Upon completion of the multiplication at step S17, long-range index is left in the digital signal processor 63. The long-range index corresponding to the sampled value (n) is hereinafter referred to as "long-range index (n)". Thus, the long-range index . . . (n−2), (n−1) and (n) is left in the digital signal processor 63 upon completion of the data processing at step S17. The digital signal processor 63 transfers the long-range index to the random access memory 64, and the long-range index is stored in a predetermined memory area of the random access memory 64 as by step S18.

Subsequently, the digital signal processor reads out the medium-range index (n) and long-range index (n) from the random access memory 64, and compares them with each other to see whether or not the medium-range index (n) is equal to or greater than the long-range index (n) as by step S19. The positive answer at step S19 is indicative of abrupt variation in the medium range on the audio waveform expressed by the reference raw material at the point corresponding to the sampled point (n). In more detail, when the volume in the frequency range between 1 Hz and 100 Hz is abruptly enlarged on the audio waveform, the medium-range index becomes greater than the long-range index, and the answer at step S19 is given affirmative "Yes". Then, the digital signal processor 63 checks the internal clock for the present time at which the comparison results in the positive answer, and stores the present time in the random access memory 64.

Subsequently, the digital signal processor 63 reads out the time at which the previous positive answer was obtained from the random access memory 64, and subtracts the time of the previous positive answer from the present time to see whether or not the difference is equal to or less than a predetermined value τ as by step S20. If the difference is greater than the predetermined value τ, it has been a long time from the production of the previous characteristic event. Thus, the data processing at step S20 prevents the central processing unit 62 from a lot of characteristic events produced at short intervals. If the characteristic events are too many, it is difficult to make characteristic events in the series of sampled values of the audio music data codes read out from the compact disc CD-B exactly corresponding to the characteristic events produced from the sampled values of the audio music data codes (R(n), L(n)) stored in the compact disc CD-A. The predetermined value τ is experimentally determined. Of course, when the digital signal processor 63 acquires the first positive answer, there is not any time in the random access memory 64. In this situation, the answer at step S20 is automatically given negative.

With the negative answer at step S20, the digital signal processor 63 produces the characteristic event as by step S21, and notifies the central processing unit 62 of the characteristic event.

If the answer at step S19 is given negative, the digital signal processor proceeds to step S22. In case where the answer at step S20 is given affirmative, the digital signal processor 63 also proceeds to step S22. The digital signal processor 63 also proceeds to step S22 upon completion of the jobs at step S21. The digital signal processor 63 waits for the next pair of audio music data codes (R(n+1), L(N+1)). When the next pair of audio music data codes reaches the interface 65*a*, the central processing unit 62 transfers the pair of sampled values (n+1) to the audio unit 4C, and the pair of sampled values (n+1) and arrival time join the queue in the random access memory 64. The central processing unit 62 requests the digital signal processor 63 to repeat the data processing, again. Then, the digital signal processor 63 fetches the reference raw material containing the pair of sampled values (n+1) at the tail from the random access memory 64, and returns to step S11.

Thus, the digital signal processor reiterates the loop consisting of steps S11 to S22 until the raw material containing the last pair of sampled values. Thus, the digital signal processor 63 extracts plural characteristic events from the raw material or the set of pairs of audio music data codes during the progression of the piece of music.

Figure 61:
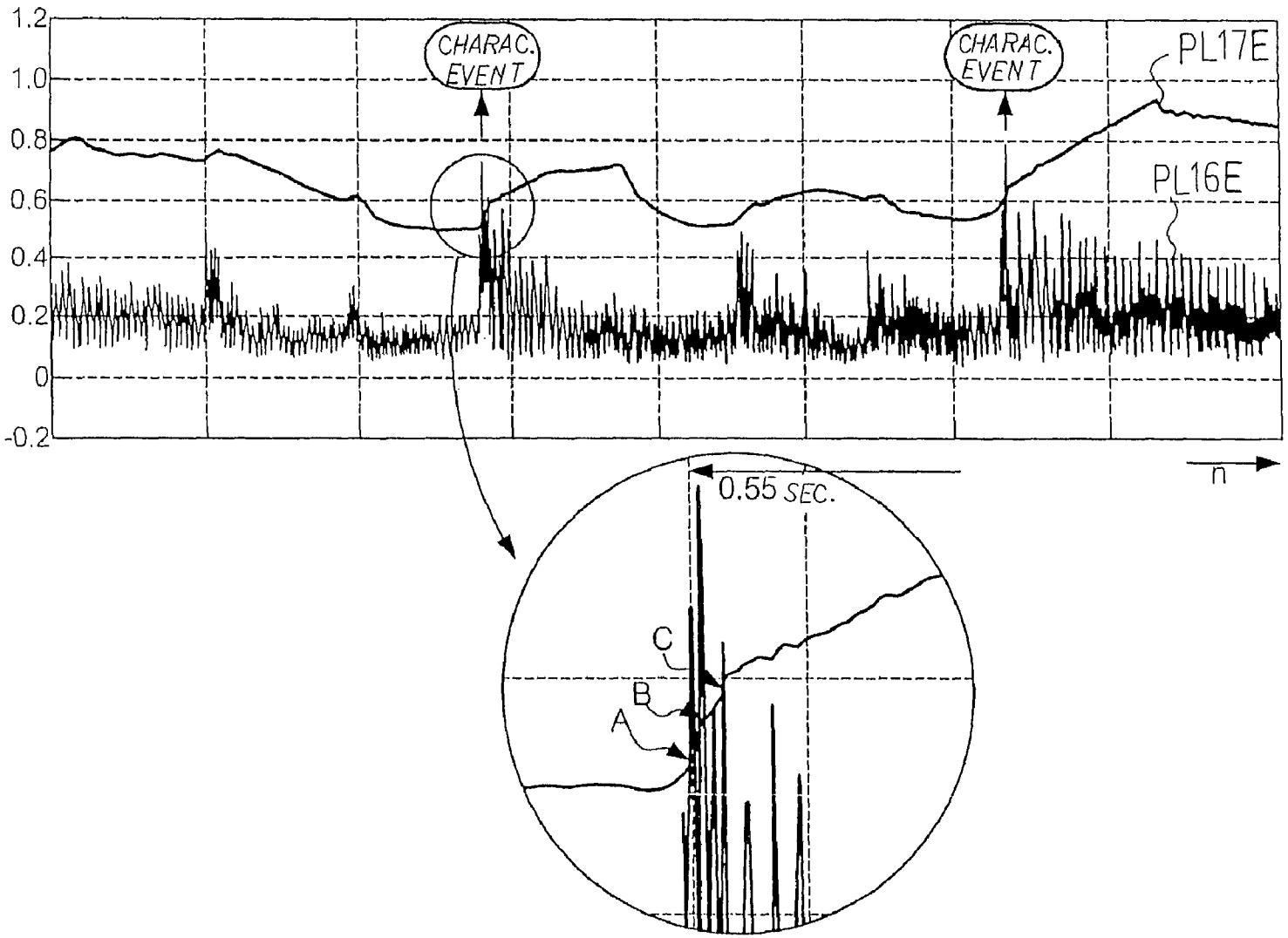
FIG. 61 is a graph showing a medium-range index and a long-range index.

The present inventor confirmed the data processing expressed by the computer program shown in FIG. 59. An IIR (Infinite Impulse Response) filter was used as the low pass filter at step S14. The constant "h" at step S17 was 4, and the time period r was 0.55 second. The data processing resulted in plots PL16E and PLI7E and the characteristic events shown in FIG. 61. Plots PL16E was representative of the medium-range index, and plots PL17E represented the long-range index. When the medium-range index PL16E became equal to or exceeded over the long-range index PL17E, the digital signal processor 63 produced the characteristic events. Although the medium-range index trice exceeds the long-range index at A, B and C as shown in a large circle, the digital processor 63 produced the characteristic events only at A, because the predetermined time of 0.55 second was not expired until points B and C (see step S21 in FIG. 59). The characteristic events extracted from the piece of music NA are hereinafter referred to as "reference characteristic events".

When the compact disc driver 1G starts to transfer the audio music data codes through the controller 6G to the audio unit 4G, the user gets ready to perform the piece of music. While the electric tones are being produced through the audio unit 4G, the user selectively depresses and releases the black/white keys, and steps on the pedals 31*e*. The acoustic piano tones are produced through the vibrations of the strings 31*d*, and the key sensors 32 and pedal sensors 33 report the key motion and pedal motion to the controller 34. The controller 34 produces the event codes representative of the note-on event, note-off event and effects to be imparted to the acoustic piano tones, and supplies the note event codes to the interface 65*a*. Thus, the central processing unit 62 receives not only the reference characteristic event codes from the digital signal processor 63 but also the note event codes from the automatic player piano 3G.

Figure 62:
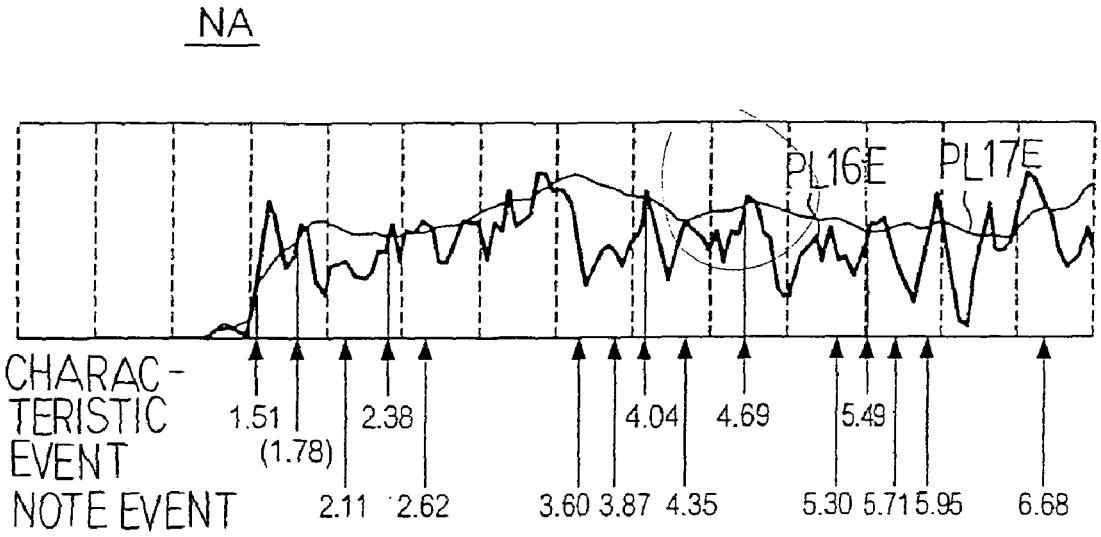
FIG. 62 is a graph showing the characteristic events and note events.

FIG. 62 shows the characteristic events and note events produced during an ensemble in the preliminary recording mode. The medium-range index and long-range index were respectively varied as indicated by plots PL16E and plots PL17E, and the time rightward went along the axis of abscissa. The first characteristic event took place at 1.51 seconds from the arrival of the first pair of audio music data codes, i.e. the reference starting time, and the other characteristic events took place at 2.38 second, 4.04 seconds, . . . On the other hand, the central processing unit 62 received the first event code at 2.11 second, and the other event codes arrived at the interface 65*a* at 2.62 seconds, 3.06 second, . . . Thus, the characteristic event codes and note event codes were produced in a real time fashion during the ensemble. Although the medium-range index PL16E exceeded the long-range index 17E at 1.78 seconds, the central processing unit 62 did not receive any characteristic event, because the predetermined period of 0.55 second had not been expired. When the central processing unit 62 is notified of the reference characteristic event code, the central processing unit 62 produces the system exclusive event code for storing the reference characteristic event therein, and checks the internal clock to see what time the reference characteristic event reaches there. The central processing unit 62 produces the delta time code indicative of the arrival time, and stores the delta time code and reference characteristic event code in the random access memory 64.

Similarly, when the central processing unit 62 fetches the note event code, the central processing unit 62 checks the internal clock to see what time the note event code reaches there. The central processing unit 62 produces the delta time code indicative of the arrival time, and stores the delta time code and note event code in the random access memory 64.

Assuming now that the compact disc driver 1G supplies the last pair of audio music data codes, the sampled values of the last pair of audio music data codes join the queue at the tail together with the arrival time, and the digital signal processor 63 carries out the data processing on the raw material containing the last pair of sampled values at the tail position for finding the reference characteristic event. Upon completion of the last data processing, the central processing unit 62 branches to a computer program for finding the end of the piece of music N in the set of pairs of audio music data codes.

In detail, when the central processing unit 62 completes the data processing for the reference characteristic event, the last pair of sampled values and other 1322999 pairs of sampled values are left in the queue together with the arrival times. If the last pair of sampled value is expressed as the pair of sampled values (7673399), the pair of sampled values (6350400) to the last pair of sampled value (7673399) have joined the queue together with their arrival times.

The central processing unit 62 reads out the pair of sampled values at the tail of the queue, and checks the pair of sampled values to see whether or not at least one of the sampled values of the pair exceeds the threshold, which is 1000 in this instance. If the answer is given negative, the central processing unit 62 reads out the pair of sampled values at one place before the tail, and checks the pair of sampled values to see whether or not at least one of the sampled values exceeds the threshold. While the answer is being given negative, the central processing unit 62 reads out the pair of sampled values toward the head of the queue, and repeats to compare the sampled values with the threshold.

One of the sampled values (7634297) is assumed to exceed the threshold. The pair of sampled values (7673399) to pair of sampled values (7634298) have not exceeded the threshold. This means that there is the silence continued for 0.89 second at the end of the set of pairs of audio music data codes. The pair of sampled value, which contains at least one sampled value greater than the threshold value, is hereinafter referred to as "pair of sampled value (Z)". The piece of music N is completed at the pair of sampled values (Z). When the central processing unit 62 finds the pair of sampled values (Z) in the set of pairs of audio music data codes, the central processing unit 62 does not continue the search for the end of the piece of music.

Figure 63:
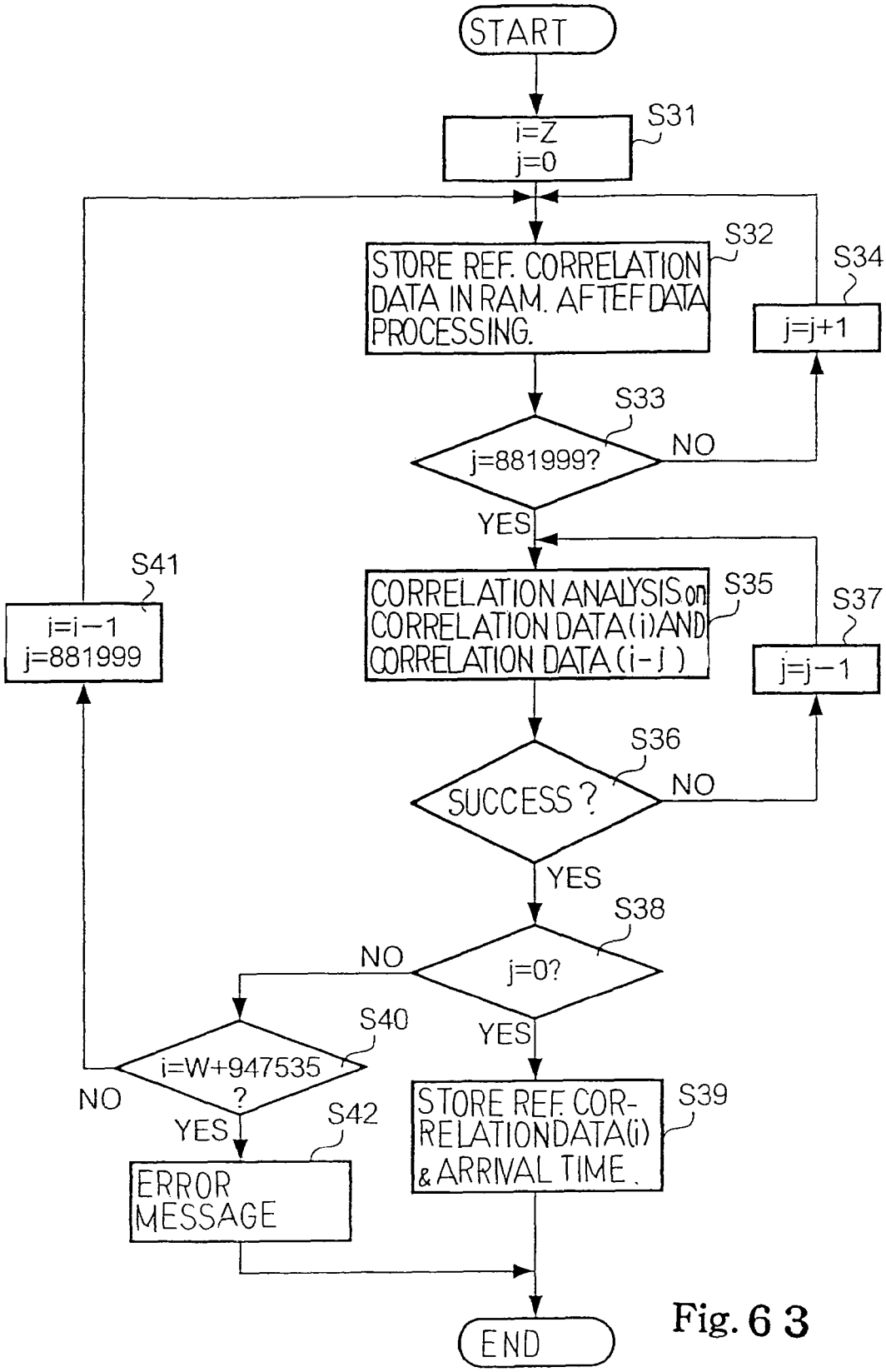
FIG. 63 is a flowchart showing a data processing for producing reference correlation data at the end portion of a piece of music from reference material.

Upon completion of the data processing for searching the queue for the end of the piece of music, the central processing unit 62 branches to a computer program for producing pieces of reference correlation data at the end portion or ending audio data. The central processing unit 62 produces pieces of reference correlation data at the end portion from raw material at the end portion, i.e., pairs of sampled values in the queue through the data processing expressed by the computer program. The computer program is illustrated in FIG. 63 together with several jobs to be executed by the digital signal processor 63.

In the following description, the pair of sampled values (W) occupies the head of the queue, and "W" and "Z" are assumed to be 6350400 and 7634297, respectively. "W" and "Z" may have other values in another example. This means that the pair of sampled values (6350400) to the pair of sampled values (7673399) have joined the queue together with the arrival times. The pair of sampled values (7634297) occupies the end of the piece of music N. 65536 pairs of sampled values are referred to as "pieces of raw material (n) at the end portion", and the pair of sampled values (n) occupies the end of the raw material at the end portion.

Firstly, the central processing unit 62 sets counters i and j to "Z", i.e., 7634297 and zero, respectively, as by step S31, and requests the digital signal processor to produce the pieces of reference correlation data at the end position or ending audio data from the reference raw material at the end position (i-j). The data processing for producing the pieces of reference correlation data at the end position is similar to that for producing the pieces of reference correlation data at the head portion already described hereinbefore. Upon completion of the data processing, the digital signal processor 63 stores 256 pieces of reference correlation data at the end portion in the random access memory as by step S32. Thus, 256 pieces of reference correlation data (n) at the end portion are acquired from the reference raw material (n) at the end portion. Since (i-j) is 7634297, the reference correlation data (7634297) at the end portion is stored in the random access memory 64.

Subsequently, the central processing unit 62 checks the counter j to see whether or not the counter j has reached 881999 as by step S33. The value stored in the counter j is less than 881999 so that the answer at step S33 is given negative, and the central processing unit 62 increments the counter j by 1 as by step S34. After incrementing the counter j, the central processing unit 62 returns to step S31. Thus, the central processing unit stepwise shifts the end of the raw material by 1, and repeats the data processing consisting of steps S32 to S34 881999 times for the pairs of sampled values equivalent to 20 seconds. In other words, the raw material at the end portion is renewed 882000 times. When the digital signal processor 63 completes the data processing on the $882000^{th}$ set of 65536 pairs of sampled values, the central processing unit 62 finds the counter j to be 881999, and the answer at step S33 is changed to affirmative. When the answer at step S33 is given affirmative, the reference correlation data (7634297), reference correlation data (7634296), . . . and reference correlation data (6752298) were stored in the random access memory 64.

Subsequently, the central processing unit 62 requests the digital signal processor 63 to carry out a correlation analysis between the reference correlation data (i) and the reference correlation data (i-j) as by step S35. The digital signal processor 63 determines the similarity between the two sets of audio data, and the data processing for the correlation analysis will be hereinafter described with reference to FIG. 42.

When the central processing unit 62 requests the digital signal processor 63 to carry out the correlation analysis, the central processing unit 62 specifies "source audio data" and "audio data to be analyzed". In this instance, the source audio data is the reference correlation data (i) at the end portion, and the audio data to be analyzed is the reference correlation data (i-j). The pieces of source audio data are expressed as X(0) to X(255), and the pieces of audio data to be analyzed are expressed as $Y_m(0)$ to $Y_m(255)$. "m" is (i-j), and is equal to "n" of the pair of sampled values (n) at the tail of the set of pairs of sampled values.

When the digital signal processor 63 acknowledges the request for the correlation analysis, the digital signal processor 63 reads out the pieces of reference correlation data (i) and the pieces of reference correlation data (i-j).

Subsequently, the digital signal processor 63 determines an absolute correlation index, and compares the absolute correlation index IDXEa with a constant p to see whether or not the absolute correlation index IDXEa is equal to or greater than the constant p.

$$\sum_{i=0}^{255}(x(i)\times Y_m(i))\Big/\sum_{i=0}^{255}(x(i)^2)\geq p \qquad \text{expression 13}$$

The left side of expression 13 is representative of the absolute correlation index IDXEa, and the constant p has a value ranging from zero to 1. In the first calculation, "i" is 7634297, and m is equal to (i-j), i.e., 6752298. When the source audio data X(0) to X(255) are respectively close to the audio data to be analyzed $Y_m(0)$ to $Y_m(255)$, the absolute correlation index IDXEa has a greater value close to 1. If expression 13 is satisfied, the result represents that a music passage is highly correlated with another music passage, and the music passages are corresponding to each other. In other words, even if a first music passage is different in edition from another music passage, the source audio data X(0) to X(255), which represents the part of the music passage, and the pieces of the audio data to be analyzed $Y_m(0)$ to $Y_m(255)$, which represents the other music passage, satisfy expression 13 in so far as the first and second music passages are corresponding to each other. However, when a music passage and another music passage form different parts of a piece of music, the source audio data X(0) to X(255) and the audio data to be analyzed $Y_m(0)$ to $Y_m(255)$ do not satisfy expression 13. In short, the constant p is experimentally optimized in order to result the examination through expression 13 in the manner described hereinbefore.

The digital signal processor further determines a relative correlation index IDXEr, and compares the relative correlation index IDXEr with a constant q to see whether or not the relative correlation index IDXEr is equal to or greater than the constant q.

$$\left\{\sum_{i=0}^{255}(x(i)\times Y_m(i))\right\}^2\Big/\left\{\sum_{i=0}^{255}(x(i)^2)\times\sum_{i=0}^{255}(Y_m(i)^2)\right\}\geq q \qquad \text{expression 14}$$

The left side of expression 14 is representative of a relative correlation index IDXEr, and has a value ranging between zero and 1. The more analogous the audio waveform represented by the source audio data X(0) to X(255) is to the audio waveform represented by the audio data to be analyzed $Y_m(0)$ to $Y_m(255)$, the relative correlation Index IDXEr becomes closer to 1. Even if the audio waveform represented by the source audio data X(0) to X(255) is similar to the audio waveform represented by the audio data to be analyzed $Y_m(0)$ to $Y_m(255)$, the dynamic range may be different between those audio waveforms. In this situation, the value of the absolute correlation index IDXEa is varied. On the other hand, the difference in dynamic range does not have any influence on the relative correlation index IDXEr. In case where the audio waveforms are similar to one another, the relative correlation Index IDXEr becomes close to 1 regardless of the difference in dynamic range.

Both answers to expressions (13) and (14) are assumed to be changed to affirmative. The digital signal processor 63 proceeds to step S52, and calculates the rate of change as expressions (15) and (16).

$$d\left(\sum_{i=0}^{255}(x(i)\times Y_m(i))\right)/dm=0 \qquad \text{expression 15}$$

$$d^2\left(\sum_{i=0}^{255}(x(i)\times Y_m(i))\right)/d^2m=0 \qquad \text{expression 16}$$

The sum of products between X(0) to X(255) and $Y_m(0)$ to $Y_m(255)$ is hereinafter referred to as "correlation value RE". The left side of expression 15 is the rate of change of the correlation value RE at "m". When the pieces of source audio data X(0) to X(255) are respectively paired with the pieces of audio data to be analyzed $Y_m(0)$ to $Y_m(255)$, the correlation value RE becomes large under the condition that the values of each pair are closer to each other. Moreover, when the correlation value RE is plotted in terms of m, the rate of change becomes zero at the extreme values on the function of correlation value RE. Thus, the digital signal processor 63 checks the correlation value RE for the extreme values through expression 15.

Subsequently, the digital signal processor 63 differentiates the function f(RE), again, and checks the function to see whether or not the extreme value is a local maximum MX. Thus, the digital signal processor 63 checks the audio data X(0) to X(255) and $Y_m(0)$ to $Y_m(255)$ to see whether or not the correlation value RE is the local maximum on the function at step S52.

In more detail, the pieces of audio data X(0) to X(255) and the pieces of audio data to be analyzed $Y_m(0)$ to $Y_m(255)$ are discrete values in this instance. It is rare that the left side of expression 15 is strictly equal to zero. For this reason, the decision at step S52 is carried out as follows. First, the digital signal processor 63 calculates the difference $D_m$ between the sum product of X(0) to X(255) and $Y_m(0)$ to $Y_m(255)$ and the sum product of X(0) to X(255) and $Y_{m-1}(0)$ to $Y_{m-1}(255)$. Subsequently, the digital signal processor 63 checks the differences $D_m$ and $D_{m-1}$ to see whether or not the difference $D_{m-1}$ is greater than zero and whether or not the difference $D_m$ is equal to or less than zero. If both answers are given affirmative, i.e., $D_{m-1}$ is greater than zero and $D_m$ is equal to or less than zero, the rate of change is varied from a positive value to zero or across zero. Then, the digital signal processor 63 decides that the extreme value is a local maximum or in the vicinity of the local maximum. This results in the positive answer at step S52. On the other hand, If at least one of the answers is given negative, the answer at step S52 is given negative. With the positive answer at step S52, the digital signal processor 63 notifies the central processing unit 62 of the success, which means that the audio data to be analyzed $Y_m(0)$ to $Y_m(255)$ are highly correlated with the source audio data X(0) to X(255) as by step S53. If the answer at S51 or S52 is given negative, the digital signal processor 63 notifies the central processing unit 62 of the failure, which means that the waveform corresponding to the audio data to be analyzed $Y_m(0)$ to $Y_m(255)$ is not analogous to the waveform corresponding to the source audio data X(0) to X(255) as by step S54.

Figure 65:
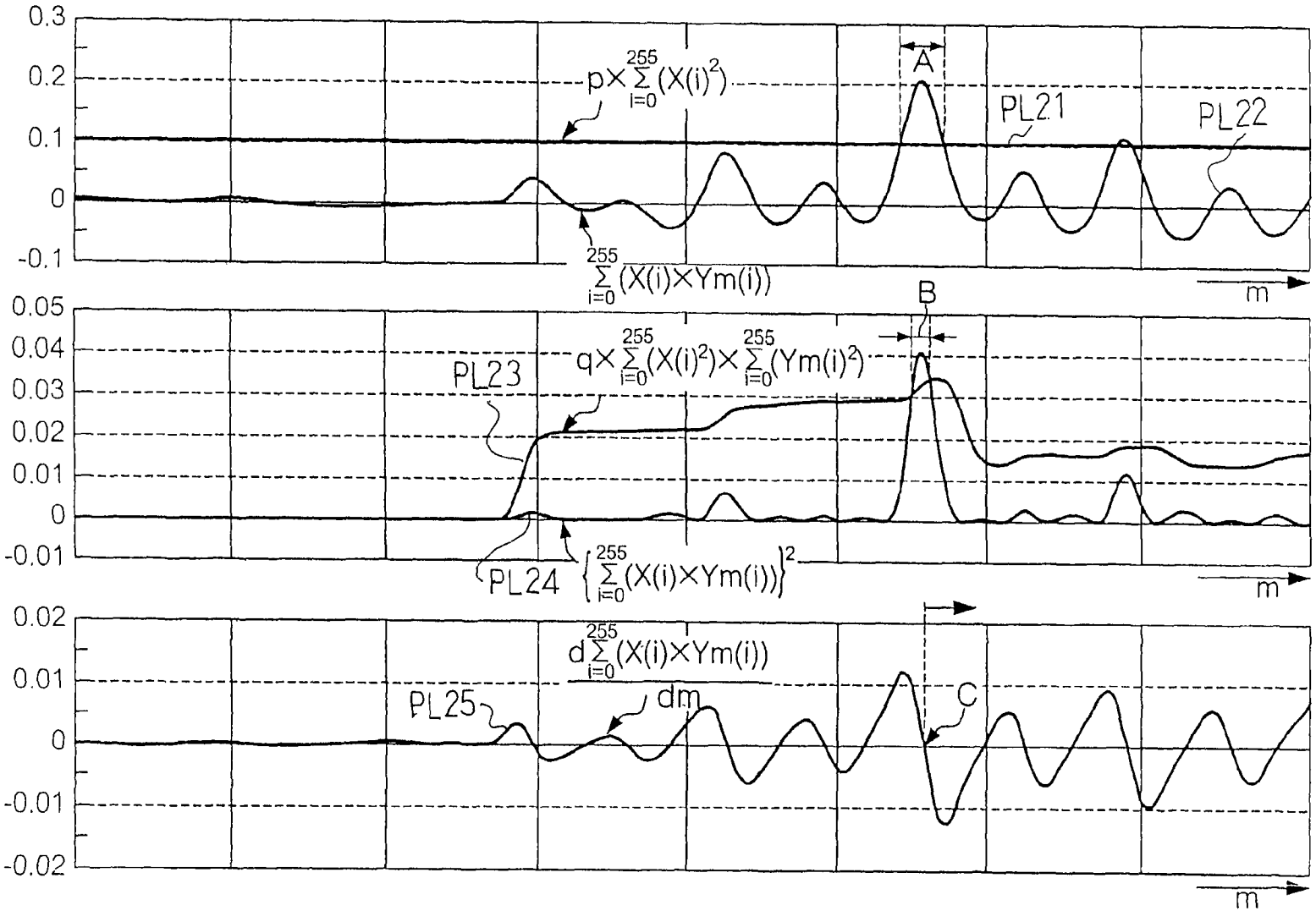
FIG. 65 is a graph showing an absolute correlation index, a relative correlation index and an extreme value thereof.

FIG. 65 shows the values calculated through the expressions used in steps S51 and S52. Plots PL21 are indicative of the product between the constant p and the denominator of the left side of expression 13, plots PL22 are indicative of the numerator of the left side of expression 13. Plots PL23 are indicative of the product between the constant q and the denominator of the left side of expression 14, and plots PL24 are indicative of the numerator of the left side of expression 14. Plots PL25 are indicative of the left side of expression 15. The experiment was carried out under the following conditions. A single stage IIR filter was used as the high-pass filter at 25 Hz (see step S3 of FIG. 57), k and f were 4410 and 1, respectively, in the comb line filter (see step 5 of FIG. 57). A single stage IIR filter was used as the low pass filter at 25 Hz (see the next step 6), and constants p and q were 0.5 and 0.8, respectively. Expression 13 was satisfied in so far as m was fallen within range A, and expression 14 was satisfied under the condition that m was fallen within range B, which was within the range A. When m was C, which was in the range B, expression 15 was satisfied, and expression 16 was also satisfied at C. Thus, the answer at step S52 was given affirmative at C.

Turning back to FIG. 63, if the digital signal processor 63 notifies the central processing unit 62 of the failure, the central processing unit 62 decrements "i-j" by one as by step S37, and requests the correlation analysis to the digital signal processor 63, again. On the other hand, when expressions 13, 14, 15 and 16 are satisfied, the digital signal processor 63 notifies the central processing unit 62 of the success, and the answer at step S36 is given affirmative. When the central processing unit 62 requests the digital signal processor 63 to carry out the correlation analysis for the first time, the source audio data is corresponding to the pieces of reference correlation data (7634297), and the audio data to be analyzed is corresponding to the pieces of reference correlation data (6752298). The correlation analysis usually results in the failure, and the central processing unit 62 returns to step S35 through step S37. Thus, the central processing unit 62 cooperates with the digital signal processor 63, and reiterates the loop consisting of steps S35 to S37.

If there is not any audio waveform analogous to the audio waveform represented by the source audio data in the end portion of the audio data NA equivalent to the tone and/silence for 20 seconds, the loop consisting of steps S35, S36 and S36 is repeated 881999 times, and the correlation analysis at step S35 is repeated 882000 times. Although the source audio data, i.e., "i" is unchanged, the audio data to be analyzed, i.e., "j" is changed. When the source audio data is corresponding to the pieces of reference correlation data (7634297), the audio data to be analyzed is changed from the pieces of reference correlation data (6752298), through the pieces of reference correlation data (6752299), the pieces of reference correlation data (6752300), . Upon completion of the $882000^{th}$ correlation analysis, "j" is equal to "i", and the audio data to be analyzed becomes same as the source audio data. This results in the positive answer at step S36.

With the positive answer at step S36, the central processing unit 62 checks "j" to see whether or not the audio data to be analyzed is same as the source audio data as by step S38. If there is not any audio waveform same as that represented by the source audio data in the end portion equivalent to 20 seconds, the answer at step S36 is continuously given negative until the audio data to be analyzed becomes same as the source audio data, and the answer at step S38 is given affirmative. Then, the central processing unit 62 stores the piece of correlation data (i) and its arrival time in the random access memory 64 as by step S39. In the following description, terms "reference ending audio data" and "reference ending time" mean the reference correlation data and its arrival time stored in the random access memory 64, respectively. If the digital signal processor 63 notifies the central processing unit 62 of the succeed at the correlation analysis for the first time, "i" is 7634297, and the arrival time of the pair of sampled value (7634297), i.e., 173.11 seconds is stored in the random access memory 64 as the reference ending time.

If, on the other hand, the digital signal processor 62 finds an audio waveform to be analogous to the audio waveform represented by the source audio data within the audio data to be analyzed equivalent to 20 seconds, expressions 13, 14, 15 and 16 are satisfied in the correlation analysis before the loop consisting of steps S35 to S37 repeated 881999 times, and the digital signal processor 63 notifies the central processing unit 62 of the succeed. Then, the answer at step S36 is changed to affirmative. However, the answer at step S38 is given negative. With the negative answer at step S38, the central processing unit 62 investigates whether or not "i", i.e., the sum of W+65536+881999 or the sum of W+947535 is equal to 7297935 as by step S40. If the source audio data is the $882000^{th}$ reference correlation data counted from the head of the queue, the answer at step S40 is given affirmative. When the central processing unit 62 investigates the source audio data for the first time, "i" is equal to Z, which is equal to 7634297, and the answer at step S40 is given negative. Then, the central processing unit decrements "i" by one, and changes "j" to 881999 as by step S41. The central processing unit 62 returns to step S32. The pieces of reference raw material (i-j) have been shifted to the head of the queue by one, because "i" was decremented by one and "j" was changed to 88199.

The central processing unit 62 is assumed to achieve the job at step S41 for the first time. The central processing unit 62 carries out the correlation analysis on the reference correlation data (6752297) at step S32, because "i" is 7634296. This means that the piece of correlation data (6752297) is newly stored in the random access memory 64 together with the pieces of correlation data (7634297)-(6752298). Since j is 881999, the answer at step S33 is given affirmative. The central processing unit 62 proceeds to step S35, and reiterates the loop consisting of steps S35 to S37. When the digital signal processor 63 notifies the central processing unit 62 of the succeed, the answer at step S36 is given affirmative, and the central processing unit 62 proceeds to step S38. As described hereinbefore, in case where there is not any other waveform analogous to the audio waveform represented by the source audio data having the sampled value (i) at the tail in the end portion of the audio data NA equivalent to 20 seconds, "j" is zero, and the central processing unit 62 proceeds to step S39 for storing the reference ending audio data and reference ending time in the random access memory 64.

If, on the other hand, the answer at step S38 is given negative, the central processing unit 62 proceeds to step S40.

Thus, the central processing unit 62 and digital signal processor 63 reiterate the loop consisting of steps S32 to S38, S40 and S41 until the answer at step S38 is changed to affirmative. While the central processing unit 62 and digital signal processor 63 are repeating the loop, the central processing unit 62 decrements "i" by one at step S41. If the sampled values in the queue are representative of a constant audio waveform, the answer at step S38 is never changed to affirmative. As a result, "i" becomes equal to the sum of W and 947535, i.e., 7297935. Then, the answer at step S40 is changed to affirmative. With the positive answer at step S40, the central processing unit 62 requests the manipulating panel/display 5 to produce an error message as by step S42. The error message means that the data processing for the reference ending audio data and reference ending time has resulted in failure.

The central processing unit 62 is assumed to successfully complete the data processing for producing the reference ending audio data and reference ending time. The central processing unit 62 reads out (1) the reference correlation data at the head portion, (2) reference starting time, (3) note events, (4) reference ending audio data and (5) reference ending time from the random access memory 64, and fabricates the track chunk from these data codes. The central processing unit 62 adds the header chunk to the track chunk. When the standard MIDI file is completed, the central processing unit 62 supplies the standard MIDI file to the floppy disc driver 2C, and requests the floppy disc driver 2C to store the standard MIDI file in the floppy disc FD.

Figure 66:
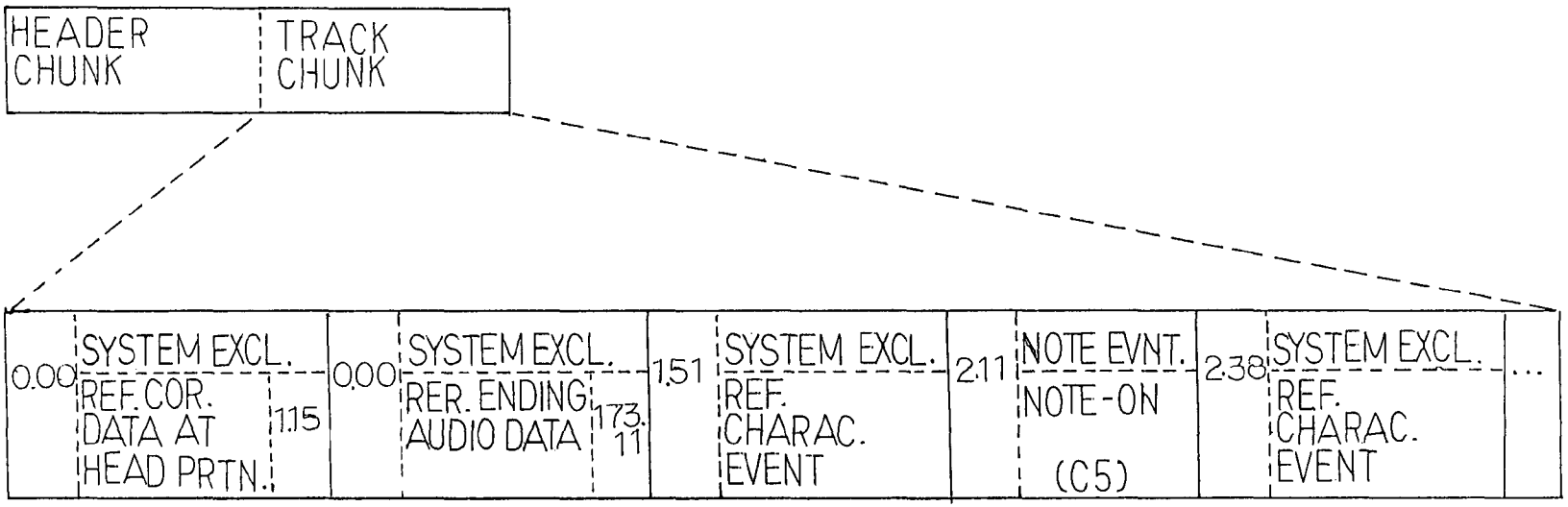
FIG. 66 is a view showing the data structure of a standard MIDI file.

FIG. 66 shows the data structure of the standard MIDI file. The standard MIDI file is broken down into a header chunk and a track chunk. System exclusive event codes and note event codes are respectively associated with the delta time codes, and are stored in the track chunk. The first system exclusive event code is assigned to the pieces of reference correlation data at the head portion and reference starting time indicative of 1.15 seconds. The second exclusive event code is assigned to the reference ending audio data and reference ending time indicative of 173.11 seconds. Although the delta time codes are indicative of 0.00 second for the first and second system exclusive event codes, those system exclusive event codes may be moved to another place or places in the track chunk, and the delta time codes are indicative of other lapses of time. The third to last system exclusive event codes are mixed with the note event codes, and these system exclusive event codes and note event codes are respectively accompanied with the delta time codes. In this instance, the third system exclusive event code and fourth system exclusive event codes are representative of the reference characteristic events, and these reference characteristic events take place at 1.51 seconds and 2.38 seconds, respectively. The first note event takes place at 2.11 seconds, and the acoustic piano tone is to be generated at C5.

Figure 67:
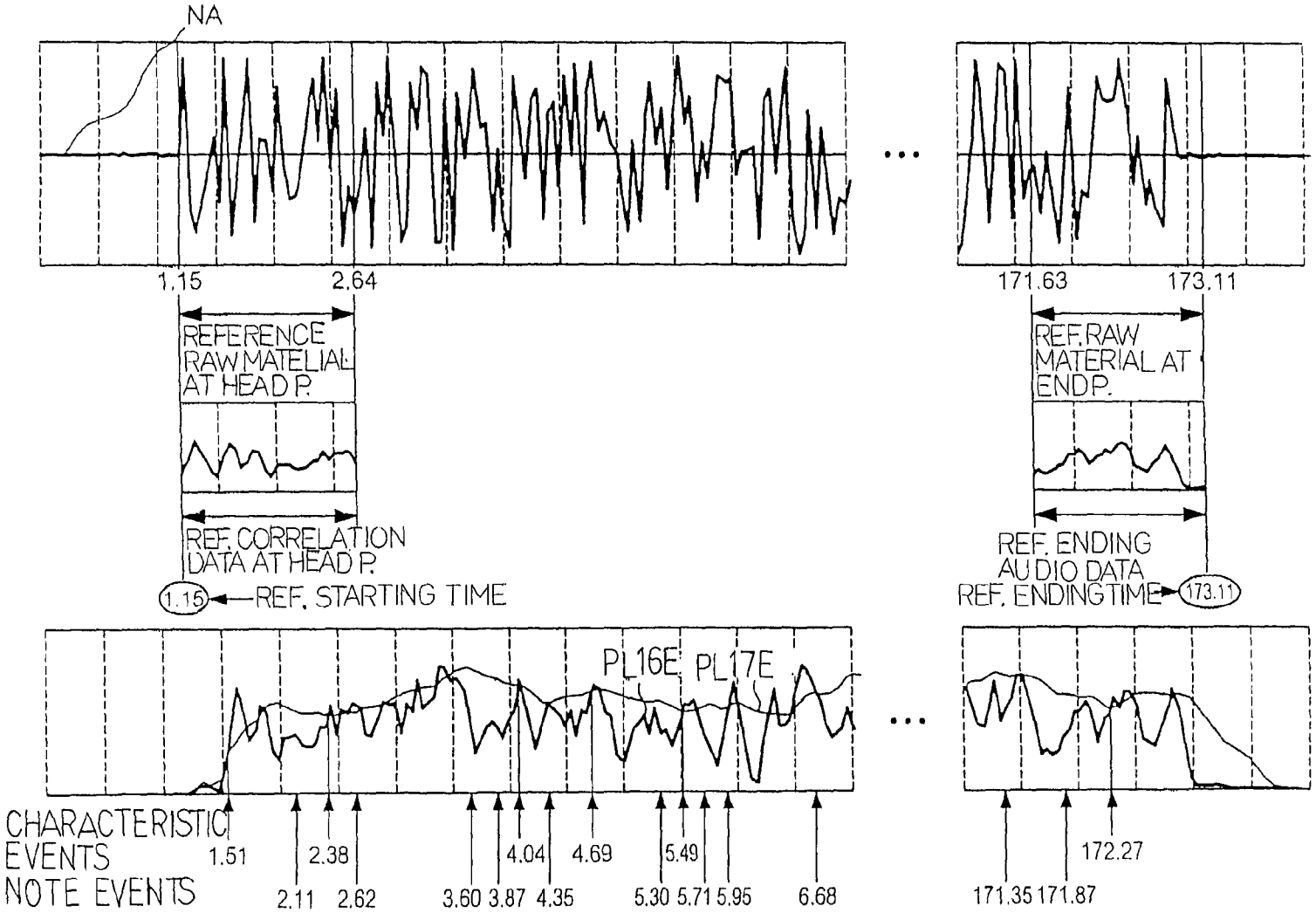
FIG. 67 is a view showing a relation between an audio waveform represented by audio data and characteristic/note events.

FIG. 67 shows a relation between an audio waveform represented by the audio data NA and the system exclusive/note events stored in the standard MIDI file. Plots NA designate the audio waveform represented by the audio data recorded in the compact disc CD-A, and the time goes rightward. The audio waveform expresses the silence until 1.15 seconds, and the electric tones are produced after the silence. In this instance, the reference starting time is 1.15 seconds.

The pairs of audio music data codes from 1.1.5 seconds to 2.64 seconds serve as the reference raw material, and the reference correlation data at the head portion are produced from the reference raw material at the head portion. The characteristic events are extracted from the reference raw material at the head portion. Plots PL16E and plots PL17E are indicative of the medium-range index and long-range index, respectively.

The pairs of audio music data codes from 171.63 seconds to 173.11 seconds serve as the reference raw material at the end portion, and the reference ending audio data is produced from the reference raw material at the end portion. In this instance, one of the pairs of sampled values becomes lower than the threshold at 173.11 seconds so that the lapse of time 173.11 seconds is stored in the standard MIDI file as the reference ending time.

Synchronous Playback

Description is hereinafter made on the synchronous playback mode. The compact disc CD-B is used in the synchronous playback. Although the piece of music was also recorded in the compact disc CD-B, the piece of music in the compact disc CD-B was edited differently from the piece of music recorded in the compact disc CD-A. This means that the silent time, dynamic range and time intervals between the tones are different between the piece of music recorded in the compact disc CD-A and the same piece of music recorded in the compact disc CD-B. For this reason, the audio data stored in the compact disc CD-B is hereinafter referred to as "audio data NB".

The user loads the compact disc CD-B into the compact disc driver 1G, and the floppy disc FD, in which the standard MIDI file was stored, into the floppy disc driver 2G. Subsequently, the user instructs the controller 6G to reproduce the performance on the keyboard 31*e* in good ensemble with the playback of the piece of music recorded in the compact disc CD-B.

When the central processing unit 62 acknowledges the user's instruction, the central processing unit 62 requests the floppy disc driver 2G to transfer the system exclusive event codes, delta time codes thereof, note event codes and delta time codes thereof from the floppy disc FD to the interface 65*a*. While the floppy disc driver 65*a* is transferring the data codes to the interface 65*a*, the central processing unit 62 transfers the system exclusive event codes, their delta time codes, note event codes and their delta time codes to the random access memory 64 for storing them therein.

First, the central processing unit 62 cooperates with the digital signal processor 63 for rescheduling the note events. The silence before the performance and silence after the performance are different in length between the audio data NA and the audio data NB. Moreover, the tempo is different between the performance recorded in the compact disc CD-A and the performance recorded in the compact disc CD-B. Nevertheless, the controller 6G eliminates the differences from between the lapse of time represented by the delta time codes in the standard MIDI file and the lapse of time represented by the audio time codes transferred from the compact disc driver 1G, and reschedules the note events to be reproduced in the synchronous playback.

Figure 68:
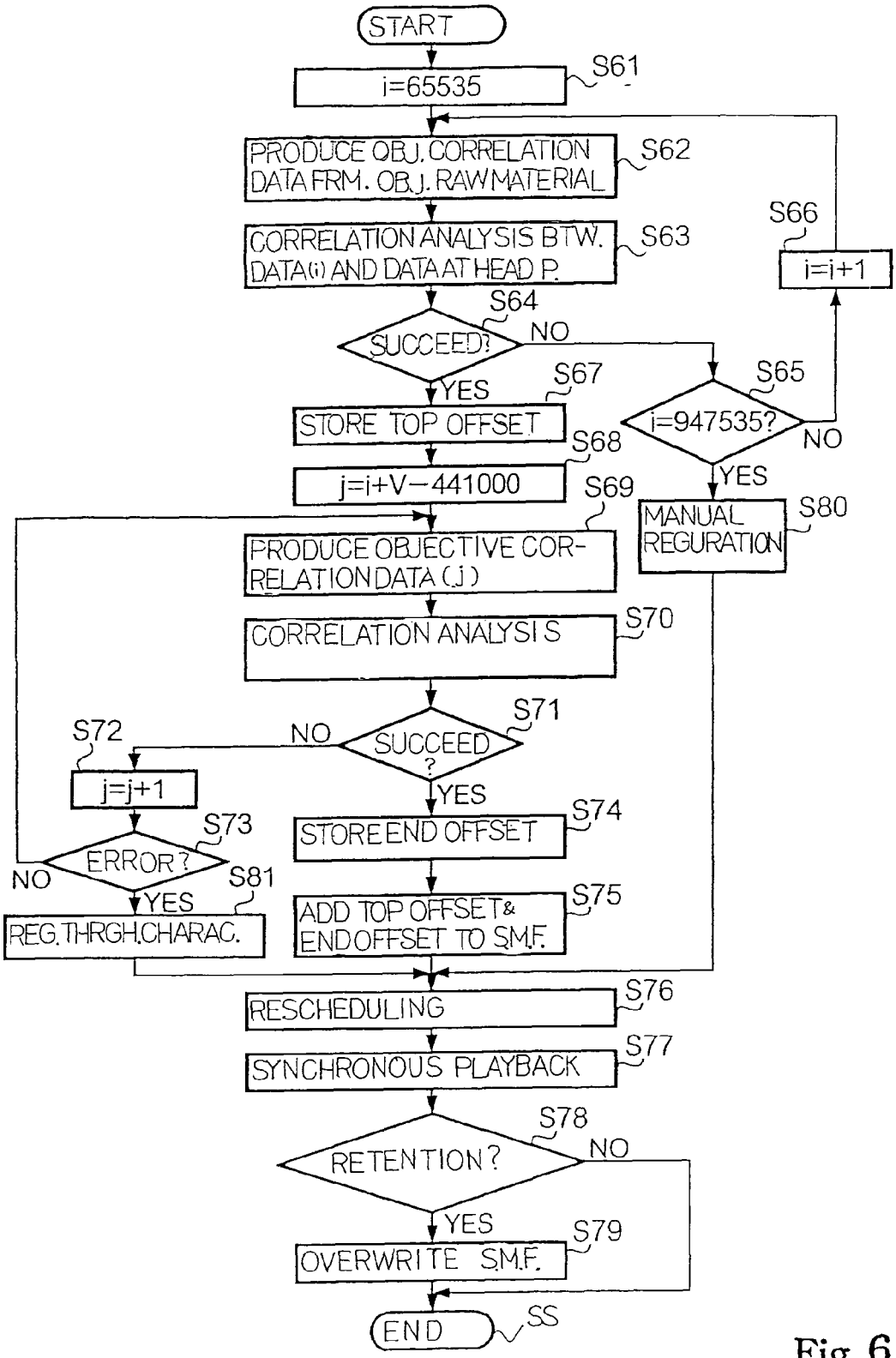
FIG. 68 is a flowchart showing a method for rescheduling note events in the synchronous playback.

FIG. 68 shows a method for rescheduling the note events. First, the central processing unit 62 defines a counter "i", and adjusts the counter "i" to 65535 as by step S61. Subsequently, the central processing unit 62 requests the compact disc driver 1G to transfer the audio data NB from the compact disc CD-B to the interface 65*a*. The compact disc driver 1G transfers the pairs of audio music data codes at time intervals of $1/44100$ second to the interface 65*a*, and the central processing unit 62 stores the pairs of sampled values and arrival time of each pair of audio music data codes in the random access memory 64. When the first pair of audio music data codes arrives at the interface 65*a*, the central processing unit 62 starts to count the clock pulses of the clock signal. The number of clock pulses is indicative of a lapse of time from the arrival of the first pair of audio music data codes, i.e., initiation time Q. The first pair of audio music data codes expresses the first pair of sampled values (0), and the next pair of audio music data codes expresses the pair of sampled values (1). Thus, the pairs of sampled values (0), (1), (2), . . . intermittently arrive at the interface 65*a*, and joins a queue together with their arrival times. The queue is formed in the random access memory 64. The arrival time is equal to the lapse of time from the initiation time Q. The arrival time of a pair of sampled values (n) is expressed as "arrival time (n)". In this instance, 1323000 pairs of sampled values and their arrival times join the queue at the maximum.

A pair of sampled values (i) is assumed to join the queue together with the arrival time (i). Then, the central processing unit 62 requests the digital signal processor 63 to produce pieces of objective correlation data from the 65536 pairs of sampled values, which are hereinafter referred to as "objective raw material". The pair of sampled values (i) occupies the tail of the objective raw material. The digital signal processor 63 carries out the data processing for producing the pieces of correlation data from the raw material as by step S62. The data processing for producing the objective correlation data is similar to that shown in FIG. 57, and description is omitted for avoiding repetition. Upon completion of the data processing, the pieces of objective correlation data (i) are stored in the random access memory 64.

Figure 64:
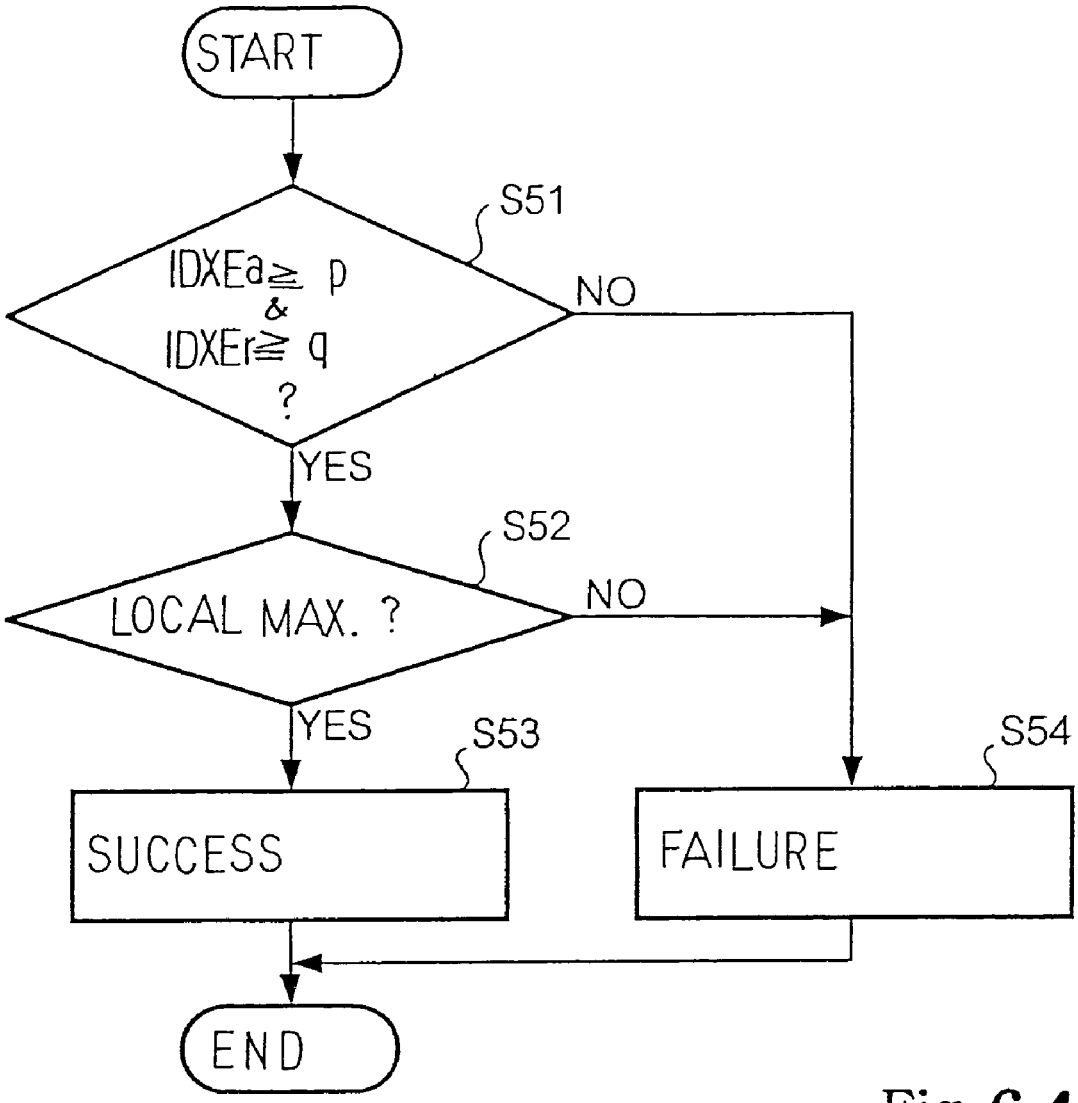
FIG. 64 is a flowchart showing a data processing for a correlation analysis.

Subsequently, the central processing unit 62 requests the digital signal processor 63 to carry out the correlation analysis between the reference correlation data at the head portion and the objective correlation data (i). The digital signal processor 63 reads out the reference correlation data at the head portion already stored in the standard MIDI file transferred to the random access memory 64 and the objective correlation data stored in the random access memory at step S62, and investigates whether or not the objective correlation data (i) is highly correlated with the reference correlation data at the head portion as by step S63. The data processing for the correlation analysis is similar to the data processing shown in FIG. 64, and no further description is hereinafter incorporated for the sake of simplicity.

When the data processing for the correlation analysis is completed, the digital signal processor 63 notifies the central processing unit 62 of the result of the data processing, i.e., succeed or failure. Then, the central processing unit 62 checks the notification to see whether or not the data processing is successfully completed as by step S64. If the objective correlation data (i) is highly correlated with the reference correlation data at the head portion, the answer is given affirmative. However, it is rare to initiate the performance without silence. The answer at step S64 is usually given negative upon completion of the data processing for the first time.

With the negative answer at step S64, the central processing unit 62 checks the counter (i) to see whether or not "i" is 947535, i.e., 65535+882000 as by step S65. If the digital signal processor 63 fails to find all the objective correlation data equivalent to 20 seconds from the initiation to be less correlated with the reference correlation data at the head, the answer at step S65 is given affirmative, and the central processing unit 62 gives up the correlation analysis. Thus, the data processing at step S65 prevents the digital signal processor 63 from the correlation analysis endlessly.

When the digital signal processor 63 completes the correlation analysis for the first time, the counter (i) is indicative of 65535, and, accordingly, the answer at step S65 is given negative. Then, the central processing unit 62 increments the counter (i) by 1 as by step S66, and returns to step S62. Thus, the central processing unit 62 cooperates with the digital signal processor 63, and reiterates the loop consisting of steps S62 to S66 until the digital signal processor 63 finds the objective correlation data (i) to be highly correlated with the reference correlation data at the head portion.

The digital signal processor 63 is assumed to notify the central processing unit 62 that the objective correlation data, which has been produced from the objective raw material having the pair of sampled values (28740) occupying at the head thereof, is highly correlated with the reference correlation data. Although the central processing unit 62 and digital signal processor 63 fails to find the objective correlation data highly correlated with the reference correlation data 28740 times, the digital signal processor 63 notifies the central processing unit 62 of the successful result upon completion of the $28741^{st}$ data processing. The reference correlation data and objective correlation data were produced from the reference raw material at the head portion and objective raw material representative of a part of the piece of music through the same data processing. This means that the music passage represented by the set of pieces of objective raw material (97275) is corresponding to the music passage represented by the pieces of reference correlation data at the head portion.

With the positive answer at step S64, the central processing unit 62 divides the difference (i−65535) by 44100, and determines an objective starting time corresponding to the reference starting time. The pair of sampled values, which exceeds the threshold, occupies the place at the objective starting time. The answer at step S64 is assumed to be changed at "i"=94275. The calculation on (94275−65535)/44100 results in 0.65. This means that the pair of sampled values exceeds the threshold at 0.65 second from the initiation of the playback. Subsequently, the central processing unit 62 reads out the reference starting time from the random access memory 64, and calculates the difference between the objective starting time and the reference starting time. The time difference is hereinafter referred to as "top offset". The top offset takes a negative value if the initiation of the piece of music NB is earlier than the initiation of the piece of music NA. On the other hand, when the initiation of the piece of music NB is delayed from the initiation of the piece of music NA, the top offset takes a positive value. The objective starting time and reference starting time are assumed to be 0.65 second and 1.15 seconds, respectively. The top offset is calculated through the subtraction of the reference starting time from the objective starting time, i.e., (0.65−1.15), and is −0.50 second. The central processing unit 62 stores the top offset in the random access memory 64 as by step S67.

Subsequently, the central processing unit 62 reads out the reference starting time and the reference ending time from the random access memory 64, and subtracts the reference ending time from the reference starting time. The central processing unit 62 multiplies the difference between the reference starting time and the reference ending time by 441000 so as to determine the number of pairs of audio music data codes between the reference starting time and the reference ending time. The number of the pairs of audio music data codes between the reference starting time and the reference ending time is equal to the number of the pairs of audio music data codes between the first piece of reference correlation data at the head portion and the last piece of reference ending audio data. Subsequently, the central processing unit 62 subtracts 65536 from the number of the pairs of audio music data codes. The difference "V" is equal to the number of the pairs of audio music data codes between the last piece of reference correlation data and the last piece of ending audio data.

For example, the reference starting time and reference ending time are assumed to be 1.15 seconds and 173.11 seconds. The time period between the reference starting time and the reference ending time is given as (173.11−1.15), i.e., 171.96 seconds. Then, the number of the pairs of audio music data codes is given as 171.96×44100, which results in 7583436. The difference "V" is given as 7583436−65536=7517900.

Subsequently, the central processing unit 62 defines a counter "j", and adjusts the counter "j" to (i+V−441000) as by step S68. The pieces of objective raw material (i) at the head portion recorded in the compact disc CD-B are corresponding to a passage of the piece of music N for 1.49 seconds. The audio data representative of the last part of the piece of music N for 1.49 seconds is presumed to be around the objective raw material (i+V). The pieces of objective raw material (i), i.e., (i+V−441000) are to be found 10 seconds before the objective raw material (i+V).

Subsequently, the central processing unit 62 requests the compact disc driver 1G to transfer the pairs of audio music data codes (j−65535), (j−065534), . . . From the compact disc CD-B to the interface 65*a*. While the compact disc driver 1G is transferring the pairs of audio music data codes (j−65535), (j−65534), . . . to the interface 65*a*, the central processing unit 62 determines the arrival time for each pair of audio music data codes, and stores the pairs of sampled values in the random access memory 64 together with the arrival times. The pairs of sampled values and arrival times join a queue in the random access memory 64.

When the pair of sampled values (j) joins the queue, the central processing unit 62 requests the digital signal processor 63 to produce the objective correlation data from the objective raw material (j). Then, the digital signal processor 63 starts to produce the objective correlation data from the objective raw material (j) as by step S69. The data processing for producing the objective correlation data is similar to that shown in FIG. 57. Upon completion of the data processing, the objective correlation data (j) is stored in the random access memory 64.

Subsequently, the central processing unit 62 requests the digital signal processor 63 to carry out the correlation analysis between the reference ending audio data, which was stored in the standard MIDI file, and the objective correlation data (j) stored in the random access memory at step S69. The digital signal processor 63 reads out the reference ending audio data and the objective correlation data (j) from the random access memory 64, and carries out the correlation analysis for the objective correlation data (j) highly correlated with the reference ending audio data as by step S70. The data processing for the correlation analysis is similar to that shown in FIG. 64. When the digital signal processor 63 completes the data processing for the correlation analysis, the digital signal processor 63 notifies the central processing unit 62 of the result of the correlation analysis.

The digital signal processor 63 checks the notification to see whether or not the correlation analysis results in the succeed as by step S71. It is rare that the time for reproducing the piece of music NB is different from the time for reproducing the piece of music NA by 10 seconds. For this reason, when the digital signal processor 63 completes the data processing for the first time, the answer at step S71 is given negative "No". Then, the central processing unit 62 increments the counter (j) by 1 as by step S72, and requests the digital signal processor 63 to produce the next objective correlation data from the new objective raw material. If the counter (j) is greater than the total number of the pairs of sampled values of the audio data NB, i.e., the objective raw material has already reached the end of the audio data NB, the digital signal processor 63 fails to read out the objective raw material (j) from the queue, and notifies the central processing unit 62 of the failure. For this reason, the central processing unit 62 checks the register to see whether or not the digital signal processor 63 has sent the error message as by step S73. When the central processing unit 62 increments the counter (j) for the first time, the objective raw material (j) does not reach the end of the audio data NB, and the answer at step S73 is given negative.

With the negative answer at step S73, the central processing unit 62 returns to step S69, and requests the digital signal processor 63 to produce the next objective correlation data (j) from the objective raw material. Thus, the central processing unit 62 and digital signal processor 63 reiterates the loop consisting of steps S69 to S73, and searches the audio data NB for the objective correlation data (j) highly correlated with the reference ending audio data.

When the digital signal processor 63 finds the objective correlation data to be highly correlated with the reference ending audio data, the digital signal processor 63 notifies the central processing unit 62 of the succeed, and the answer at step S69 is changed to affirmative "Yes". Then, the central processing unit 62 requests the compact disc driver 1G to stop the data transfer from the compact disc CD-B to the interface 65*a*.

Subsequently, the central processing unit 62 divides the number "j" by 44100, and determines the objective ending time, at which the playback of the piece of music NB is to be completed. If the counter (j) is indicative of 7651790, the objective ending time is 7651790/44100, i.e., 173.51 seconds. Subsequently, the central processing unit 62 reads out the reference ending time from the random access memory 64, and determines an end offset, i.e., the difference between the objective ending time and the reference ending time. In this instance, the end offset is 0.40 second, i.e., 173.51−173.11. The central processing unit 62 stores the end offset in the random access memory 64 as by step S74. Furthermore, the central processing unit 62 adds the top offset and end offset to the standard MIDI file already transferred to the random access memory 64 as by step S75.

Figure 69:
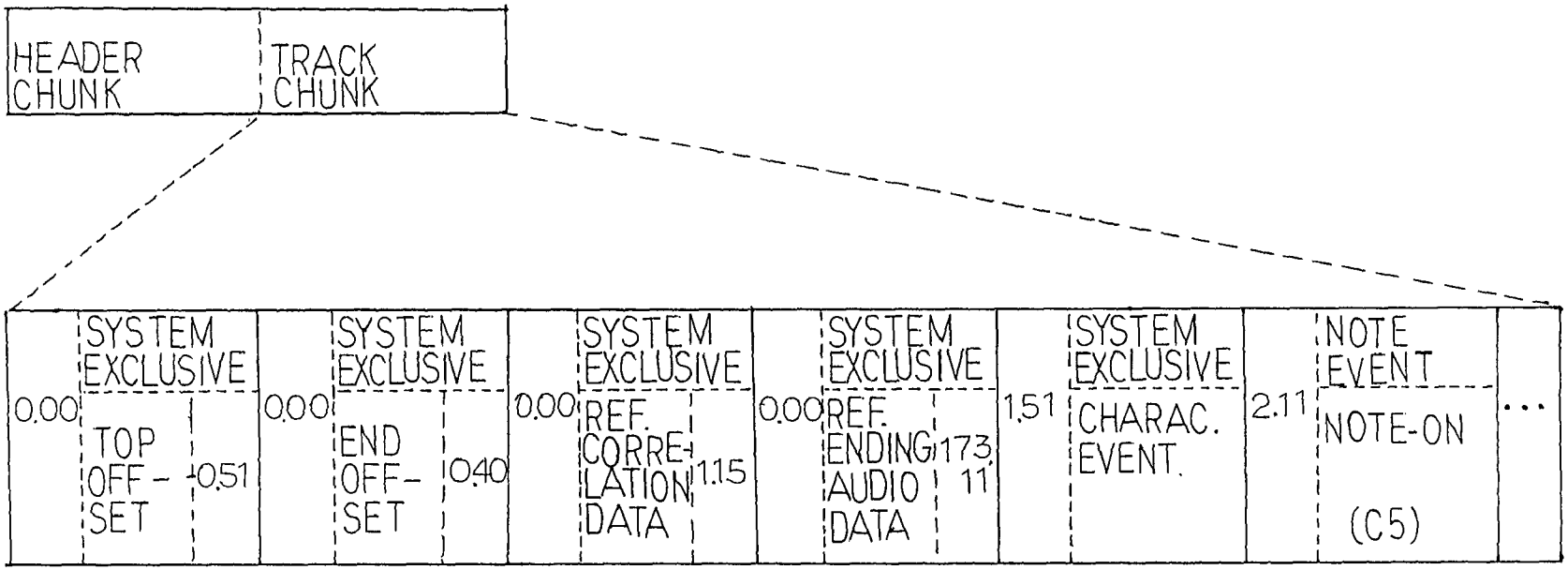
FIG. 69 is a view showing the data structure of a standard MIDI file created after the correlation analysis for a top offset time and an end offset time.

FIG. 69 shows the top offset and end offset added to the standard MIDI file. The top offset and end offset are stored in the system exclusive event codes. The first, second, third and fourth system exclusive event codes are respectively assigned to the top offset, end offset, reference correlation data at the head portion and reference ending audio data, and the system exclusive event codes, which are assigned to the reference characteristic events, are mixed with the note event codes. All the system exclusive/note event codes are associated with the delta time codes. In this instance, the first to fourth system exclusive event codes are associated with the delta time codes indicative of zero. However, other delta time codes may be added to these system exclusive event codes.

Upon completion of the addition of the system exclusive event codes representative of the top offset and end offset to the standard MIDI file, the central processing unit 62 reads out all the note event codes from the standard MIDI file stored in the random access memory 64, and reschedules the note events as by step S76. The rescheduling is carried out through the following expression.

$$d=(N_T+O_T)+(D-N_T)\times\{(N_E+O_E)-(N_T+O_T)\}/(N_E-N_T) \quad \text{Expression 17}$$

where d is the delta time after the rescheduling, D is the delta time before the rescheduling, $N_T$ is the reference starting time, $N_E$ is the reference ending time, $O_T$ is the top offset and $O_E$ is the end offset.

In expression 17, $(N_T+O_T)$ is indicative of the timing to start the playback on the audio data NB with respect to the timing to reproduce the first pair of sampled values, and $(D-N_T)$ is indicative of the timing to reproduce a note event with respect to the initiation of the playback on the audio data NA representative of the piece of music N. $\{(N_E+O_E)-(N_T+O_T)\}$ is indicative of the time to be consumed for reproducing the piece of music N represented by the audio data NB, and $(N_E-N_T)$ is indicative of the time to be consumed for reproducing the piece of music N represented by the audio data NA. The second term $(D-N_T)\times\{(N_E+O_E)-(N_T+O_T)\}/(N_E-N_T)$ is indicative of the timing to reproduce a corresponding note event with respect to the initiation of the playback on the audio data NB. Therefore, d is indicative of the timing to reproduce the corresponding note event with respect to the timing to reproduce the first pair of sampled values of the audio data NB.

The first note event is representative of the note-on at C5 (see FIG. 69). The note-on at C5 is rescheduled through the calculation of expression 17. D is 2.11, $N_T$ is 1.15, $N_E$ is 173.11, $O_T$ is −0.50, and $O_E$ is 0.40. The note-on is rescheduled at 1.62 seconds through the calculation of expression 17. All the event codes are rescheduled, and regulated delta time codes, which are indicative of the timing to produce the note events in the synchronous playback, are stored in the random access memory 64.

Upon completion of the rescheduling, the central processing unit 62 start the synchronous playback, i.e., synchronously reproducing the performance expressed by the note events and the piece of music represented by the audio data NB as by step S77. In detail, the central processing unit 62 requests the compact disc driver 1G to transfer the pairs of audio music data codes from the compact disc CD-B to the interface 65*a*. The compact disc driver 1G starts to transfer the pairs of audio music data codes from the compact disc CD-B to the interface 65*a* at regular intervals of 1/44100 second. When the first pair of audio music data code (0) reaches the interface 65*a*, the central processing unit 62 determines the arrival time on the basis of the clock signal, and the arrival time of the first pair of audio music data codes as the reference time R. The central processing unit 62 starts to measure the lapse of time from the reference time R.

The central processing unit 62 intermittently receives the pair of audio music data codes (0), (1), (2), . . . , and transfers them to the audio unit 4E. The pairs of audio music data codes are converted to the electric tones through the laud speakers 44. Thus, the user hears the piece of music NB through the audio unit 4G.

The central processing unit 62 sequentially reads out the regulated delta time codes from the random access memory 64, and compares the lapse of time with the time expressed by each regulated delta time code to see whether or not the associated note event code is to be supplied to the automatic player piano 3G. When the lapse of time becomes equal to the time expressed by the regulated delta time code, the central processing unit 62 supplies the note event code to the controller 34.

When the controller 34 receives the note event code, the controller 34 checks an internal flag for the user's option, i.e., acoustic piano 31A or the audio unit 4G. If the user's option is the audio unit 4G, the controller 34 supplies the note event code to the tone generator 35. The tone generator produces the digital audio signal on the basis of the note event code, and supplies the digital audio signal to the mixer 41. Thus, the synchronous playback is achieved through only the audio unit 4G. On the other hand, if the user's option is the acoustic piano 3G, the controller 34 determines a trajectory along which the black/white key is moved. The controller 34 notifies the driver 36*a* of the trajectory, and driver 36*a* produces the driving signal on the basis of the notification. The driver 36*a* supplies the driving signal to the solenoid-operated key actuator 36*b* so that the solenoid-operated key actuator 36*b* gives rise to the rotation of the black/white key. The black/white key actuates the action unit 31*b*, which in turn drives the hammer 31*c* for rotation. The hammer strikes the string 31*d* at the end of the rotation, and the acoustic piano tone is radiated from the vibrating string 31*d*. Since the note events have been already regulated to appropriate timing for the synchronous playback, the user feels the acoustic piano tones and electric tones to be in good ensemble with each other.

When the central processing unit 62 supplies the last pair of audio music data codes and the last note event to the audio unit 4G and automatic player piano 3G, respectively, the central processing unit 62 requests the manipulating panel/display to produce a prompt message such as, for example, "Do you want to store the top offset and end offset ?" The prompt message is produced on the display, and the central processing unit 62 waits for the user's instruction as by step S78.

If the user gives the negative answer "No", the central processing unit 62 terminates the data processing for the synchronous playback at step SS. When the user instructs the controller 6G to store the top offset and end offset in the floppy disc FD, the central processing unit 62 supplies the standard MIDI file from the random access memory 64 to the floppy disc driver 2G, and requests the floppy disc driver 2G to overwrite the standard MIDI file. The floppy disc driver 2G overwrites the new standard MIDI file as by step S79, and the new standard MIDI file is stored in the floppy disc FD. Upon completion of the retention, the central processing unit 62 terminates the data processing for the synchronous playback at step SS. The standard MIDI file overwritten by the floppy disc driver 2G is hereinafter referred to as "Standard MIDI File B".

The central processing unit 62 successfully completes the data processing for the synchronous playback in so far as the audio data NB is not widely different from the audio data NA. However, if the difference between the audio data NB and the audio data NA is serious, the central processing unit 62 fails to find the objective correlation data at steps S63 and/or S70. In this situation, the central processing unit 62 reschedules the note events as follows.

First, the central processing unit 62 is assumed not to find any objective correlation data (i) highly correlated with the reference correlation data at the head portion. In this situation, the central processing unit 62 repeats the negative answer at step S64, and, the counter (i) finally reaches 947535. Then, the answer at step S65 is given affirmative "Yes", and the user starts the manually regulate the delta time codes as by step S80.

Figure 70:
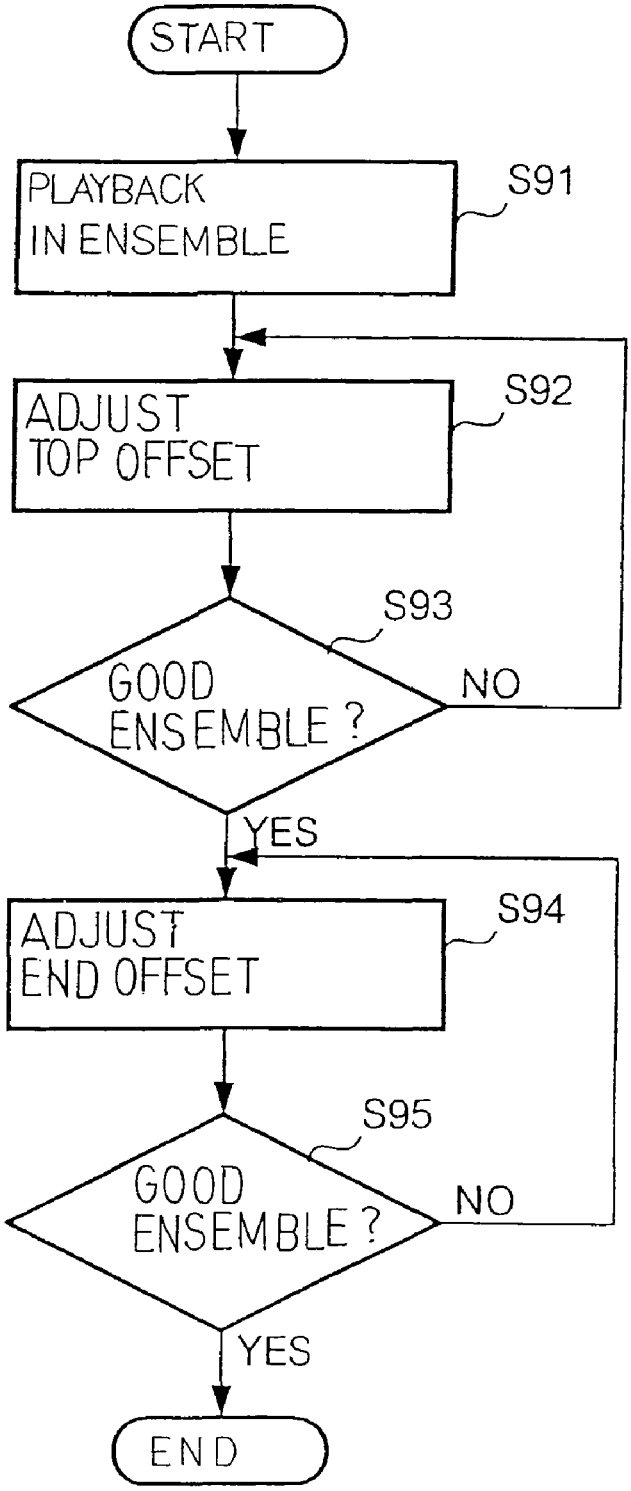
FIG. 70 is a flowchart showing a method for manually rescheduling timing to produce event codes.

The manual regulation proceeds as shown in FIG. 70. Firstly, the central processing unit 62 defines counters $O_T$ and $O_E$, and adjusts the counters $O_T$ and $O_E$ to zero. The counter $O_T$ is assigned to the top offset, and the counter $O_E$ is assigned to the end offset. Subsequently, the central processing unit 62 requests the compact disc driver 1G to stop the data transfer and restart the data transfer at the head of the audio data NB. When the first pair of audio music data codes reaches the interface 65*a*, the central processing unit 62 starts to measure the lapse of time. While the compact disc driver 1G is transferring the pairs of audio music data codes to the interface 65*a* at the regular intervals of 1/44100 second, the central processing unit 62 supplies the pairs of sampled values to the audio unit 4G. The pairs of sampled values are converted to the electric tones through the laud speakers 44. When the central processing unit 62 starts to measure the lapse of time, the central processing unit 62 reads out the first delta time code from the standard MIDI file already stored in the random access memory 64, and compares the time expressed by the first delta time code with the internal clock to see whether or not the internal clock catches up the delta time code. When the answer is given affirmative, the central processing unit 62 supplies the associated note event to the automatic player piano 3G. The acoustic piano tone or electric tone is reproduced through the acoustic piano 31A or audio unit 4G. Thus, the synchronous player system reproduces the piece of music N in ensemble as by step S91.

While the central processing unit 62 is transferring the pairs of sampled values and note event codes to the audio unit 4G and automatic player piano 3G, respectively, the central processing unit 62 requests the manipulating panel/display 5G to produce a prompt message prompting the user to adjust the top offset. When the user feels the acoustic piano tones to be earlier than the electric tones, the user pushes a key pad "−" for delay. On the other hand, if the user feels the acoustic piano tones to be delayed from the electric tones, the user pushes a key pad "+" for advance. The manipulation on the manipulating panel/display 5G is reported to the controller 6G. When the manipulating panel/display 5G reports the manipulation on the key pad "−", the central processing unit 62 increases the counter $O_T$ by 1/75 second. On the other hand, when the user pushes the key pad "+", the central processing unit 62 decreases the counter $O_T$ by 1/75 second. The increment and decrement, i.e., 1/75 second is equivalent to the time period for a single frame of the audio data. Thus, the user manually adjusts the top offset by hearing the piece of music.

When the user manually makes the performance through the automatic player piano 3G in good ensemble with the playback of the piece of music NB, the central processing unit 62 reschedules the timing to reproduce the note events by using the expression 17. Upon completion of the regulation of the delta time codes, the central processing unit 62 stores the regulated delta time codes in the random access memory 64. Upon completion of the regulation of the delta time codes, the central processing unit 62 compares the internal clock with the regulated delta time code to see whether or not the note event code is to be supplied to the automatic player piano 3G. As a result, the progression of the piece of music reproduced through the automatic player piano 3G is either advanced or delayed, and the user checks the synchronous playback to see whether or not the performance through the automatic player piano 3G is in good ensemble with the playback of the piece of music NB, again, as by step S93.

If the performance is still advanced or delayed, the central processing unit 62 returns to step S92, and prompts the user to change the top offset, again. Thus, the user repeatedly adjusts the top offset until the answer at step S93 is changed to affirmative. When the user feels the playback to be in good ensemble, the user pushes a key pad "ENTER", the central processing unit 62 proceeds to step S94.

With the positive answer at step S93, the central processing unit 62 prompts the user to adjust the end offset through the message produced on the display as by step S94. If the user feels the performance through the automatic player piano 3G to be getting earlier and earlier than the playback through the audio unit 4G, the user pushes the key pad "−". On the other hand, when the user feels the performance through the automatic player piano 3G to be getting latter and latter than the playback through the audio unit 4G, the user pushes the key pad "+". When the user pushes the key pad "−", the central processing unit 62 increments the counter $O_E$ by 1/75 second. On the other hand, if the user pushes the key pad "+", the central processing unit 62 decreases the counter $O_E$ by 1/75 second. Thus, the user manually adjusts the end offset as by step S94.

When the counter $O_E$ is regulated, the central processing unit 62 reschedules the timing to reproduce the note events by using the expression 17, and stores the regulated delta time codes in the random access memory 64. After the rescheduling, the central processing unit 62 compares the internal clock with the regulated delta time code to see whether or not the associated note event code is supplied to the automatic player piano 3G. Thus, the timing to produce the note events is rescheduled, and the progression of the piece of music is controlled with the regulated delta time codes. When the user feels the performance through the automatic player piano 3G to be in good ensemble with the playback through the audio unit 4G, the user pushes the key pad "ENTER", and the central processing unit 62 finds the answer at step S95 to be affirmative. On the other hand, if the user feels the automatic player piano 3G to be out of the synchronization with the audio unit 4G, the central processing unit 62 returns to step S94, and repeats the data processing at step S94 until the user pushes the key pad "ENTER". With the positive answer at step S95, the central processing unit 62 completes the manual regulation at step S80, and proceeds to step S76.

The central processing unit 62 rescheduling the timing to reproduce the note events at step S76 by using the top offset and end offset manually adjusted at step S80, and starts the synchronous playback at step S77. Thus, even if the difference between the audio data NA and audio data NB is serious, the synchronous playback system implementing the third embodiment achieves good ensemble between the automatic player piano 3G and the audio unit 4G.

The correlation analysis at step S70 is assumed to result in the failure. This means that the central processing unit can not find the objective correlation data highly correlated with the reference ending audio data in the series of objective correlation data at the end portion equivalent to 10 seconds measured from the last pair of audio music data code. Then, the answer at step S73 is given affirmative.

With the positive answer at step S73, the central processing unit 62 starts to reschedule the timing to produce the note events by using the reference characteristic event codes as by step S81.

First, the central processing unit 62 requests the compact disc driver 1G to transfer the audio data NB from the compact disc CD-B to the interface 65*a*. The compact disc driver 1G reads out the pairs of audio music data codes (0), (1), . . . from the compact disc CD-B, and transfers them to the interface 65*a* at the regular intervals of 1/44100 second. When the first pair of audio music data codes (0) reaches the interface 65*a*, the central processing unit 62 starts the internal clock, and measures the lapse of time. While the compact disc driver 1G is transferring the pairs of audio music data codes to the interface 65*a*, the central processing unit 62 determines the arrival time for each pair of audio music data codes, and makes the pairs of sampled values and their arrival times join a queue in the random access memory 64. Moreover, the central processing unit 62 checks the pairs of audio music data codes to see whether or not at least one of the pairs of sampled values exceeds the threshold. In this instance, the threshold is adjusted to 1000.

When the central processing unit 62 finds at least one of the pair of sampled values to be greater than the threshold, the central processing unit 62 requests the digital signal processor 63 to find the characteristic events in the pairs of sampled values. The data processing for the characteristic events is similar to that shown in FIG. 59, and is not described for avoiding the repetition. When the digital signal processor 63 finds each characteristic event, the digital signal processor 63 notifies the central processing unit 62 of the characteristic event. Then, the central processing unit 62 determines the arrival time for each notification, and stores the characteristic event code and its arrival time code in the random access memory 64. The characteristic events already stored in the standard MIDI file and the characteristic events found through the data processing are respectively referred to as "characteristic event A" and "characteristic event B".

Upon completion of the data processing on the last pair of sampled values read out from the compact disc CD-B, the central processing unit 62 compares the delta time codes associated with the characteristic event codes A with the arrival time codes for the characteristic event codes B, and makes the characteristic events A paired with the characteristic events B as shown in FIG. 71.

The reference starting time occupies the head of the left column, and the characteristic events A follow the reference starting time in the left column. The first characteristic event A, second characteristic event A, . . . are hereinafter labeled with "A1", "A2" . . . On the other hand, the total time of the objective starting time and the top offset occupies the head of the right column, and the characteristic events B follow the total time in the right column. The first row of the left column is corresponding to the first row of the right column, and the pieces of time data information indicated by the first rows of the left and right columns are hereinafter referred to as "time data information A" and "time data information B".

The central processing unit 62 firstly calculates (characteristic event A1−time data information A)/(characteristic event B1−time data information B), and the calculation results in (1.51−1.15)/(1.01−0.65)=1.00.

Subsequently, the central processing unit 62 checks the quotient to see whether or not the quotient is fallen within a predetermined range. In this instance, the predetermined range is assumed to be from 0.97 to 1.03, i.e., ±3%. If the quotient is fallen within the predetermined range, the central processing unit 62 presumes that the characteristic event A is corresponding to the characteristic event B. The predetermined range of ±3% is changeable.

The quotient means that the difference in time between the characteristic events A1 and B1 is at zero. Then, the central processing unit 62 decides that the characteristic event A1 is corresponding to the characteristic event B1. If the quotient is less than 0.97, the characteristic event A1 is too early for the characteristic event B1, and the central processing unit 62 decides that any characteristic event B does not correspond to the characteristic event A1. Then, the central processing unit 62 checks the characteristic event A2 and characteristic event B1 to see whether or not the error is fallen within the predetermined range. On the other hand, if the quotient is greater than 1.03, the characteristic event A1 is too late for the characteristic event B1, and the central processing unit 62 decides that any characteristic event A does not correspond to the characteristic event B1. Then, the central processing unit 62 checks the characteristic event A1 and characteristic event B2 to see whether or not the difference in time is fallen within the predetermined range.

The central processing unit 62 sequentially checks the characteristic events A and B to see whether or not the difference in time is fallen within the predetermined range. The last characteristic events A and B, which are corresponding to each other, are hereinafter referred to as "characteristic events An and Bn".

Subsequently, the central processing unit 62 presumes arrival times of the characteristic events B, at which the characteristic event codes B were expected to arrive at the interface 65*a*, on the basis of the lapse of time expressed by the associated delta time code by using {(time data information B+(characteristic event An+1−time data information A)×(characteristic event B−time data information B)/(characteristic event An−time data information A)}.

FIG. 72 shows the presumed arrival times of the characteristic events B. The presumed arrival times are equivalent to the regulated In case where characteristic events A1 and B1 serve as the characteristic events An and Bn, respectively, the presumed arrival time is calculated as {0.65+(2.38−1.15)×(1.01−0.65)/(1.51−1.15)}=1.88.

The central processing unit 62 checks the result of the calculation to see whether or not the difference between the arrival time of the characteristic event B and the presumed arrival time is fallen within the range between −0.20 second and +0.20 second. When the central processing unit 62 confirmed that the difference is fallen within the range, the central processing unit 62 determines that the characteristic event Bn+1 is corresponding to the characteristic event An+1. The range ±0.20 is changeable.

If the difference is less than −0.20 second, the central processing unit 62 presumes that any characteristic event B does not correspond to the characteristic event An+1, and changes the characteristic event An+1 to the next characteristic event An+2 for the above-described data processing. On the other hand, if the difference is greater than +0.20 second, the central processing unit 62 presumes that any characteristic event A does not correspond to the characteristic event Bn+1, and changes the characteristic event Bn+1 to the next characteristic event Bn+2 for repeating the above-described data processing.

In case where the characteristic events A5 and B5 serve as the characteristic events An and Bn, respectively, the central processing unit 62 presumes that the characteristic event B arrived at 8.25 seconds on the basis of the lapse of time expressed by the delta time code associated with the characteristic event A6. The actual arrival time of the characteristic event B6 is 9.76 seconds, and the difference in time is −1.51 seconds, which is out of the range of ±0.20 second. For this reason, the central processing unit 62 determines that any characteristic event B does not correspond to the characteristic event A6.

In case where the characteristic events A9 and B8 serve as the characteristic events An and Bn, respectively, the central processing unit 62 presumes that the characteristic event B arrived at 17.79 seconds on the basis of the lapse of time expressed by the delta time code associated with the characteristic event A10. The actual arrival time of the characteristic event B9 is 15.57 seconds, and the difference in time is 2.22 seconds, which is out of the range of ±0.20 second. For this reason, the central processing unit 62 determines that any characteristic event A does not correspond to the characteristic event B9.

Figure 73:
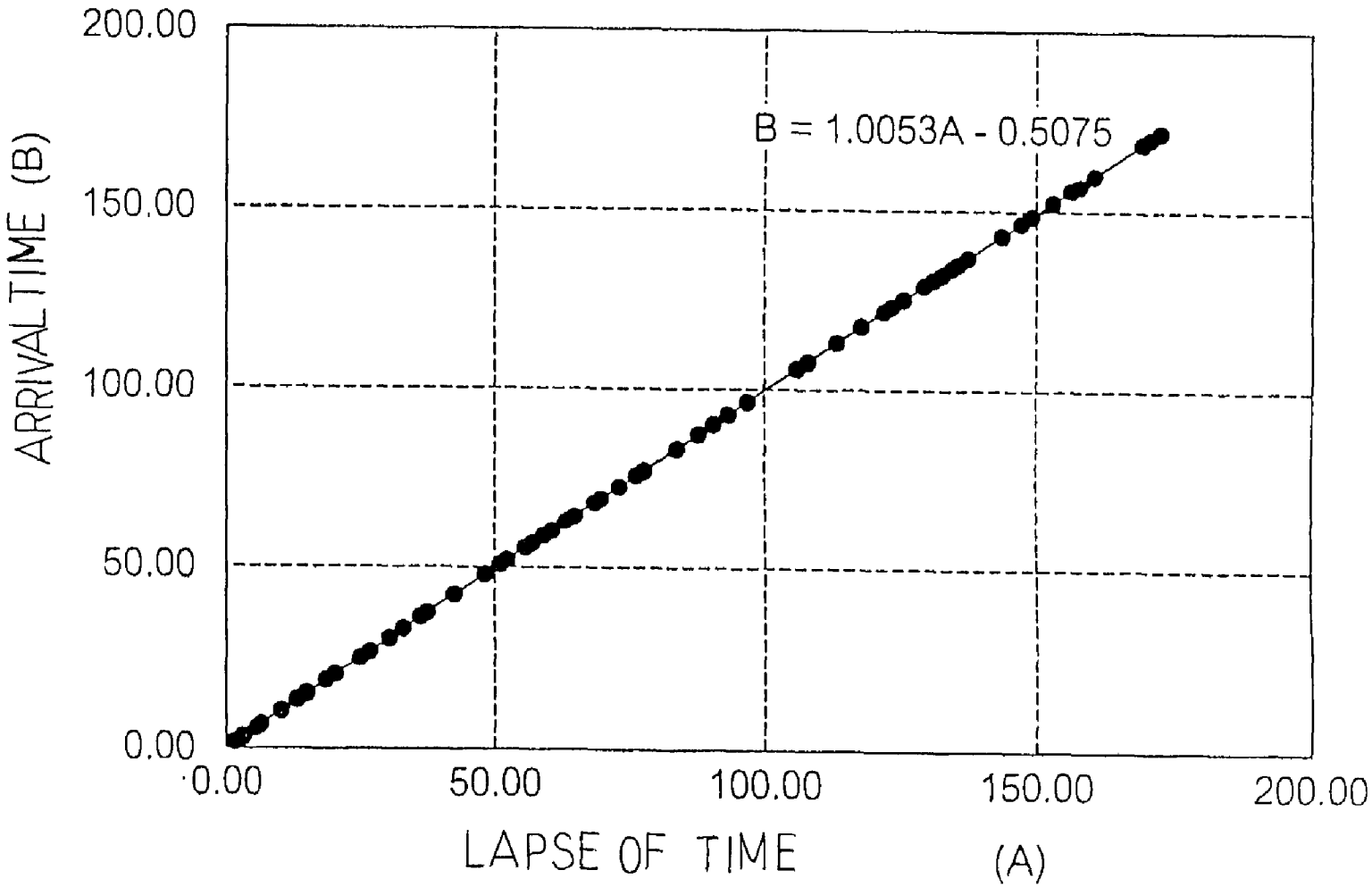
FIG. 73 is a graph showing a regression line presumed between the lapse of time and the presumed arrival time.
Figure 74:
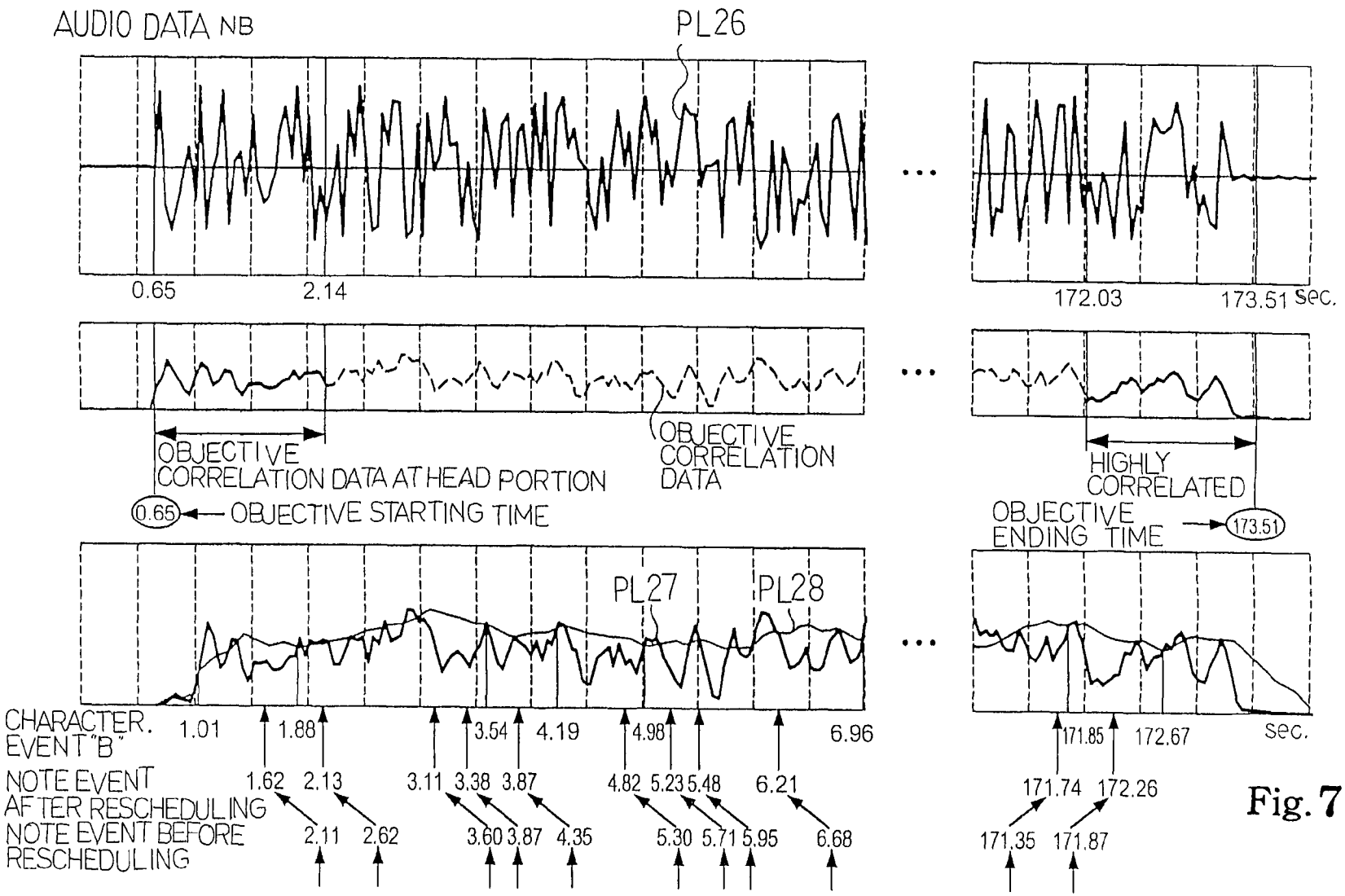
FIG. 74 is a timing chart showing audio data, objective correlation data, indexes and note events before and after rescheduling.

Upon completion of the above-described data processing for making the characteristic events A correspond to the characteristic events B, the central processing unit presumes the relation between the lapse of time expressed by the delta time codes and the arrival times of the characteristic events B. The central processing unit 62 may use the least square method for the presumption. FIG. 73 shows a regression line presumed through the least square method between the lapse of time (A) and the arrival time (B). The regression line is expressed as B=1.0053A−0.5075.

Subsequently, the central processing unit 62 reads out the reference ending time from the standard MIDI file already transferred to the random access memory 64, and substitutes the reference ending time, i.e., 173.11 seconds for A. Then, the objective ending time is presumed to be 173.52 seconds. Subsequently, the central processing unit 62 subtracts the reference ending time from the objective ending time for presuming the end offset. The central processing unit 62 stores the end offset in the random access memory 64. The central processing unit 62 produces the system exclusive event codes for storing the top offset and end offset, and adds the system exclusive event codes to the standard MIDI file in the random access memory 64.

When the central processing unit 62 stores the system exclusive event representative of the top offset and end offset in the standard MIDI file, the central processing unit 62 proceeds to step S76 (see FIG. 68), and reschedules the note events through the data processing at step S76 to S79. This results in the perfect synchronization between the performance through the automatic player piano 3G and the playback through the compact disc driver/audio unit 1G/4G.

The present inventors confirmed that the note events were rescheduled through the data processing described hereinbefore. The audio analog signal PL26 was produced from the pairs of audio music data codes recorded in the compact disc CD-B. The objective correlation data was produced from the pairs of audio music data codes, and the medium-range index PL27 and long-range index 28 were produced from the pairs of sampled values stored in the pairs of audio music data codes. The characteristic events "B" were extracted from the medium-range/long-range indexes PL27/PL28. The note events had been scheduled at 2.11 seconds, 2.62 seconds, 3.00 seconds, . . . However, the silent time period before the piece of music NB was shorter than the silent time period before the piece of music NA. Moreover, the time period consumed by the playback of the piece of music NB was longer than the time period consumed by the playback of the piece of music NA. This meant that the playback of the piece of music NB was initiated earlier than the playback of the piece of music NA and that the performance through the automatic player piano 3E was faster than the playback of the piece of music NB.

The present inventors rescheduled the note events through the data processing shown in FIG. 68. Then, the note events were rescheduled at 1.62 seconds, 2.13 seconds, 3.11 seconds, . . . By using expression 17. The present inventors confirmed that the automatic player piano 3G was perfectly synchronized with the compact disc driver/audio unit 1G/4G. This means that the piece of music is performed through the automatic player piano 3G in good ensemble with the piece of music recorded in the compact disc CD-B.

Playback from Standard MIDI File B

When the user requests the controller 6G to reproduce the performance in good ensemble with the playback of the piece of music NB, the user may loads the floppy disc, which stores the standard MIDI file B, in the floppy disc driver 2G. In this situation, the controller 6G is not expected to carry out the data processing shown in FIG. 68. The central processing unit 62 behaves as follows.

Firstly, the central processing unit 62 requests the floppy disc driver 2G to transfer the standard MIDI file B from the floppy disc FD to the interface 65*a*, and stores the standard MIDI file in the random access memory 64.

Subsequently, the central processing unit 62 reads out the top offset and end offset from the standard MIDI file B, and reschedules the note events through the expression 17. The regulated delta time codes are stored in the random access memory 64.

Subsequently, the central processing unit 62 requests the compact disc driver 1G to transfer the pairs of audio music data codes from the compact disc CD-B to the interface 65*a*. When the first pair of audio music data codes (0) arrives at the interface 65*a*, the central processing unit 62 starts the internal clock so as to measure the lapse of time. The central processing unit 62 supplies the pairs of sampled values to the audio unit 4G so that the electric tones are radiated from the laud speakers 44.

The central processing unit 62 fetches the delta time associated with the first note event from the standard MIDI file B, and compares the internal clock with the delta time code to see whether or not the lapse of time becomes equal to the time indicated by the delta time code. When the internal clock catches up the delta time code, the central processing unit 62 supplies the first note event to the automatic player piano 3G, and fetches the delta time code associated with the next note event code from the standard MIDI file B. The central processing unit 62 sequentially fetches the delta time codes from the standard MIDI file B, and supplies the associated note event code or codes to the automatic player piano 3G when the internal clock catches up the delta time code. The acoustic piano tones are reproduced through the automatic player piano 3G, and the user feels the performance through the automatic player piano 3G to be in good ensemble with the playback through the compact disc driver/audio unit 1G/4G.

However, the user may feel the automatic player piano to be out of the synchronization with the compact disc player/audio unit 1G/4G. Then, the user manually regulates the timing to reproduce the note events. In detail, the user firstly pushes a key pad for the manual regulation. Then, the central processing unit 62 branches to step S80, and carries out the data processing shown in FIG. 70. The top offset and end offset are varied through the steps S91 to S95. When the user feels the performance in good ensemble with the playback, the user pushes the key pad "ENTER". Then, the central processing unit 62 stores the top offset and end offset in the standard MIDI file B in the random access memory 64.

If the user wishes to store the standard MIDI tile B in the floppy disc FD, the user pushes the key pad assigned to the retention. Then, the central processing unit 62 supplies the data representative of the standard MIDI file B to the floppy disc driver 2G together with the request for the retention. The floppy disc driver 2G overwrites the standard MIDI file B received from the central processing unit 62.

As will be understood from the foregoing description, the synchronous player system stores at least the reference correlation data at the head portion, reference starting time, reference ending audio data and reference ending time together with the note events in the preliminary recording mode, and reschedules the note events in the synchronous playback mode. In the synchronous playback mode, the central processing unit carries out the correlation analysis on the objective correlation data and the reference correlation data at the head portion/reference ending audio data so as to determine the objective starting time and objective ending time for the piece of music NB recorded in the compact disc CD-B. When the objective starting time and objective ending time are known, the central processing unit 62 determines the top offset and end offset, the time difference between the reference starting time and the objective starting time and the time difference between the reference ending time and the objective ending time, and determines the timing to reproduce the note events by using the expression 11. Upon completion of the rescheduling, the controller 6E reproduces the performance through the automatic player piano 3E and the playback through the compact disc driver/audio unit 1E/4E in good ensemble with one another.

If the reference characteristic events are further extracted in the preliminary recording, the reference characteristic events are further stored in the memory together with the note event codes. In this instance, the controller 6G firstly extracts the objective characteristic events from the medium-range/long-range indexes, which are produced from the pairs of sampled values stored in the compact disc CD-B, and looks for the last objective event to be paired with the last reference characteristic event. When the last objective characteristic event is found, the central processing unit 62 determines the top offset and end offset, and reschedules the note events. Thus, even if the controller 6E fails to find the objective correlation data highly correlated with the reference ending audio data, the central processing unit 62 can determine the end offset through the data processing on the reference and objective events, and makes the automatic player piano 3G synchronously reproduce the performance together with the compact disc driver/audio unit 1G/4G.

First Modification

Figure 75:
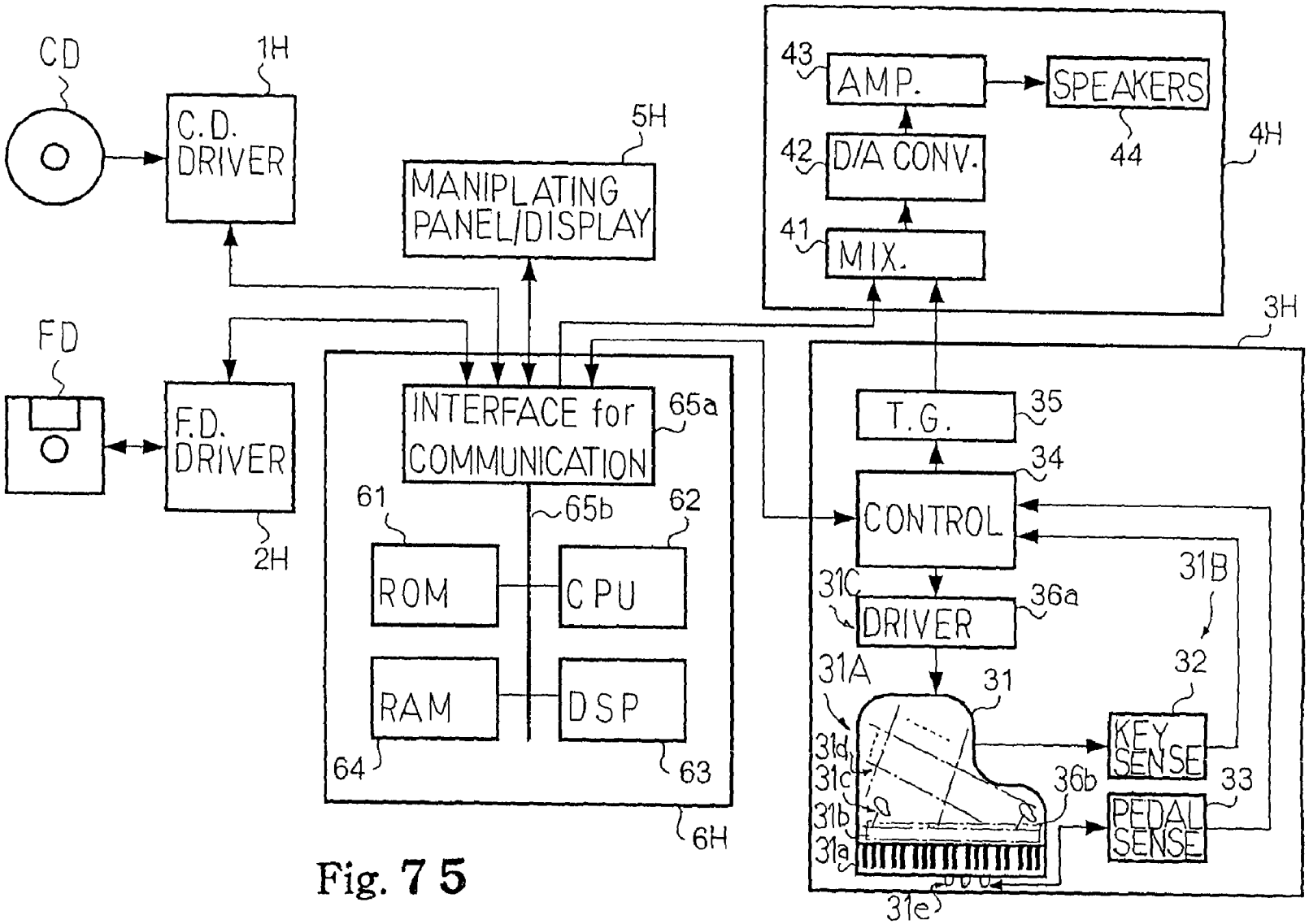
FIG. 75 is a block diagram showing the system configuration of a modification of the synchronous player system.

FIG. 75 shows the first modification of the synchronous player system. The first modification of the synchronous player system embodying the present invention also largely comprises a compact disc driver 1H, a floppy disc driver 2H, an automatic player piano 3H, an audio unit 4H, a manipulating panel/display 5H and a controller 6H. The floppy disc driver 2H, automatic player piano 3H, audio unit 4H and manipulating panel/display 5H are similar in configuration and behavior to those of the synchronous player system, and the component parts are labeled with the references designating the corresponding component parts shown in FIG. 54 Although the controller 6H is slightly different in data processing from the controller 6G, the system configuration is similar to that of the controller 6G, and, for this reason, the component parts are labeled with references designating the corresponding component parts of the controller 6G without detailed description.

The first modification also selectively enters the preliminary recording mode and synchronous playback mode, and the behavior in those modes of operation is generally identical with that of the synchronous playback system. For this reason, description is focused on differences from the digital processing executed by the synchronous playback system.

The compact disc driver 1H sequentially reads out the audio music data codes and audio time data codes from compact discs CD-A and CD-B, and transfers not only the audio music data codes but also the audio time data codes to the controller 6H. This is the difference from the behavior of the compact disc driver 1G. The audio time data code is provided for each frame, in which 588 pairs of audio music data codes are written, and the lapse of time from the initiation of playback is expressed by the audio time data codes.

The controller 6H supplies the clock signal to the compact disc driver 1G at all times, and the compact disc driver 1H transfers the audio music data codes to the controller 6H in synchronization with the clock signal. When the central processing unit 62 stores the pairs of sampled values in the random access memory 647 the central processing unit 62 duplicates the latest audio time data into the delta time code, and stores the delta time code together with the pairs of sampled values. If accurate time data is required for the data processing, the central processing unit 62 defines a counter, and increments the counter at the reception of each pair of audio music data codes so as to accurately determine the time through the proportional allotment on the time interval between the audio music data codes.

While the central processing unit 62 is extracting the characteristic events and receiving the note events, the audio time data codes intermittently arrives at the interface 65*a* so that the central processing unit 62 produces the delta time codes from the latest audio time code.

In the first modification, any internal clock, which is, by way of example, implemented by a counter or software timer, is net required for the data processing so that the system configuration or computer program is simplified.

Other Modifications

In the above-described third embodiment and its modification, the system components 1G/1H, 2G/2H, 4G/4H, 5G/5H and 6G/6H are accommodated in the automatic player piano 3G/3H. However, a second modification is constituted by plural components physically separated from one another. The synchronous player system implementing the second modification may be physically separated into plural components such as 22. Compact disc driver 1G/1H,
23. Floppy disc driver 2G/2H,
24. Automatic player piano 3G/3H,
25 Mixer/digital-to-analog converter 41/42,
26. Amplifiers 43,
27. Laud speakers 44, and
28. Manipulating panel/display and controller 5G/5H and 6G/6H.

Moreover, the controller 6G/6H may be physically separated into a recording section and a playback section.

These system components may be connected through audio cables, MIDI cables, optical fibers for audio signals, USB (Universal Serial Bus) cables and/or cable newly designed for the synchronous playback system. Standard floppy disc drivers, standard amplifiers and standard laud speakers, which are obtainable in the market, may be used in the synchronous playback system according to the present invention.

The separate type synchronous payback system is desirable for users, because the users constitute their own systems by using some system components already owned.

The third modification of the synchronous playback system does not include the compact disc driver 1G/1H and floppy disc driver 2G/2H, but the controller 6G/6H has a hard disc driver and an interface connectable to a LAN (Local Area Network), WAN or an internet. In this instance, the audio are stored in the hard disc. Similarly, a standard MIDI file is transferred from the external data source through the interface, and is also stored in the hard disc. While a user is fingering on the keyboard 31*a*, the audio music data codes are read out from the hard disc, and are transferred to the audio unit 4G/4H for converting them to electric tones. The event codes and delta time codes are stored in the track chunk, and the standard MIDI file is left in the hard disc.

In the synchronous playback system implementing the fourth embodiment, the digital signal processor 63 carries out the correlation analysis through the analysis on the absolute correlation index, analysis on the relative correlation index and analysis on the correlation value. Although the three sorts of analysis make the correlation analysis accurate, the three sorts of analysis may be too heavy. For this reason, the forth modification carries out the correlation analysis through one of or two of the three sorts of analysis.

The fifth modification makes a decision at step S52 through only expression (13). In detail, the digital signal processor calculates the product between $D_{m-1}$ and $D_m$ and checks it to see whether or not the product is equal to or less than zero. When the product is equal to or less than zero, the rate of change in the function of correlation value is zero or is changed across zero. This means that the correlation value is at the maximum or in the vicinity of the maximum. For this reason, the answer at step S52 is given affirmative. In case where there is little possibility to have the minimum and maximum close to one another, the same answer is obtained through the simple data processing.

In the fourth embodiment, when the sampled value exceeds the threshold, the central processing unit 62 determines the reference starting time and reference ending time. Accordingly, the reference correlation data at the head portion and reference ending audio data are produced from the reference raw material at the head portion of the music NA and the reference raw material at the end portion of the music NA. On the other hand, the central processing unit determines the reference starting time and reference ending time on the basis of certain raw material at an arbitrary part of the music NA in the sixth modification. For example, the central processing unit may appoint a certain lapse of time from the initiation of the playback and another certain time before the end of the playback as the reference starting time and reference ending time, respectively for the sixth modification. This feature is desirable for music to be recorded in a live concert. Even though voice and/or hand clapping are mixed with the recorded music, the reference raw material is extracted from an appropriate part of the music without the influence of the voice and/or hand clapping. A passage may be repeated immediately after the initiation of the performance. Even so, the raw material is extracted from a middle part of the piece of music representative of a characteristic passage.

A particular feature of the seventh modification is directed to a tag or a piece of discriminative information stored in the standard MIDI file. The tag may be representative of the discriminative data exclusively used for the compact disc CD-B or a combination of the track numbers where the piece of music NB is recorded. The discriminative data is stored in the compact disc CD-B as the index so that the central processing unit 62 requests the compact disc driver to transfer the discriminative data from the index of the compact disc. The central processing unit 62 produces a system exclusive event code where composite data representative of the track number and the discriminative number are stored, and adds the system exclusive event code to the standard MIDI file Upon completion of the standard MIDI file, the central processing unit 62 transfers it to the floppy disc driver, and requests the floppy disc driver to store it in a floppy disc.

The user is assumed to instruct the seventh modification to carry out the synchronous playback after loading a compact disc and the floppy disc in the compact disc driver and floppy disc driver, respectively. When the user specifies a piece of music stored in the compact disc, the central processing unit requests the compact disc driver to transfer the discriminative data assigned to the compact disc and the track number where the piece of music is recorded to the interface.

Subsequently, the central processing unit supplies the discriminative data and the track number to the floppy disc driver, and requests the floppy disc driver to search the floppy disc for the standard MIDI file where the system exclusive event representative of the same discriminative data and same track number are stored. If the floppy disc driver successfully completes the search, the floppy disc driver transfers the standard MIDI file to the controller, and the controller starts the synchronous playback On the other hand, if the floppy disc driver can not find the standard MIDI file in the floppy disc, the floppy disc driver reports the failure to the controller, and the controller requests the manipulating panel/display to produce an error message.

The seventh modification makes the management on the floppy discs easy. Moreover, the seventh modification automatically searches the floppy discs for the piece of music so that the user can easily enjoy the synchronous playback.

Although particular embodiments of the present invention have been shown and described, it will be apparent to those skilled in the art that various changes and modifications may be made without departing from the spirit and scope of the present invention.

For example, each of the delta time codes may express the time interval between an event/events and the next event. Even though, the synchronous player systems implementing the above-described embodiments carry out the preliminary recording and synchronous playback, because the lapse of time is equal to the total sum of the time intervals. The synchronous player system may include an accumulator for converting the time intervals to the lapse of time. In case where time intervals are required for the delta time codes, the controller stores the lapse of time at an event in a register, and subtracts the lapse of time at the next event from the lapse of time stored in the register Then, the time interval is determined for the delta time code. Thus, the synchronous player system according to the present invention is operable in both preliminary recording and synchronous playback modes on the basis of the delta time codes representative of the time intervals.

Values of the time periods are examples, and do not set any limit to the technical scope of the present invention. The experimentally determined values are appropriate to certain pieces of music. However, other values may be optimum for other pieces of music.

The audio data codes and MIDI data codes do not set any limit on the technical scope of the present invention. A piece of music or a music passage may be converted to a series of digital codes according to another standard book, and the performance on the keyboard may be converted to another sort of music data codes and time data codes. An analog signal representative of a performance or voice may be recorded in an information storage medium, and is reproduced therefrom. In this instance, the correlation analysis or analysis for characteristic events is carried out on the analog signal.

The combination between the central processing unit 62 and the digital signal processor 63 does not set any limit to the technical scope of the present invention. If a high-performance microprocessor is employed in the controller 6, 6A, 6B, 6C, 6D or 6E, the microprocessor achieves all the jobs shaped between the central processing unit 62 and the digital signal processor 63.

The standard MIDI file does not set any limit to the technical scope of the present invention. Any sort of data file is available for the synchronous playback system according to the present invention.

The automatic player piano does not set any limit on the technical scope of the present invention. Any sort of musical instrument is available for the synchronous player system in so far as the musical instrument produces note events and reproduces tones from the note events. The musical instrument may belong to the stringed instrument family, wind instrument family or percussion instrument family such as, for example, an electronic vibraphone. A personal computer, which runs on a program for composing, may serve as a data source and/or a sound source.

The floppy disc driver 2-2G, floppy disc FD, compact disc driver 1-1G and compact disc CD-A/CD-B do not set any limit on the technical scope of the present invention. Any sort of data storage such as, for example, a hard disc, an optomagnetic disc and memory stick are available for the synchronous player system according to the present invention.

The read only memory 61 and random access memory 64 do not set any limit on the technical scope of the present invention. Any sort of memory such as, for example, a bubble memory, electrically programmable and erasable memory and array of registers are available for the program and working memories.

Correspondence Between Embodiments and claims

The system components of the above-described embodiments are correlated with claim languages as follows. The interface 65*a* is corresponding to an interface, and the read only memory 61, central processing unit 62, digital signal processor 63, random access memory 64 and bus system 65*b* as a whole constitute a data processing unit. The note event codes, audio music data codes are respectively corresponding to pieces of first sort of music data and pieces/other pieces of second sort of music data. The pieces of reference correlation data and pieces of reference characteristic event data serve as pieces of reference characteristic data so that the extreme values/local maximum and reference characteristic events are indicative of particular features of an audio waveform. Similarly, the pieces of objective correlation data pieces of objective characteristic event data serve as pieces of objective characteristic data.

The automatic player piano 3/3A/3B/3C/3D/3E/3F/3G/3H, the combination of compact disc driver 1/1A/1B/1C/1D/1E/1F/1G/1H and compact disc CD-A and the combination of floppy disc driver 2/2A/2B/2C/2D/2E/2F/2G/2H and floppy disc FD respectively serve as a data source, another data source and a destination in an independent claim for defining a recorder.

The combination of floppy disc driver 2-2G and floppy disc FD, combination of compact disc driver 1-1G and compact disc CD-B, automatic player piano 3-3G, automatic player piano 3-3G and audio units 4-4G respectively serve as a source of music data file, a data source, a sound source and another sound source in an independent claim for defining a player.

The automatic player piano 3-3G, combination of the compact disc driver 1-1G and compact discs CD-A/CD-B, combination of the floppy disc driver 2-20 and the floppy disc FD, automatic player piano 3-30 and audio unit 44G respectively serve as a data source. Another data source, a source of music data file, a sound source and another sound source in an independent claim for defining a synchronous player system.

The pieces of reference correlation data and reference characteristic event codes serve as pieces of characteristic data, and the data processing for producing the reference correlation data (see FIGS. 4, 6, 8, 9A-9C; 35; 43, 45) and data processing for producing the reference characteristic data (see figures 20, 22, 23; 37, 39, 40, 45) are corresponding to data processing executed by the data processing unit of the recorder for extracting the pieces of characteristic data. The standard MIDI file serves as a music data file. The pieces of characteristic data are stored in the music data file in the form of system exclusive events.

The data processing shown in FIGS. 10, 13, 16, 41 and 52 and data processing shown in FIGS. 25, 28, 31, 49 and 50, are corresponding to data processing for comparing the pieces of objective characteristic data with the pieces of reference objective characteristic data executed by the data processor of a player.

What is claimed is:

1. A recorder for recording a performance represented by pieces of first sort of music data in ensemble with a playback of a music passage represented by pieces of second sort of music data different in format from said first sort of music data, comprising:

an interface connected to a data source of said pieces of said first sort of music data, another data source of said pieces of said second sort of music data and a destination to which a music data file is supplied; and a data processing unit connected to said interface, extracting pieces of reference characteristic data representative of particular features of an audio waveform expressing said music passage from said pieces of said second sort of music data for synchronization between said performance and another music passage produced in another playback, and forming said pieces of said first sort of music data, said pieces of reference characteristic data and pieces of time data representative of timing to reproduce tones produced in said performance into said music data file for supplying said music data file through said interface to said destination, in which said data processor extracts pieces of reference correlation data representative of variation of certain frequency components from said pieces of second sort of music data as said pieces of said reference characteristic data, and said pieces of reference correlation data are used in a correlation analysis between said music passage and said another music passage.

2. The recorder as set forth in claim 1, in which said music passage occupies a head portion of a piece of music, and said data processing unit further stores a time at which a certain piece of reference correlation data was produced from a piece of said second sort of music data during the performance of said head portion into said music data file.

3. A recorder for recording a performance represented by pieces of first sort of music data in ensemble with a playback of a music passage represented by pieces of second sort of music data different in format from said first sort of music data, comprising:

an interface connected to a data source of said pieces of said first sort of music data, another data source of said pieces of said second sort of music data and a destination to which a music data file is supplied; and a data processing unit connected to said interface, extracting pieces of reference characteristic data representative of particular features of an audio waveform expressing said music passage from said pieces of said second sort of music data for synchronization between said performance and another music passage produced in another playback, and forming said pieces of said first sort of music data, said pieces of reference characteristic data and pieces of time data representative of timing to reproduce tones produced in said performance into said music data file for supplying said music data file through said interface to said destination, in which the format for said piece of said first sort of music data is defined in MIDI (Musical Instrument Digital Interface), and the format for said pieces of said second sort of music data is defined in Red Book for compact discs and in which said data processor extracts pieces of reference correlation data representative of variation of certain frequency components from said pieces of second sort of music data as said pieces of said reference characteristic data, and said pieces of reference correlation data are used in a correlation analysis between said music passage and another music passage.

4. The recorder as set forth in claim 3, in which said music passage occupies a head portion of a piece of music, and said data processing unit stores said pieces of reference correlation data and a time at which a certain piece of reference correlation data was produced during said performance of said head portion in said music data file in the form of system exclusive event code.

5. The recorder as set forth in claim 4, in which said certain piece of reference correlation data occupies the head of the series of the pieces of said second sort of music data representative of said music passage immediately after the pieces of said second sort of music data representative of silence so that said music passage starts at said time.

6. A recorder for recording a performance represented by pieces of first sort of music data in ensemble with a playback of a music passage represented by pieces of second sort of music data different in format from said first sort of music data, comprising:

an interface connected to a data source of said pieces of said first sort of music data, another data source of said pieces of said second sort of music data and a destination to which a music data file is supplied; and a data processing unit connected to said interface, extracting pieces of reference characteristic data representative of particular features of an audio waveform expressing said music passage from said pieces of said second sort of music data for synchronization between said performance and another music passage produced in another playback, and forming said pieces of said first sort of music data, said pieces of reference characteristic data and pieces of time data representative of timing to reproduce tones produced in said performance into said music data file for supplying said music data file through said interface to said destination, in which the format for said piece of said first sort of music data is defined in MIDI (Musical Instrument Digital Interface), and the format for said pieces of said second sort of music data is defined in Red Book for compact discs and said data processor extracts pieces of reference correlation data at a head portion representative of variation of a certain frequency components from the pieces of said second sort of music data representative of a head portion of said music passage and other pieces of reference correlation data at an end portion representative of variation of a certain frequency components from the pieces of said second music data representative of an end portion of said music passage as said pieces of said reference characteristic data, and said pieces of reference correlation data at said head portion and said other pieces of reference correlation data at said end portion are used in a correlation analysis between said music passage and another music passage.

7. The recorder as set forth in claim 6, in which said data processing unit stores said pieces of reference correlation data at said head portion, a time at which a certain piece of said reference correlation data at said head portion was produced from a pieces of said second sort of music data during the performance of said head portion, said other pieces of said reference correlation data at said end portion and a time at which another certain piece of said reference correlation data at said end portion was produced from another piece of said second sort of music data during the performance of said end portion in said music data file in the form of system exclusive event code.

8. The recorder as set forth in claim 7, in which said certain piece of said reference correlation data at said head portion and said another certain piece of said reference correlation data at said end portion occupy a head of the series of the pieces of said second sort of music data and an end of said series of said pieces of said second sort of music data so that the length of said music passage is determined on the basis of said times.

9. A recorder for recording a performance represented by pieces of first sort of music data in ensemble with a playback of a music passage represented by pieces of second sort of music data different in format from said first sort of music data, comprising:

an interface connected to a data source of said pieces of said first sort of music data, another data source of said pieces of said second sort of music data and a destination to which a music data file is supplied; and a data processing unit connected to said interface, extracting pieces of reference characteristic data representative of particular features of an audio waveform expressing said music passage from said pieces of said second sort of music data for synchronization between said performance and another music passage produced in another playback, and forming said pieces of said first sort of music data, said pieces of reference characteristic data and pieces of time data representative of timing to reproduce tones produced in said performance into said music data file for supplying said music data file through said interface to said destination, in which the format for said piece of said first sort of music data is defined in MIDI (Musical Instrument Digital Interface), and the format for said pieces of said second sort of music data is defined in Red Book for compact discs and said data processing unit extracts abrupt changes of an attribute of sound from said pieces of said second sort of music data as said pieces of said reference characteristic data, and said abrupt changes are stored in said music data file together with other pieces of said time data representative of timing at which said abrupt changes take place in the form of system exclusive event code and in the form of time data code.

10. The recorder as set forth in claim 9, in which said abrupt changes are extracted from the entire music passage so that another music passage is made consistent with said music passage by making said abrupt changes correspond to abrupt changes extracted from pieces of said second sort of music data representative of said another music passage.

11. A player for reproducing tones in a performance represented by pieces of first sort of music data in ensemble with a playback of a music passage represented by pieces of second sort of music data different in format from said first sort of music data, comprising:

an interface connected to a source of music data file storing at least one music data file containing said pieces of sad first sort of music data, pieces of reference characteristic data representative of particular features of an audio waveform represented by other pieces of said second sort of music data expressing said music passage and pieces of time data representative of timing to reproduce said tones in said performance, a data source of said pieces of said second sort of music data, a sound source for producing said tones on the basis of said pieces of said first music data and another sound source for producing other tones from said pieces of said second sort of music data; and a data processing unit connected to said interface, extracting pieces of objective characteristic data representative of particular features of another audio waveform expressing said music passage from said pieces of second sort of music data, comparing said pieces of objective characteristic data with said pieces of reference objective characteristic data so as to find time differences between said particular features of said audio waveform and said particular features of said another audio waveform, rescheduling timing to supply said pieces of said first sort of music data to said sound source by changing said pieces of time data, and supplying said pieces of said second sort of music data to said another sound source and said pieces of said first sort of music data to said sound source at the timing represented by the pieces of time data already changed.

12. The player as set forth in claim 11, in which said pieces of said reference characteristic data and said pieces of said objective characteristic data are representative of a variation of certain frequency components extracted from said other pieces of said second sort of music data and a variation of said certain frequency components extracted from said pieces of said second sort of music data, and said data processing unit compares said pieces of said reference characteristic data with said pieces of said objective characteristic data through a correlation analysis therebetween.

13. The player as set forth in claim 12, in which said pieces of said reference characteristic data are extracted from said pieces of said second sort of music data representative of a certain portion of said music passage, and said data processing unit carries out said correlation analysis between said pieces of said reference characteristic data and said pieces of said objective characteristic data for finding a portion of said music passage corresponding to said certain portion in said music passage represented by said pieces of said second sort of music data.

14. The player as set forth in claim 13, in which said certain portion is a head portion of said music passage so that said data processing unit makes said playback of said music passage start at timing same as that in a playback of said music passage represented by said other pieces of music after said correlation analysis.

15. The player as set forth in claim 13, in which said certain portion is a head portion and an end portion of said music passage so that said data processing unit determines a difference between the length of said playback of said music passage represented by said pieces of said second sort of music data and the length of said playback of said music passage represented by said other pieces of said second sort of music data after said correlation analysis, and said data processing unit reschedules said timing to supply said pieces of said first sort of music in such a manner as to minimize the difference.

16. The player as set forth in claim 11, in which said pieces of said reference characteristic data and said pieces of said objective characteristic data are representative of certain abrupt changes of an attribute of sound found in said audio waveform and other abrupt changes of said attribute of sound found in said another audio waveform, respectively, and data processing unit makes said other abrupt changes corresponding to said certain abrupt changes for determining said time differences.

17. The player as set forth in claim 16, in which said attribute is the loudness of sound in a certain frequency range.

18. The player as set forth in claim 11, in which the format for said pieces of said first sort of music data and the format for said pieces of said second sort of music data are defined in MIDI (Musical Instrument Digital Interface) standards and Red Book for compact discs, respectively.

19. The player as set forth in claim 18, in which said pieces of said reference characteristic data stored in said at least one music data file in the form of system exclusive event code and said pieces of said objective characteristic data are representative of a variation of certain frequency components extracted from said other pieces of said second sort of music data and a variation of said certain frequency components extracted from said pieces of said second sort of music data, respectively, and said data processing unit compares said pieces of said reference characteristic data with said pieces of said objective characteristic data through a correlation analysis therebetween.

20. The player as set forth in claim 19, in which said pieces of said reference characteristic data are extracted from said pieces of said second sort of music data representative of a certain portion of said music passage, and said data processing unit carries out said correlation analysis between said pieces of reference characteristic data and said pieces of objective characteristic data for finding a portion corresponding to said certain portion in said music passage represented by said pieces of said second sort of music data.

21. The player as set forth in claim 20, in which said certain portion is a head portion of said music passage so that said data processing unit makes said playback of said music passage start at timing same as that in a playback of said music passage represented by said other pieces of music after said correlation analysis.

22. The player as set forth in claim 20, in which said certain portion is a head portion and an end portion of said music passage so that said data processing unit determines a difference between the length of said playback of said music passage represented by said pieces of said second sort of music data and the length of said playback of said music passage represented by said other pieces of said second sort of music data after said correlation analysis, and said data processing unit reschedules said timing to supply said pieces of said first sort of music in such a manner as to minimize the difference.

23. The player as set forth in claim 18, in which said pieces of said reference characteristic data and said pieces of said objective characteristic data are representative of certain abrupt changes of an attribute of sound found in said audio waveform and other abrupt changes of said attribute of sound found in said another audio waveform, respectively, and data processing unit makes said other abrupt changes corresponding to said certain abrupt changes for determining said time differences.

24. The player as set forth in claim 23, in which said attribute is the loudness of sound in a certain frequency range.

25. The player as set forth in claim 18, in which a compact disc loaded in a compact disc driver, an automatic player piano and an audio unit serve as said data source, said sound source and said another sound source, respectively.

26. A synchronous player system carrying out at least a preliminary recording and a synchronous playback, comprising:

an interface connected to a data source of pieces of first sort of music data representative of tones to be produced in a performance, another data source of pieces of second sort of music data different in format from said first sort of music and expressing a music passage and other pieces of said second sort of music data expressing said music passage, a source of music data file storing at least one music data file containing said pieces of said first music data, pieces of reference characteristic data representative of particular features of an audio waveform represented by said pieces of second sort of music data and pieces of time data represented by timing to produce said tones in said performance, a sound source producing said tones on the basis of said pieces of first sort of music data and another sound source producing other tones from said other pieces of said second music data; and a data processing unit connected to said interface and communicating with said data source, said another and said source of music data file for said preliminary recording and with said source of music data file, said sound source and said another sound source for said synchronous playback, in which said data processing unit extracts said pieces of reference characteristic data from said pieces of said second sort of music data, and forms said pieces of said first sort of music data, said pieces of reference characteristic data and said pieces of time data into said music data file for supplying said music data file through said interface to said source of music data file, and in which said data processing unit extracts pieces of objective characteristic data representative of particular features of another audio waveform expressing said music passage from said other pieces of second sort of music data, compares said pieces of objective characteristic data with said pieces of reference objective characteristic data so as to find time differences between said particular features of said audio waveform and said particular features of said another audio waveform, reschedules timing to supply said pieces of said first sort of music data to said first sound source by changing said pieces of time data, and supplies said other pieces of said second sort of music data to said another sound source and said pieces of said first sort of music data to said sound source at the timing represented by the pieces of time data already changed.

27. The synchronous player system as set forth in claim 26, in which the format for said pieces of said first sort of music data and the format for said pieces of said second sort of music data are defined in MIDI (Musical Instrument Digital Interface) standards and Red Book for compact discs, respectively.

28. The synchronous player system as set forth in claim 27, in which an automatic player piano serves as said data source and said sound source, and compact discs loaded in a compact disc driver and an audio unit serve as said another data source and said another sound source, respectively.

* * * * *